United States Patent [19]

Furner

[11] 4,251,688

[45] Feb. 17, 1981

[54] AUDIO-DIGITAL PROCESSING SYSTEM FOR DEMULTIPLEXING STEREOPHONIC/QUADRIPHONIC INPUT AUDIO SIGNALS INTO 4-TO-72 OUTPUT AUDIO SIGNALS

[75] Inventor: John A. Furner, Bellefonte, Pa.

[73] Assignee: Ana Maria Furner, Bellefonte, Pa.

[21] Appl. No.: 3,733

[22] Filed: Jan. 15, 1979

[51] Int. Cl.[3] ..... H04S 3/00; H04S 5/02

[52] U.S. Cl. ..... 179/1 GQ; 179/1 GP

[58] Field of Search ..... 179/1 GQ, 1 G, 1 GP, 179/100.4 ST, 100.1 TD

[56] References Cited

U.S. PATENT DOCUMENTS

| | | | |
|---|---|---|---|
| 3,943,287 | 3/1976 | Gravereaux et al. | 179/1 GQ |
| 3,944,735 | 3/1976 | Willcocks | 179/1 GQ |
| 3,982,071 | 9/1976 | Weiss et al. | 179/1 GQ |
| 4,021,612 | 5/1977 | Takahashi | 179/1 GQ |

*Primary Examiner*—Douglas W. Olms

[57] ABSTRACT

An audio-digital processing system for processing and converting audio localization data from stereophonic or quadriphonic input audio signals into digital localization data. Said digital localization data is further processed into digital commutation data which demultiplexes said stereophonic or quadriphonic input audio signals into 4 . . . 16 . . . 72 output audio signals.

This system includes an Input Audio Processor and a Psychoacoustic Data Converter that process and convert each audio field of audio localization data into digital localization data, comprising: digital phase-angle differential, phasor differential, and amplitude differential data; digital field activity, threshold, and dropout data; and digital peak-amplitude strobes. Each type of digital localization data is updated in a corresponding memory for each change in the associated audio localization data. Each corresponding memory is enabled, inhibited, or cleared by respective digital threshold and/or dropout data which are responsive to predetermined audio signal-to-noise amplitude relationships.

This system also includes a Psychoacoustic Data Processor that processes each type of updated digital localization data into digital commutation data (a digital psychoacoustic process analogous to binaural fusion). This digital psychoacoustic process functions to: execute and priority evaluate demultiplexing decisions for each output audio field; restore the reproduced sound to near infinite separation; resolve monophonic, stereophonic, and quadriphonic directional ambiguities; and provide preselectable quadrifield operations that create permutations of listening experiences previously unobtainable from the same recording. These preselectable quadrifield operations function to create 16 selectable listening formats that interchange the original panpotted musical instrument/voice positions to other predetermined transducer positions; sequentially reposition, or continuously swirl the discrete sound images in the 360-degree quadrifield; and preselect 4 . . . 16 . . . 72 output audio channels to match the number of transducers configured by the listener.

This system further includes an Output Audio Processor that processes said stereophonic or quadriphonic input audio signals into output audio signals. The output audio signals are processed in accordance with the preselectable quadrifield operations into one or more of the following: discrete direct audio signals, a system bass signal that automatically tracks the Fletcher-Munson equal loudness contours, recovered/synthesized concert hall ambience signals, rear matrix encoded audio signals, recovered direct audio signals when rear matrix encoded audio signals predominate, and recovered rear matrix encoded audio signals when discrete direct audio signals predominate.

This system includes a Psychoacoustic Audio Demultiplexer that demultiplexes, in response to said digital commutation data, said output audio signals into 4, 5, 6, 8, 10, 12, 14, 16 . . . 72 preselected output audio channels and associated configuration of transducers. The demultiplexed and point-source reproduced discrete sound images establish a 360-degree walkthrough quadrifield that eliminates the stereophonic/qaudriphonic seat; a consumer problem initiated in 1924 and defying practical solution since the first commercial stereophonic tape recording in 1954 or disc recording in 1958.

22 Claims, 175 Drawing Figures

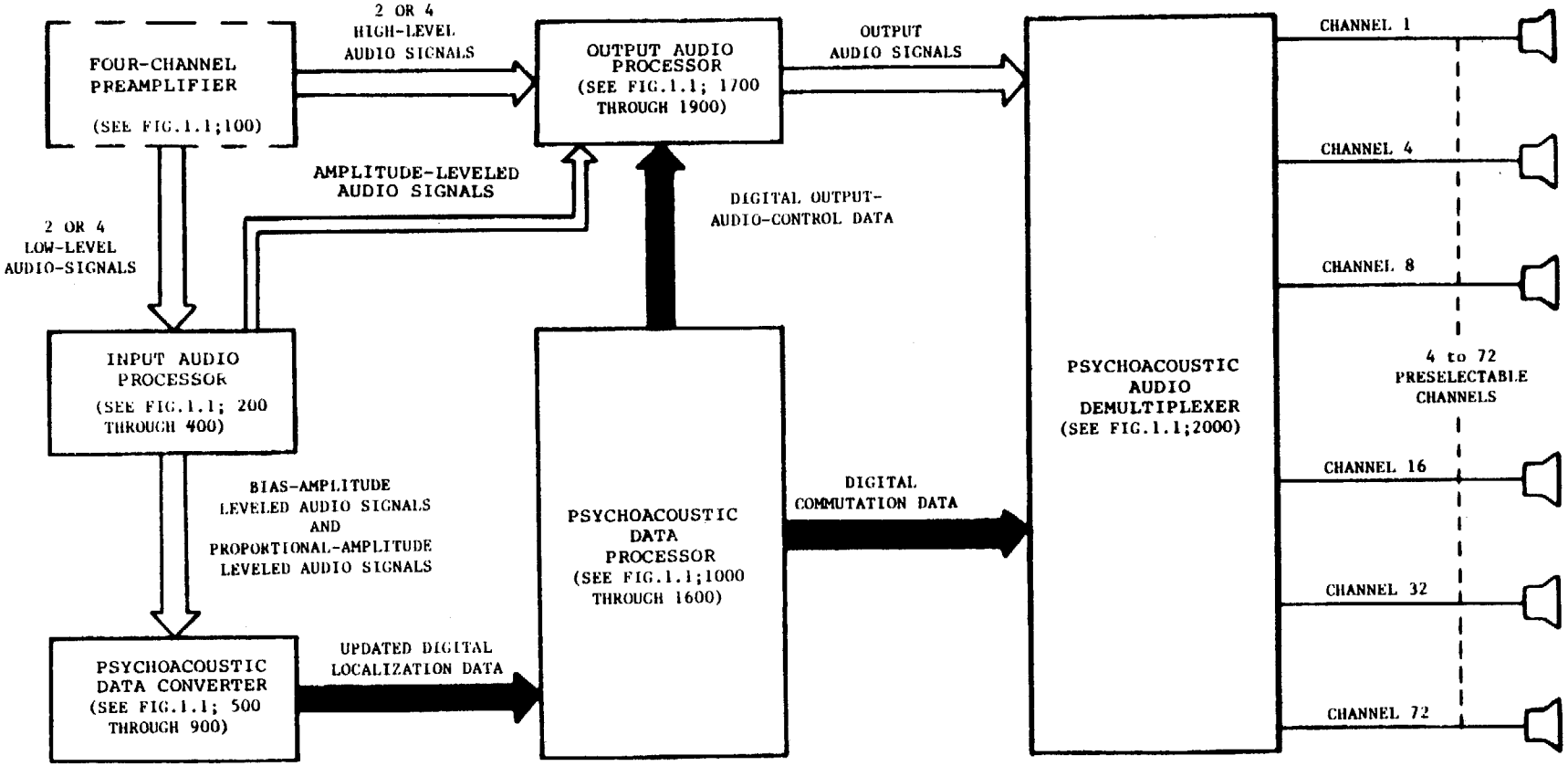
FIG. 1.0

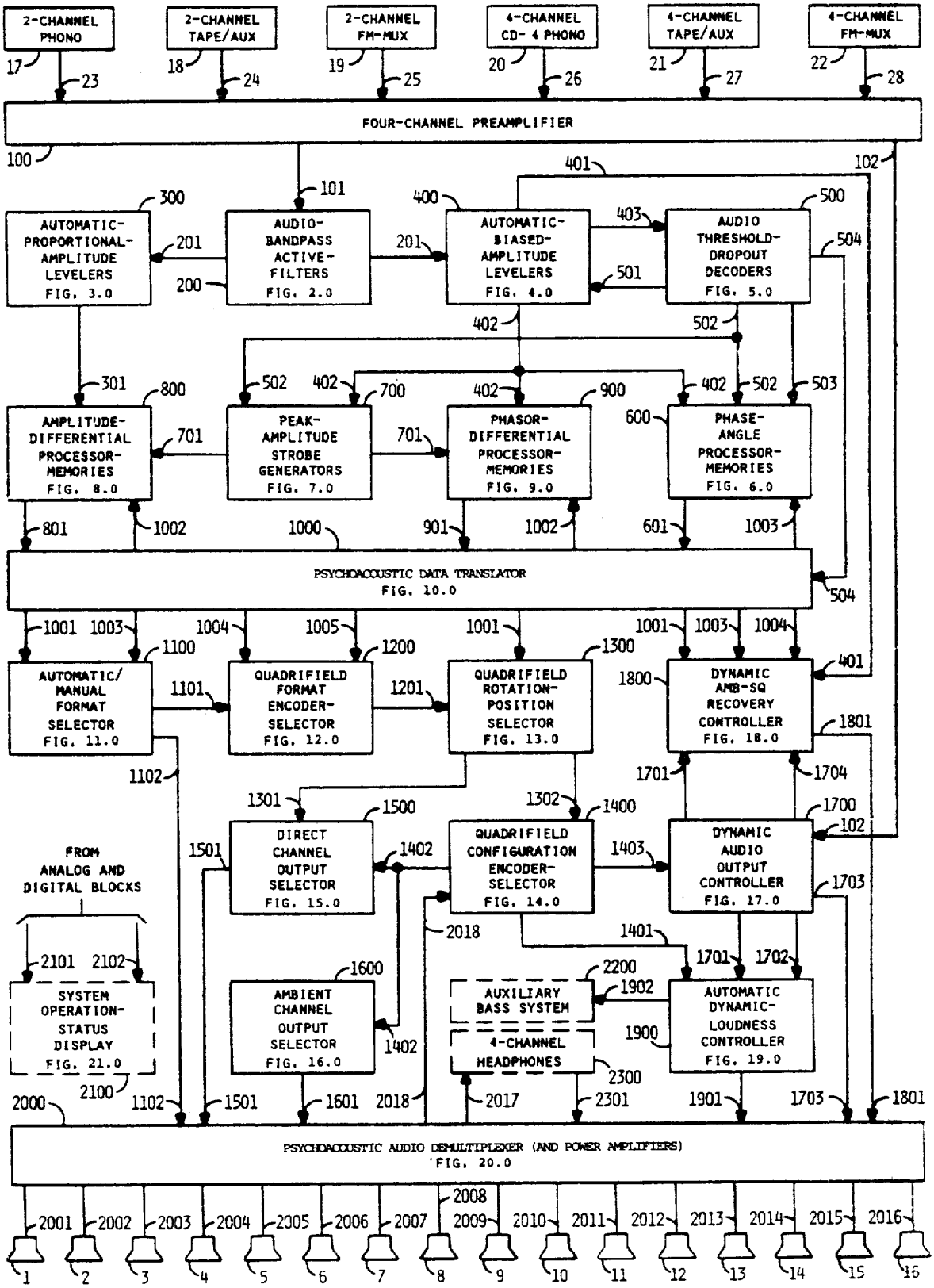
FIG. 1.1

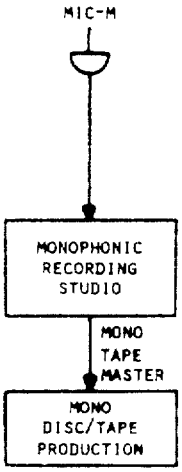
FIG.1.2
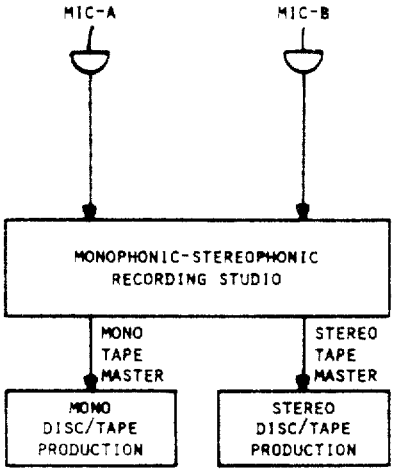
FIG.1.3
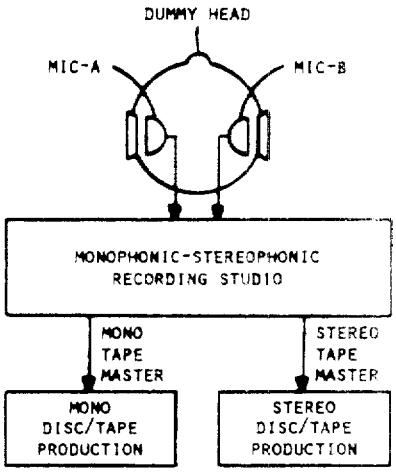
FIG.1.4
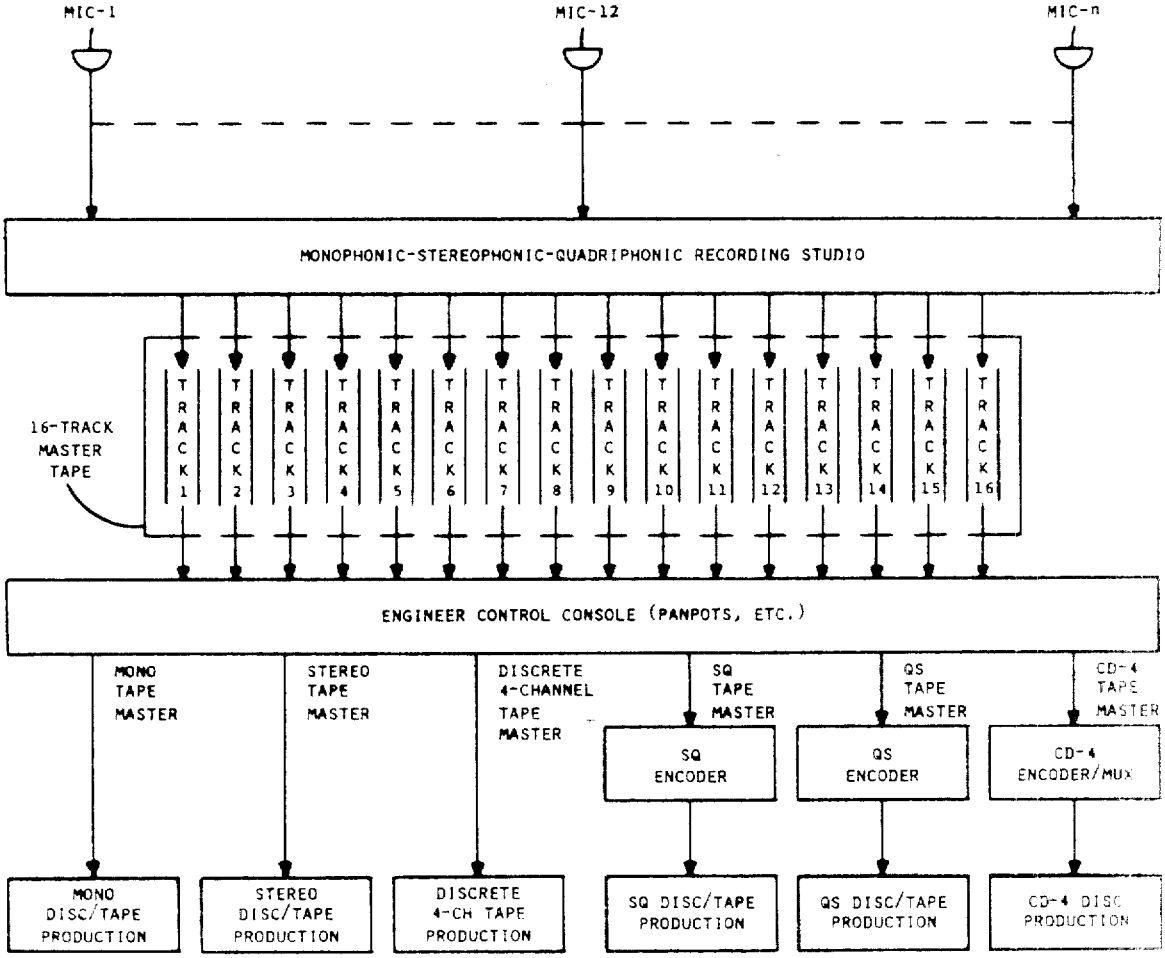
FIG.1.5

| PANPOT STEP | PANPOT ANGULAR DISPLACEMENT PARAMETERS | | | | SYSTEM ANGULAR DISPLACEMENT PARAMETERS | | | |
|---|---|---|---|---|---|---|---|---|
| | dB RATIO | | VOLTAGE RATIO | | dB RATIO | | VOLTAGE RATIO | |
| | CH-X, LEFT | CH-Y, RIGHT | CH-X, LEFT | CH-Y, RIGHT | CH-X, LEFT | CH-Y, RIGHT | CH-X, LEFT | CH-Y, RIGHT |
| 0 * | 0.0 | -∞ | 1.0000 | 0.0000 | 0.0 | -∞ | 10.0 | 0.0 |
| 1 | -0.3 | -11.7 | 0.9661 | 0.2600 | 0.0 | -10.6 | 10.0 | 3.0 |
| 2 | -0.6 | -8.9 | 0.9333 | 0.3589 | 0.0 | -7.4 | 10.0 | 4.3 |
| 3 | -0.9 | -7.3 | 0.9016 | 0.4315 | 0.0 | -5.5 | 10.0 | 5.3 |
| 4 | -1.2 | -6.2 | 0.8710 | 0.4898 | 0.0 | -4.2 | 10.0 | 6.2 |
| 5 | -1.5 | -5.3 | 0.8414 | 0.5433 | 0.0 | -3.1 | 10.0 | 7.0 |
| 6 | -1.8 | -4.7 | 0.8128 | 0.5821 | 0.0 | -2.3 | 10.0 | 7.7 |
| 7 | -2.1 | -4.2 | 0.7852 | 0.6166 | 0.0 | -1.6 | 10.0 | 8.3 |
| 8 | -2.4 | -3.7 | 0.7586 | 0.6531 | 0.0 | -1.0 | 10.0 | 8.9 |
| 9 | -2.7 | -3.3 | 0.7328 | 0.6839 | 0.0 | -0.4 | 10.0 | 9.5 |
| 10 | -3.0 | -3.0 | 0.7079 | 0.7079 | 0.0 | 0.0 | 10.0 | 10.0 |
| 11 | -3.3 | -2.7 | 0.6839 | 0.7328 | -0.4 | 0.0 | 9.5 | 10.0 |
| 12 | -3.7 | -2.4 | 0.6531 | 0.7586 | -1.0 | 0.0 | 8.9 | 10.0 |
| 13 | -4.2 | -2.1 | 0.6166 | 0.7852 | -1.6 | 0.0 | 8.3 | 10.0 |
| 14 | -4.7 | -1.8 | 0.5821 | 0.8128 | -2.3 | 0.0 | 7.7 | 10.0 |
| 15 | -5.3 | -1.3 | 0.5433 | 0.8414 | -3.1 | 0.0 | 7.0 | 10.0 |
| 16 | -6.2 | -1.2 | 0.4898 | 0.8710 | -4.2 | 0.0 | 6.2 | 10.0 |
| 17 | -7.3 | -0.9 | 0.4315 | 0.9016 | -5.5 | 0.0 | 5.3 | 10.0 |
| 18 | -8.9 | -0.6 | 0.3589 | 0.9333 | -7.4 | 0.0 | 4.3 | 10.0 |
| 19 | -11.7 | -0.3 | 0.2600 | 0.9661 | -10.6 | 0.0 | 3.0 | 10.0 |
| 20 * | -∞ | 0.0 | 0.0000 | 1.0000 | -∞ | 0.0 | 0.0 | 10.0 |
* DISC AND TAPE MAX SEPARATION APPROX. 26dB AND 60dB, RESPECTIVELY
FIG.1.6
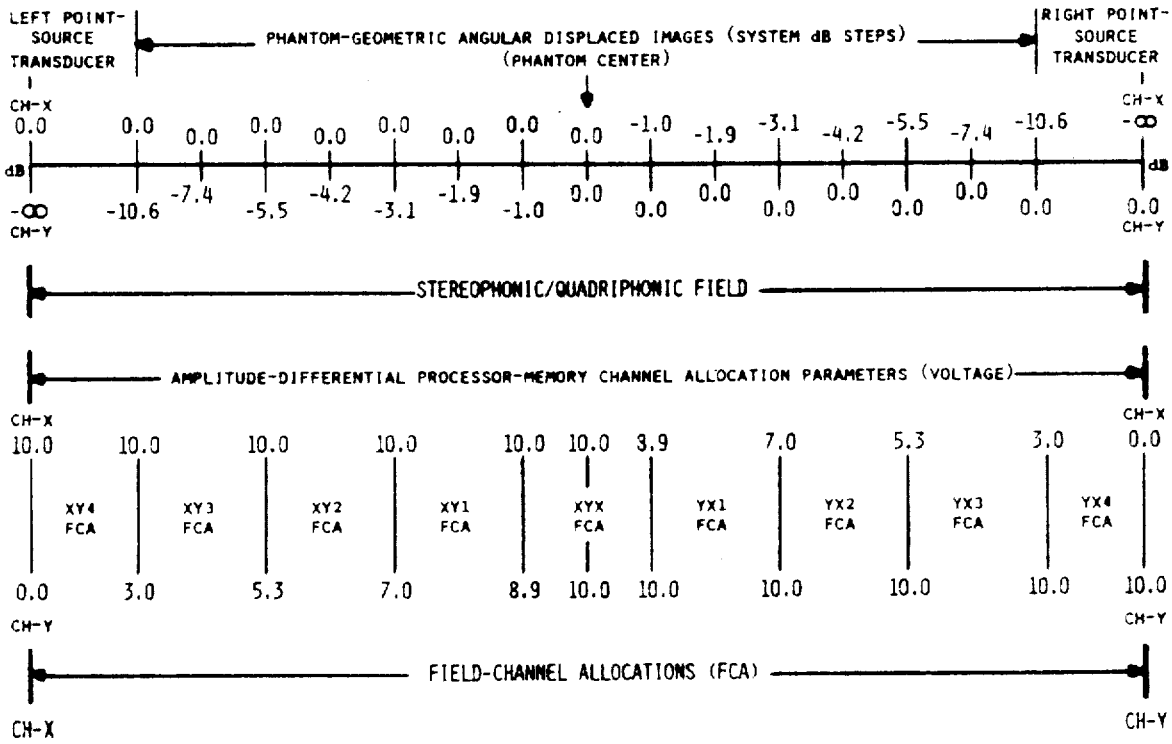
FIG.1.7

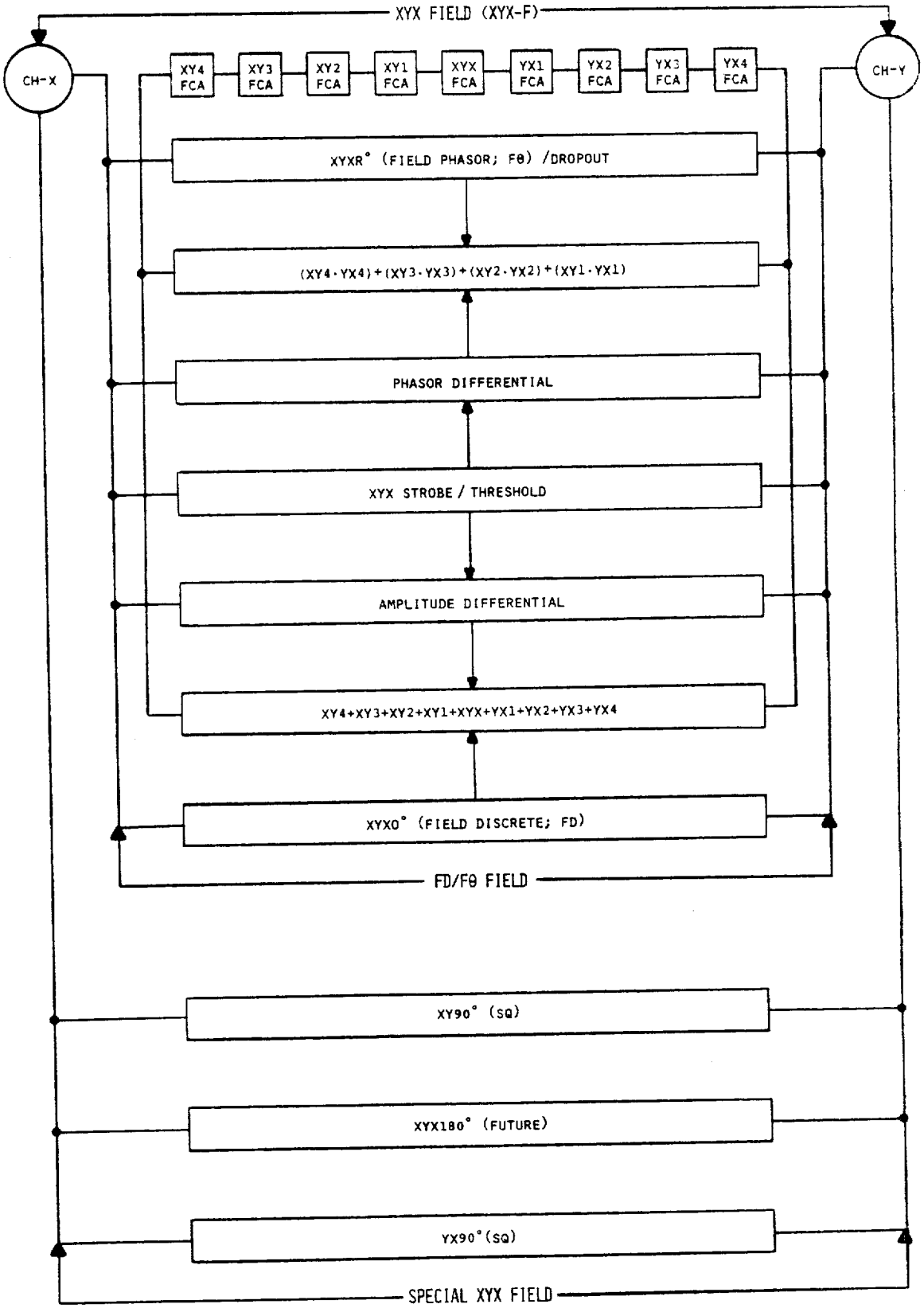
FIG. 1.8

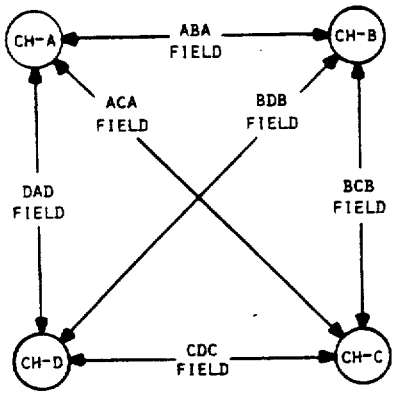

FIG. 1.9

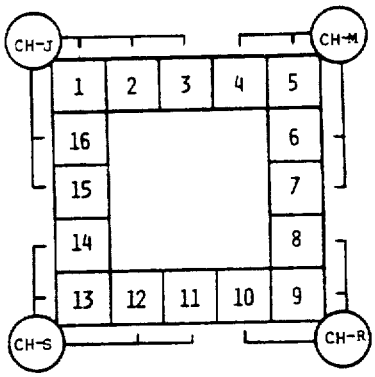

FIG. 1.10

| COMMON DIGITAL PARAMETERS | SYSTEM-FIELD DIGITAL PROCESSING PARAMETERS<br>** NOT USED IN CURRENT SYSTEM; USE REQUIRED FOR EXPANSION TO 72 CHANNEL SYSTEM | | | | | |
|---|---|---|---|---|---|---|
| XYX FIELD | ABA FIELD | BCB FIELD | CDC FIELD | DAD FIELD | ACA FIELD ** | BDB FIELD ** |
| $X_t$ | $A_t$ | $B_t$ | $C_t$ | $D_t$ | $A_t$ | $B_t$ |
| $Y_t$ | $B_t$ | $C_t$ | $D_t$ | $A_t$ | $C_t$ | $D_t$ |
| $X_d$ | $A_d$ | $B_d$ | $C_d$ | $D_d$ | $A_d$ | $B_d$ |
| $Y_d$ | $B_d$ | $C_d$ | $D_d$ | $A_d$ | $C_d$ | $D_d$ |
| XYX STROBE | ABA STROBE | BCB STROBE | CDC STROBE | DAD STROBE | ACA STROBE | BDB STROBE |
| XYX0° | ABA0° | BCB0° | CDC0° | DAD0° | ACA0° | BDB0° |
| XY90° | AB90° | ** BC90° | ** CD90° | ** DA90° | AC90° | BD90° |
| XYX180° | ABA180° | ** BCB180° | ** CDC180° | ** DAD180° | ACA180° | BDB180° |
| YX90° | BA90° | ** CB90° | ** DC90° | ** AD90° | CA90° | DB90° |
| XYXR° | ABAR° | BCBR° | CDCR° | DADR° | ACAR° | BDBR° |
| XY4 | AB4 | BC4 | CD4 | DA4 | AC4 | BD4 |
| XY3 | AB3 | BC3 | CD3 | DA3 | AC3 | BD3 |
| XY2 | AB2 | BC2 | CD2 | DA2 | AC2 | BD2 |
| XY1 | AB1 | BC1 | CD1 | DA1 | AC1 | BD1 |
| XYX | ABA | BCB | CDC | DAD | ACA | BDB |
| YX1 | BA1 | CB1 | DC1 | AD1 | CA1 | DB1 |
| YX2 | BA2 | CB2 | DC2 | AD2 | CA2 | DB2 |
| YX3 | BA3 | CB3 | DC3 | AD3 | CA3 | DB3 |
| YX4 | BA4 | CB4 | DC4 | AD4 | CA4 | DB4 |

FIG. 1.11

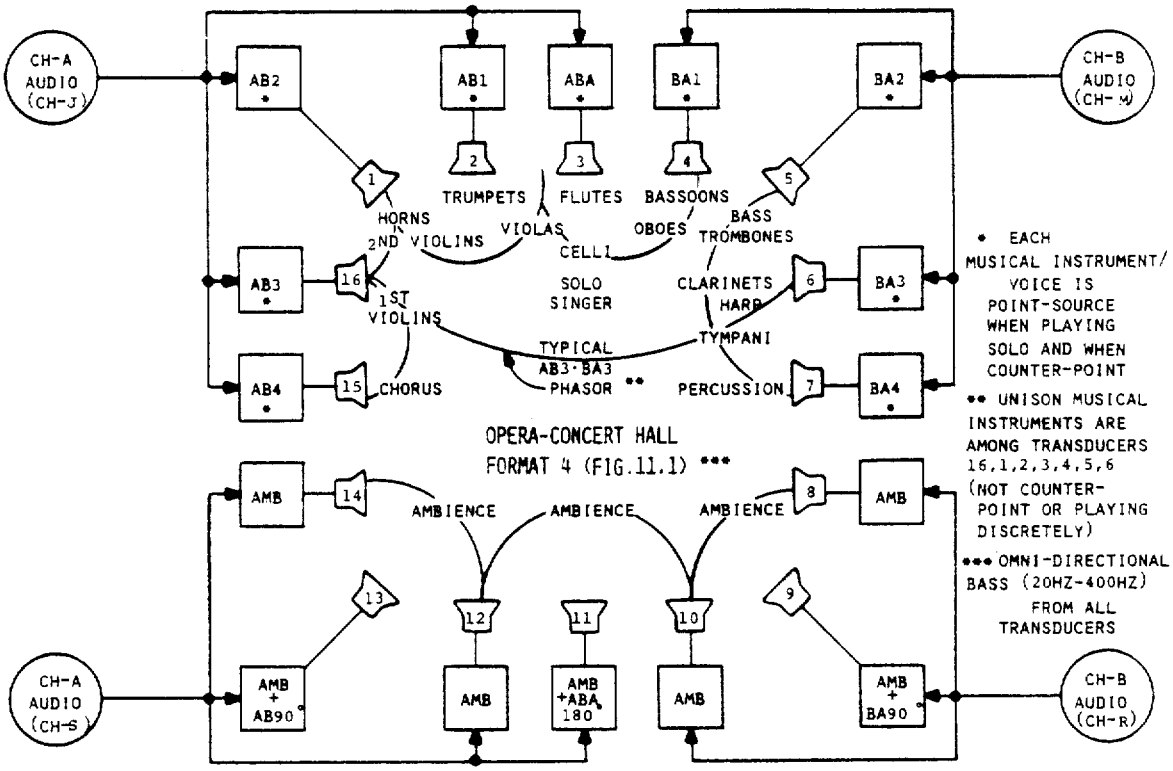
FIG. 1.12
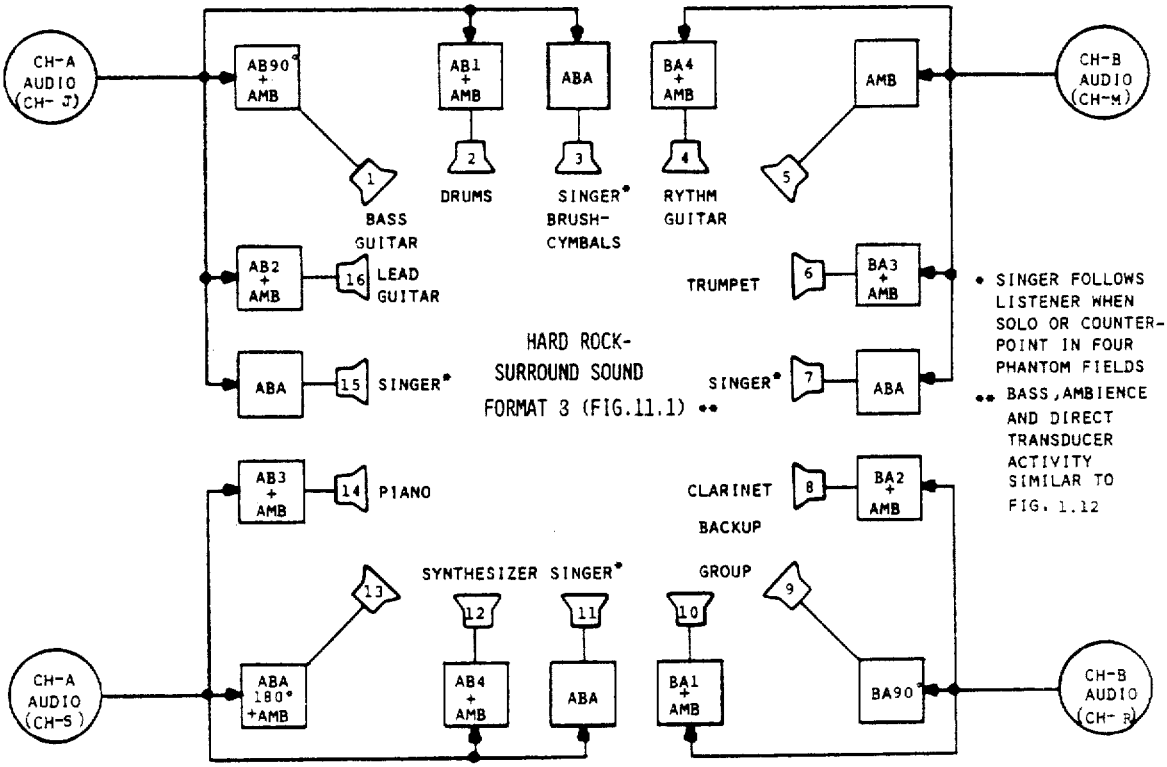
FIG. 1.13

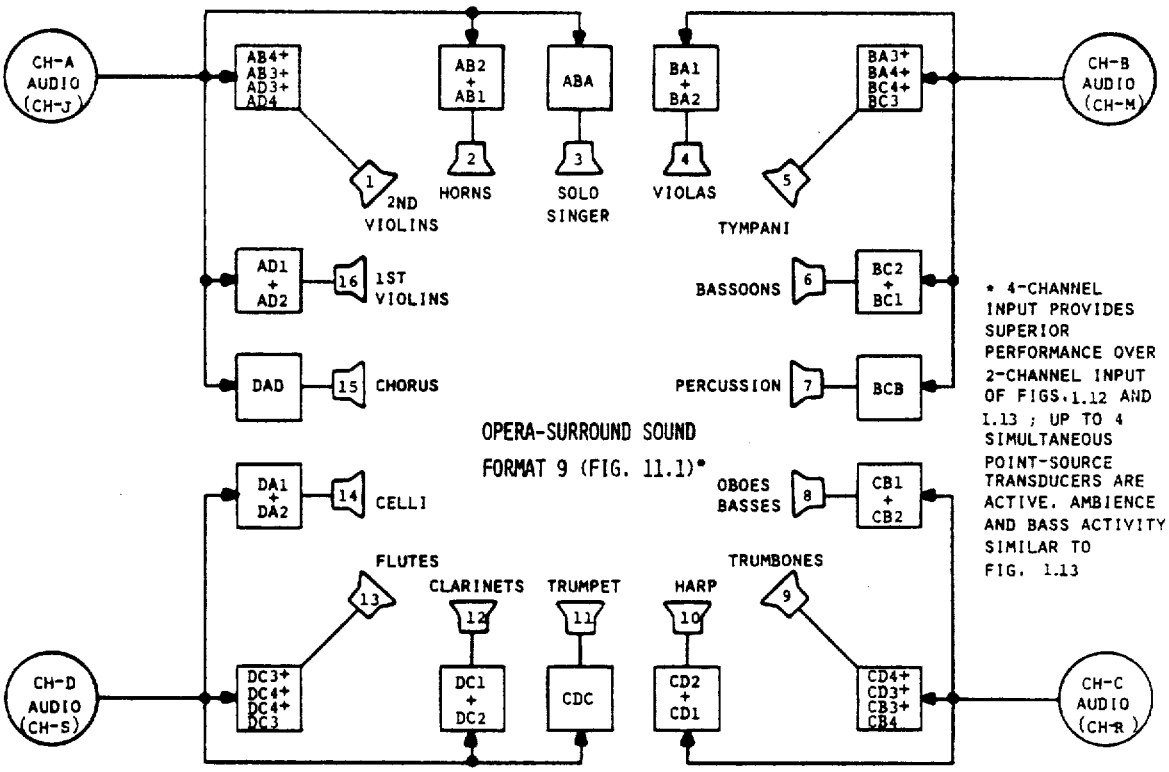
FIG. 1.14
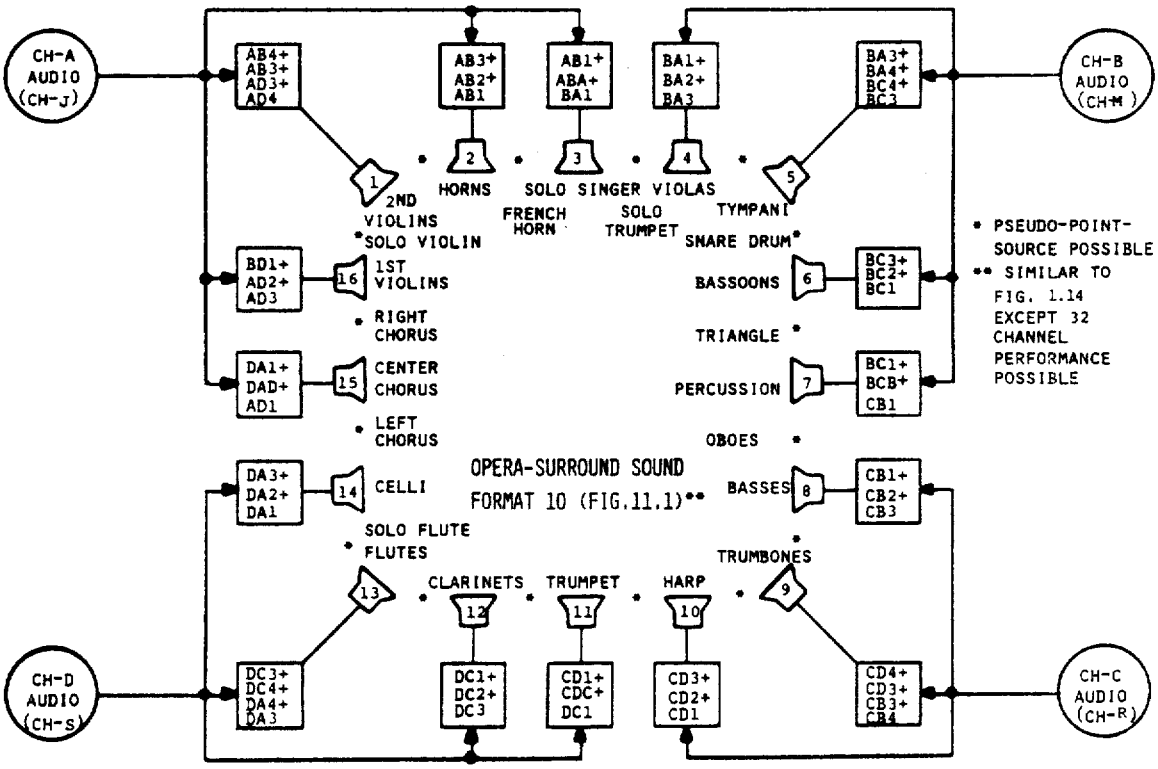
FIG. 1.15

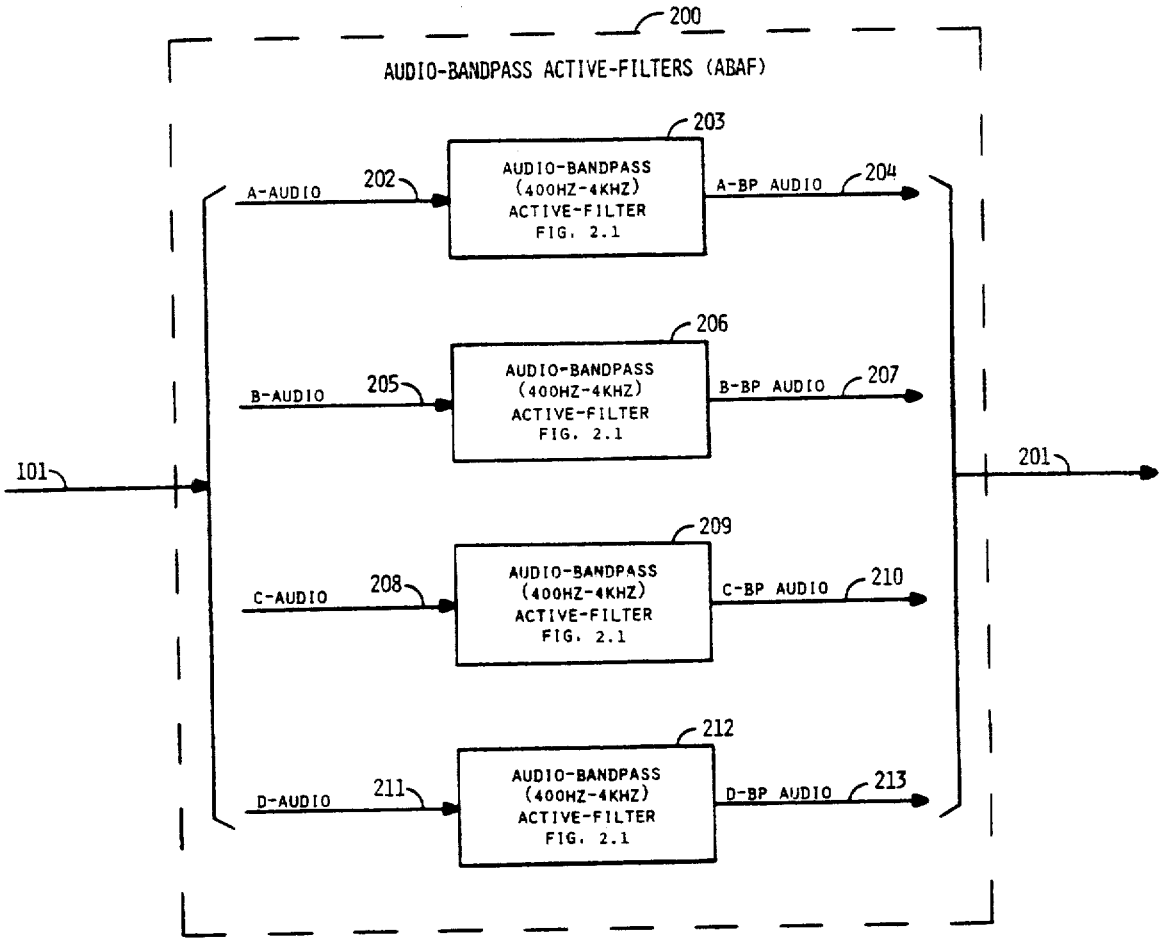
FIG. 2.0
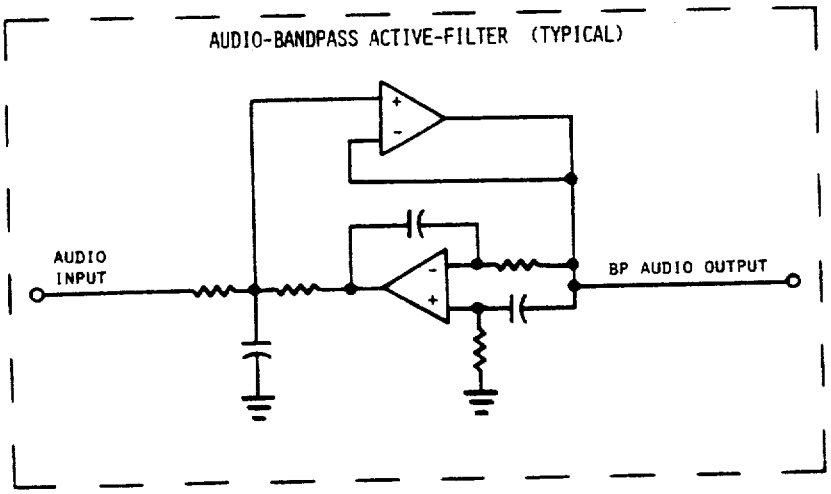
FIG. 2.1

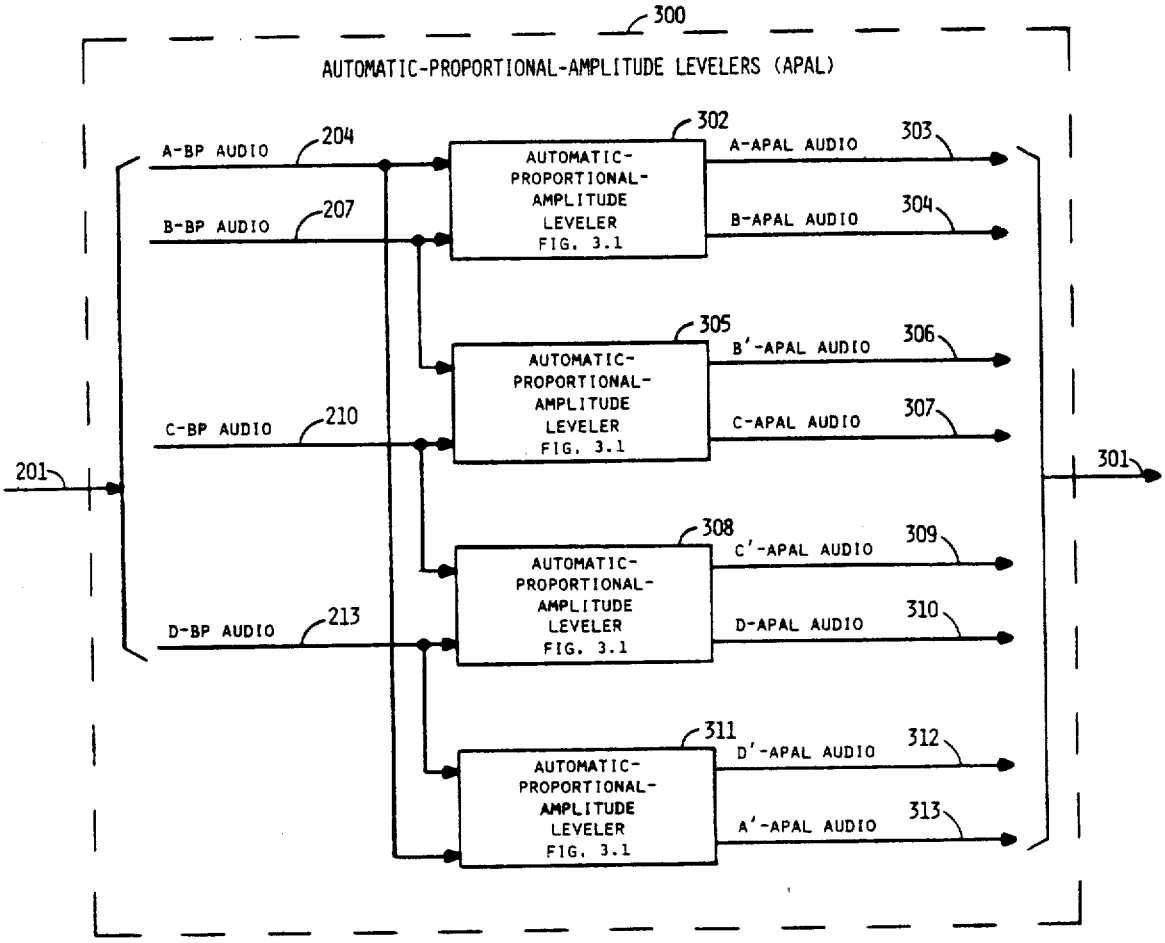
FIG.3.0
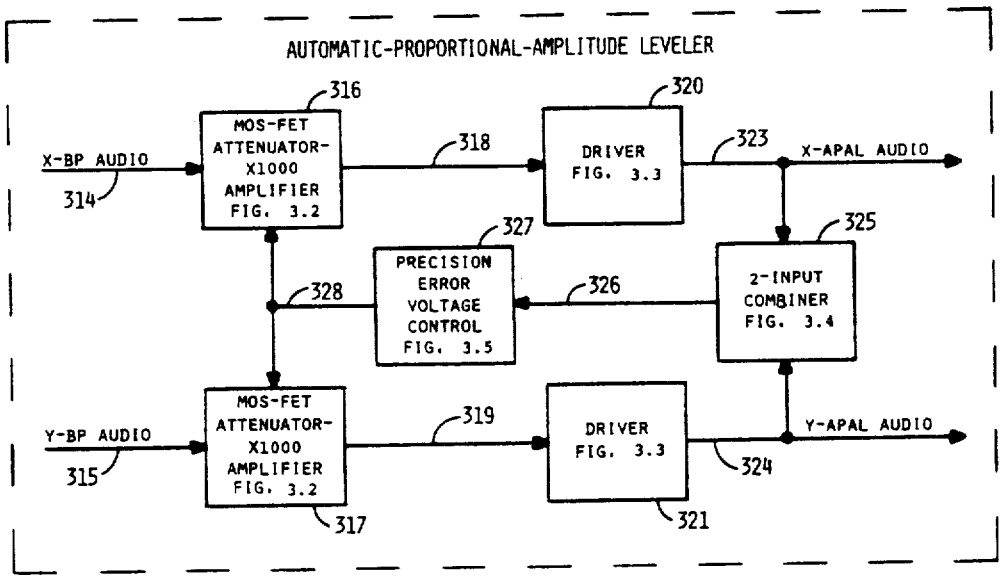
FIG.3.1

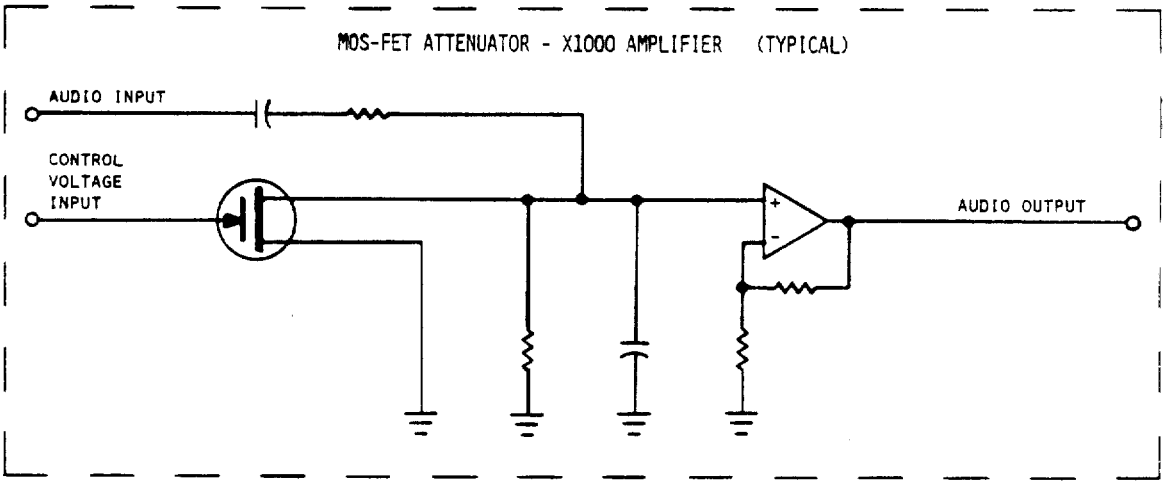
FIG.3.2
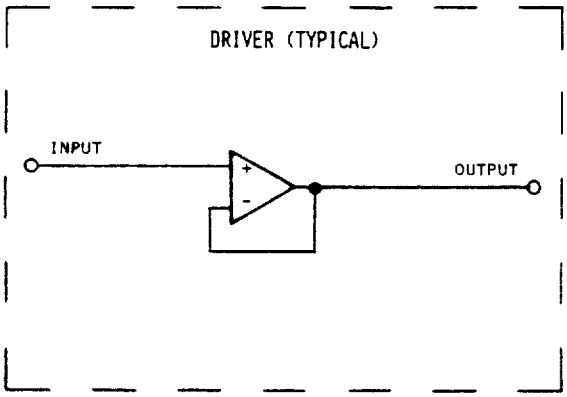
FIG.3.3
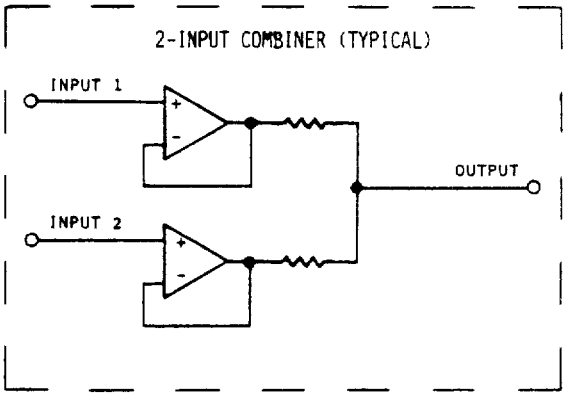
FIG.3.4
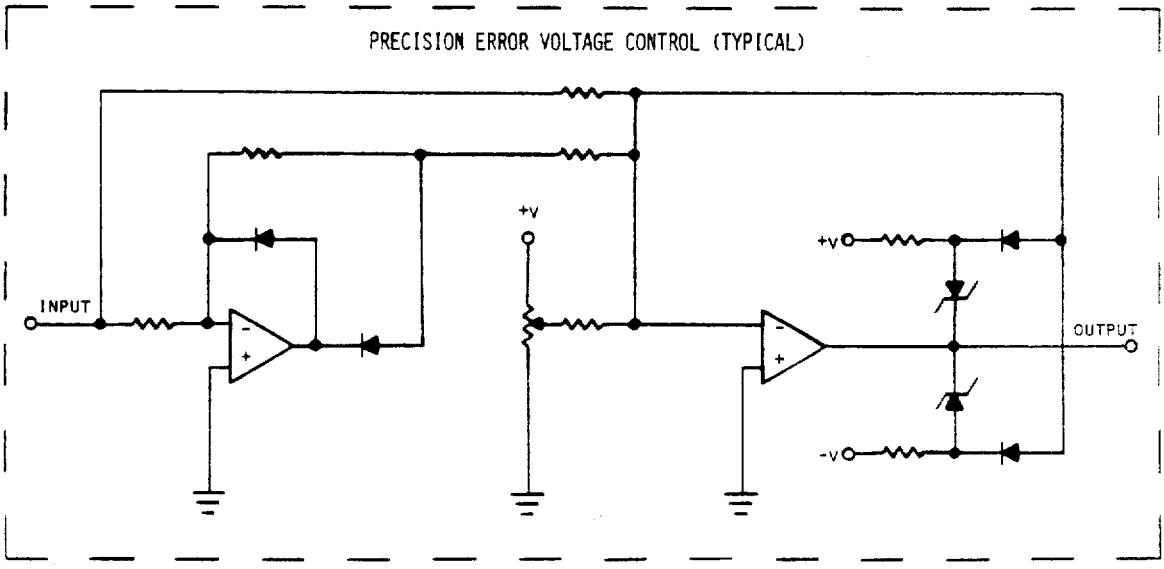
FIG.3.5

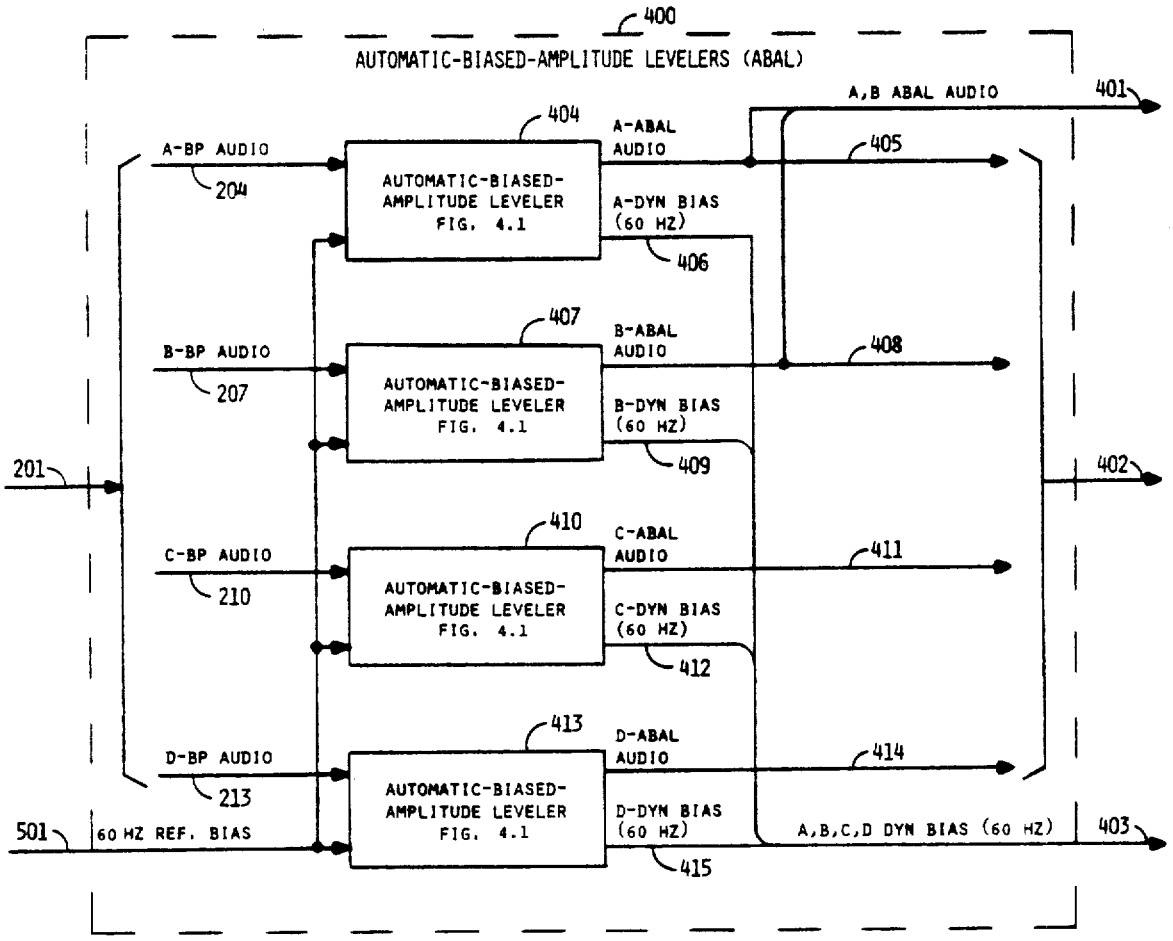
FIG.4.0
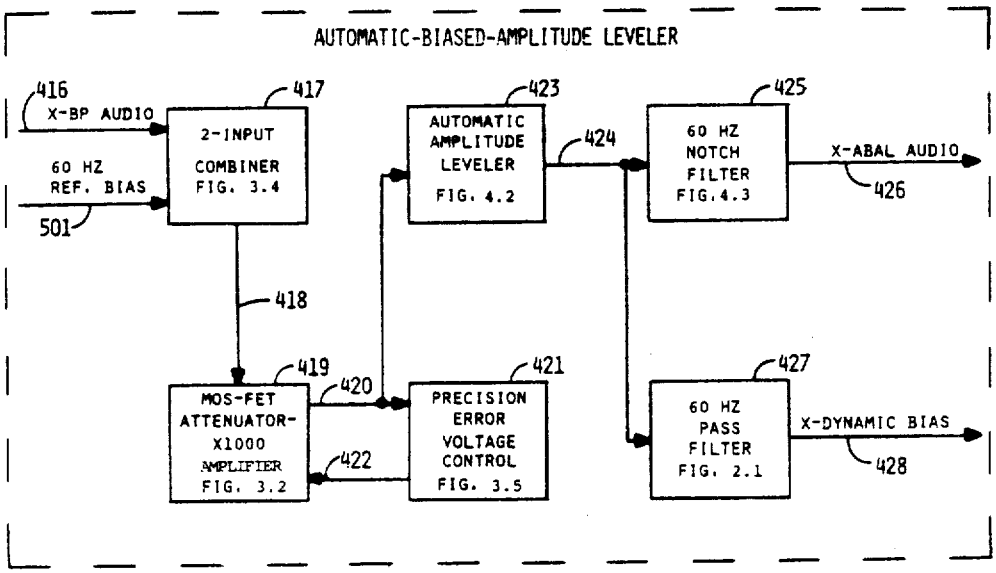
FIG.4.1

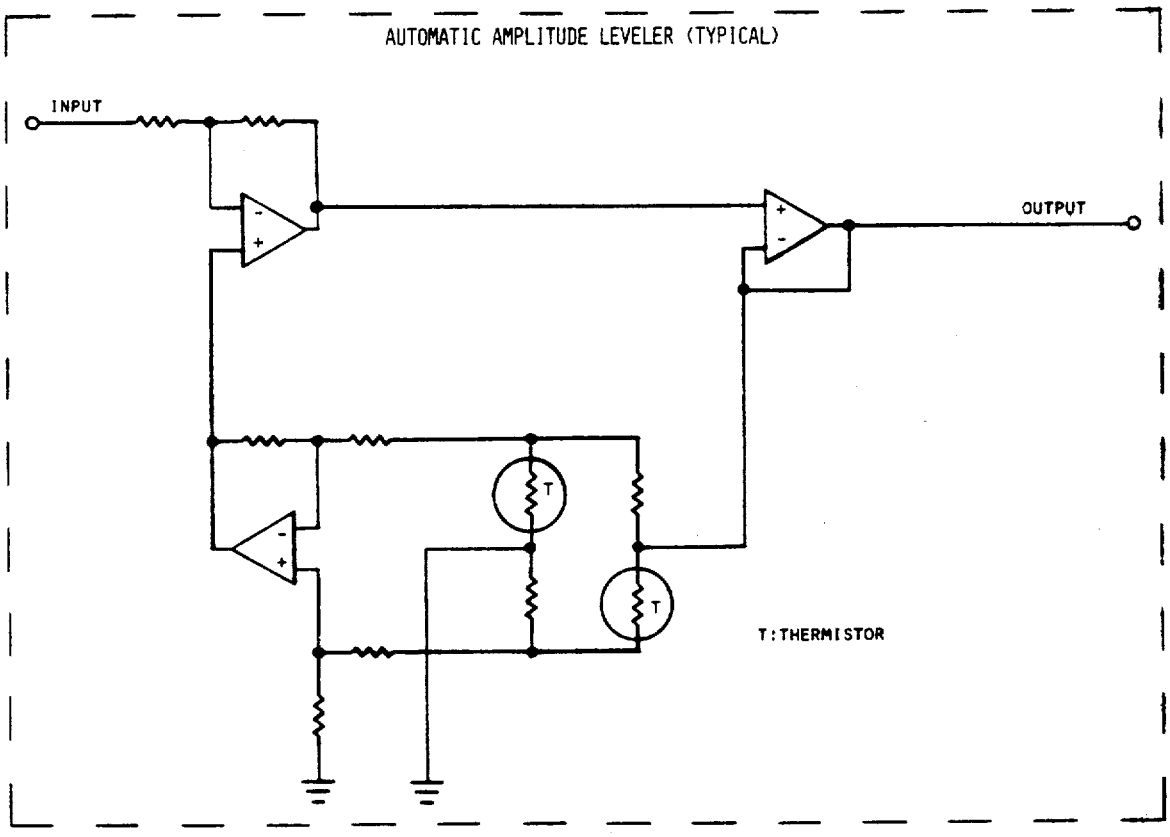
FIG.4.2
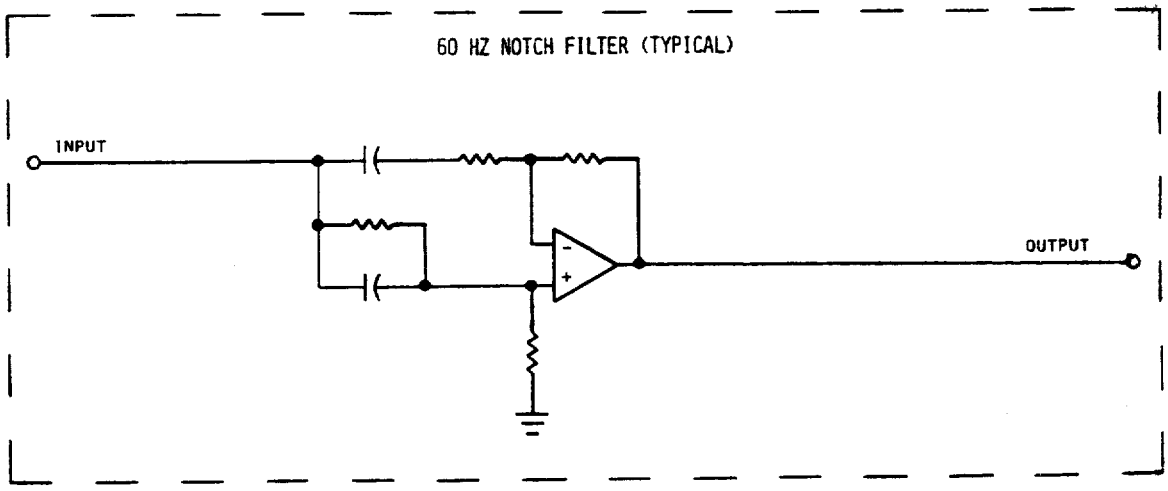
FIG.4.3

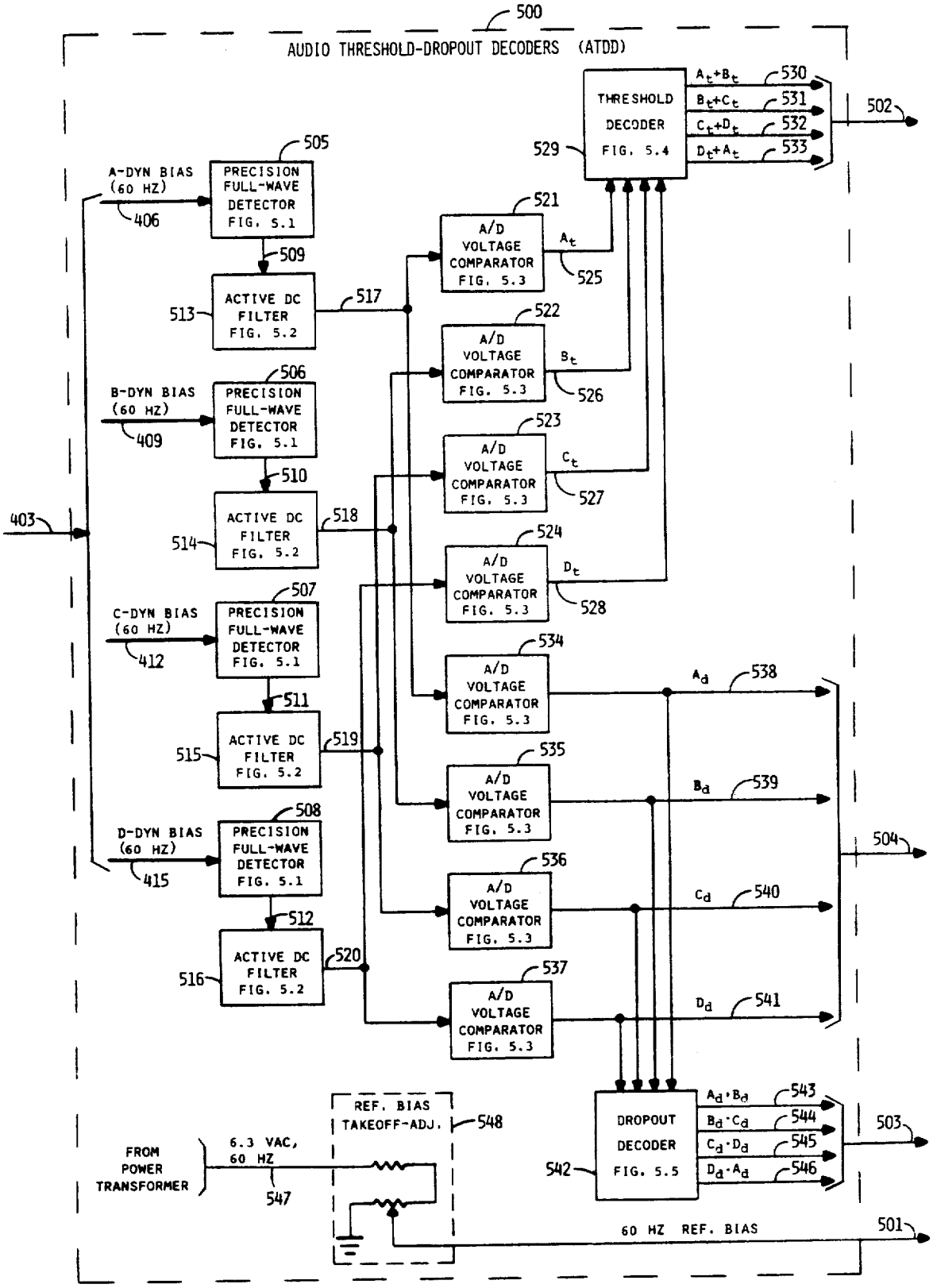
FIG. 5.0

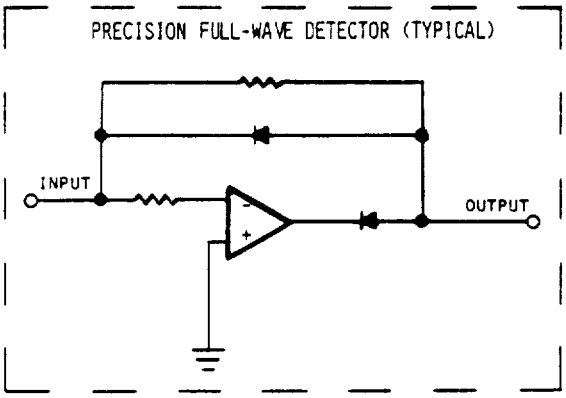
FIG.5.1
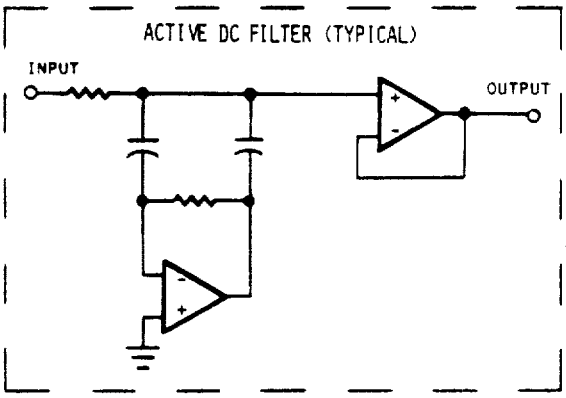
FIG.5.2
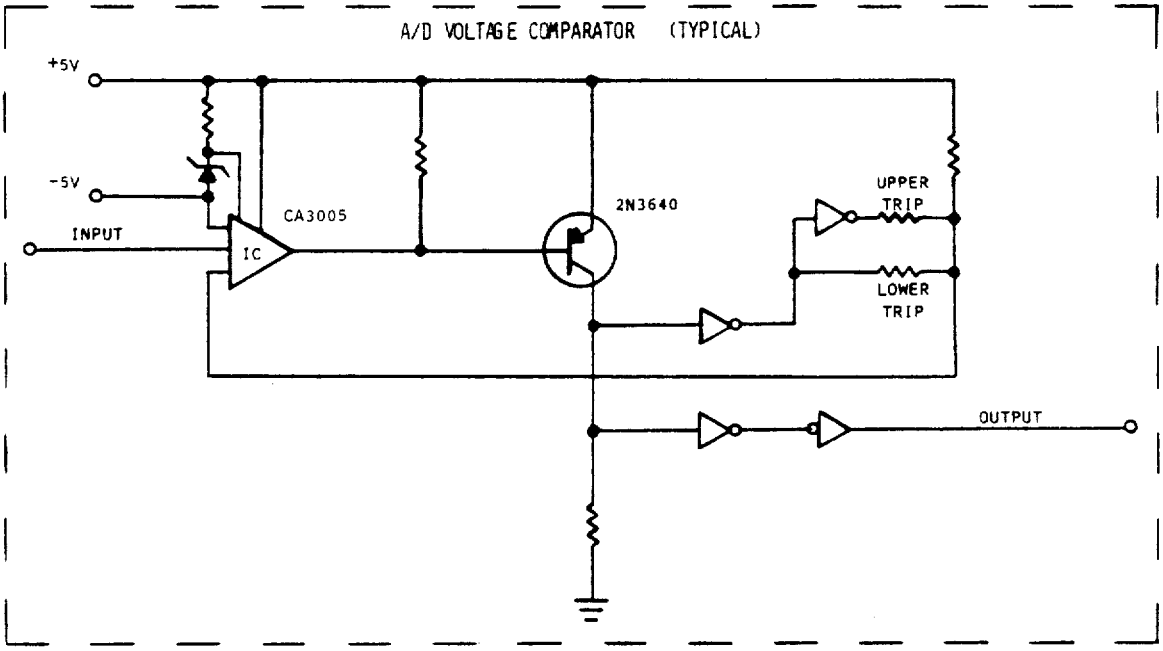
FIG.5.3
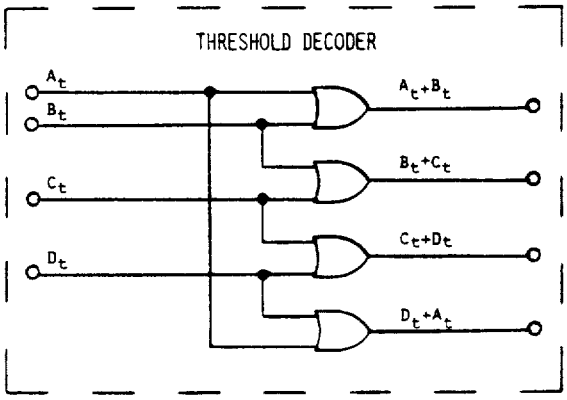
FIG.5.4
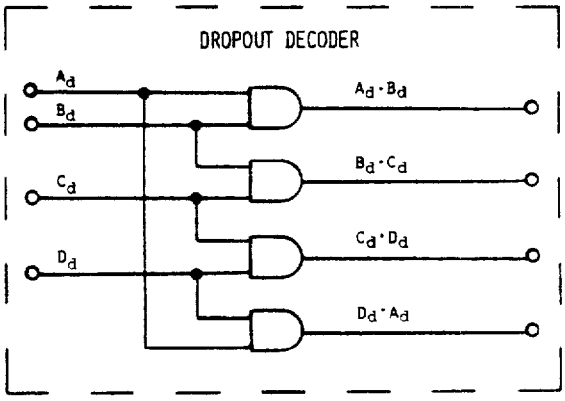
FIG.5.5

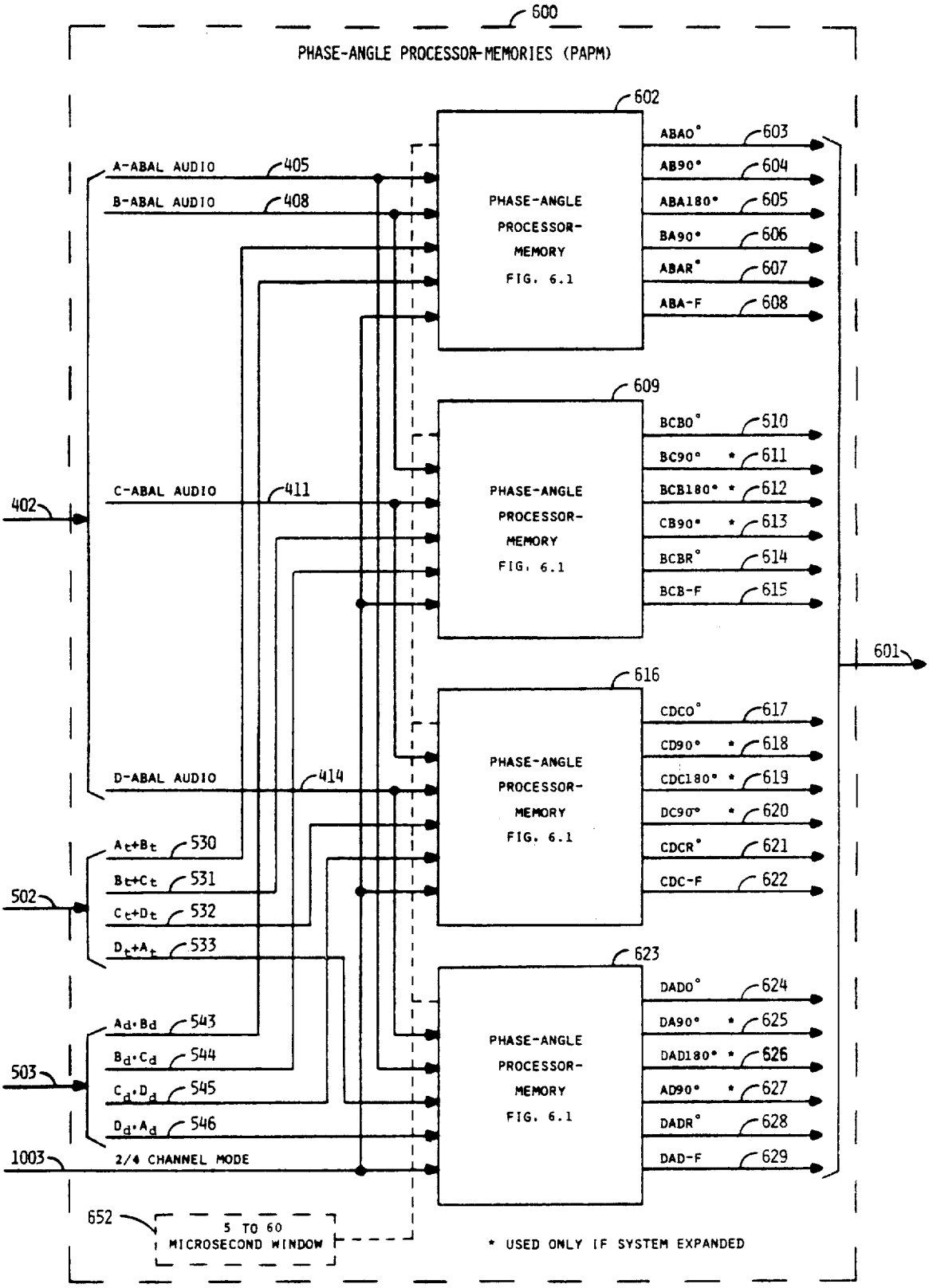
FIG. 6.0

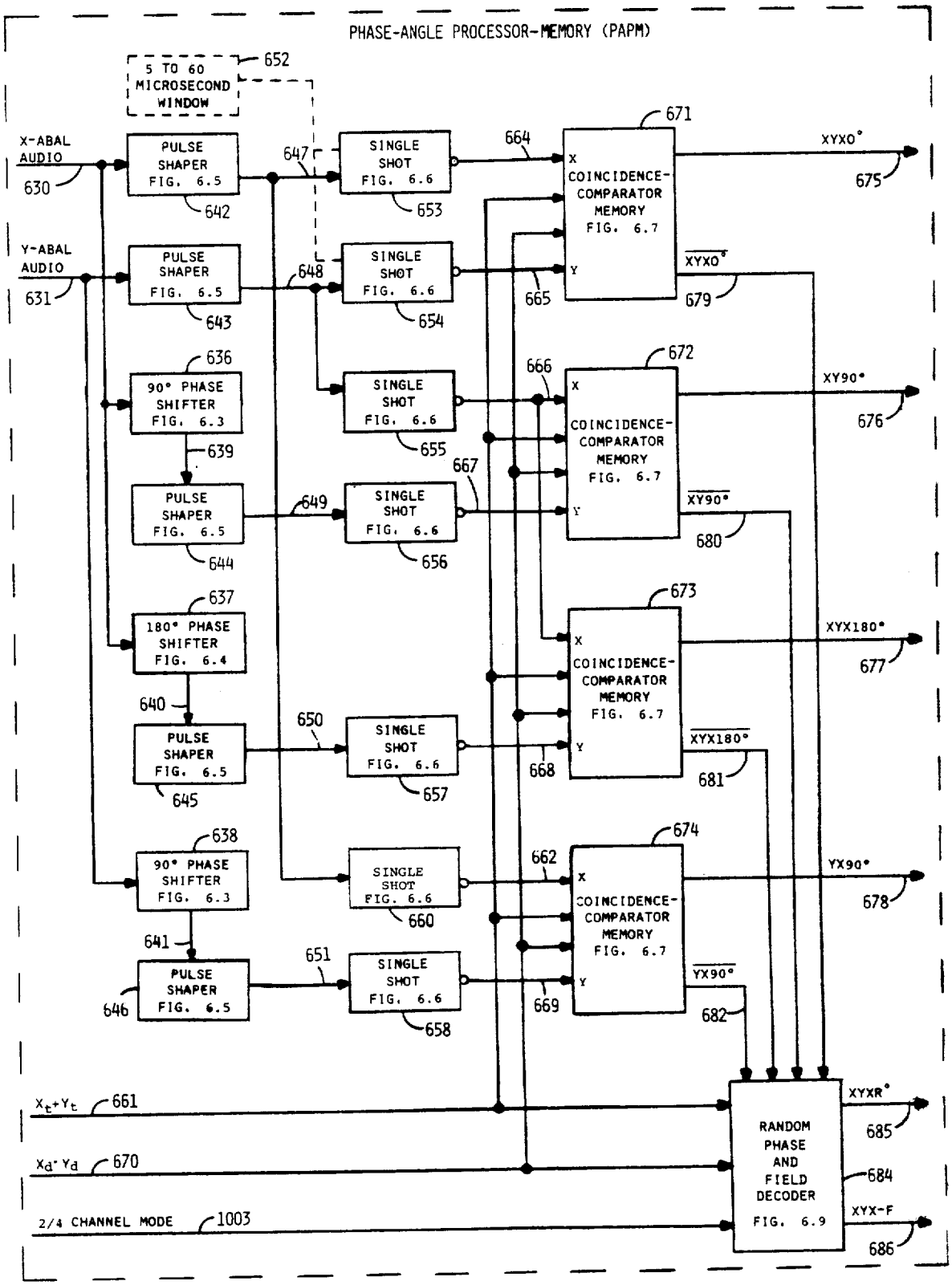
FIG. 6.1

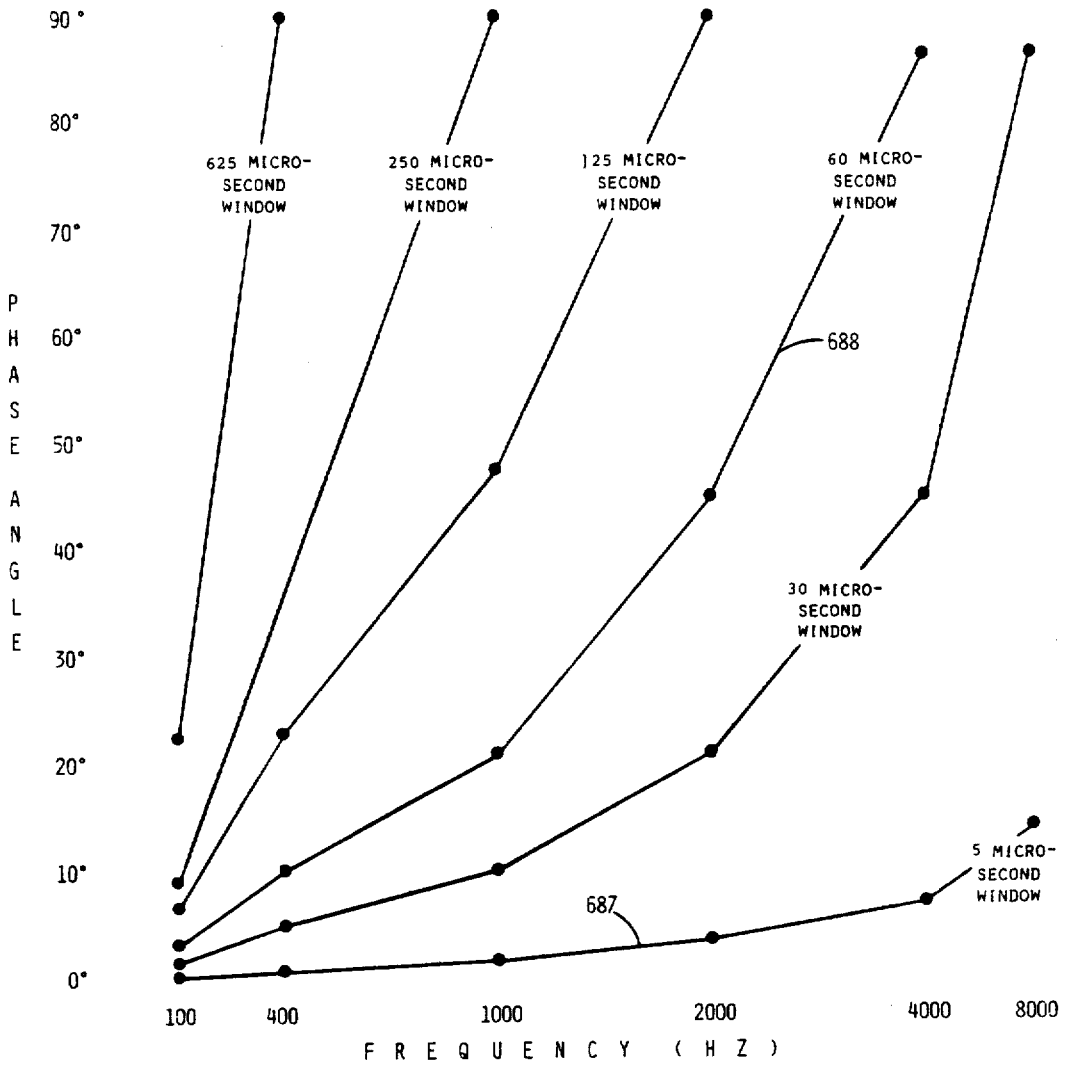
FIG.6.2
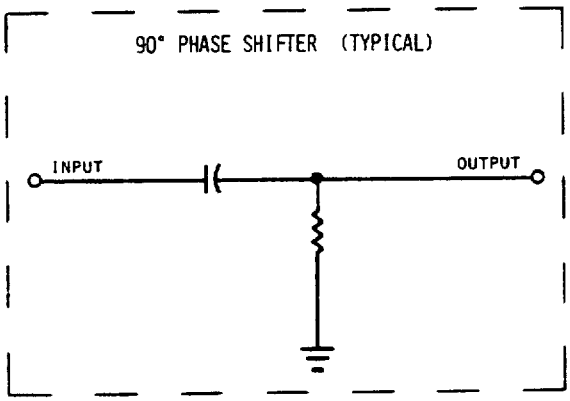
FIG.6.3
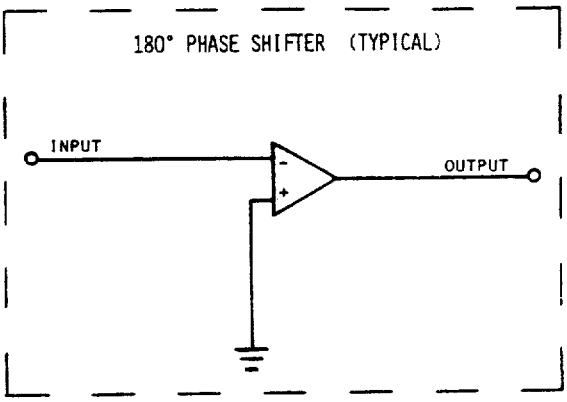
FIG.6.4

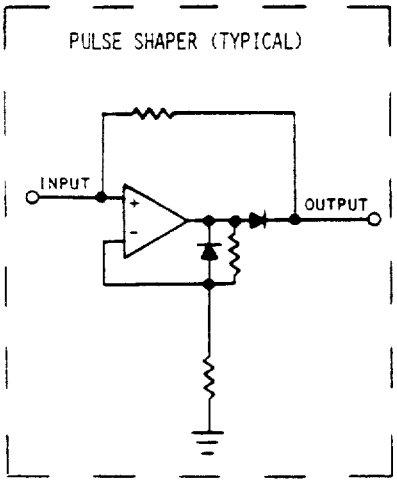
FIG.6.5
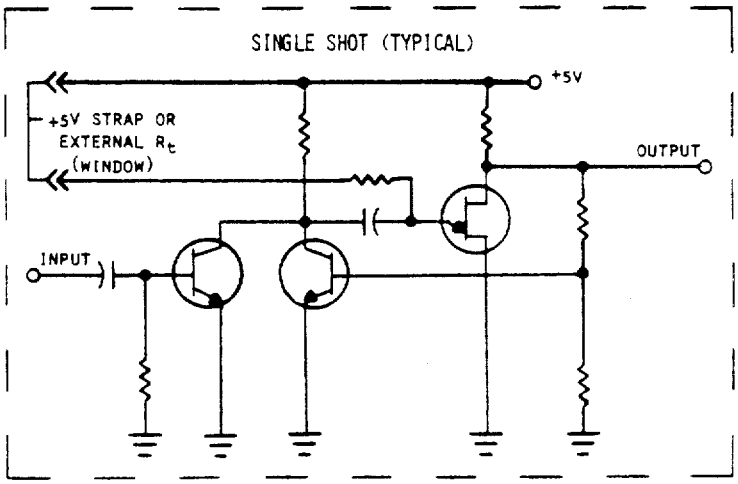
FIG.6.6
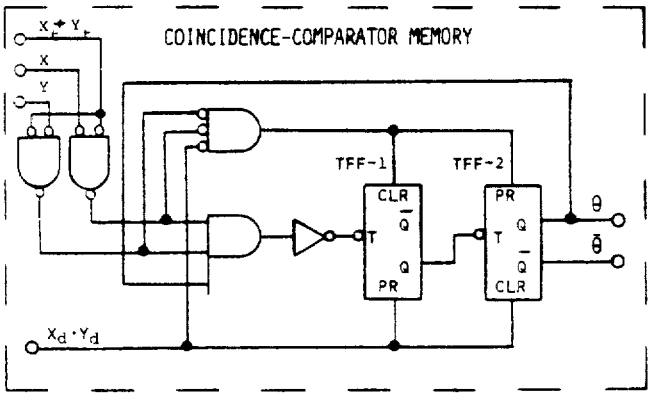
FIG.6.7
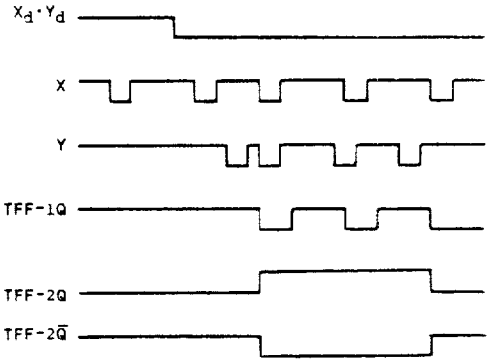
FIG.6.8
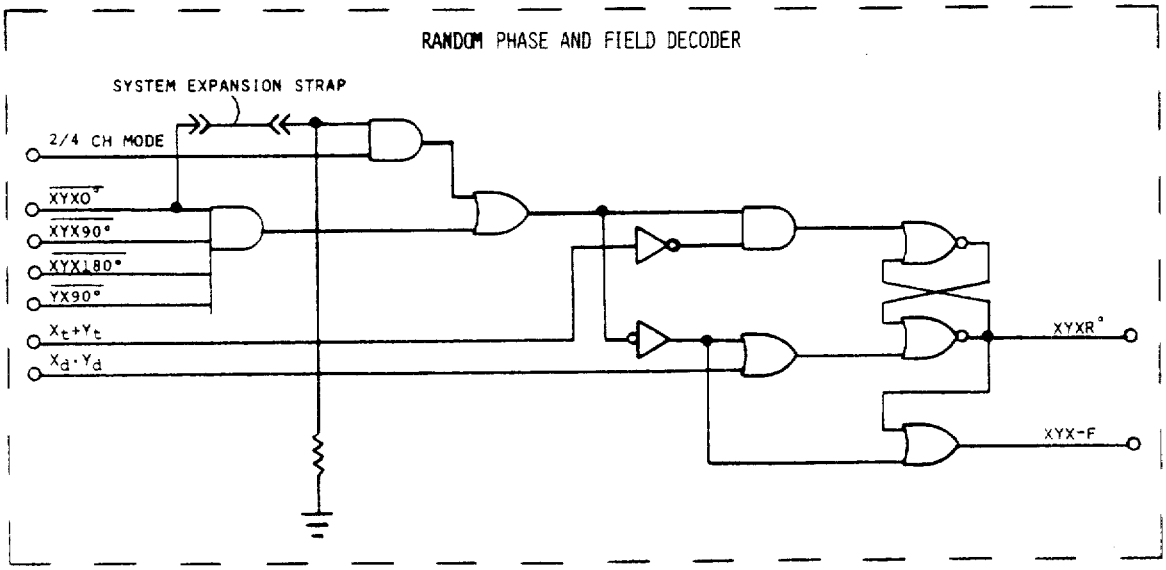
FIG.6.9

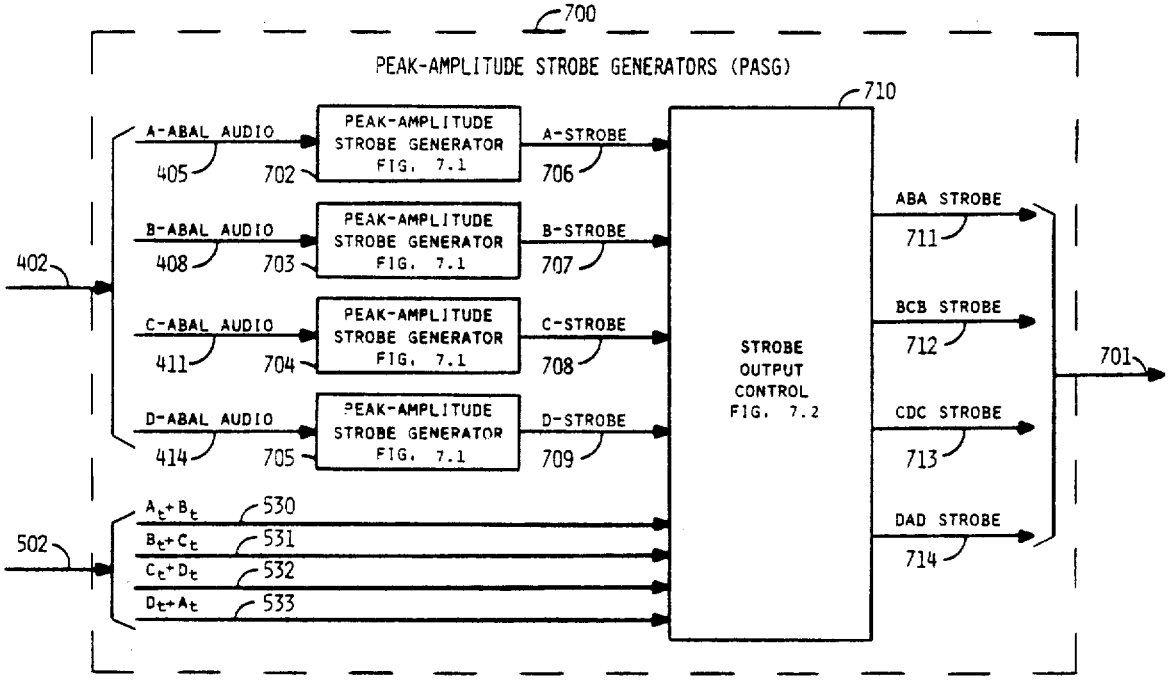
FIG. 7.0
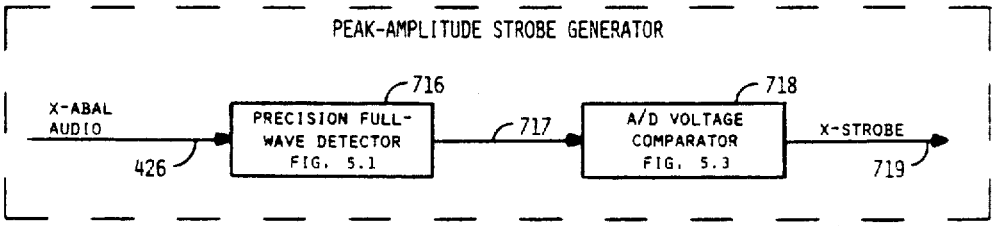
FIG. 7.1
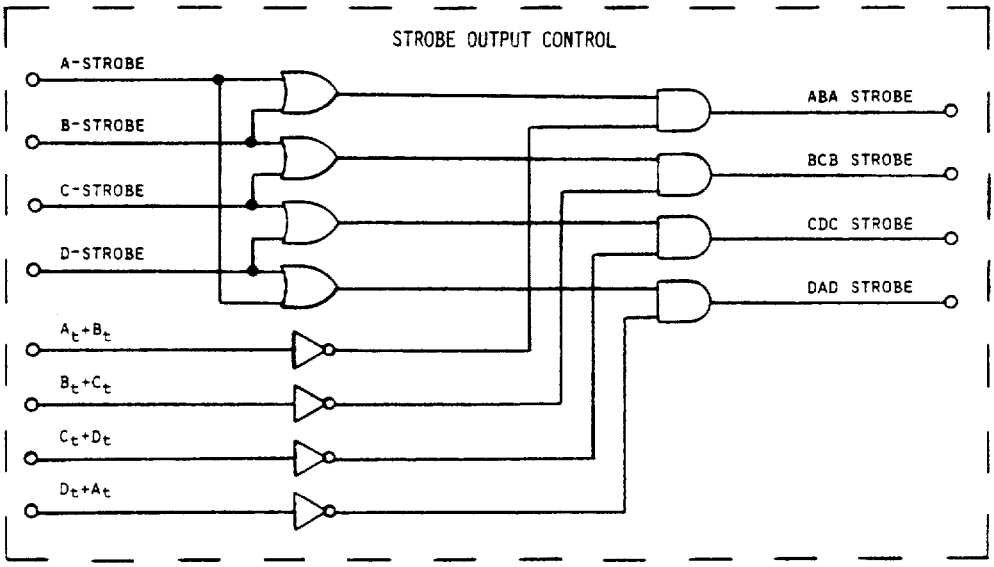
FIG. 7.2

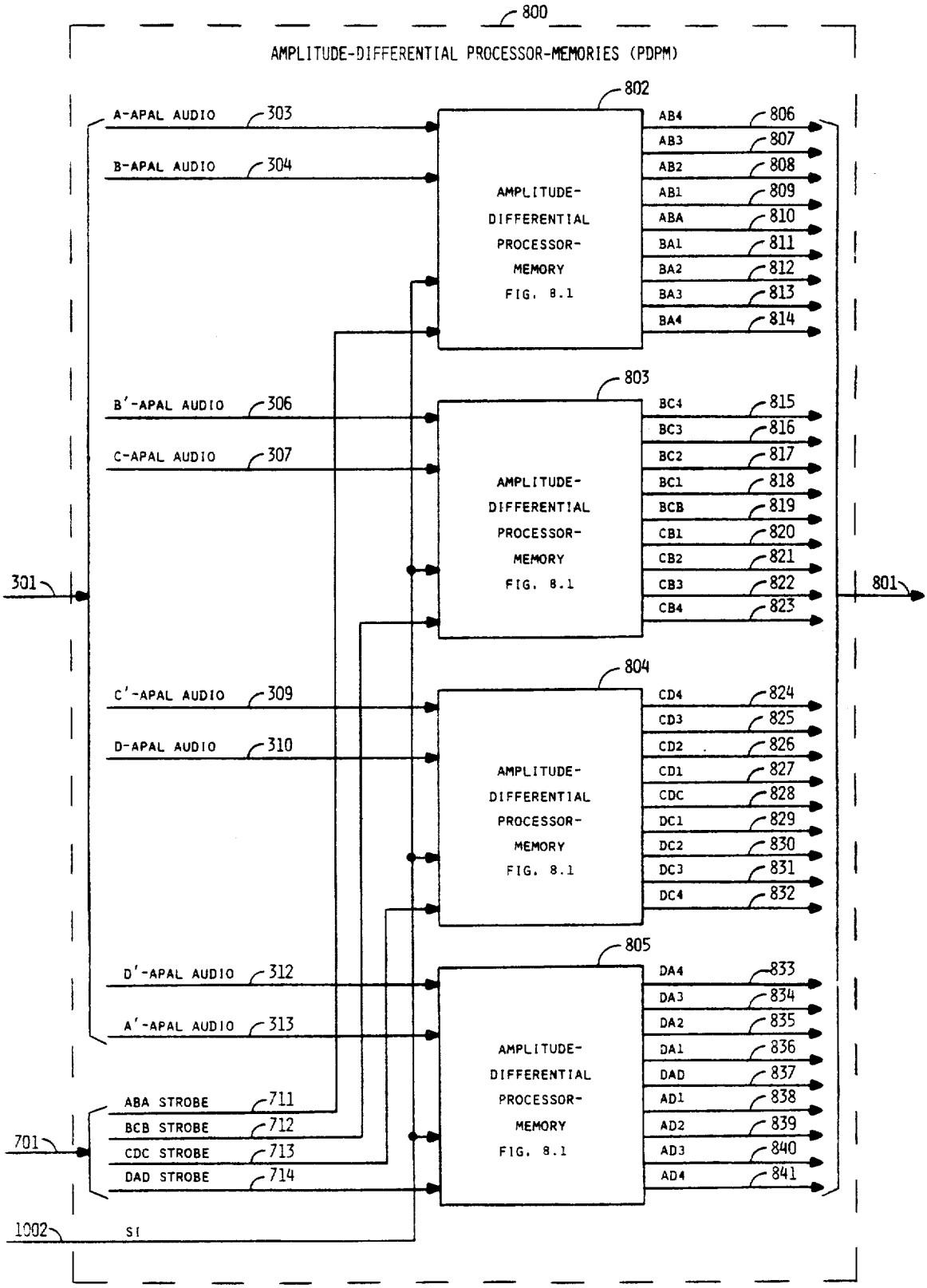
FIG. 8.0

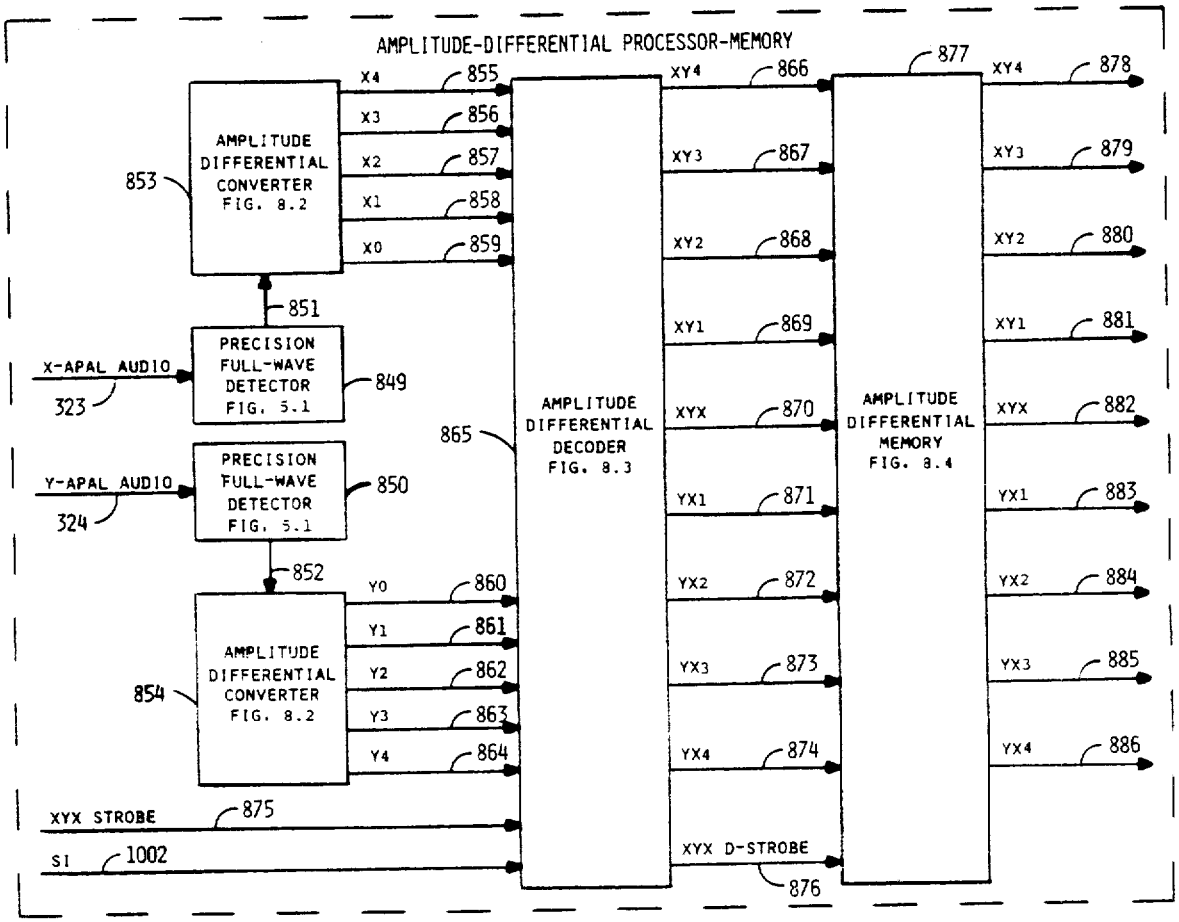
FIG. 8.1
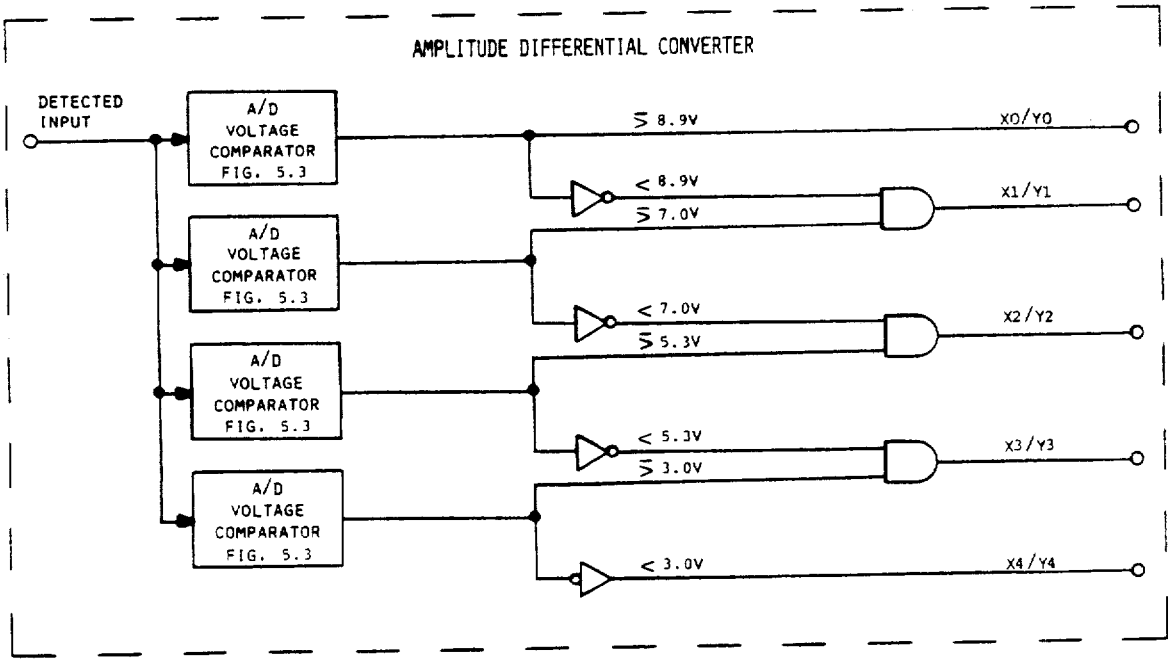
FIG. 8.2

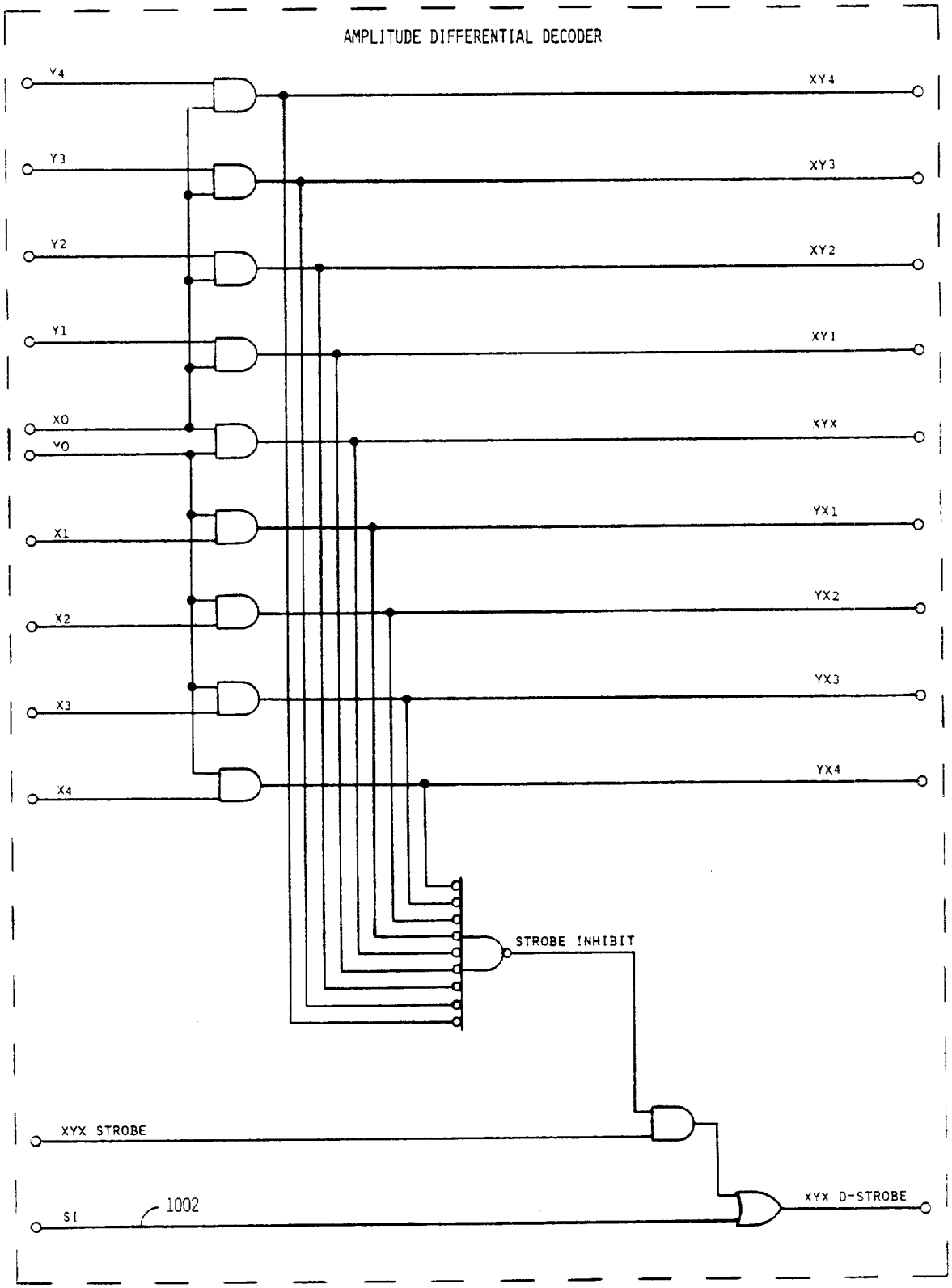
FIG. 8.3

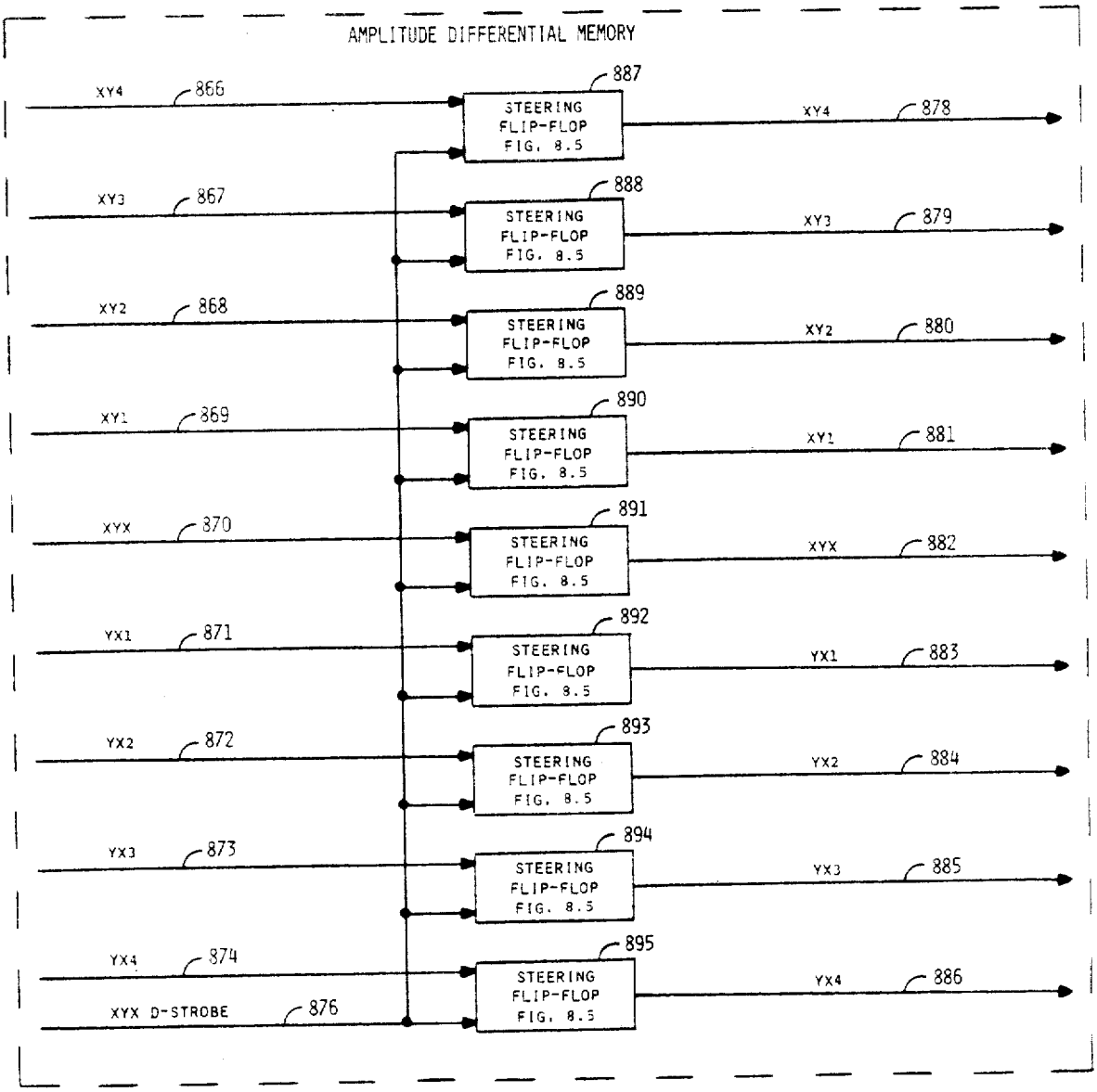
FIG. 8.4
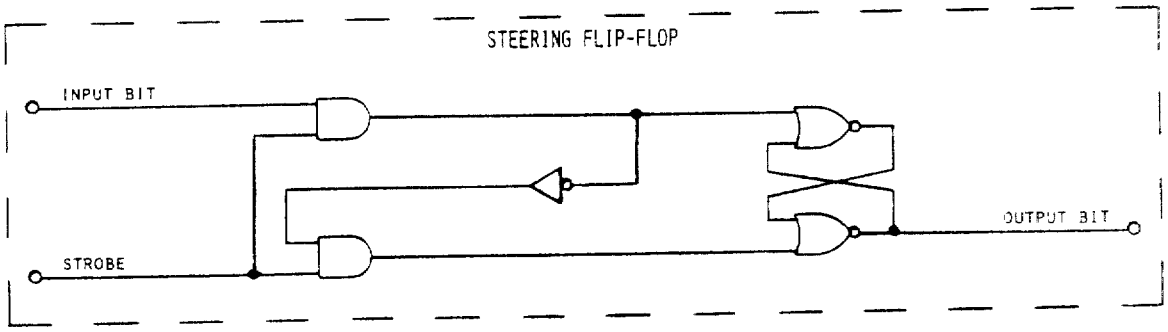
FIG. 8.5

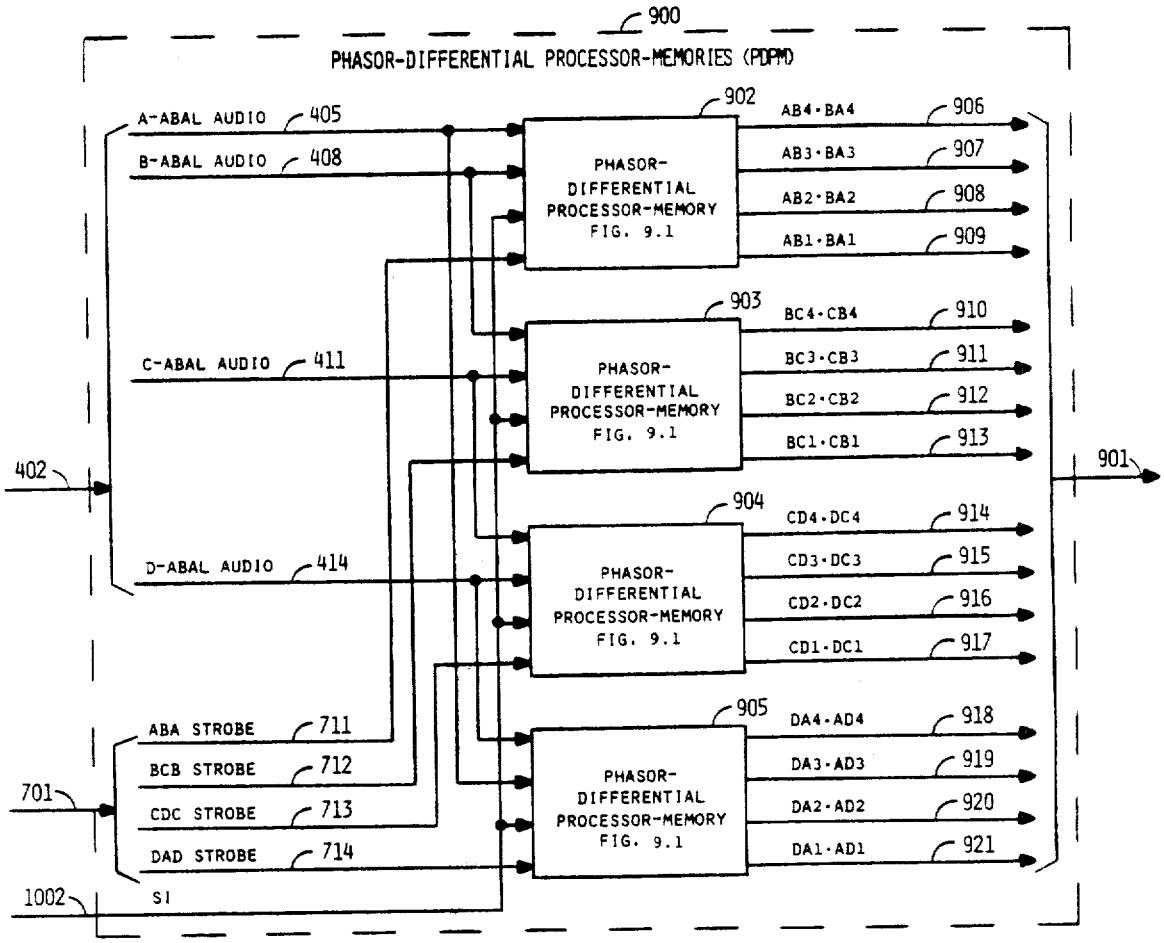
FIG.9.0
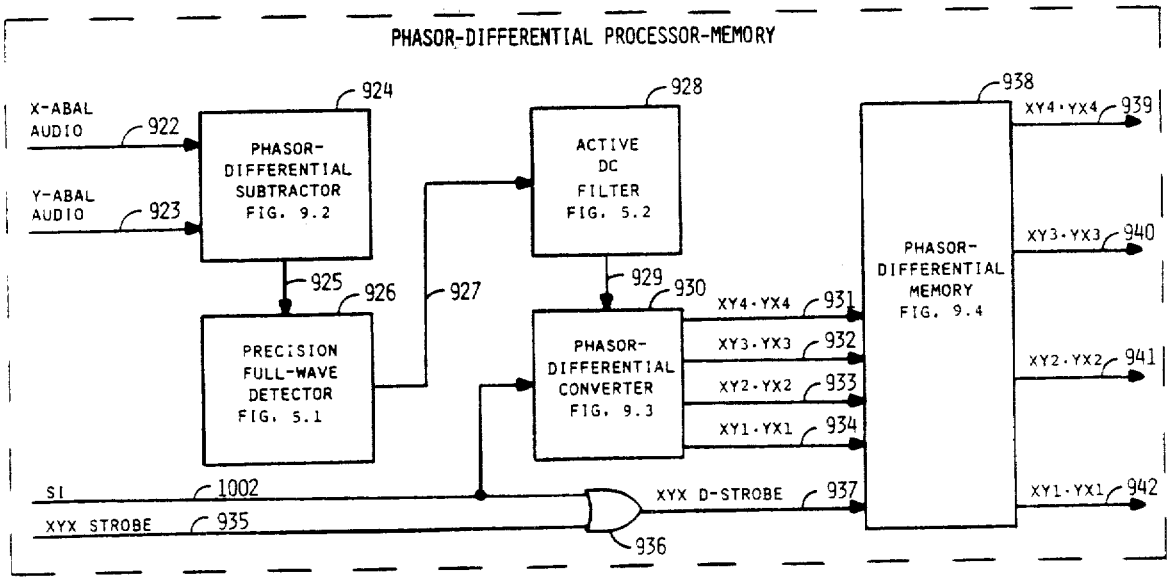
FIG.9.1

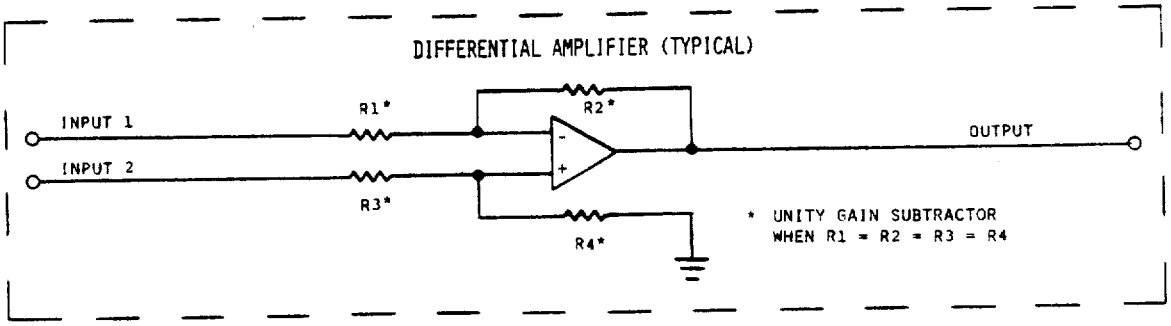
FIG. 9.2
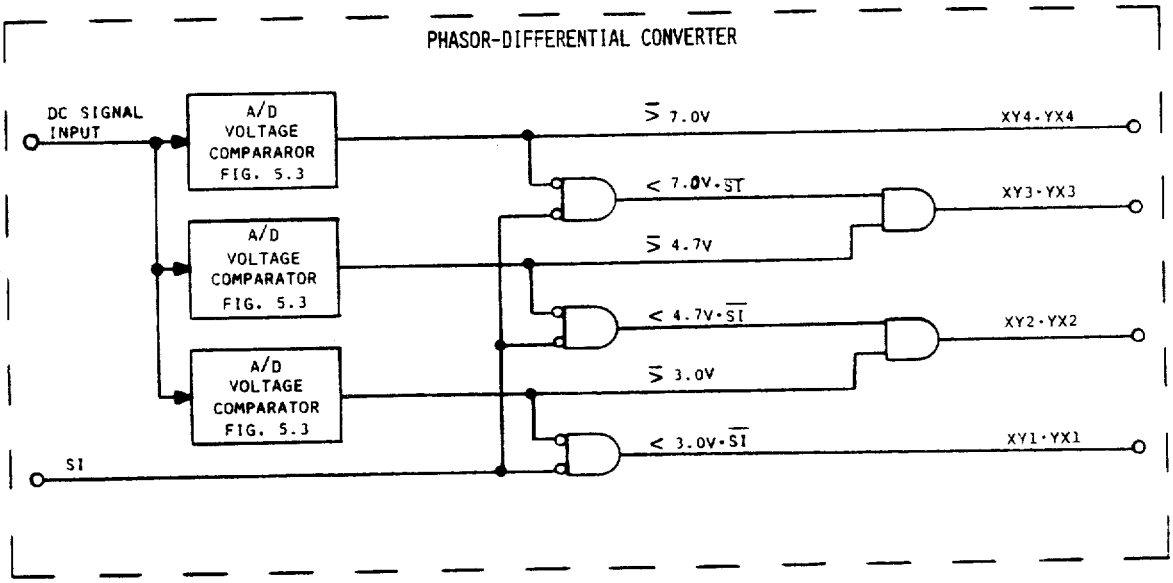
FIG. 9.3
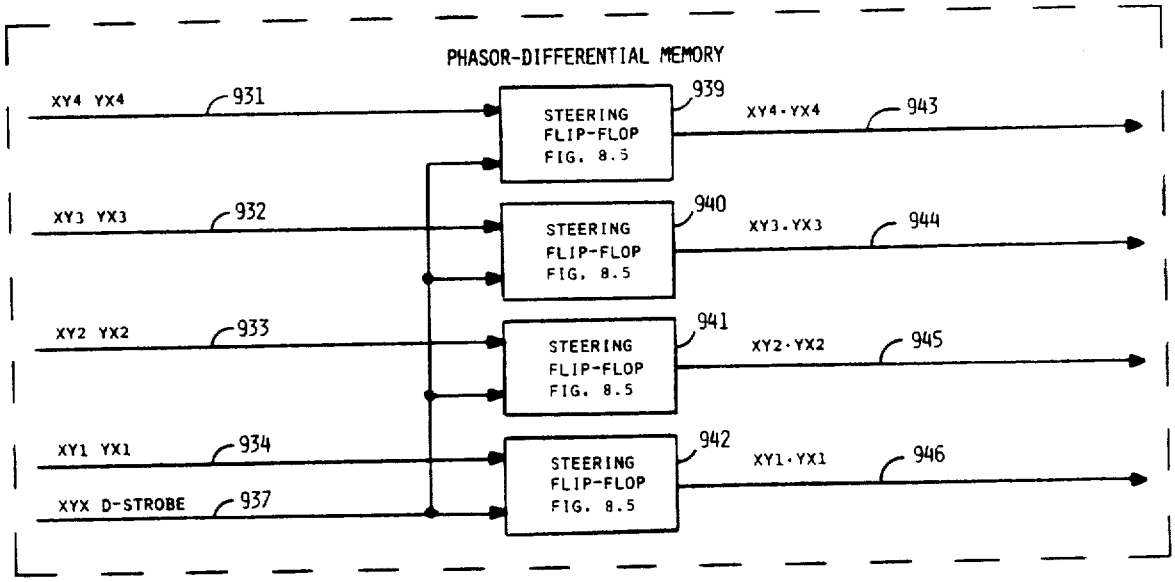
FIG. 9.4

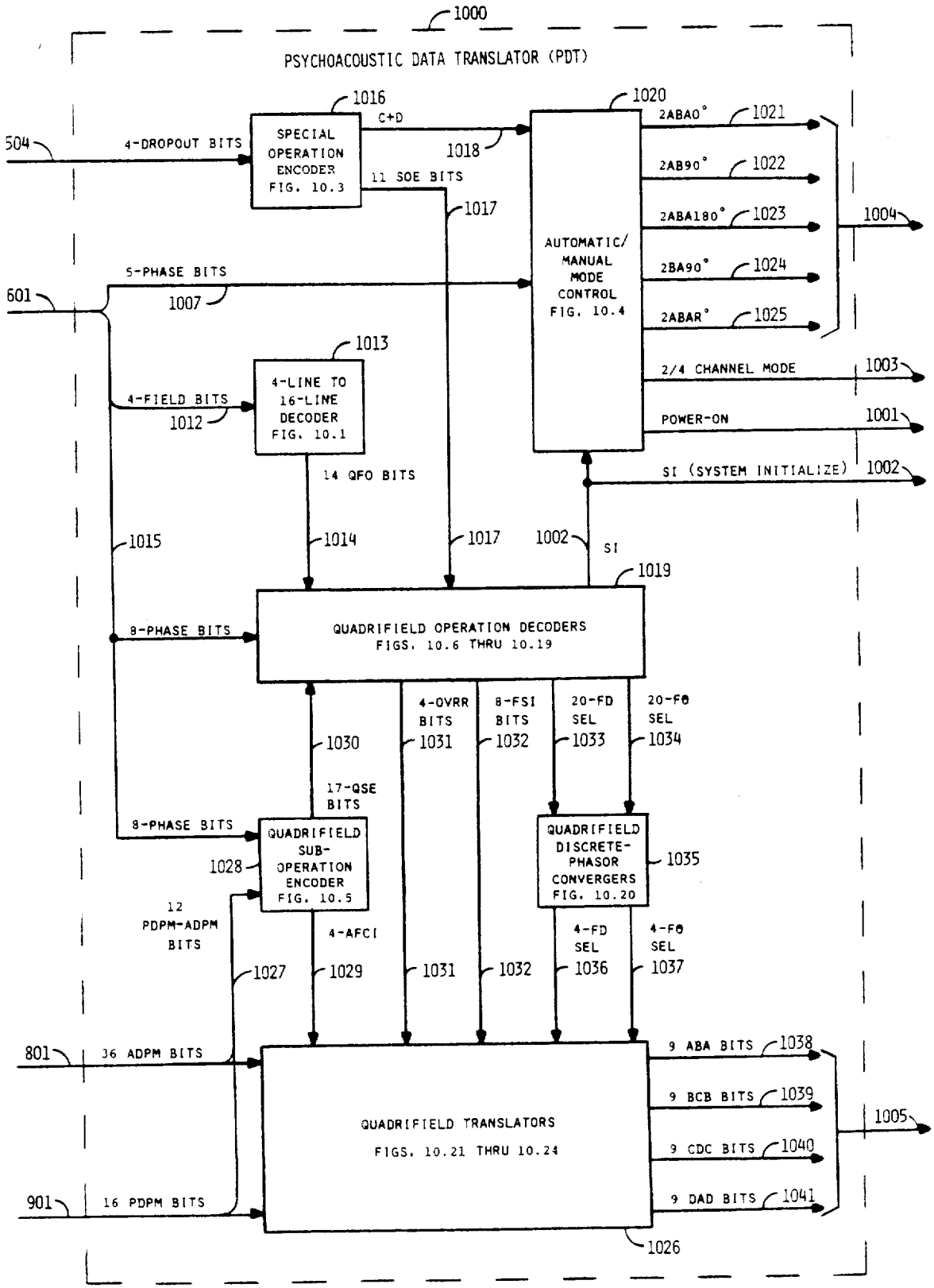
FIG. 10.0

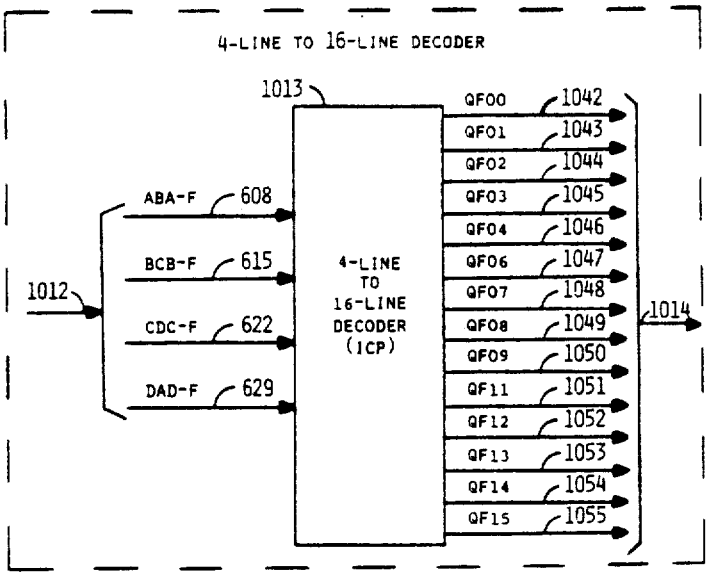
FIG. 10.1
| 8 | 4 | 2 | 1 | QUADRIFIELD OPERATION |
|---|---|---|---|---|
| DAD-F | CDC-F | BCB-F | ABA-F | |
| 0 | 0 | 0 | 0 | QF00 |
| 0 | 0 | 0 | 1 | QF01 |
| 0 | 0 | 1 | 0 | QF02 |
| 0 | 0 | 1 | 1 | QF03 |
| 0 | 1 | 0 | 0 | QF04 |
| 0 | 1 | 0 | 1 | NO OP |
| 0 | 1 | 1 | 0 | QF06 |
| 0 | 1 | 1 | 1 | QF07 |
| 1 | 0 | 0 | 0 | QF08 |
| 1 | 0 | 0 | 1 | QF09 |
| 1 | 0 | 1 | 0 | NO OP |
| 1 | 0 | 1 | 1 | QF11 |
| 1 | 1 | 0 | 0 | QF12 |
| 1 | 1 | 0 | 1 | QF13 |
| 1 | 1 | 1 | 0 | QF14 |
| 1 | 1 | 1 | 1 | QF15 |
FIG. 10.2
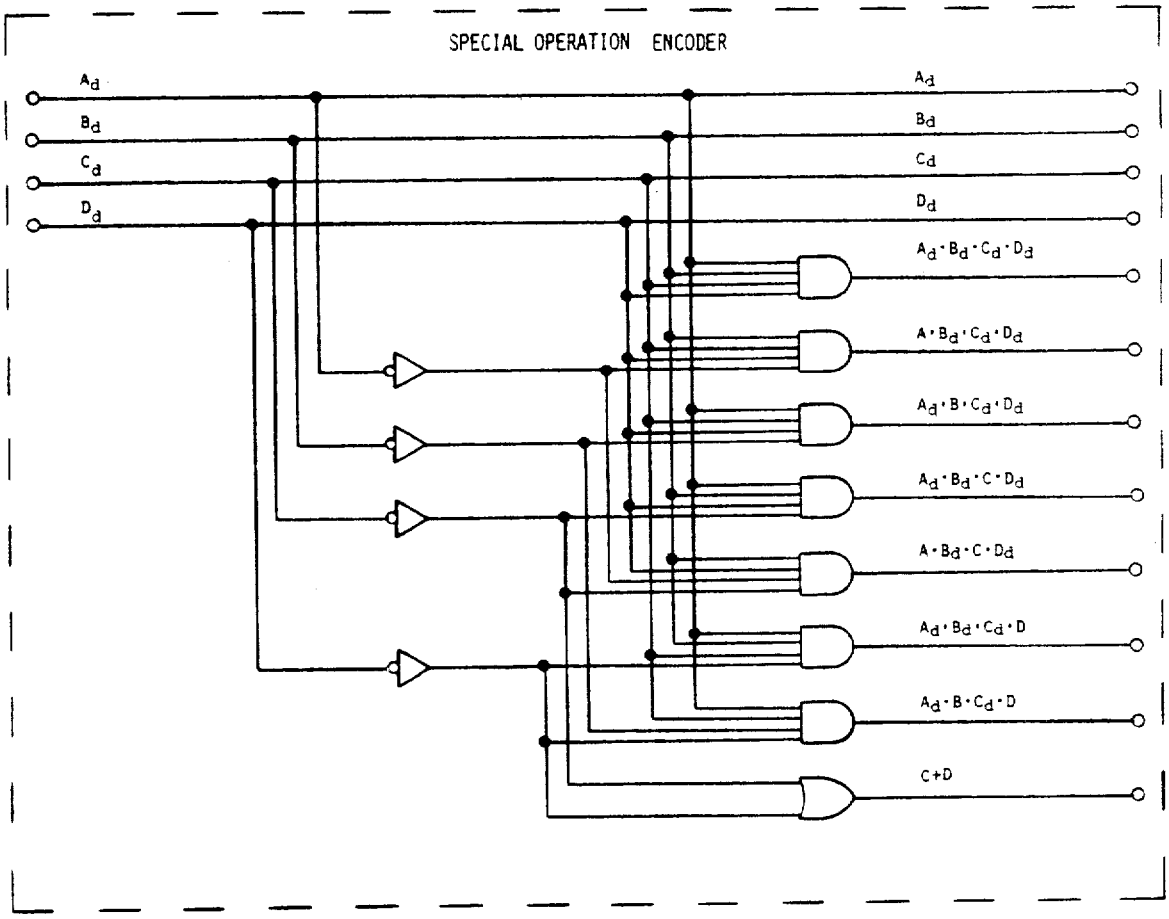
FIG. 10.3

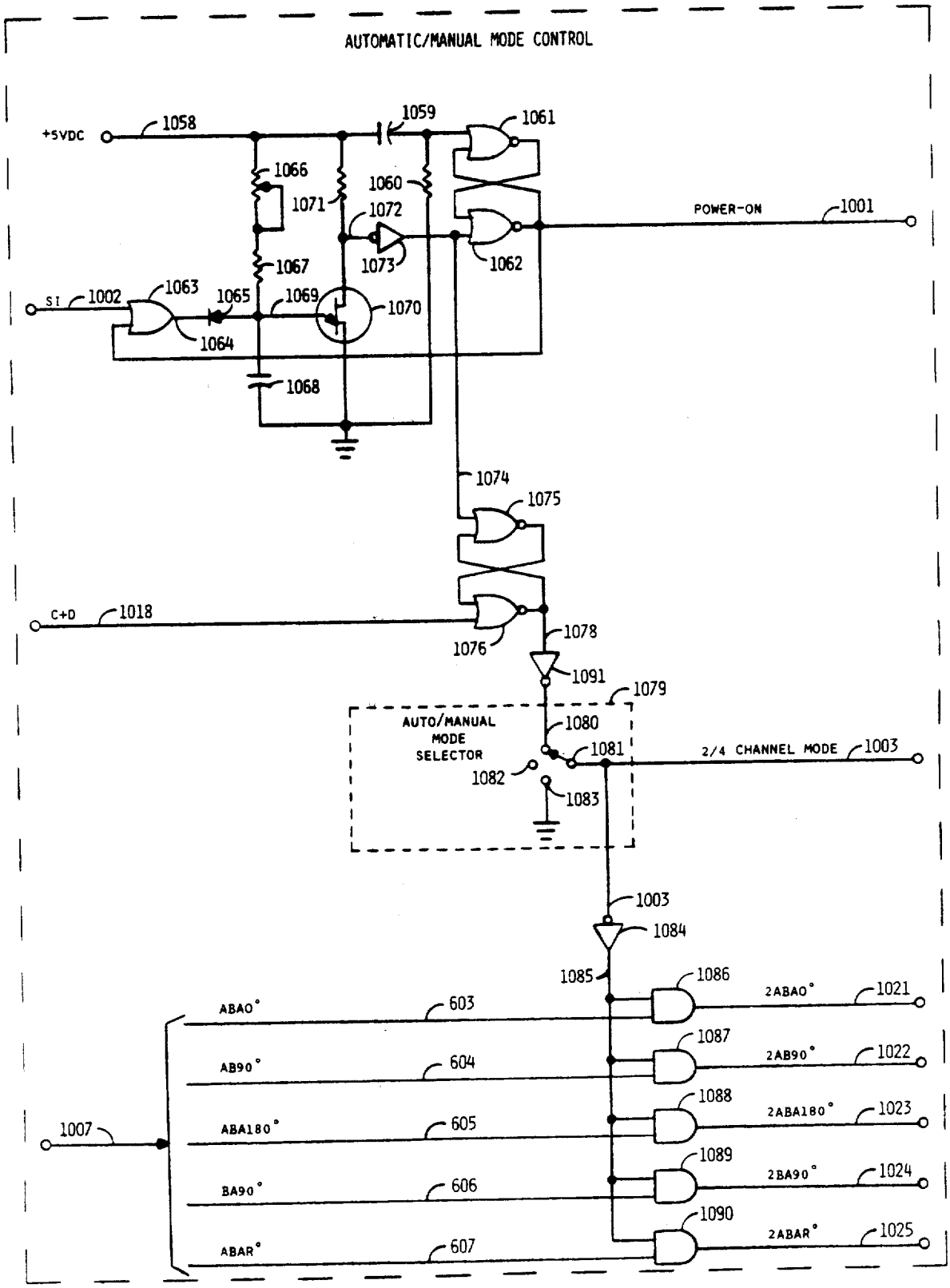
FIG. 10.4

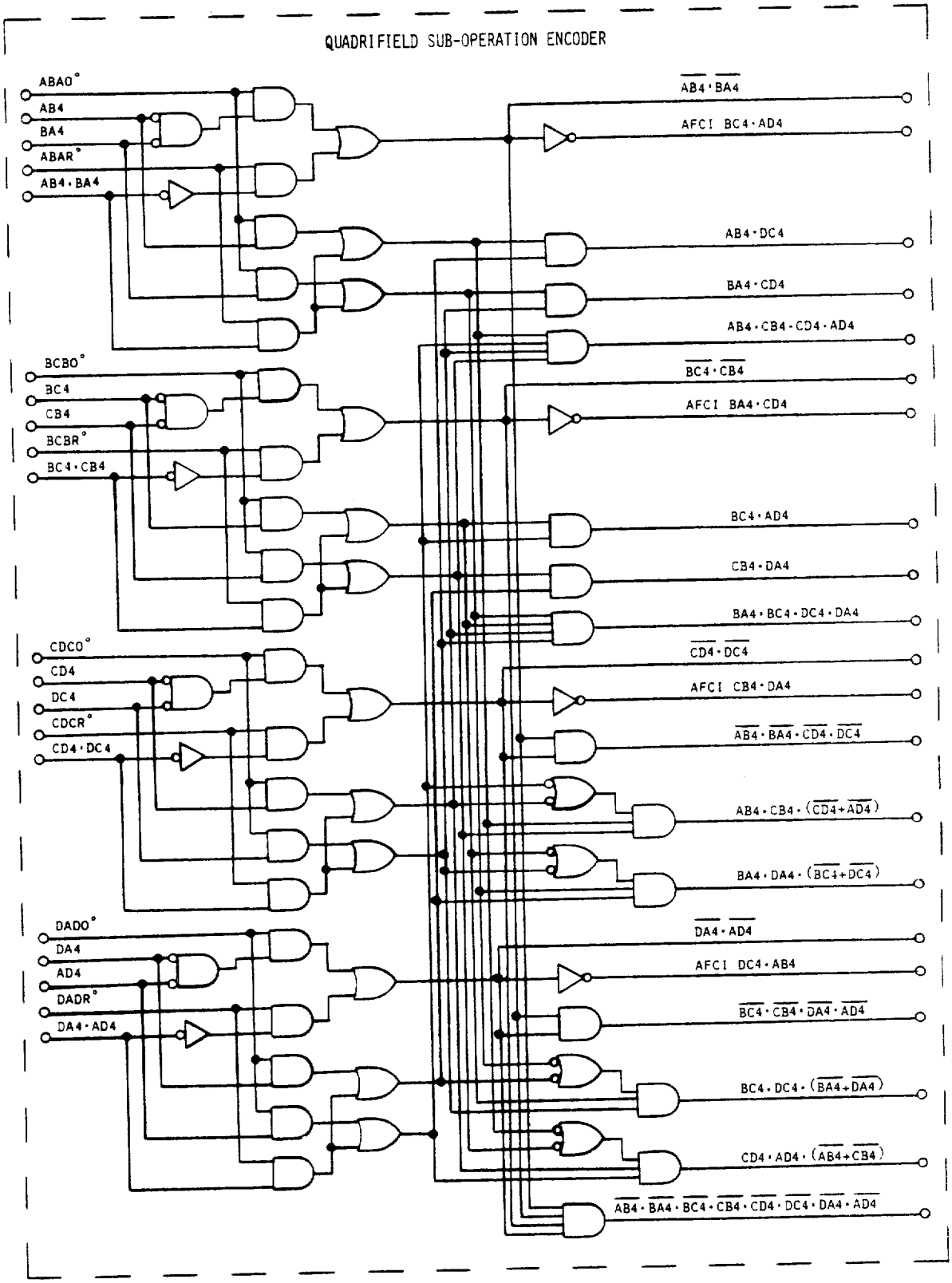
FIG. 10.5

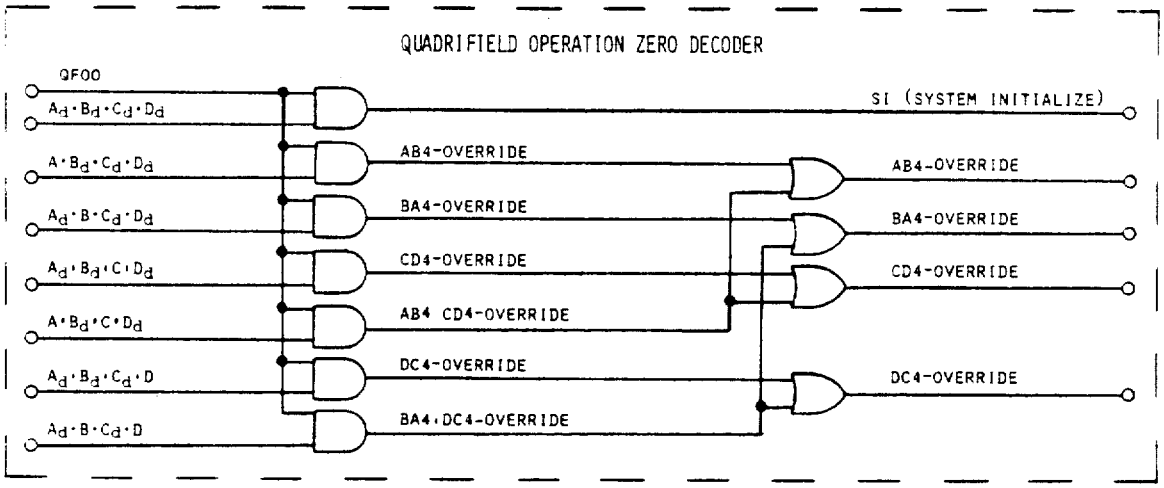
FIG.10.6
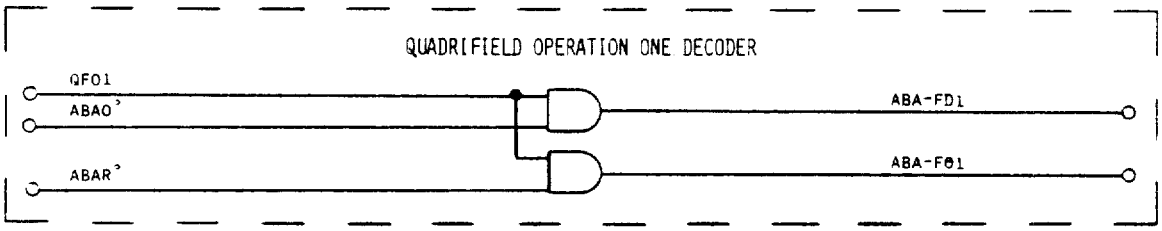
FIG.10.7
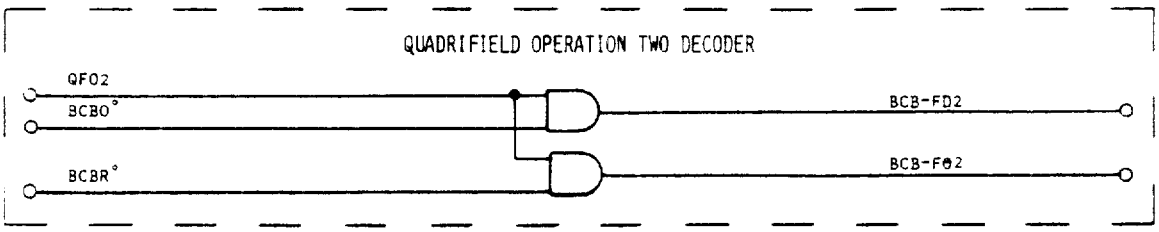
FIG.10.8

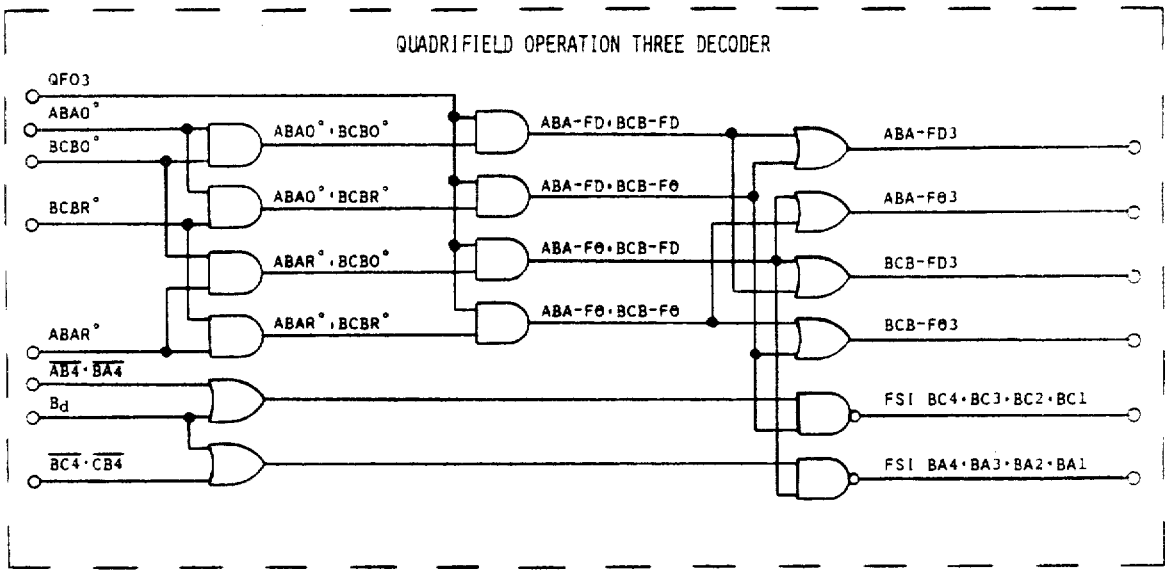
FIG.10.9
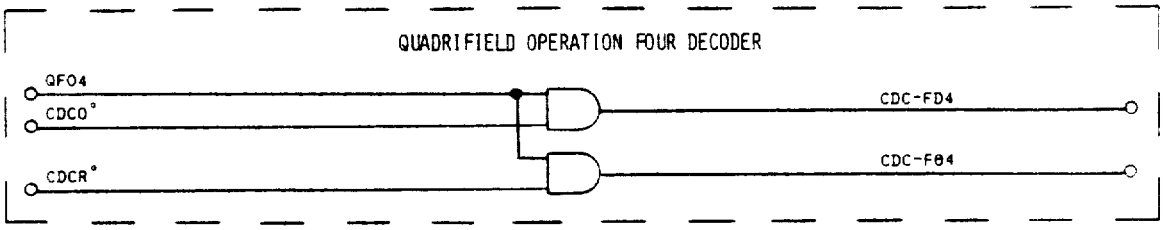
FIG.10.10
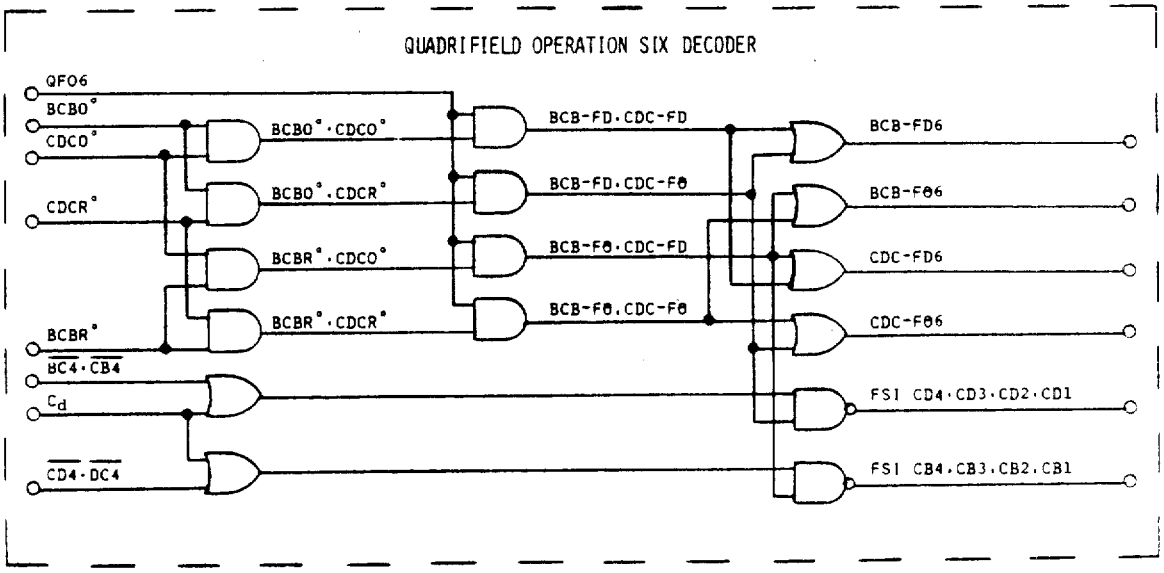
FIG.10.11

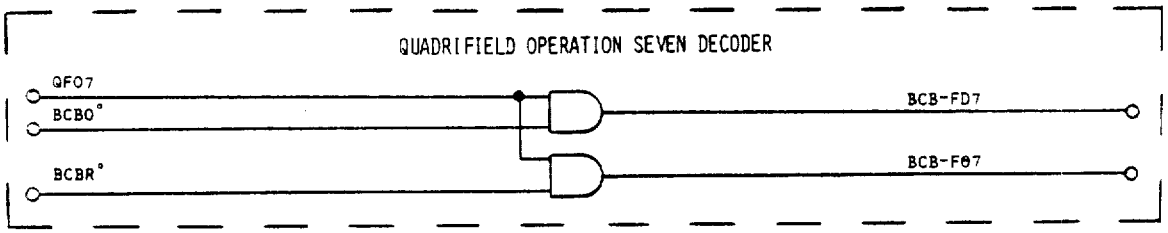
FIG.10.12
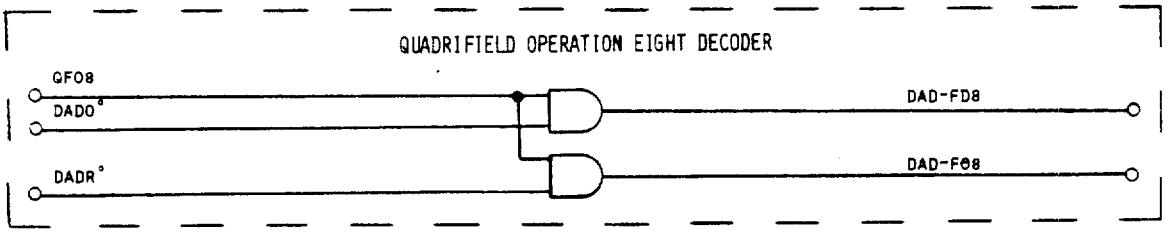
FIG.10.13
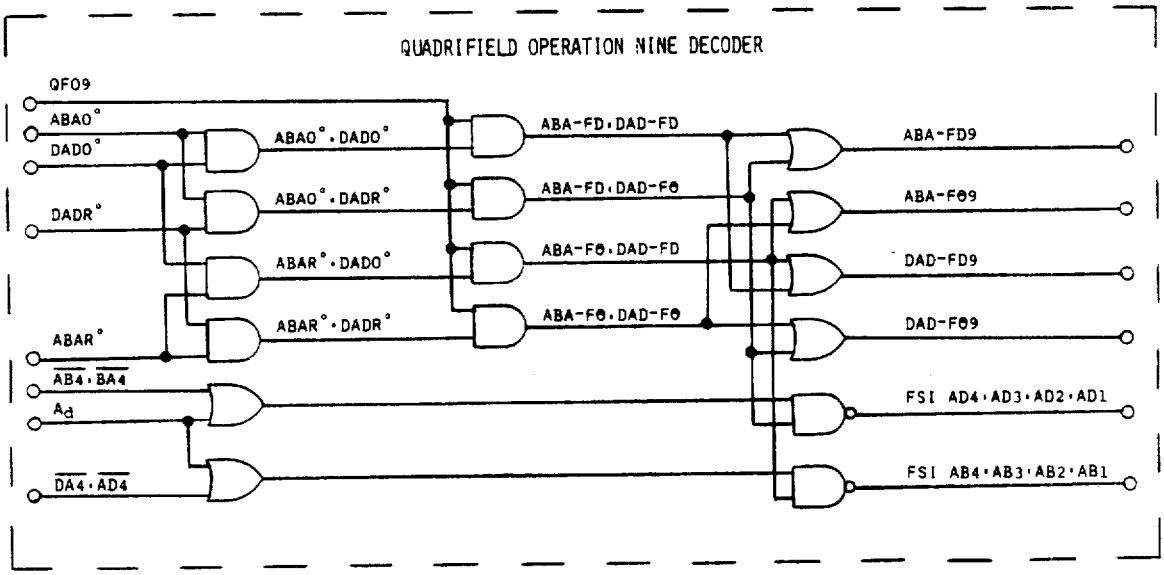
FIG.10.14
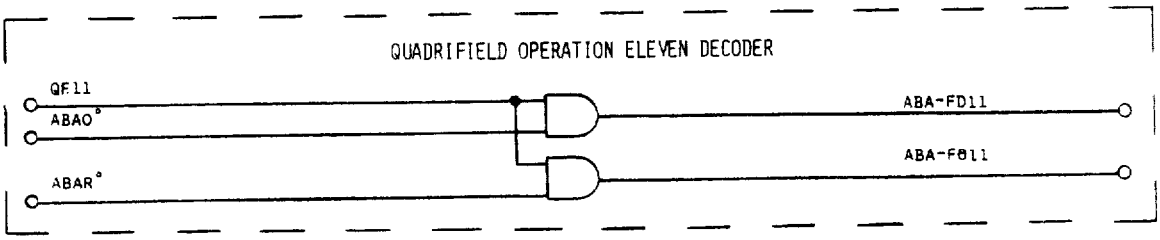
FIG.10.15

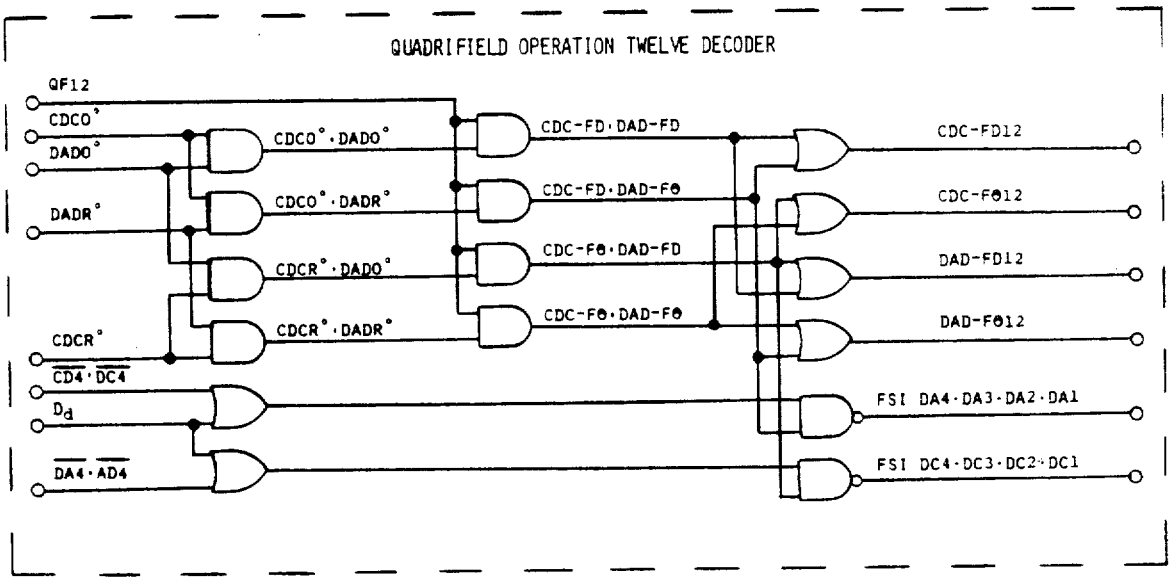
FIG.10.16
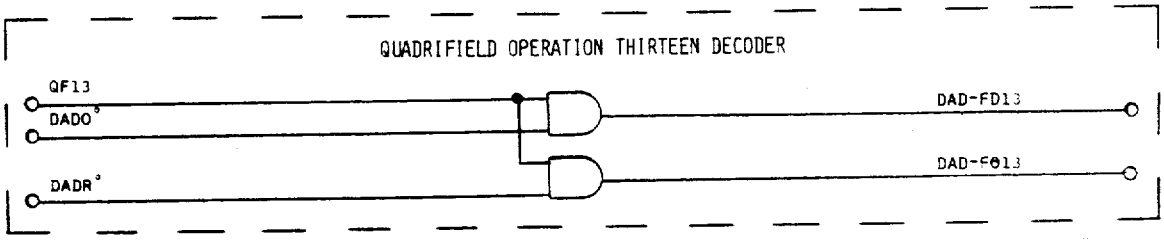
FIG.10.17
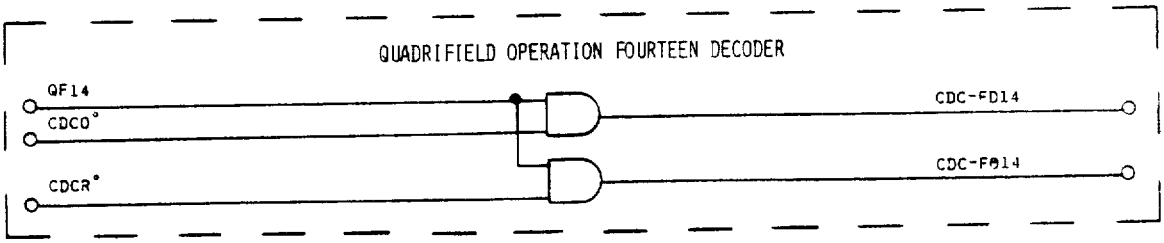
FIG.10.18

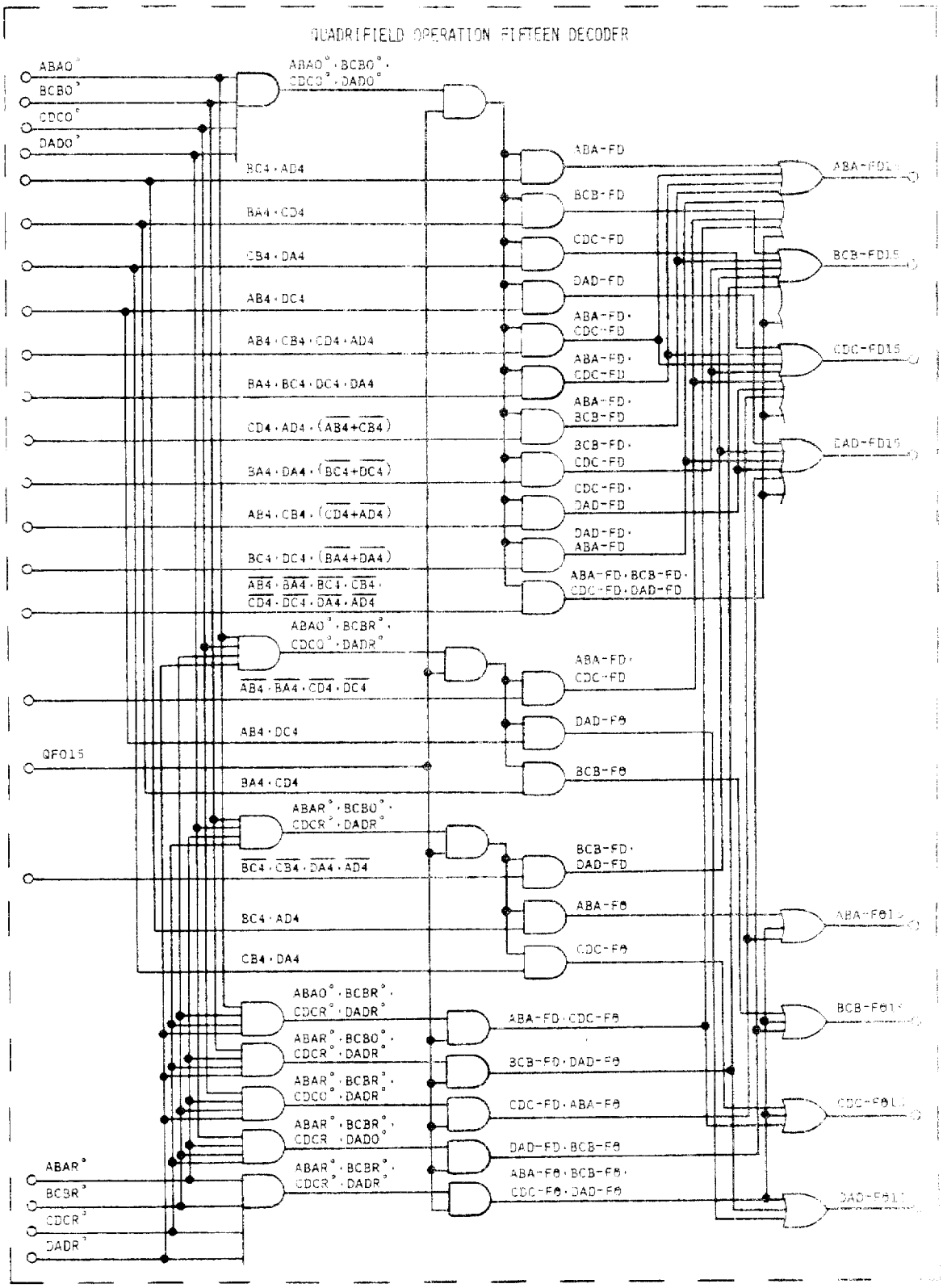
FIG.10.19

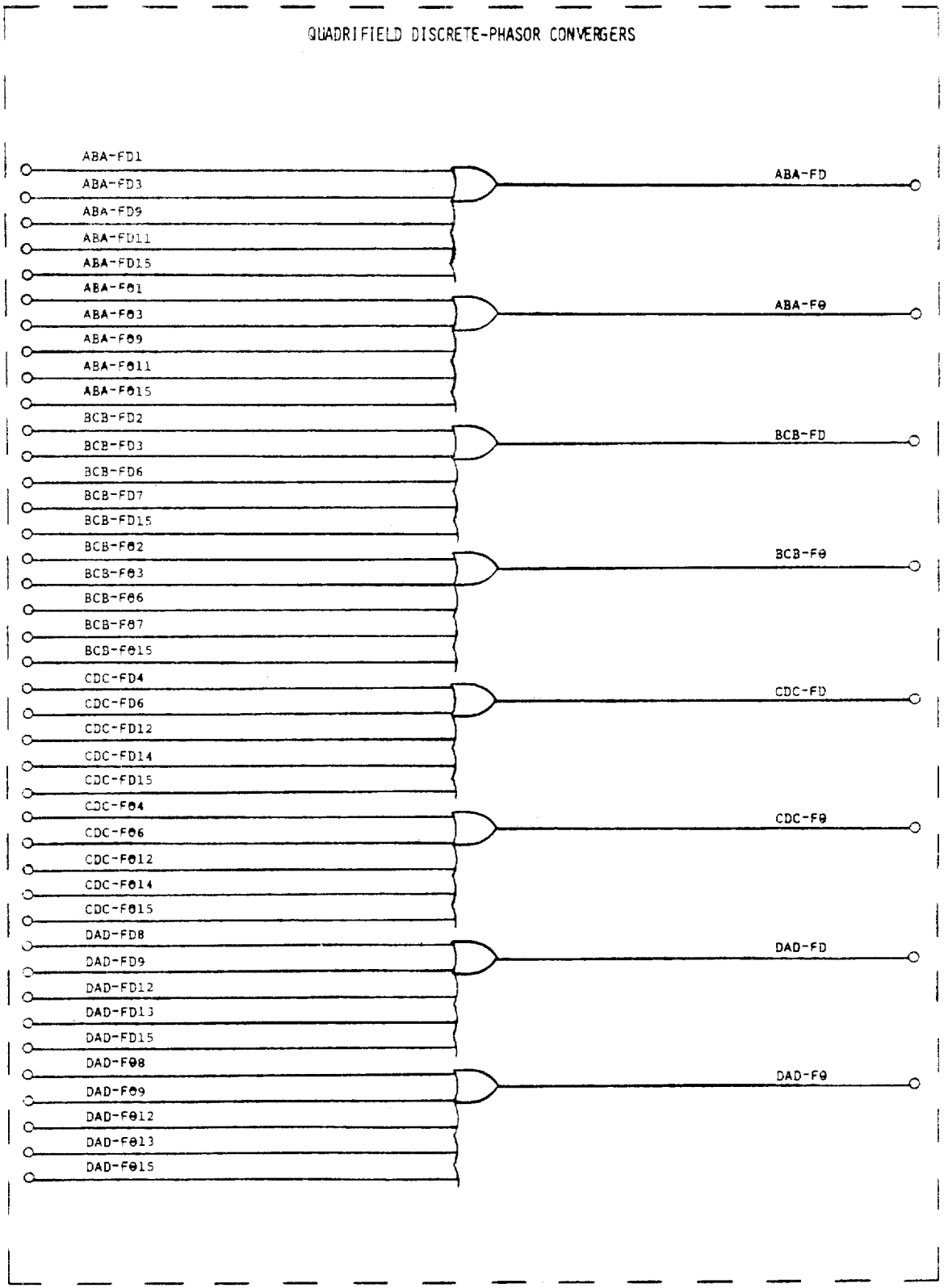
FIG. 10.20

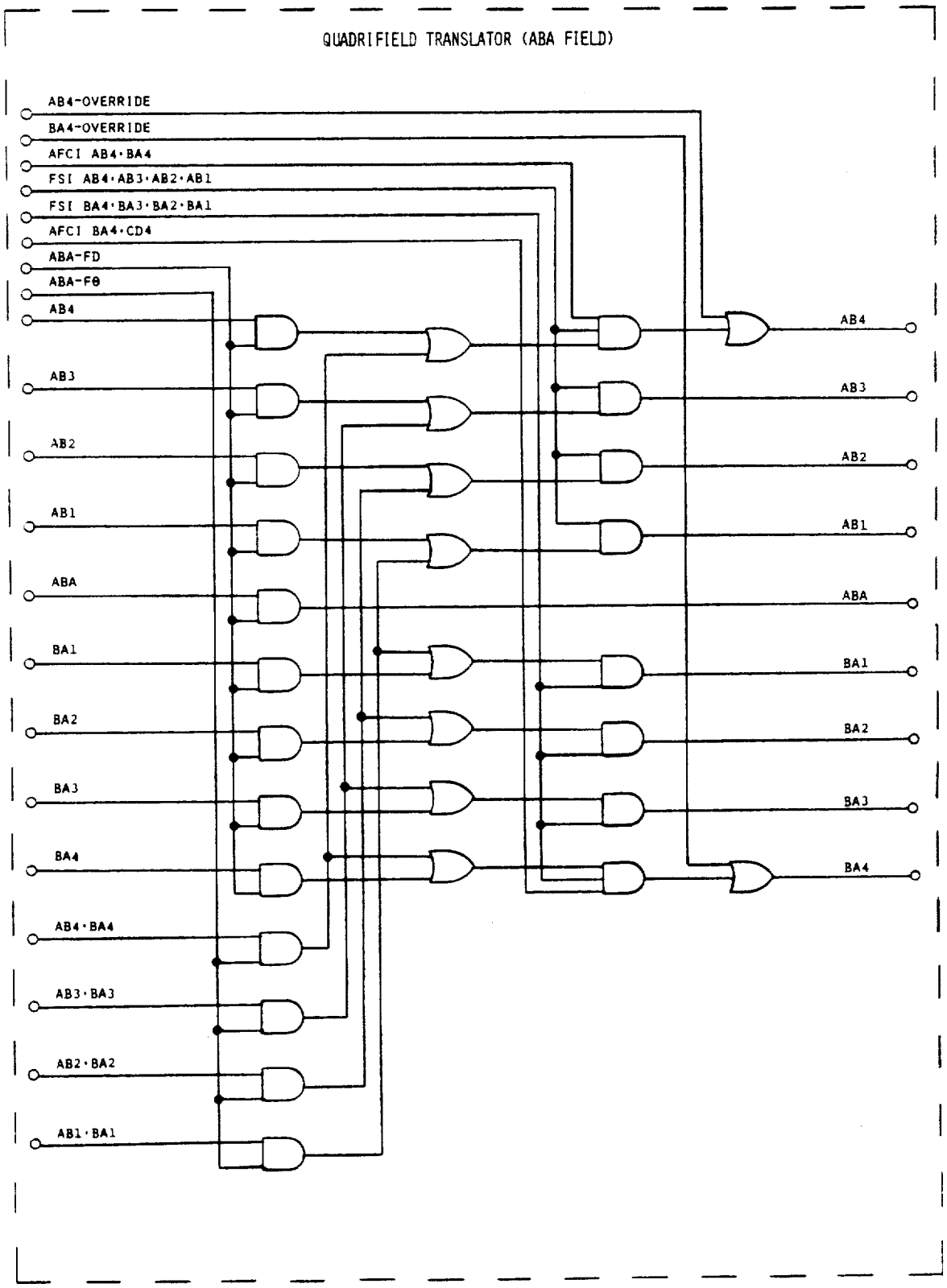
FIG.10.21

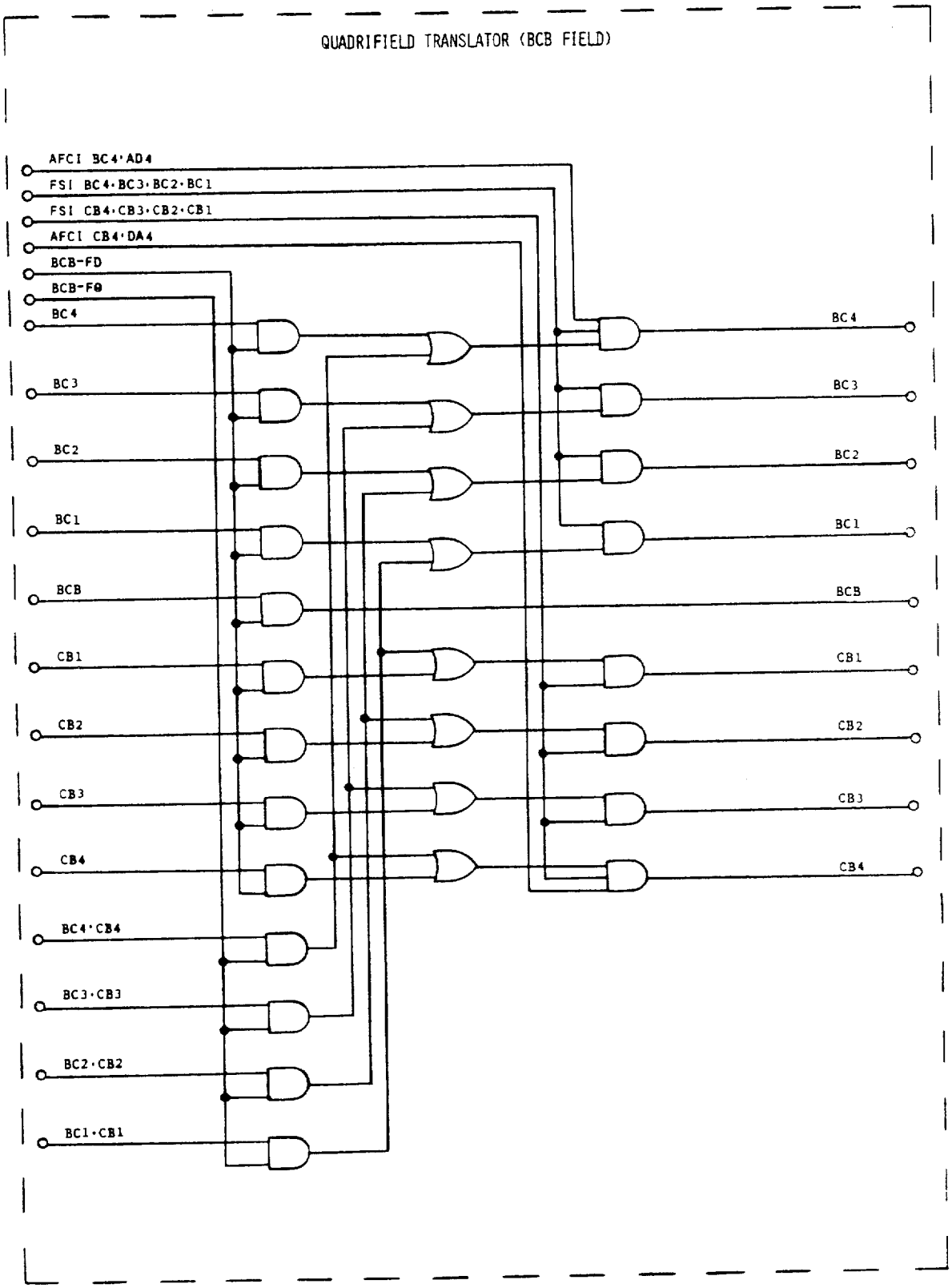
FIG. 10.22

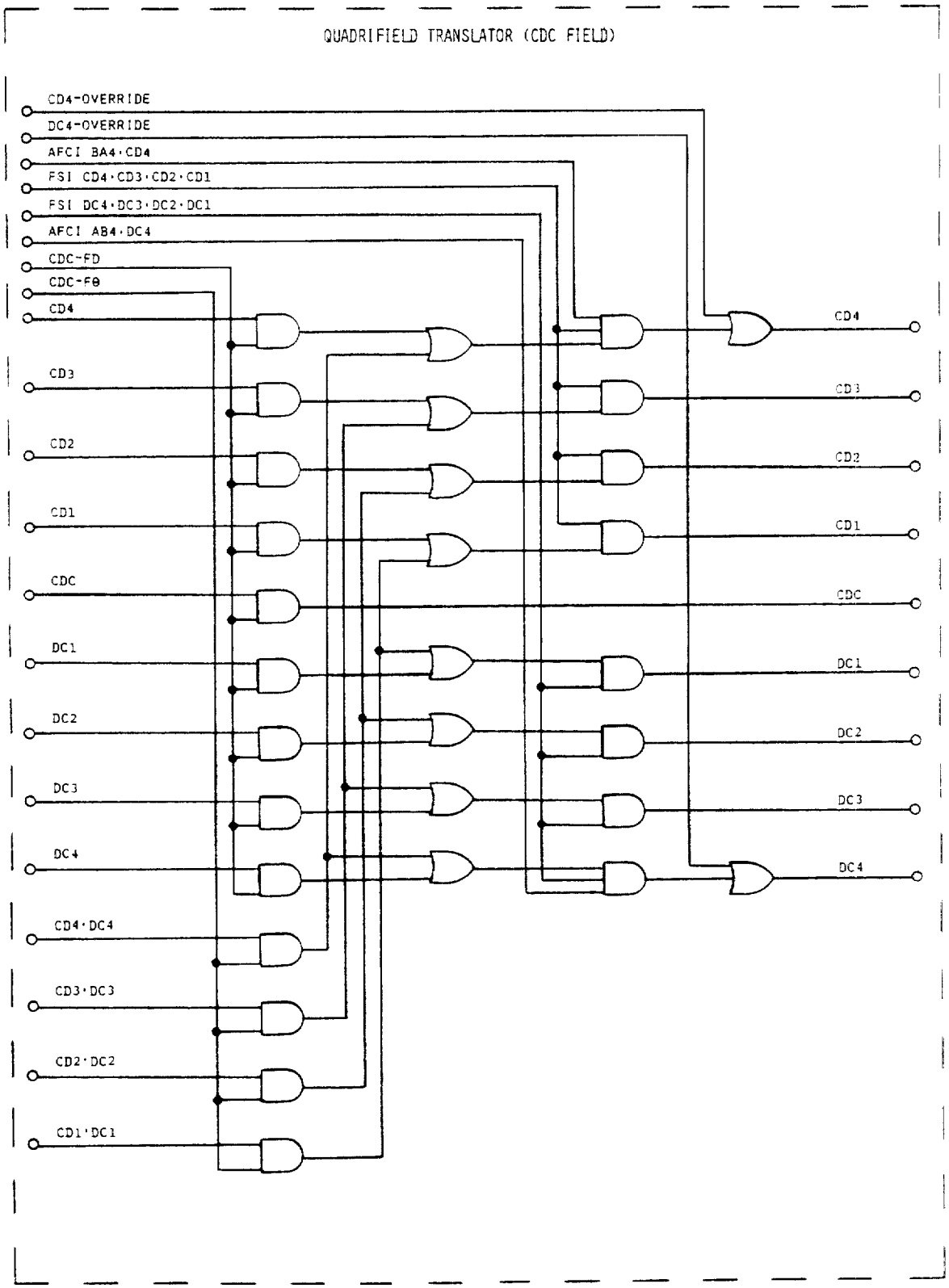
FIG. 10.23

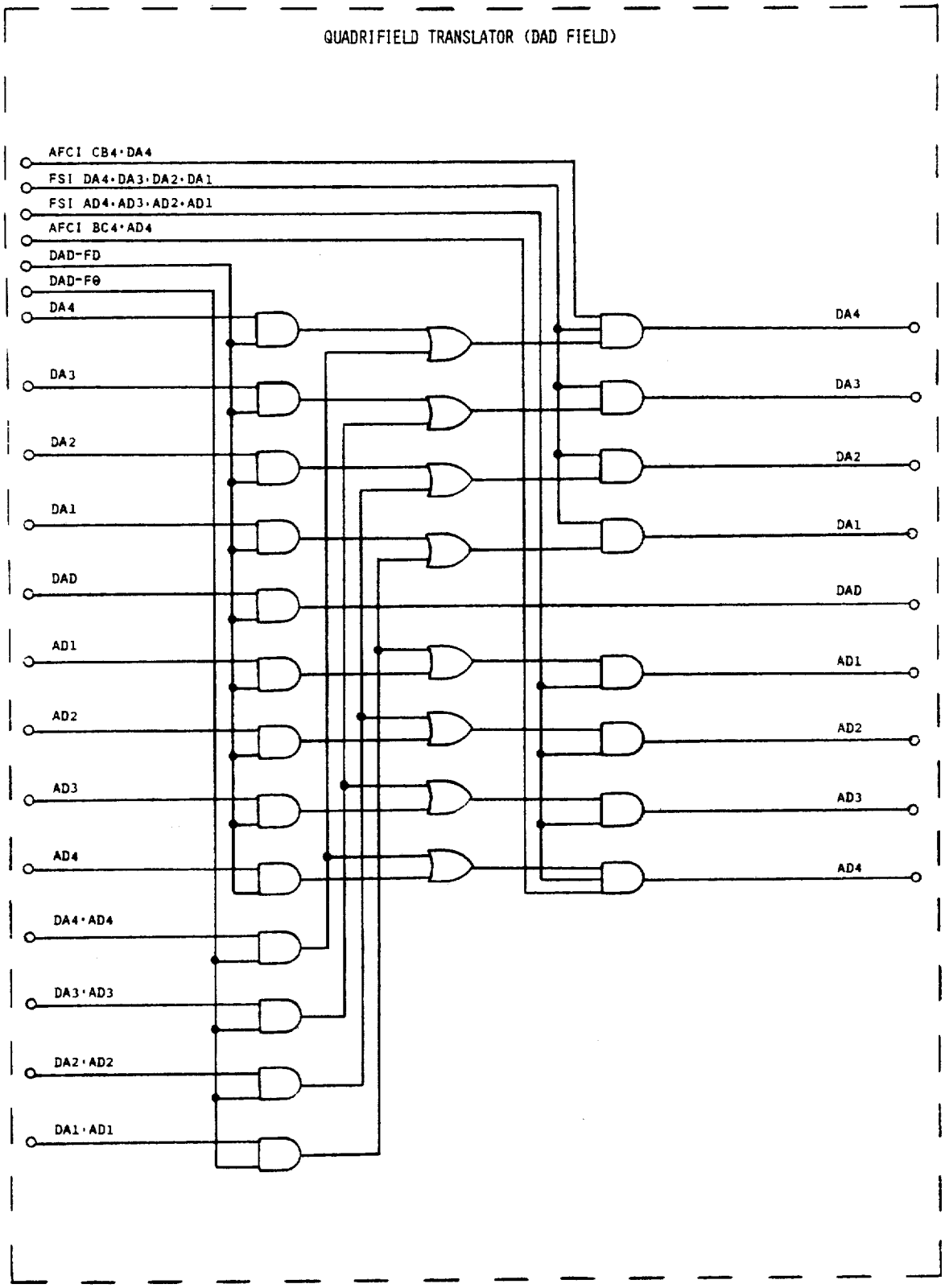
FIG. 10.24

MAJOR CASE OPERATIONS

C001: $QF00 \cdot (A_d \cdot B_d \cdot C_d \cdot D_d) \rightarrow$ SI (SYSTEM INITIALIZE)
C002: $QF00 \cdot (A \cdot B_d \cdot C_d \cdot D_d) \rightarrow$ AB4-OVERRIDE
C003: $QF00 \cdot (A_d \cdot B \cdot C_d \cdot D_d) \rightarrow$ BA4-OVERRIDE
C004: $QF00 \cdot (A_d \cdot B_d \cdot C \cdot D_d) \rightarrow$ CD4-OVERRIDE
C005: $QF00 \cdot (A \cdot B_d \cdot C \cdot D_d) \rightarrow$ AB4·CD4-OVERRIDE
C006: $QF00 \cdot (A_d \cdot B_d \cdot C_d \cdot D) \rightarrow$ DC4-OVERRIDE
C007: $QF00 \cdot (A_d \cdot B \cdot C_d \cdot D) \rightarrow$ BA4·DC4-OVERRIDE
C008: $QF01 \cdot ABAO^\circ \rightarrow$ ABA-FD
C009: $QF01 \cdot ABAR^\circ \rightarrow$ ABA-FΘ
C010: 2-CH MODE·AB90° → 2AB90° ($L_b$)·MATRIX FRONT RECOVERY; SPECIAL FUNCTION INDEPENDENT OF QF01
C011: 2-CH MODE·ABA180° → 2ABA180°(FUTURE).FUTURE FRONT RECOVERY; SPECIAL FUNCTION INDEPENDENT OF QF01
C012: 2-CH MODE·BA90° → 2BA90°($R_b$)·MATRIX FRONT RECOVERY; SPECIAL FUNCTION INDEPENDENT OF QF01
C013: $QF02 \cdot BCBO^\circ \rightarrow$ BCB-FD
C014: $QF02 \cdot BCBR^\circ \rightarrow$ BCB-FΘ
C015: $QF03 \cdot ABAO^\circ \cdot BCBO^\circ \rightarrow$ ABA-FD·BCB-FD
C016: $QF03 \cdot ABAO^\circ \cdot BCBR^\circ \cdot [B_d + (\overline{AB4} \cdot \overline{BA4})] \rightarrow$ ABA-FD·BCB-FΘ·(FSI BC4·BC3·BC2·BC1)
C017: $QF03 \cdot ABAR^\circ \cdot BCBO^\circ \cdot [B_d + (\overline{BC4} \cdot \overline{CB4})] \rightarrow$ ABA-FΘ·BCB-FD·(FSI BA4·BA3·BA2·BA1)
C018: $QF03 \cdot ABAR^\circ \cdot BCBR^\circ \rightarrow$ ABA-FΘ·BCB-FΘ
C019: $QF04 \cdot CDCO^\circ \rightarrow$ CDC-FD
C020: $QF04 \cdot CDCR^\circ \rightarrow$ CDC-FΘ
C021: $QF06 \cdot BCBO^\circ \cdot CDCO^\circ \rightarrow$ BCB-FD·CDC-FD
C022: $QF06 \cdot BCBO^\circ \cdot CDCR^\circ \cdot [C_d + (\overline{CB4} \cdot \overline{BC4})] \rightarrow$ BCB-FD·CDC-FΘ·(FSI CD4·CD3·CD2·CD1)
C023: $QF06 \cdot BCBR^\circ \cdot CDCO^\circ \cdot [C_d + (\overline{CD4} \cdot \overline{DC4})] \rightarrow$ BCB-FΘ·CDC-FD.(FSI CB4.CB3.CB2.CB1)
C024: $QF06 \cdot BCBR^\circ \cdot CDCR^\circ \rightarrow$ BCB-FΘ·CDC-FΘ
C025: $QF07 \cdot BCBO^\circ \rightarrow$ BCB-FD
C026: $QF07 \cdot BCBR^\circ \rightarrow$ BCB-FΘ
C027: $QF08 \cdot DADO^\circ \rightarrow$ DAD-FD
C028: $QF08 \cdot DADR^\circ \rightarrow$ DAD-FΘ
C029: $QF09 \cdot ABAO^\circ \cdot DADO^\circ \rightarrow$ ABA-FD·DAD-FD
C030: $QF09 \cdot ABAO^\circ \cdot DADR^\circ \cdot [A_d + (\overline{AB4} \cdot \overline{BA4})] \rightarrow$ ABA-FD·DAD-FΘ·(FSI AD4·AD3·AD2·AD1)
C031: $QF09 \cdot ABAR^\circ \cdot DADO^\circ \cdot [A_d + (\overline{DA4} \cdot \overline{AD4})] \rightarrow$ ABA-FΘ·DAD-FD·(FSI AB4·AB3·AB2·AB1)
C032: $QF09 \cdot ABAR^\circ \cdot DADR^\circ \rightarrow$ ABA-FΘ·DAD-FΘ
C033: $QF011 \cdot ABAO^\circ \rightarrow$ ABA-FD
C034: $QF011 \cdot ABAR^\circ \rightarrow$ ABA-FΘ
C035: $QF012 \cdot CDCO^\circ \cdot DADO^\circ \rightarrow$ CDC-FD·DAD-FD
C036: $QF012 \cdot CDCO^\circ \cdot DADR^\circ \cdot [D_d + (\overline{CD4} \cdot \overline{DC4})] \rightarrow$ CDC-FD·DAD-FΘ·(FSI DA4·DA3·DA2·DA1)
C037: $QF012 \cdot CDCR^\circ \cdot DADO^\circ \cdot [D_d + (\overline{DA4} \cdot \overline{AD4})] \rightarrow$ CDC-FΘ·DAD-FD·(FSI DC4·DC3·DC2·DC1)
C038: $QF012 \cdot CDCR^\circ \cdot DADR^\circ \rightarrow$ CDC-FΘ·DAD-FΘ
C039: $QF013 \cdot DADO^\circ \rightarrow$ DAD-FD
C040: $QF013 \cdot DADR^\circ \rightarrow$ DAD-FΘ
C041: $QF014 \cdot CDCO^\circ \rightarrow$ CDC-FD
C042: $QF014 \cdot CDCR^\circ \rightarrow$ CDC-FΘ
C043: $QF015 \cdot ABAO^\circ \cdot BCBO^\circ \cdot CDCO^\circ \cdot DADO^\circ \cdot BC4 \cdot AD4 \rightarrow$ ABA-FD
C044: $QF015 \cdot ABAO^\circ \cdot BCBO^\circ \cdot CDCO^\circ \cdot DADO^\circ \cdot BA4 \cdot CD4 \rightarrow$ BCB-FD
C045: $QF015 \cdot ABAO^\circ \cdot BCBO^\circ \cdot CDCO^\circ \cdot DADO^\circ \cdot CB4 \cdot DA4 \rightarrow$ CDC-FD
C046: $QF015 \cdot ABAO^\circ \cdot BCBO^\circ \cdot CDCO^\circ \cdot DADO^\circ \cdot AB4 \cdot DC4 \rightarrow$ DAD-FD
C047: $QF015 \cdot ABAO^\circ \cdot BCBO^\circ \cdot CDCO^\circ \cdot DADO^\circ \cdot AB4 \cdot CB4 \cdot CD4 \cdot AD4 \rightarrow$ ABA-FD·CDC-FD
C048: $QF015 \cdot ABAO^\circ \cdot BCBO^\circ \cdot CDCO^\circ \cdot DADO^\circ \cdot BA4 \cdot BC4 \cdot DC4 \cdot DA4 \rightarrow$ ABA-FD·CDC-FD
C049: $QF015 \cdot ABAO^\circ \cdot BCBO^\circ \cdot CDCO^\circ \cdot DADO^\circ \cdot CD4 \cdot AD4 \cdot (\overline{AB4} + \overline{CB4}) \rightarrow$ ABA-FD·BCB-FD
C050: $QF015 \cdot ABAO^\circ \cdot BCBO^\circ \cdot CDCO^\circ \cdot DADO^\circ \cdot BA4 \cdot DA4 \cdot (\overline{BC4} + \overline{DC4}) \rightarrow$ BCB-FD·CDC-FD
C051: $QF015 \cdot ABAO^\circ \cdot BCBO^\circ \cdot CDCO^\circ \cdot DADO^\circ \cdot ABA \cdot CB4 \cdot (\overline{CD4} + \overline{AD4}) \rightarrow$ CDC-FD·DAD-FD
C052: $QF015 \cdot ABAO^\circ \cdot BCBO^\circ \cdot CDCO^\circ \cdot DADO^\circ \cdot BC4 \cdot DC4 \cdot (\overline{BA4} + \overline{DA4}) \rightarrow$ DAD-FD·ABA-FD
C053: $QF015 \cdot ABAO^\circ \cdot BCBO^\circ \cdot CDCO^\circ \cdot DADO^\circ \cdot \overline{AB4} \cdot \overline{BA4} \cdot \overline{BC4} \cdot \overline{CB4} \cdot \overline{CD4} \cdot \overline{DC4} \cdot \overline{DA4} \cdot \overline{AD4} \rightarrow$ ABA-FD·BCB-FD·CDC-FD·DAD-FD
C054: $QF015 \cdot ABAO^\circ \cdot BCBR^\circ \cdot CDCO^\circ \cdot DADR^\circ \cdot \overline{AB4} \cdot \overline{BA4} \cdot \overline{CD4} \cdot \overline{DC4} \rightarrow$ ABA-FD·CDC-FD
C055: $QF015 \cdot ABAO^\circ \cdot BCBR^\circ \cdot CDCO^\circ \cdot DADR^\circ \cdot AB4 \cdot DC4 \rightarrow$ DAD-FΘ
C056: $QF015 \cdot ABAO^\circ \cdot BCBR^\circ \cdot CDCO^\circ \cdot DADR^\circ \cdot BA4 \cdot CD4 \rightarrow$ BCB-FΘ
C057: $QF015 \cdot ABAR^\circ \cdot BCBO^\circ \cdot CDCR^\circ \cdot DADR^\circ \cdot \overline{BC4} \cdot \overline{CB4} \cdot \overline{DA4} \cdot \overline{AD4} \rightarrow$ BCB-FD·DAD-FD
C058: $QF015 \cdot ABAR^\circ \cdot BCBO^\circ \cdot CDCR^\circ \cdot DADR^\circ \cdot BC4 \cdot AD4 \rightarrow$ ABA-FΘ
C059: $QF015 \cdot ABAR^\circ \cdot BCBO^\circ \cdot CDCR^\circ \cdot DADR^\circ \cdot CB4 \cdot DA4 \rightarrow$ CDC-FΘ
C060: $QF015 \cdot ABAO^\circ \cdot BCBR^\circ \cdot CDCR^\circ \cdot DADR^\circ \rightarrow$ ABA-FD·CDC-FΘ
C061: $QF015 \cdot ABAR^\circ \cdot BCBO^\circ \cdot CDCR^\circ \cdot DADR^\circ \rightarrow$ BCB-FD·DAD-FΘ
C062: $QF015 \cdot ABAR^\circ \cdot BCBR^\circ \cdot CDCO^\circ \cdot DADR^\circ \rightarrow$ CDC-FD·ABA-FΘ
C063: $QF015 \cdot ABAR^\circ \cdot BCBR^\circ \cdot CDCO^\circ \cdot DADO^\circ \rightarrow$ DAD-FD·BCB-FΘ
C064: $QF015 \cdot ABAR^\circ \cdot BCBR^\circ \cdot CDCR^\circ \cdot DADR^\circ \rightarrow$ ABA-FΘ·BCB-FΘ·CDC-FΘ·DAD-FΘ

RESULTANT QUADRIFIELD TRANSLATOR OUTPUTS

ABA-FD → AB4+AB3+AB2+AB1+ABA+BA1+BA2+BA3+BA4
ABA-FΘ → (AB1·BA1)+(AB2·BA2)+(AB3·BA3)+(AB4.BA4)
BCB-FD → BC4+BC3+BC2+BC1+BCB+CB1+CB2+CB3+CB4
BCB-FΘ → (BC1·CB1)+(BC2·CB2)+(BC3.CB3)+(BC4.CB4)
CDC-FD → CD4+CD3+CD2+CD1+CDC+DC1+DC2+DC3+DC4
CDC-FΘ → (CD1.DC1)+(CD2.DC2)+(CD3.DC3)+(CD4.DC4)
DAD-FD → DA4+DA3+DA2+DA1+DAD+AD1+AD2+AD3+AD4
DAD-FΘ → (DA1.AD1)+(DA2.AD2)+(DA3.AD3)+(DA4.AD4)

ADJACENT FIELD CORNER INHIBITS (AFCI)

AFCI $BC4 \cdot AD4 = AB3+AB2+AB1+ABA+BA1+BA2+BA3 = \overline{AB4} \cdot \overline{BA4} \rightarrow [ABAO^\circ \cdot (\overline{AB4} \cdot \overline{BA4})] + [ABAR^\circ \cdot (\overline{AB4} \cdot \overline{BA4})]$
AFCI $BA4 \cdot CD4 = BC3+BC2+BC1+BCB+CB1+CB2+CB3 = \overline{BC4} \cdot \overline{CB4} \rightarrow [BCBO^\circ \cdot (\overline{BC4} \cdot \overline{CB4})] + [BCBR^\circ \cdot (\overline{BC4} \cdot \overline{CB4})]$
AFCI $CB4 \cdot DA4 = CD3+CD2+CD1+CDC+DC1+DC2+CD3 = \overline{CD4} \cdot \overline{DC4} \rightarrow [CDCO^\circ \cdot (\overline{CD4} \cdot \overline{DC4})] + [CDCR^\circ \cdot (\overline{CD4} \cdot \overline{DC4})]$
AFCI $AB4 \cdot DC4 = DA3+DA2+DA1+DAD+AD1+AD2+AD3 = \overline{DA4} \cdot \overline{AD4} \rightarrow [DADO^\circ \cdot (\overline{DA4} \cdot \overline{AD4})] + [DADR^\circ \cdot (\overline{DA4} \cdot \overline{AD4})]$

FIG. 10.25

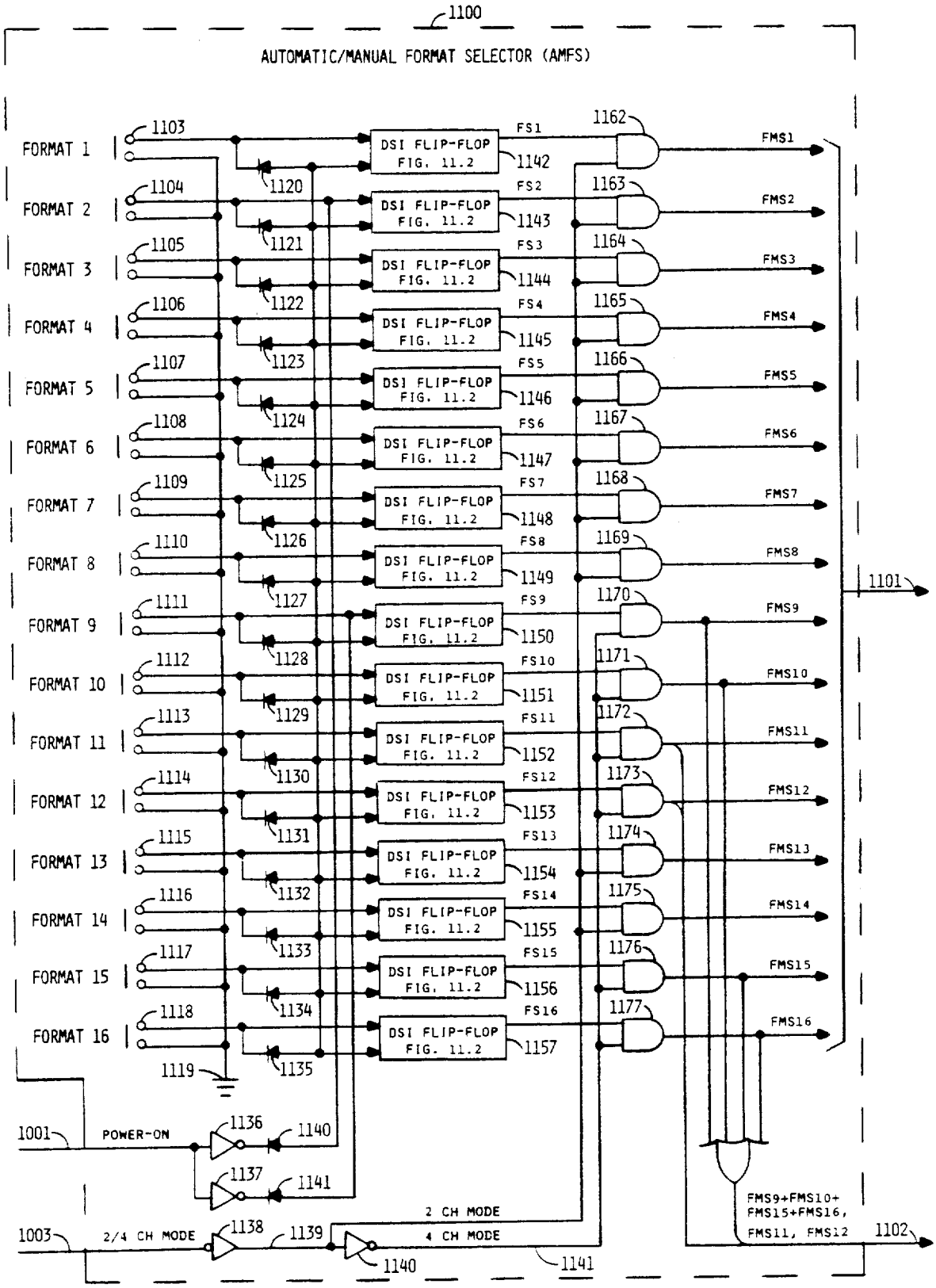
FIG. 11.0

| FORMAT | MODE | TAPE-DISC-TUNER-AUX MEDIA | TIME SHARING TRANSDUCERS | | | OVERALL FORMAT OPERATION CHARACTERISTICS |
|---|---|---|---|---|---|---|
| | | | DIRECT | AMBIENT | BASS | |
| 1 | 2 CH | MONO<br>STEREO<br>MATRIX | 1<br>3<br>6 | 1<br>3<br>6 | 16/AUX | CONCERT HALL |
| 2 | 2 CH | MONO<br>STEREO<br>MATRIX | 1<br>5<br>8 | 1<br>5<br>8 | 16/AUX | CONCERT HALL |
| 3 | 2 CH | MONO<br>STEREO<br>MATRIX | 1<br>7<br>10 | 1<br>7<br>10 | 16/AUX | CONCERT HALL |
| 4 | 2 CH | MONO<br>STEREO<br>MATRIX | 1<br>9<br>12 | 1<br>9<br>12 | 16/AUX | CONCERT HALL |
| 5 | 2 CH | MONO<br>STEREO<br>MATRIX | 1<br>9<br>12 | 1<br>9<br>12 | 16/AUX | SURROUND SOUND |
| 6 | 2 CH | MONO<br>STEREO<br>MATRIX | 1<br>9<br>12 | 1<br>9<br>12 | 16/AUX | SURROUND SOUND,<br>1/2 SURROUND SOUND FIELDS REVERSED |
| 7 | 2 CH | MONO<br>STEREO<br>MATRIX | 1<br>11<br>14 | 1<br>11<br>14 | 16/AUX | SURROUND SOUND,<br>FRONT-CENTER VOICE/INSTRUMENT FOLLOWS LISTENER |
| 8 | 2 CH | MONO<br>STEREO<br>MATRIX | 1<br>11<br>14 | 1<br>11<br>14 | 16/AUX | SURROUND SOUND,<br>FRONT-CENTER VOICE/INSTRUMENT FOLLOWS LISTENER,<br>1/2 SURROUND SOUND FIELDS REVERSED |
| 9 | 4 CH | CD-4<br>4-CH DISCRETE | 16<br>16 | 16<br>16 | 16/AUX | SURROUND SOUND |
| 10 | 4 CH | CD-4<br>4-CH DISCRETE | 16 (32)<br>16 (32) | 16 (32)<br>16 (32) | 16/AUX | SURROUND SOUND,<br>PSEUDO-POINT-SOURCES |
| 11 | 4 CH | CD-4<br>4-CH DISCRETE | 10 (18)<br>10 (18) | 10 (18)<br>10 (18) | 16/AUX | SURROUND SOUND, PSEUDO-POINT-SOURCES, 1-SURROUND SOUND FIELD REVERSED, 2-PHANTOM DIAGONAL FIELDS |
| 12 | 4 CH | CD-4<br>4-CH DISCRETE | 10 (18)<br>10 (18) | 10 (18)<br>19 (18) | 16/AUX | SURROUND SOUND, PSEUDO-POINT-SOURCES, 1-SURROUND SOUND FIELD REVERSED, 2-PHANTOM DIAGONAL FIELDS |
| 13 | 2 CH | MONO<br>STEREO<br>MATRIX | 2<br>2<br>5 | 2<br>2<br>5 | 16/AUX | CONCERT HALL, MODIFIED CONVENTIONAL |
| 14 | 2 CH | MONO<br>STEREO<br>MATRIX | 16<br>16<br>16 | 16<br>16<br>16 | 16/AUX | CONCERT HALL, MODIFIED CONVENTIONAL |
| 15 | 4 CH | CD-4<br>4-CH DISCRETE | 4<br>4 | 4<br>4 | 16/AUX | SURROUND SOUND, MODIFIED CONVENTIONAL |
| 16 | 4 CH | CD-4<br>4-CH DISCRETE | 16<br>16 | 16<br>16 | 16/AUX | SURROUND SOUND, MODIFIED CONVENTIONAL |

FIG. 11.1

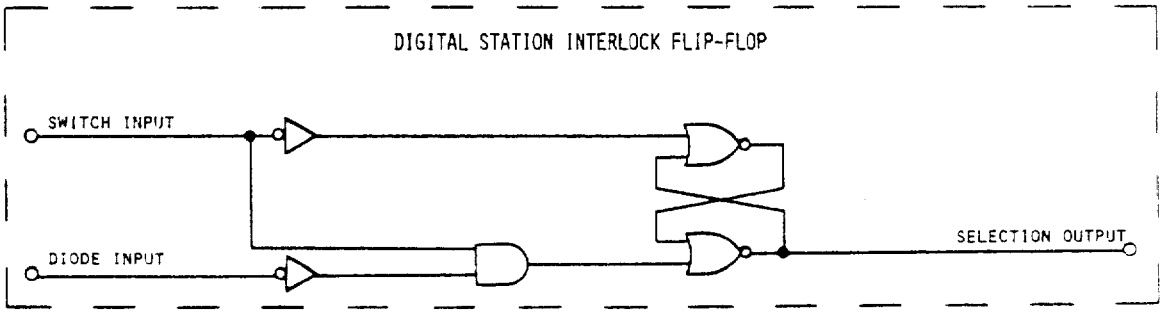

FIG. 11.2

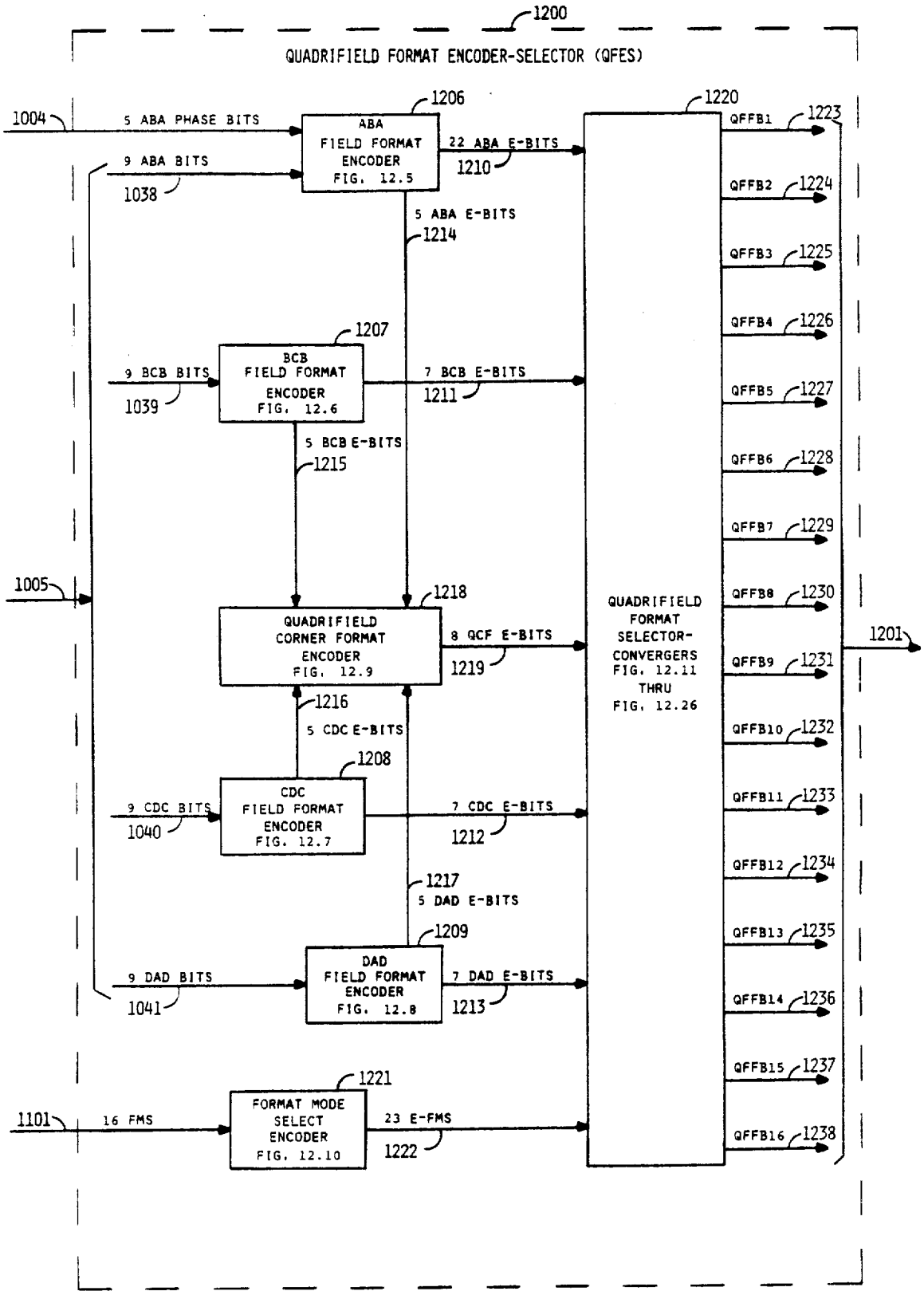
FIG. 12.0

| FORMAT | QUADRIFIELD FORMAT BIT | | | |
|---|---|---|---|---|
| | 1 | 2 | 3 | 4 |
| 1 | NA | 2ABAR°+(2ABAO°·$\overline{ABA}$) | ABA | 2ABAR°+(2ABAO°·$\overline{ABA}$) |
| 2 | AB4+AB3 | AB2+AB1 | ABA | BA1+BA2 |
| 3 | AB2 | AB1 | ABA | BA1 |
| 4 | AB2 | AB1 | ABA | BA1 |
| 5 | 2AB90° | AB1 | ABA | BA1 |
| 6 | 2AB90° | AB1 | ABA | BA4 |
| 7 | 2AB90° | AB1 | ABA+2ABA180° | BA1 |
| 8 | 2AB90° | AB1 | ABA | BA4 |
| 9 | AB4+AB3+AD3+AD4 | AB2+AB1 | ABA | BA1+BA2 |
| 10 | AB4+AB3+AD3+AD4 | AB3+AB2+AB1 | AB1+ABA+BA1 | BA1+BA2+BA3 |
| 11 | AD4+AD3+AB4+AB3+AB2+ AB1+ABA+BA1+BA2 | NA | NA | NA |
| 12 | AB4+AB3+AD4+AD3+AD2+ AD1+DAD+DA1+DA2 | AB3+AB2+AB1 | AB1+ABA+BA1 | BA1+BA2+BA3 |
| 13 | 2ABAR°+2ABAO° | NA | NA | NA |
| 14 | 2ABAR°+2ABAO° | 2ABAR°+2ABAO° | 2ABAR°+2ABAO° | 2ABAR°+2ABAO° |
| 15 | A-TOTAL | NA | NA | NA |
| 16 | A-TOTAL | A-TOTAL | A-TOTAL | B-TOTAL |

FIG.12.1

| FORMAT | QUADRIFIELD FORMAT BIT | | | |
|---|---|---|---|---|
| | 5 | 6 | 7 | 8 |
| 1 | NA | NA | NA | NA |
| 2 | BA3+BA4 | NA | NA | NA |
| 3 | BA2 | BA3+BA4 | NA | NA |
| 4 | BA2 | BA3 | BA4 | NA |
| 5 | 2BA90° | BA2 | NA | BA3 |
| 6 | NA | BA3 | NA | BA2 |
| 7 | 2BA90° | BA2 | ABA | BA3 |
| 8 | NA | BA3 | ABA | BA2 |
| 9 | BA3+BA4+BC4+BC3 | BC2+BC1 | BCB | CB1+CB2 |
| 10 | BA3+BA4+BC4+BC3 | BC3+BC2+BC1 | BC1+BCB+CB1 | CB1+CB2+CB3 |
| 11 | CB4+CB3+CD4+CD3+CD2+ CD1+CDC+DC1+DC2 | CB1+CB2+CB3 | BC1+BCB+CB1 | BC3+BC2+BC1 |
| 12 | BA4+BA3+BC4+BC3+BC2+ BC1+BCB+CB1+CB2 | NA | NA | NA |
| 13 | 2ABAR°+2ABAO° | NA | NA | NA |
| 14 | 2ABAR°+2ABAO° | 2ABAR°+2ABAO° | 2ABAR°+2ABAO° | 2BA90° |
| 15 | B-TOTAL | NA | NA | NA |
| 16 | B-TOTAL | B-TOTAL | B-TOTAL | C-TOTAL |

FIG.12.2

| FORMAT | QUADRIFIELD FORMAT BIT | | | |
|---|---|---|---|---|
| | 9 | 10 | 11 | 12 |
| 1 | 2BA90° | NA | 2ABA180° | NA |
| 2 | 2BA90° | NA | 2ABA180° | NA |
| 3 | 2BA90° | NA | 2ABA180° | NA |
| 4 | 2BA90° | NA | 2ABA180° | NA |
| 5 | NA | BA4 | 2ABA180° | AB4 |
| 6 | 2BA90° | BA1 | NA | AB4 |
| 7 | NA | BA4 | ABA | AB4 |
| 8 | 2BA90° | BA1 | ABA | AB4 |
| 9 | CD4+CD3+CB3+CB4 | CD2+CD1 | CDC | DC1+DC2 |
| 10 | CD4+CD3+CB3+CB4 | CD3+CD2+CD1 | CD1+CDC+DC1 | DC1+DC2+DC3 |
| 11 | BC4+BC3+BA4+BA3+BA2+BA1+ABA+AB1+AB2 | NA | NA | NA |
| 12 | DC4+DC3+DA4+DA3+DA2+DA1+DAD+AD1+AD2 | DC1+DC2+DC3 | CD1+CDC+DC1 | CD3+CD2+CD1 |
| 13 | 2BA90° | NA | 2ABA180° | NA |
| 14 | 2BA90° | 2BA90° | 2ABA180° | 2AB90° |
| 15 | C-TOTAL | NA | NA | NA |
| 16 | C-TOTAL | C-TOTAL | D-TOTAL | D-TOTAL |

FIG.12.3

| FORMAT | QUADRIFIELD FORMAT BIT | | | |
|---|---|---|---|---|
| | 13 | 14 | 15 | 16 |
| 1 | 2AB90° | NA | NA | NA |
| 2 | 2AB90° | NA | NA | NA |
| 3 | 2AB90° | NA | NA | AB4+AB3 |
| 4 | 2AB90° | NA | AB4 | AB3 |
| 5 | NA | AB3 | NA | AB2 |
| 6 | 2ABA180° | AB3 | NA | AB2 |
| 7 | NA | AB3 | ABA | AB2 |
| 8 | 2ABA180° | AB3 | ABA | AB2 |
| 9 | DC3+DC4+DA4+DA3 | DA2+DA1 | DAD | AD1+AD2 |
| 10 | DC3+DC4+DA4+DA3 | DA3+DA2+DA1 | DA1+DAD+AD1 | AD1+AD2+AD3 |
| 11 | DA4+DA3+DC4+DC3+DC2+DC1+CDC+CD1+CD2 | DA3+DA2+DA1 | DA1+DAD+AD1 | AD1+AD2+AD3 |
| 12 | CD4+CD3+CB4+CB3+CB2+CB1+BCB+BC1+BC2 | NA | NA | NA |
| 13 | 2AB90° | NA | NA | NA |
| 14 | 2AB90° | 2AB90° | 2ABAR°+2ABAO° | 2ABAR°+2ABAO° |
| 15 | D-TOTAL | NA | NA | NA |
| 16 | D-TOTAL | D-TOTAL | A-TOTAL | A-TOTAL |

FIG.12.4

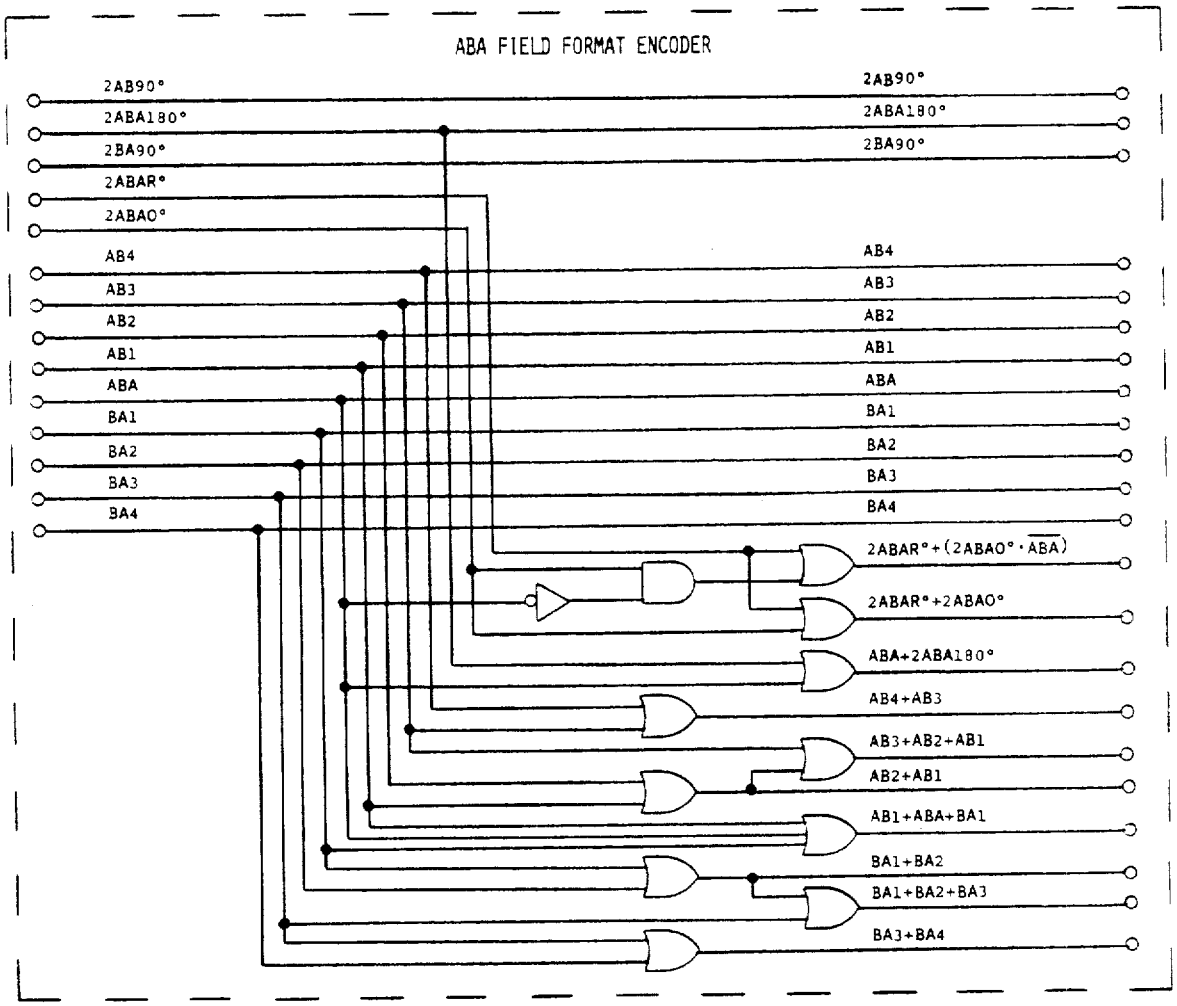
FIG. 12.5
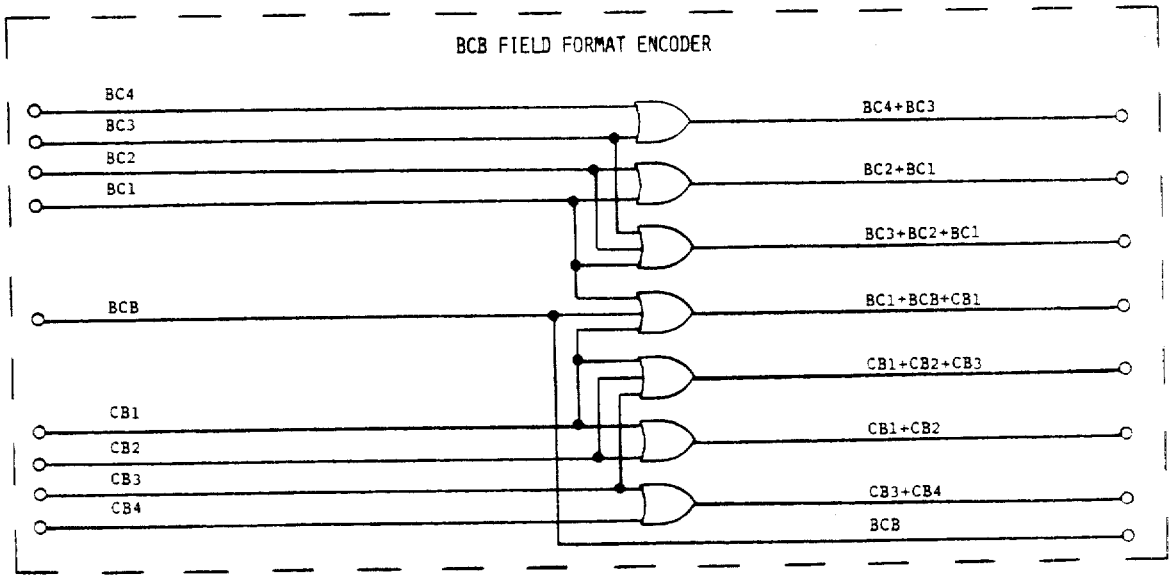
FIG. 12.6

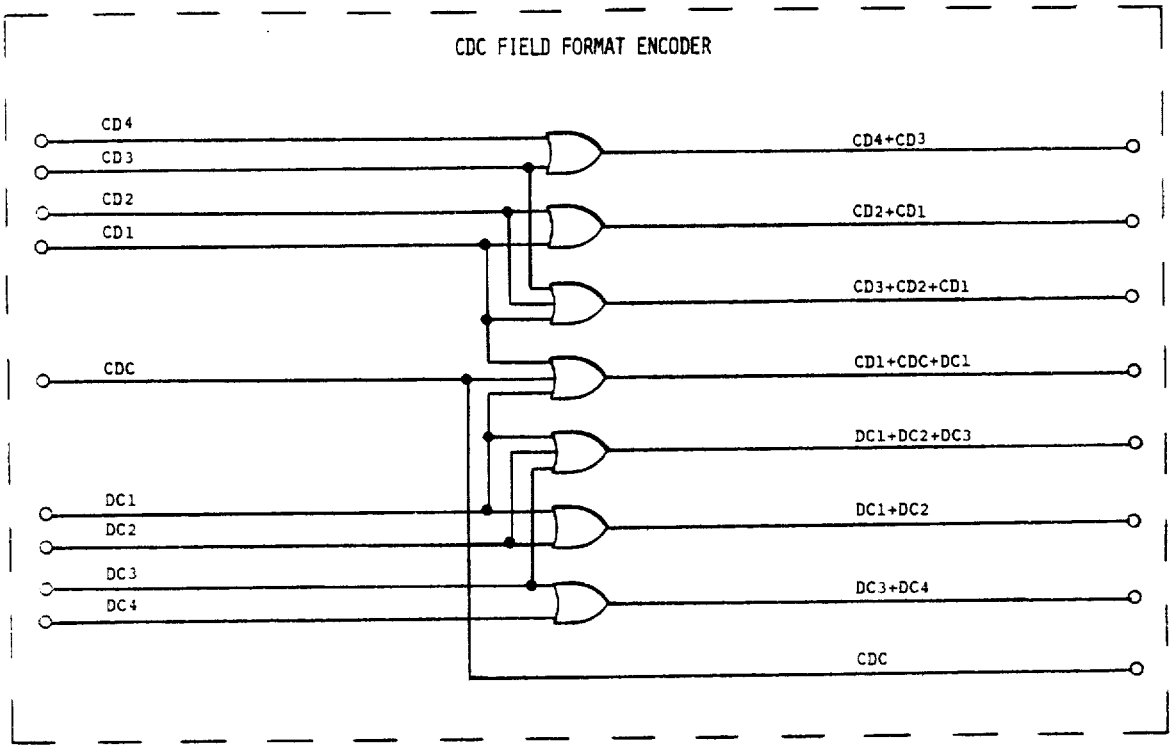
FIG. 12.7
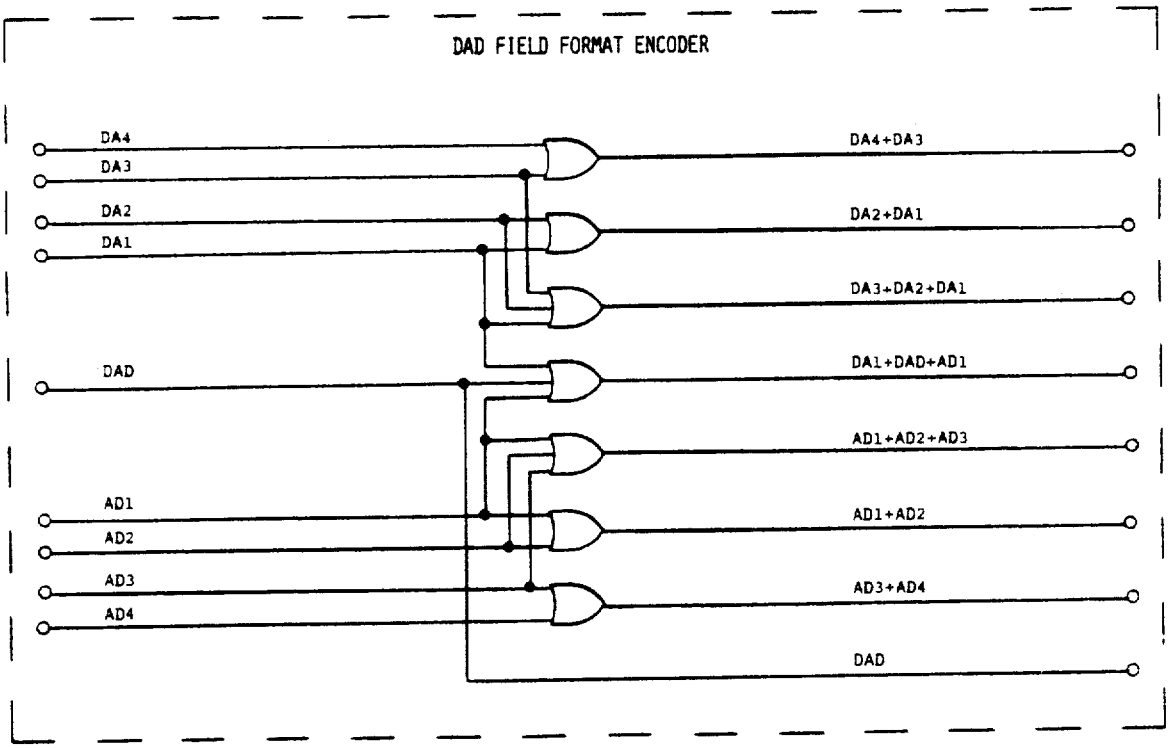
FIG. 12.8

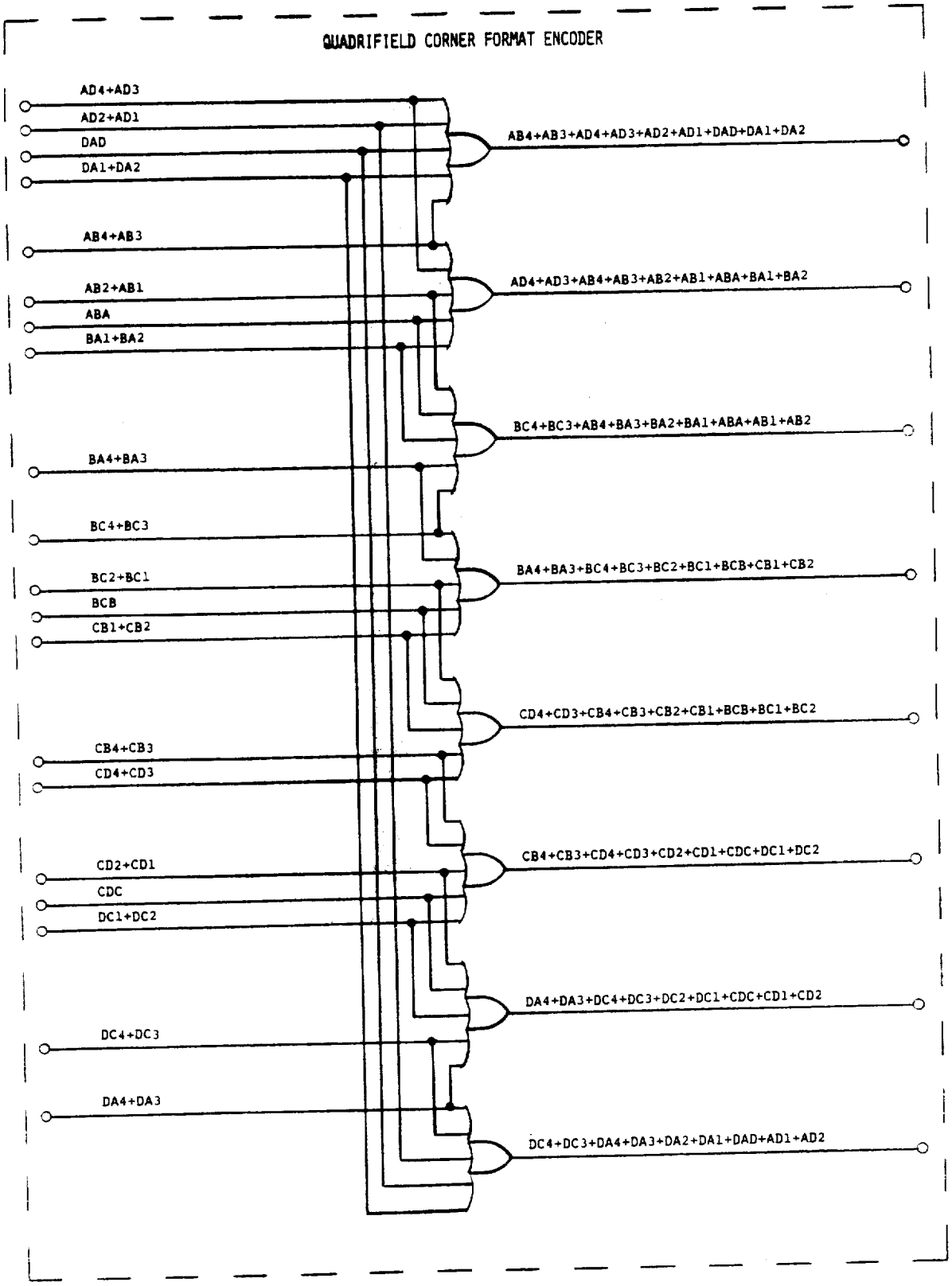
FIG. 12.9

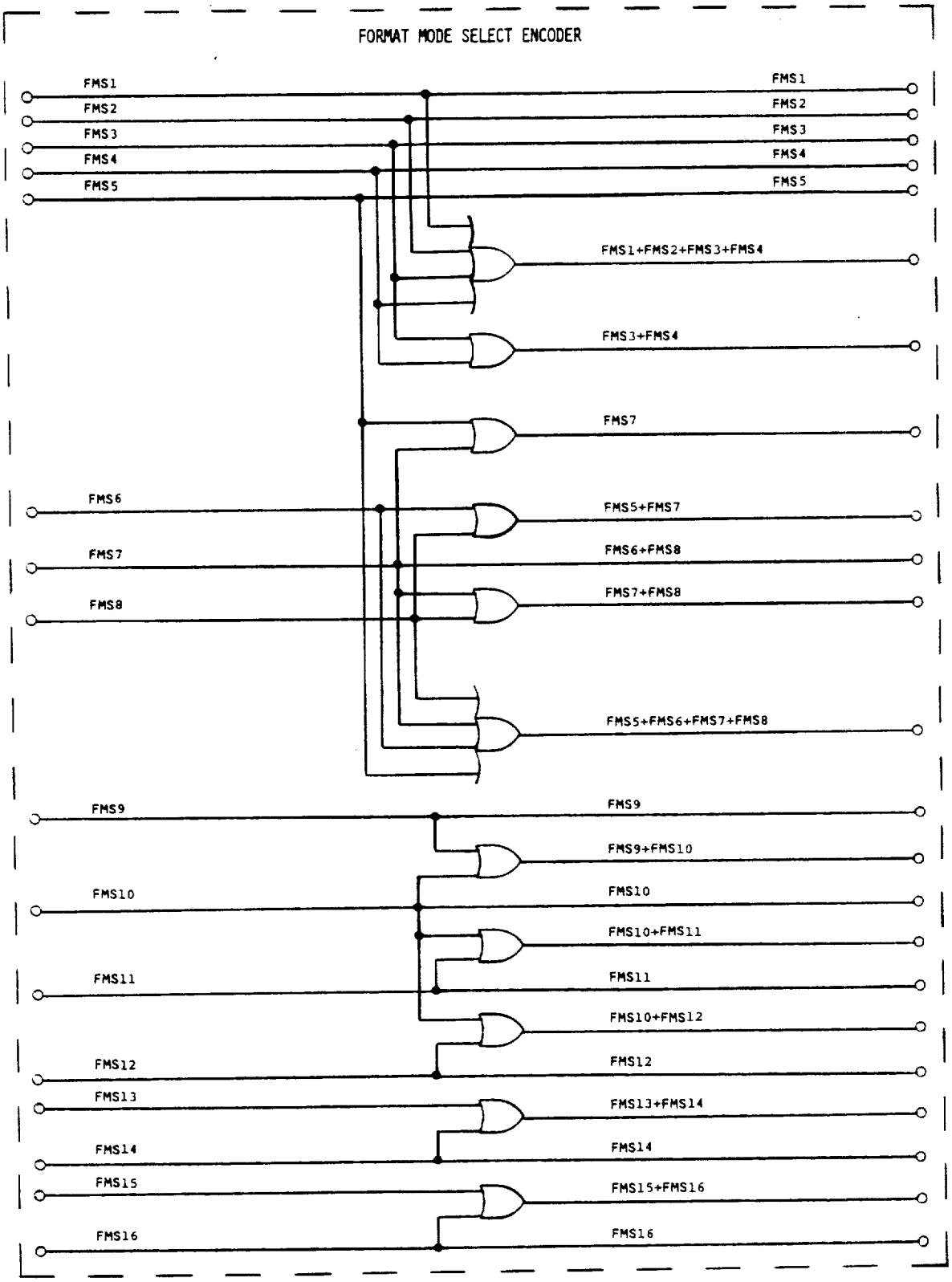
FIG.12.10

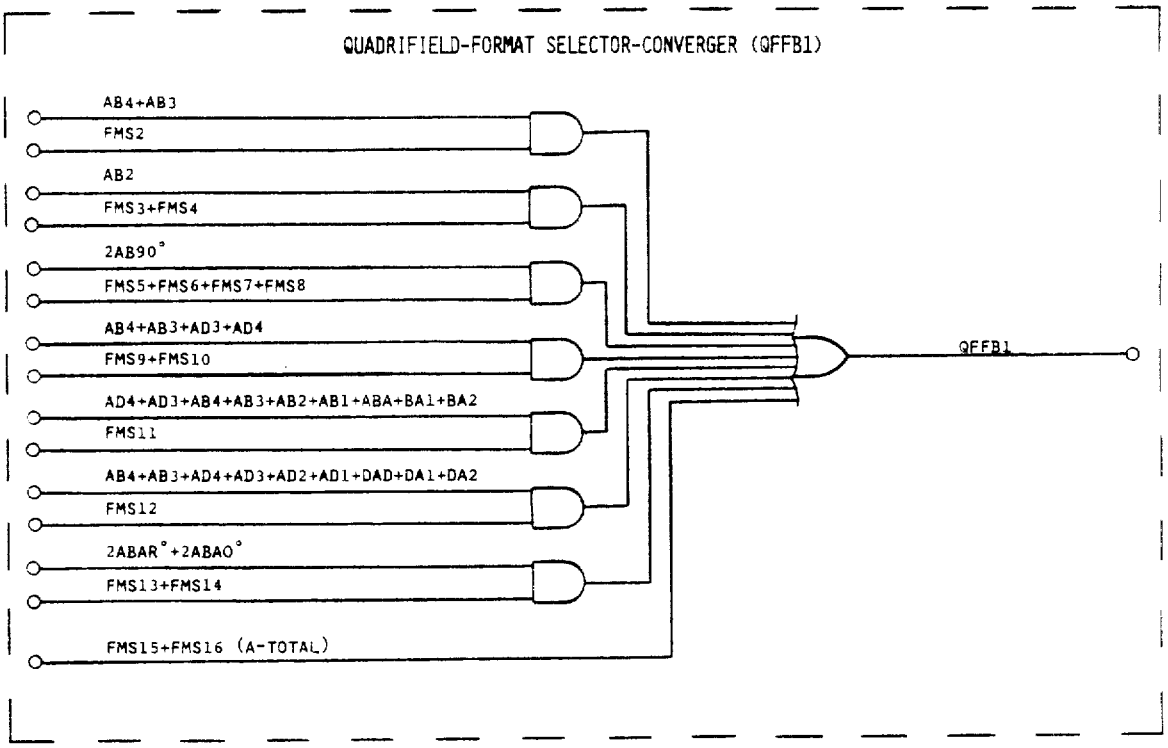
FIG.12.11
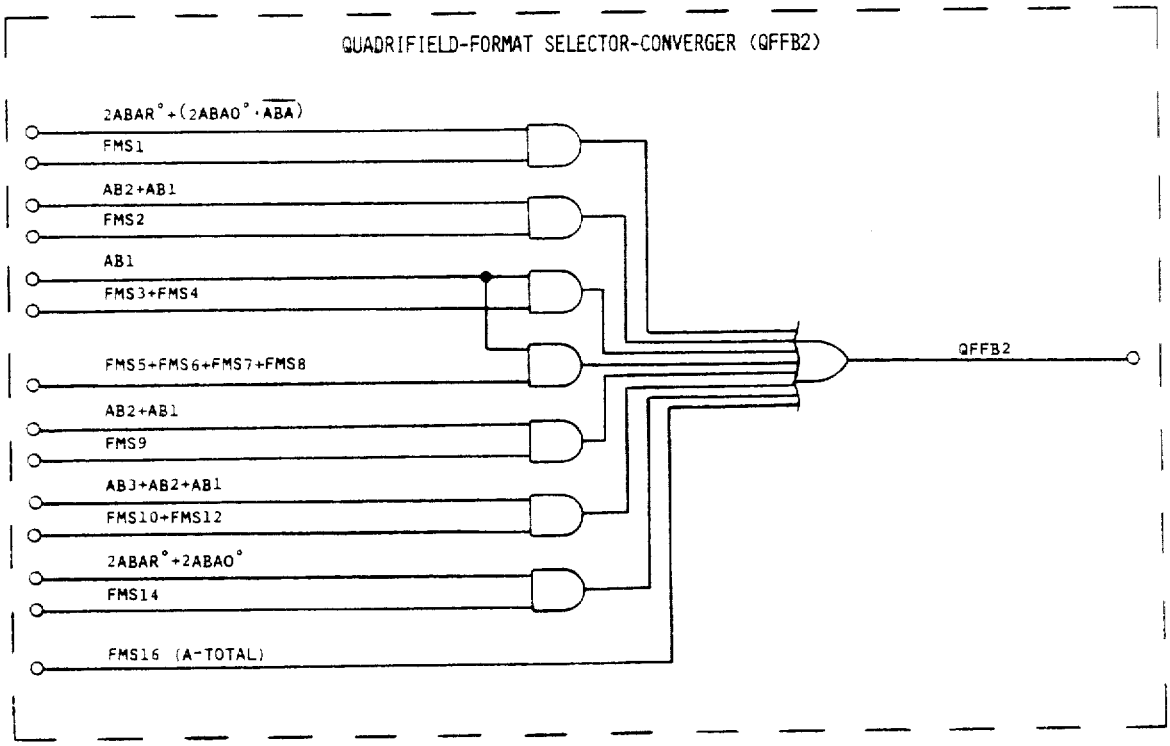
FIG.12.12

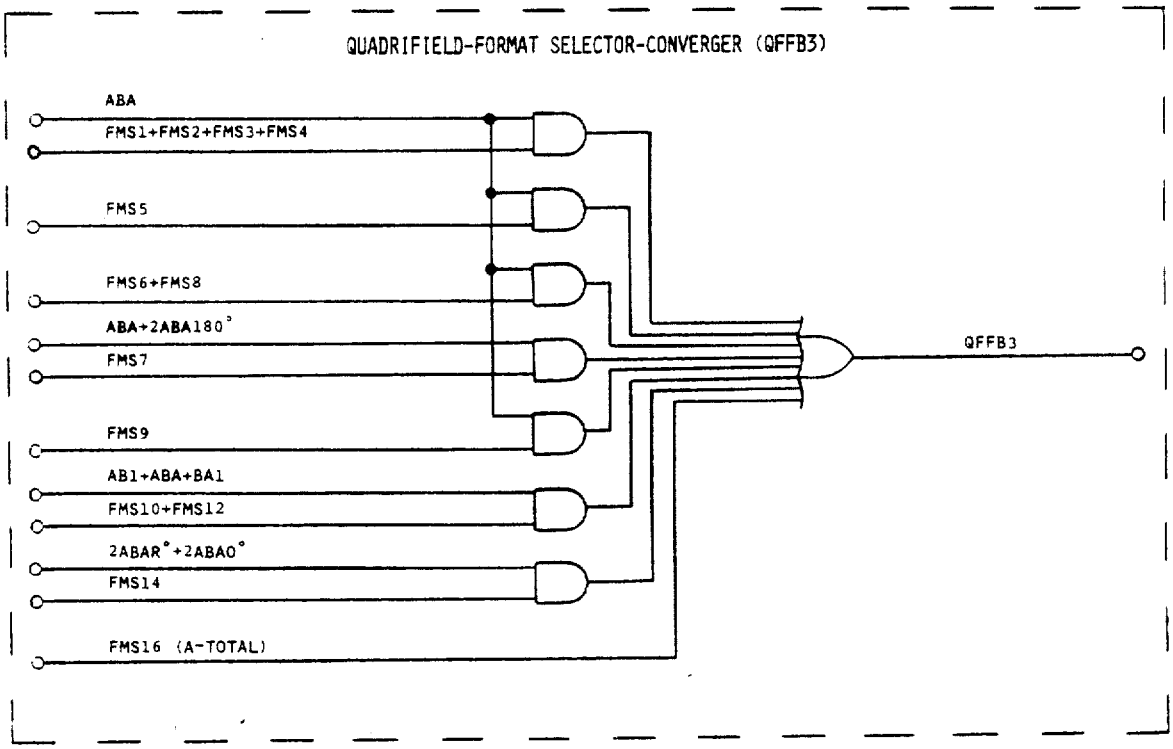
FIG.12.13
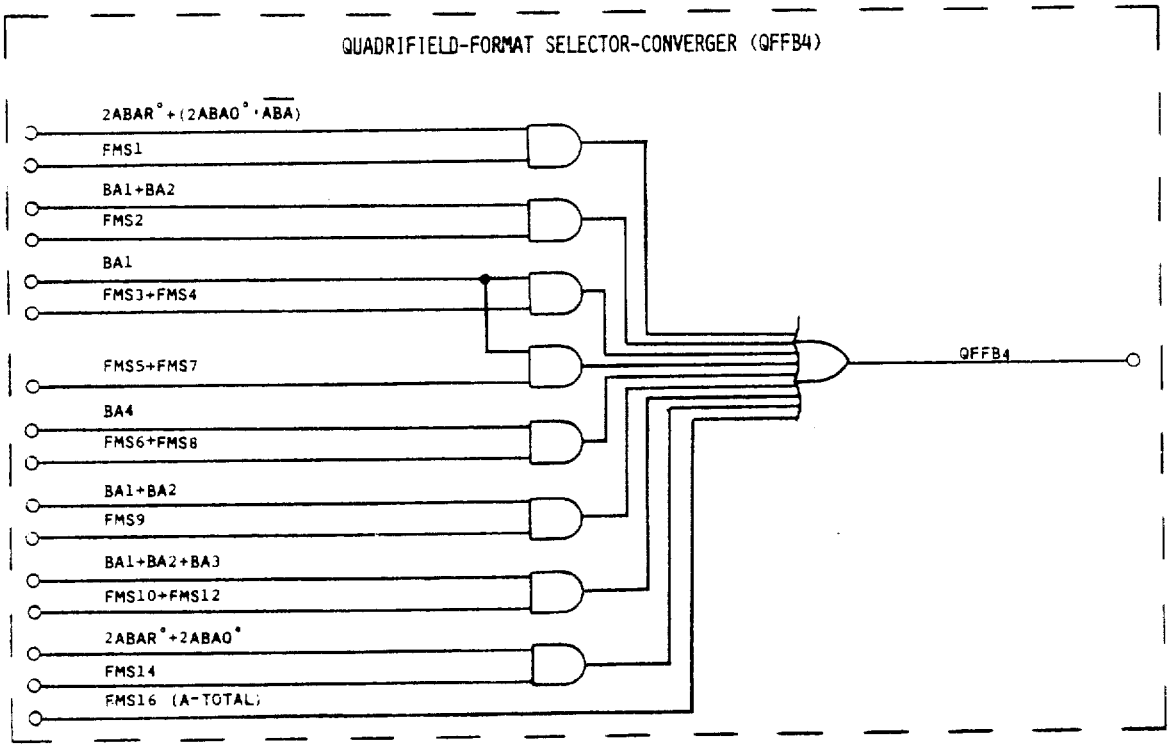
FIG.12.14

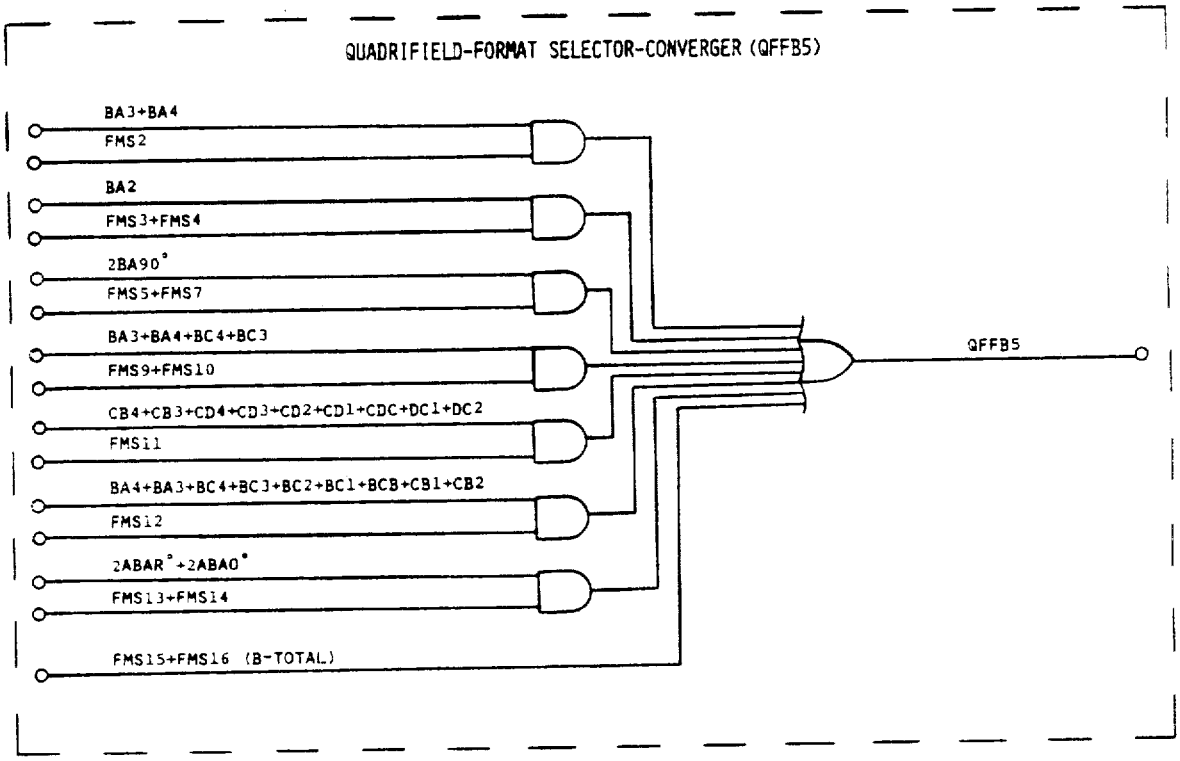
FIG.12.15
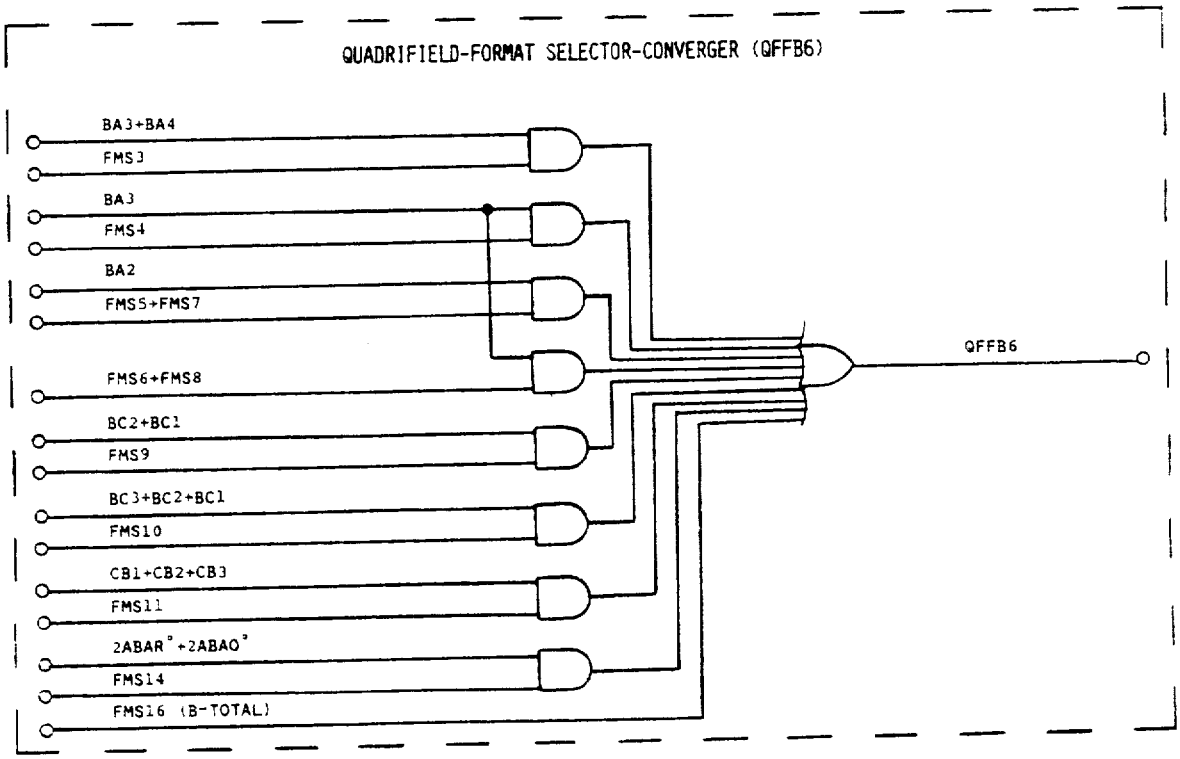
FIG.12.16

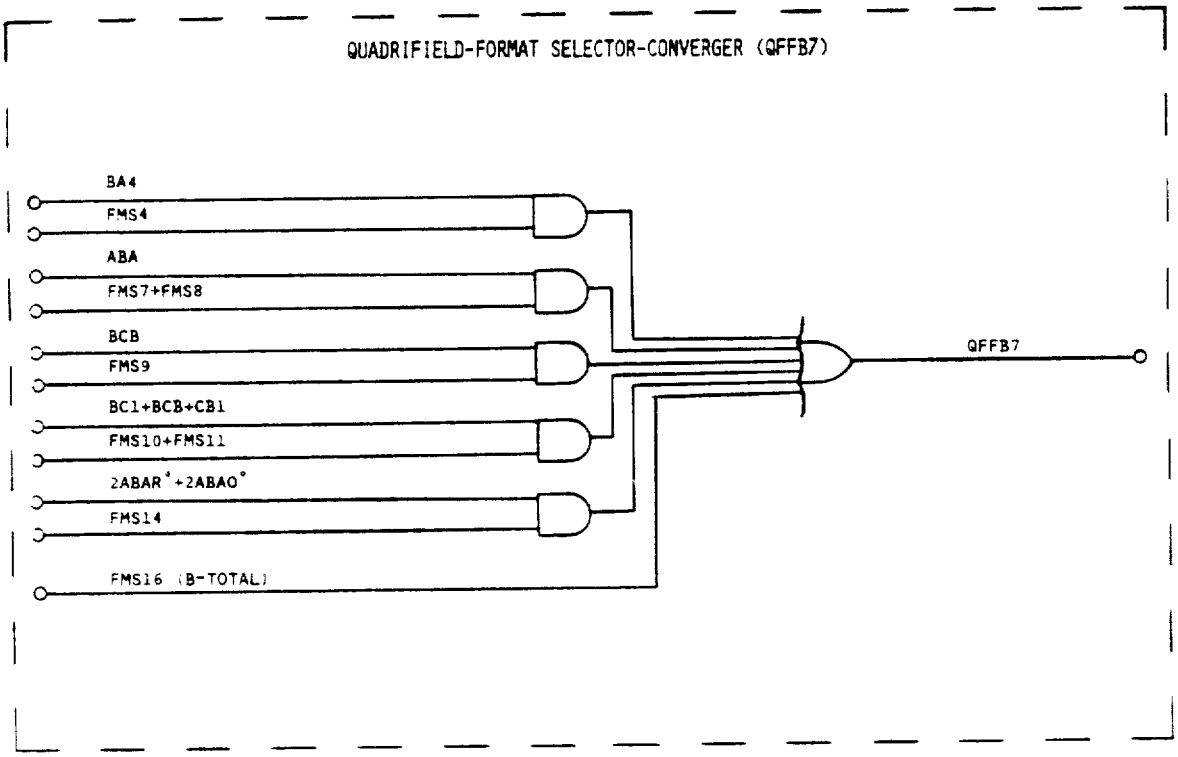
FIG.12.17
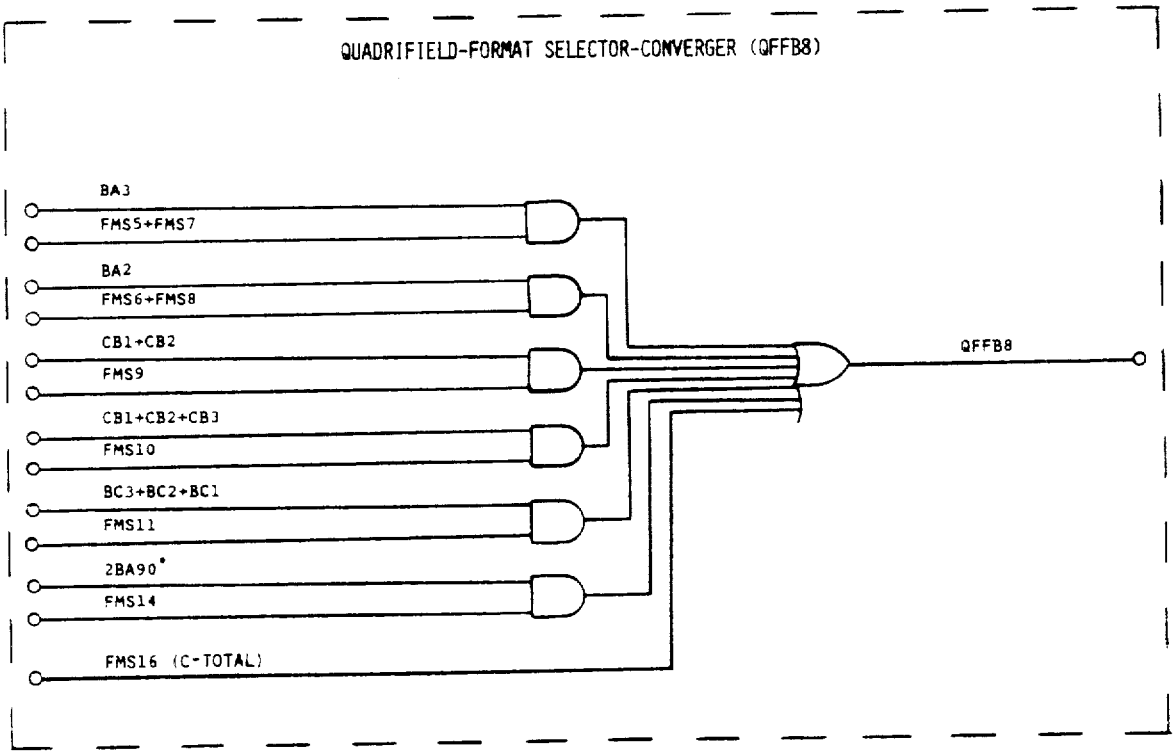
FIG.12.18

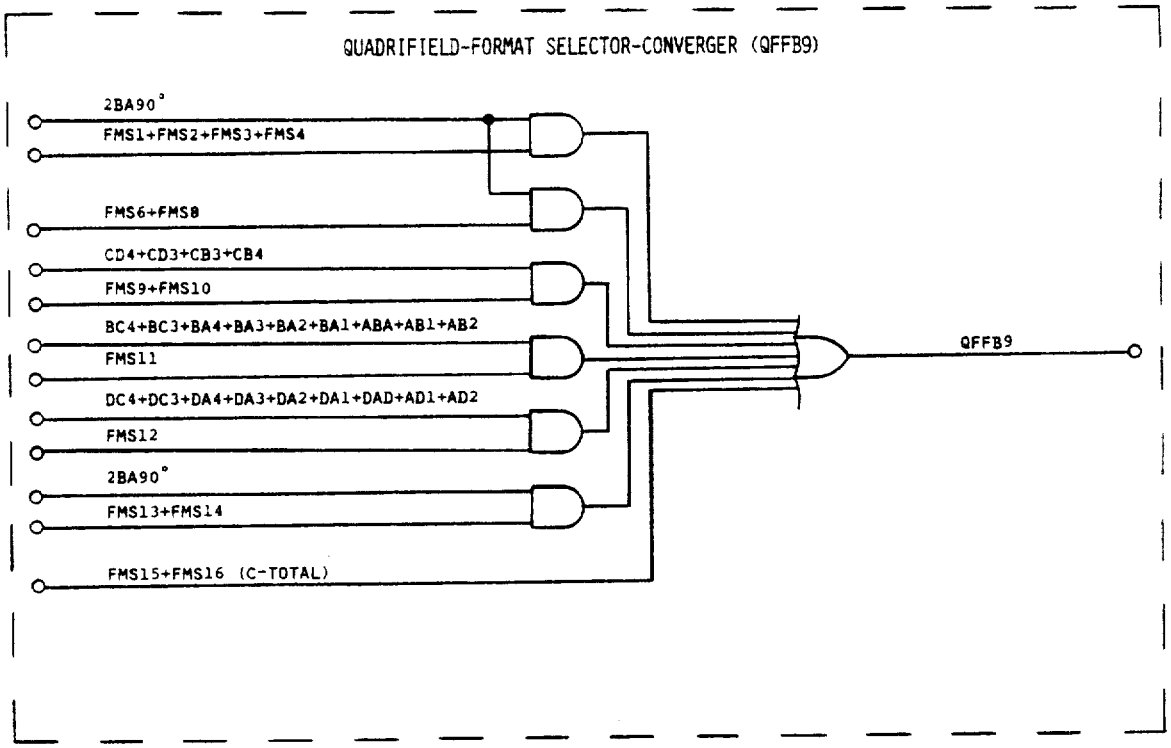
FIG.12.19
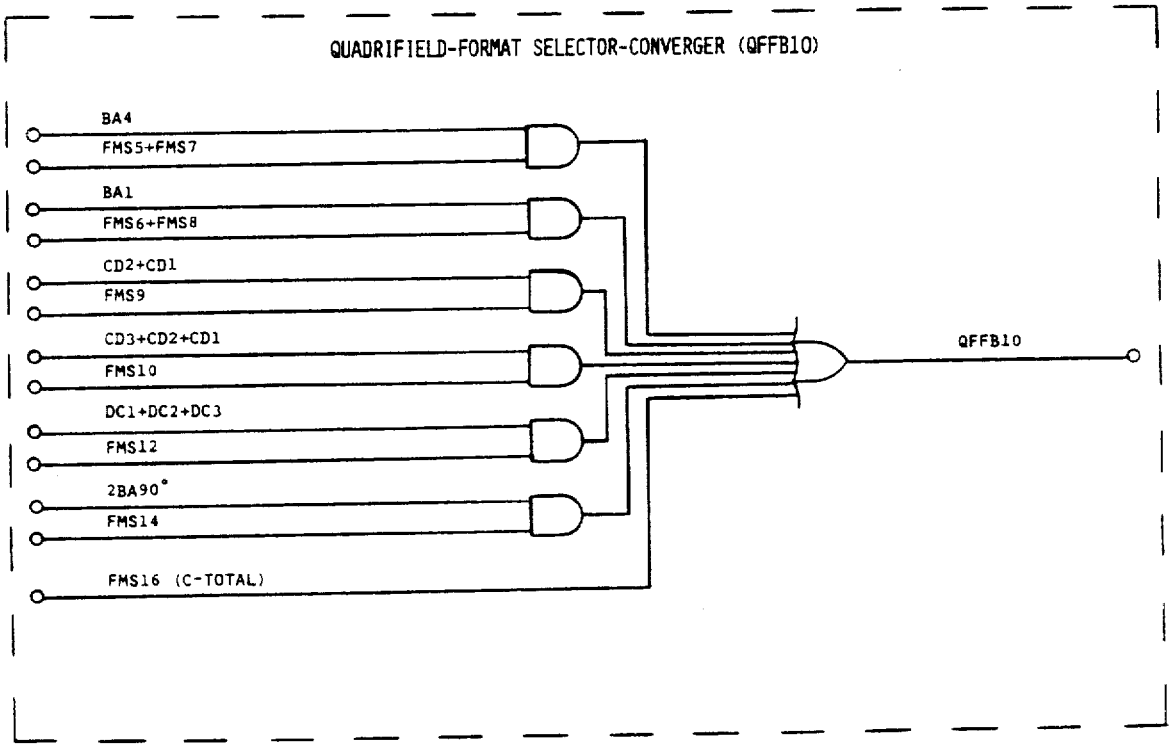
FIG.12.20

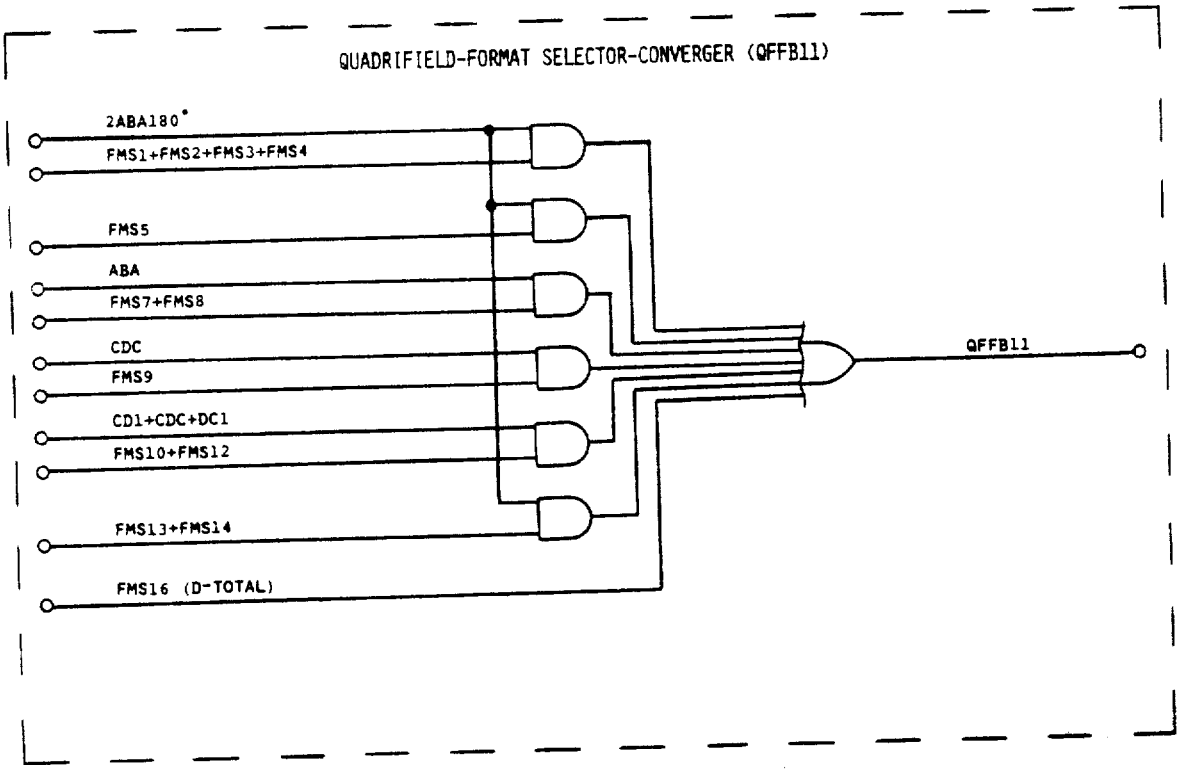
FIG. 12.21
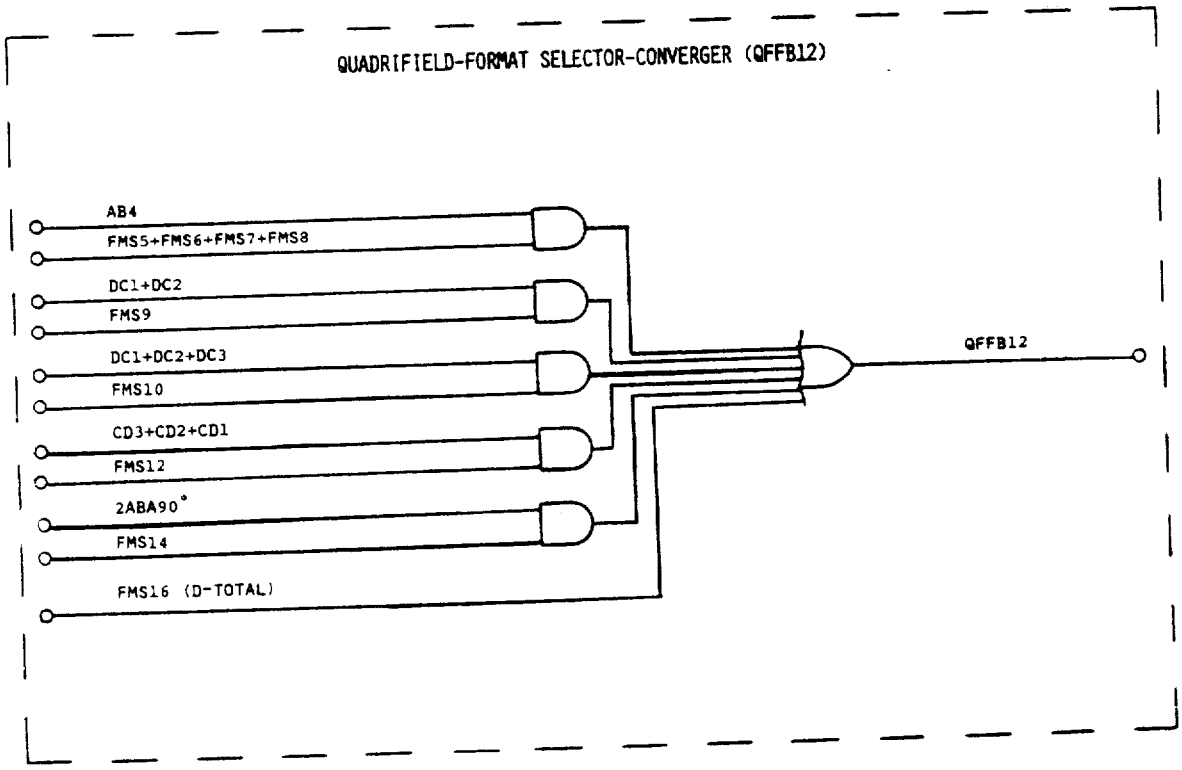
FIG. 12.22

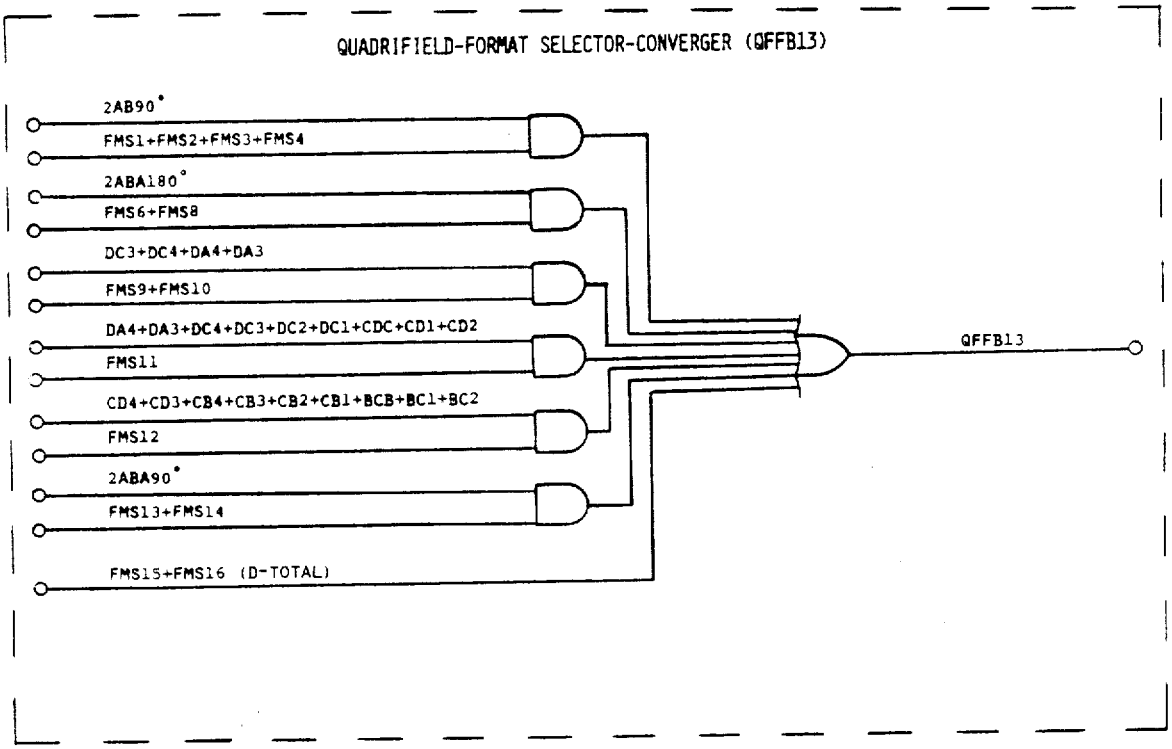
FIG. 12.23
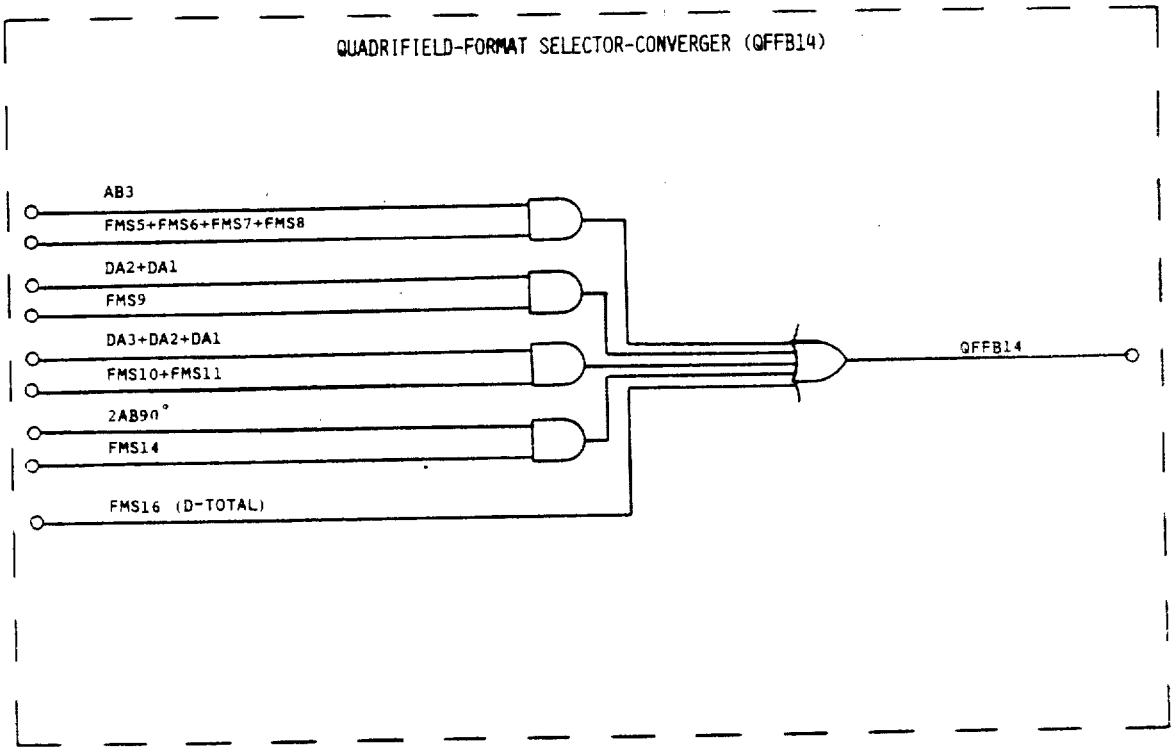
FIG. 12.24

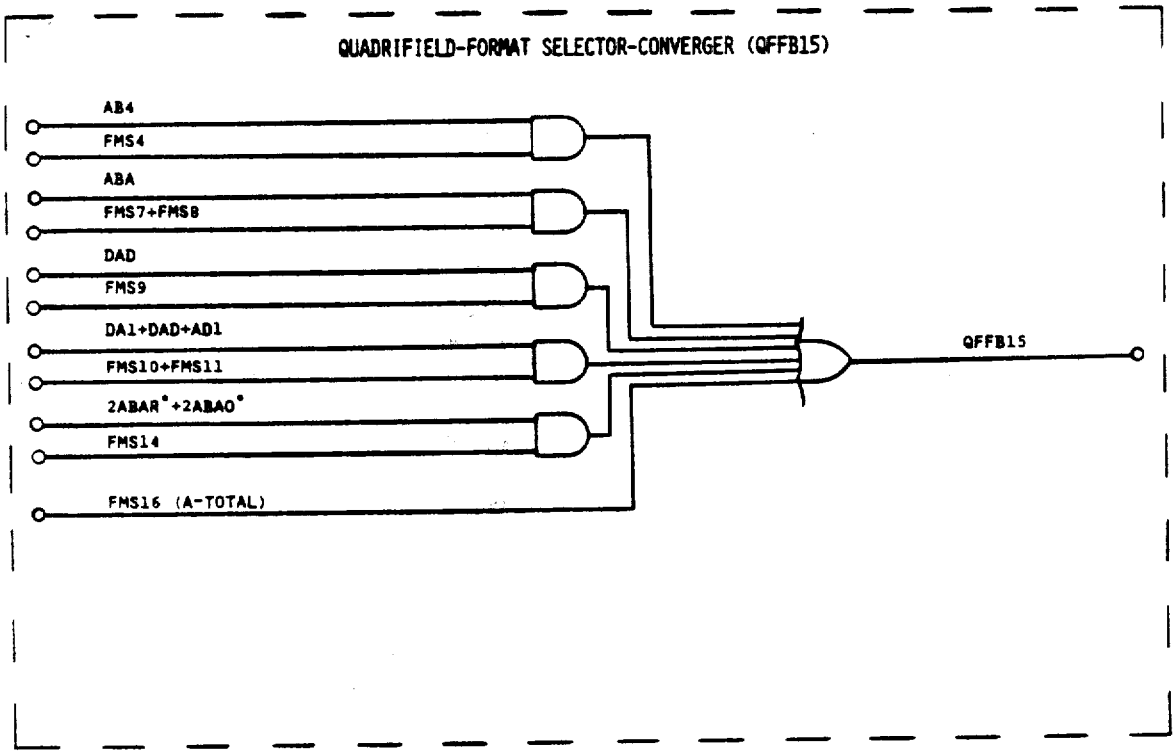
FIG.12.25
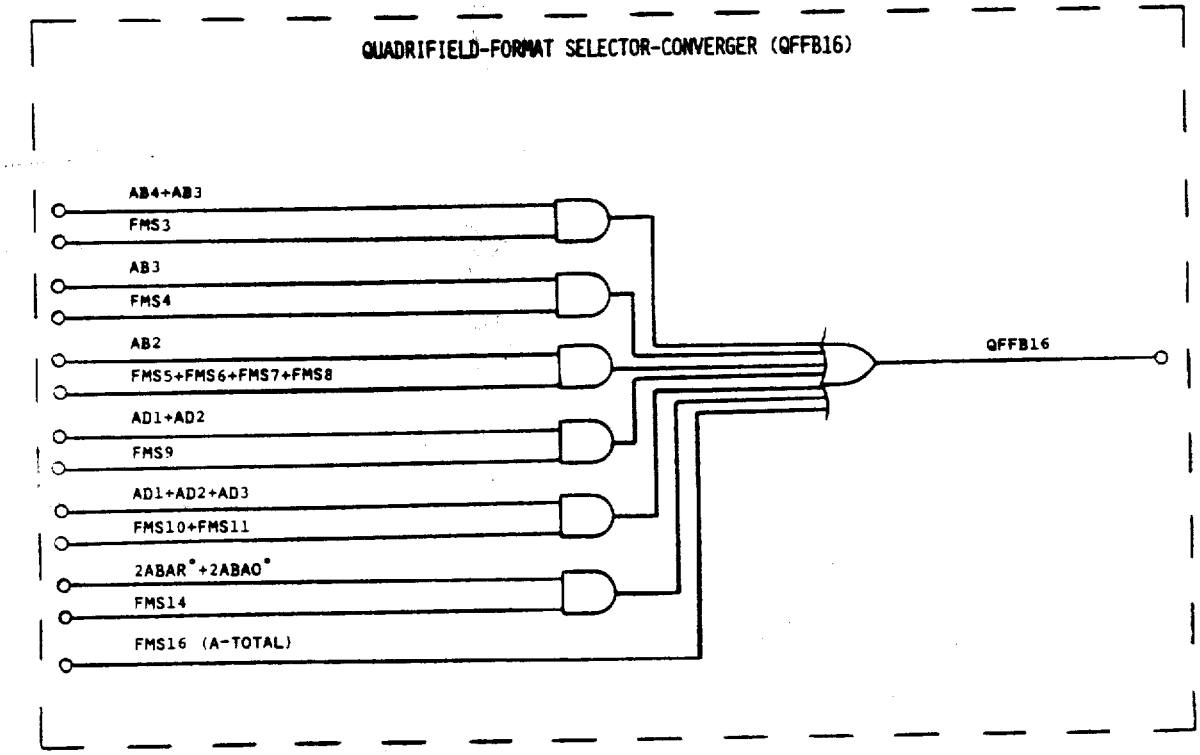
FIG.12.26

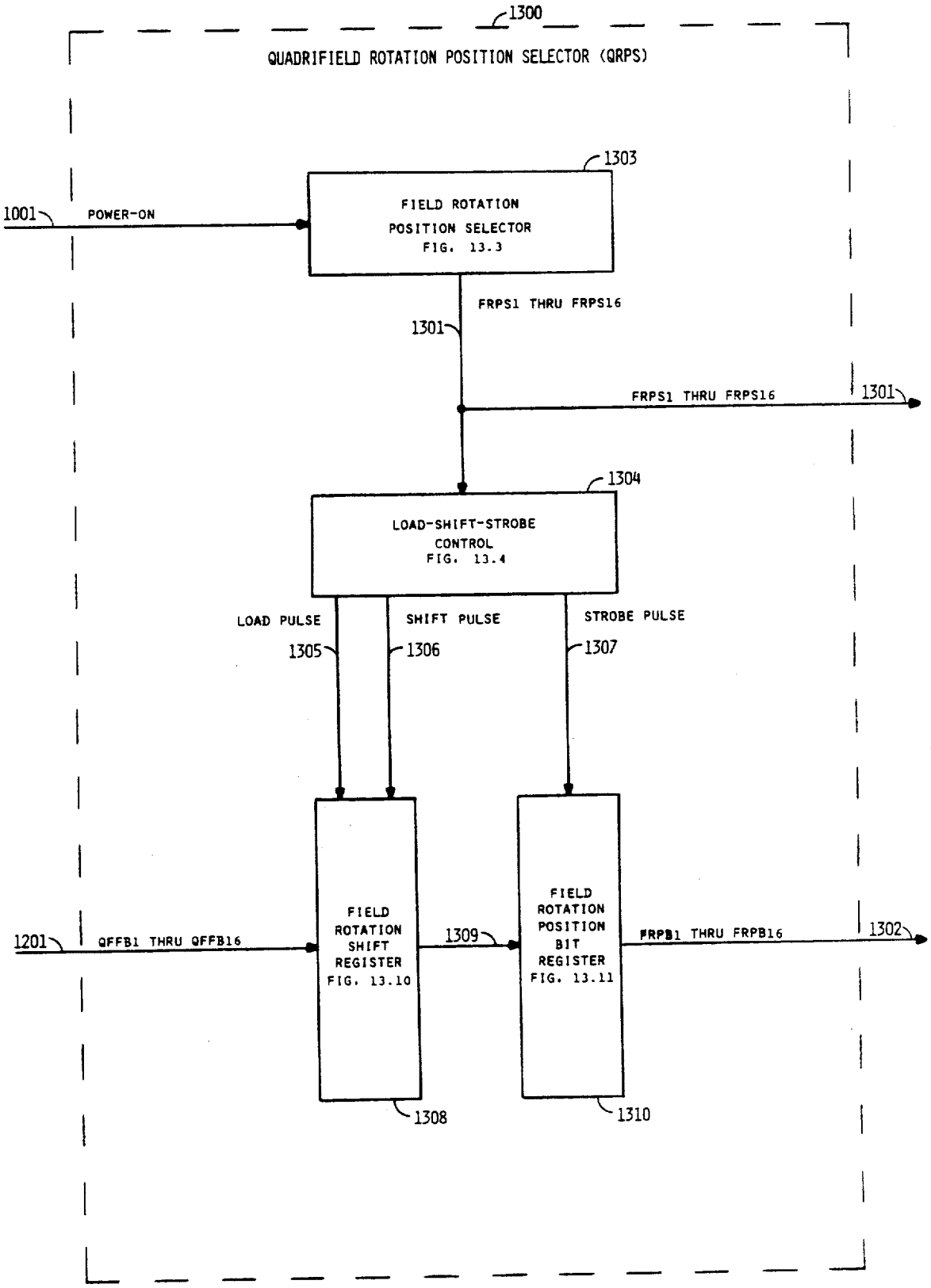
FIG.13.0

| FIELD ROTATION POSITION BIT | FIELD ROTATION POSITION SELECT (FRPS) | | | | | | | |
|---|---|---|---|---|---|---|---|---|
| | 1 | 2 | 3 | 4 | 5 | 6 | 7 | 8 |
| FRPB1 | QFFB3 | QFFB2 | QFFB1 | QFFB16 | QFFB15 | QFFB14 | QFFB13 | QFFB12 |
| FRPB2 | QFFB4 | QFFB3 | QFFB2 | QFFB1 | QFFB16 | QFFB15 | QFFB14 | QFFB13 |
| FRPB3 | QFFB5 | QFFB4 | QFFB3 | QFFB2 | QFFB1 | QFFB16 | QFFB15 | QFFB14 |
| FRPB4 | QFFB6 | QFFB5 | QFFB4 | QFFB3 | QFFB2 | QFFB1 | QFFB16 | QFFB15 |
| FRPB5 | QFFB7 | QFFB6 | QFFB5 | QFFB4 | QFFB3 | QFFB2 | QFFB1 | QFFB16 |
| FRPB6 | QFFB8 | QFFB7 | QFFB6 | QFFB5 | QFFB4 | QFFB3 | QFFB2 | QFFB1 |
| FRPB7 | QFFB9 | QFFB8 | QFFB7 | QFFB6 | QFFB5 | QFFB4 | QFFB3 | QFFB2 |
| FRPB8 | QFFB10 | QFFB9 | QFFB8 | QFFB7 | QFFB6 | QFFB5 | QFFB4 | QFFB3 |
| FRPB9 | QFFB11 | QFFB10 | QFFB9 | QFFB8 | QFFB7 | QFFB6 | QFFB5 | QFFB4 |
| FRPB10 | QFFB12 | QFFB11 | QFFB10 | QFFB9 | QFFB8 | QFFB7 | QFFB6 | QFFB5 |
| FRPB11 | QFFB13 | QFFB12 | QFFB11 | QFFB10 | QFFB9 | QFFB8 | QFFB7 | QFFB6 |
| FRPB12 | QFFB14 | QFFB13 | QFFB12 | QFFB11 | QFFB10 | QFFB9 | QFFB8 | QFFB7 |
| FRPB13 | QFFB15 | QFFB14 | QFFB13 | QFFB12 | QFFB11 | QFFB10 | QFFB9 | QFFB8 |
| FRPB14 | QFFB16 | QFFB15 | QFFB14 | QFFB13 | QFFB12 | QFFB11 | QFFB10 | QFFB9 |
| FRPB15 | QFFB1 | QFFB16 | QFFB15 | QFFB14 | QFFB13 | QFFB12 | QFFB11 | QFFB10 |
| FRPB16 | QFFB2 | QFFB1 | QFFB16 | QFFB15 | QFFB14 | QFFB13 | QFFB12 | QFFB11 |

FIG.13.1

| FIELD ROTATION POSITION BIT | FIELD ROTATION POSITION SELECT (FRPS) | | | | | | | |
|---|---|---|---|---|---|---|---|---|
| | 9 | 10 | 11 | 12 | 13 | 14 | 15 | 16 |
| FRPB1 | QFFB11 | QFFB10 | QFFB9 | QFFB8 | QFFB7 | QFFB6 | QFFB5 | QFFB4 |
| FRPB2 | QFFB12 | QFFB11 | QFFB10 | QFFB9 | QFFB8 | QFFB7 | QFFB6 | QFFB5 |
| FRPB3 | QFFB13 | QFFB12 | QFFB11 | QFFB10 | QFFB9 | QFFB8 | QFFB7 | QFFB6 |
| FRPB4 | QFFB14 | QFFB13 | QFFB12 | QFFB11 | QFFB10 | QFFB9 | QFFB8 | QFFB7 |
| FRPB5 | QFFB15 | QFFB14 | QFFB13 | QFFB12 | QFFB11 | QFFB10 | QFFB9 | QFFB8 |
| FRPB6 | QFFB16 | QFFB15 | QFFB14 | QFFB13 | QFFB12 | QFFB11 | QFFB10 | QFFB9 |
| FRPB7 | QFFB1 | QFFB16 | QFFB15 | QFFB14 | QFFB13 | QFFB12 | QFFB11 | QFFB10 |
| FRPB8 | QFFB2 | QFFB1 | QFFB16 | QFFB15 | QFFB14 | QFFB13 | QFFB12 | QFFB11 |
| FRPB9 | QFFB3 | QFFB2 | QFFB1 | QFFB16 | QFFB15 | QFFB14 | QFFB13 | QFFB12 |
| FRPB10 | QFFB4 | QFFB3 | QFFB2 | QFFB1 | QFFB16 | QFFB15 | QFFB14 | QFFB13 |
| FRPB11 | QFFB5 | QFFB4 | QFFB3 | QFFB2 | QFFB1 | QFFB16 | QFFB15 | QFFB14 |
| FRPB12 | QFFB6 | QFFB5 | QFFB4 | QFFB3 | QFFB2 | QFFB1 | QFFB16 | QFFB15 |
| FRPB13 | QFFB7 | QFFB6 | QFFB5 | QFFB4 | QFFB3 | QFFB2 | QFFB1 | QFFB16 |
| FRPB14 | QFFB8 | QFFB7 | QFFB6 | QFFB5 | QFFB4 | QFFB3 | QFFB2 | QFFB1 |
| FRPB15 | QFFB9 | QFFB8 | QFFB7 | QFFB6 | QFFB5 | QFFB4 | QFFB3 | QFFB2 |
| FRPB16 | QFFB10 | QFFB9 | QFFB8 | QFFB7 | QFFB6 | QFFB5 | QFFB4 | QFFB3 |

FIG.13.2

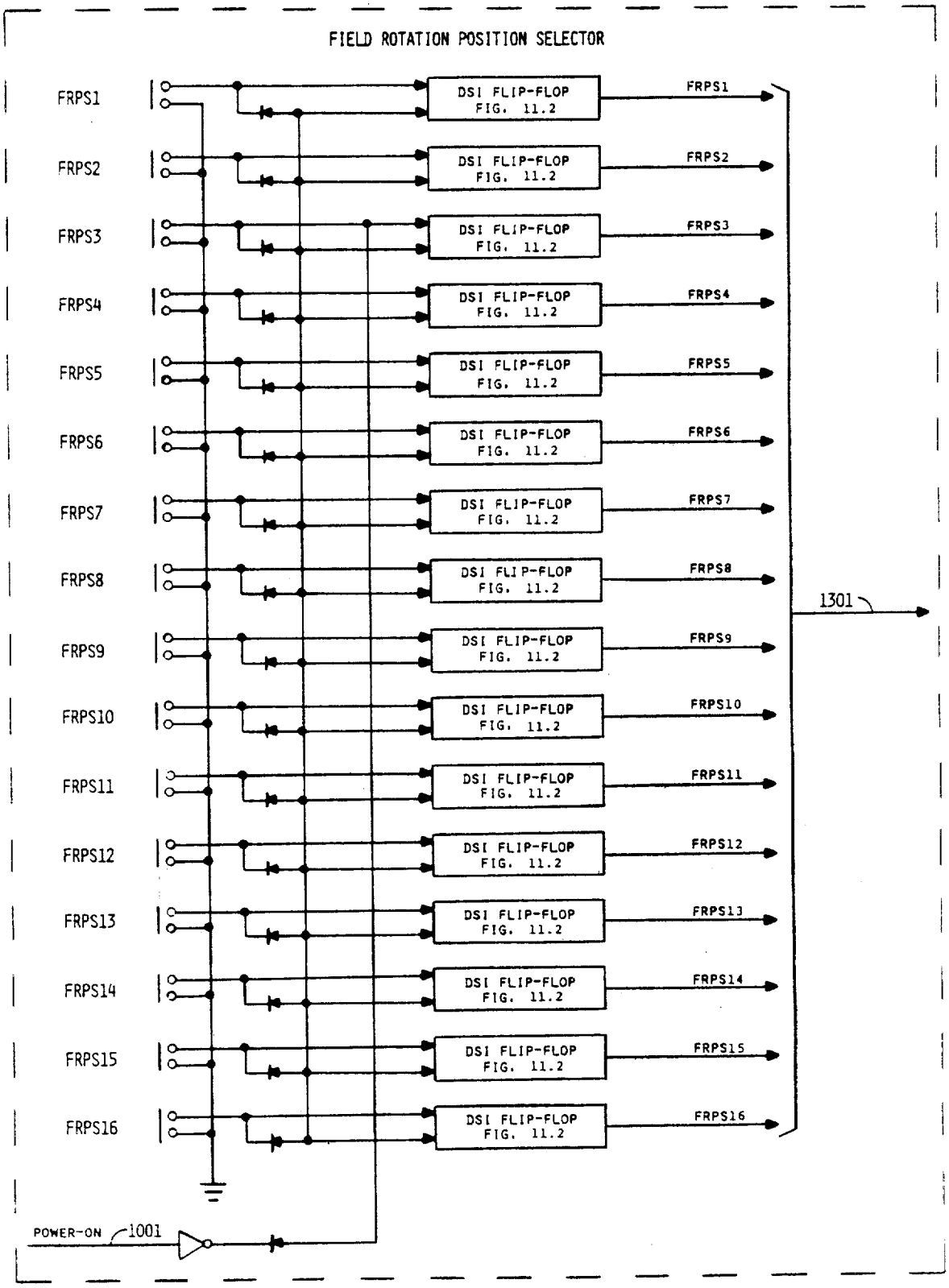
FIG. 13.3

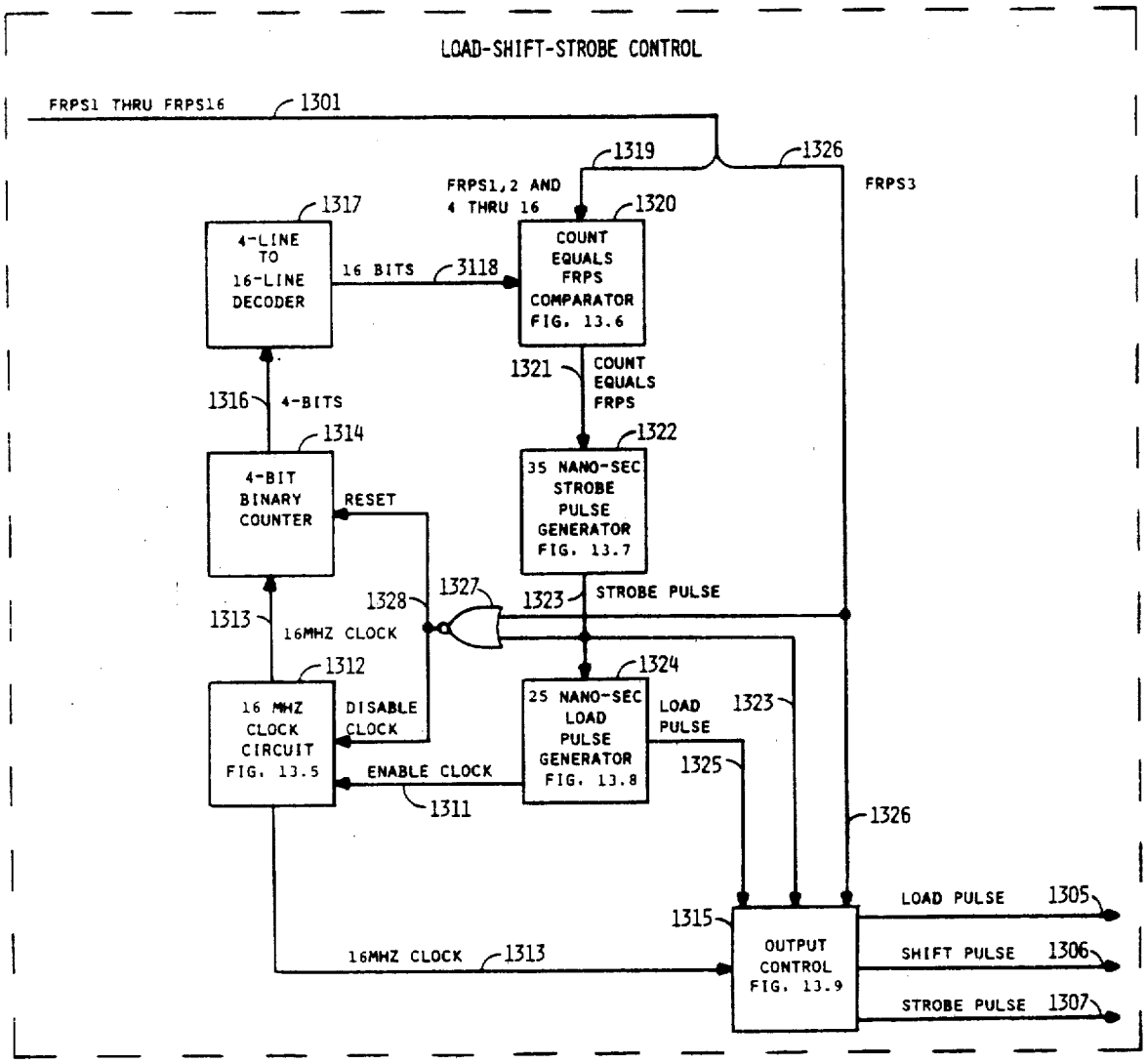
FIG. 13.4
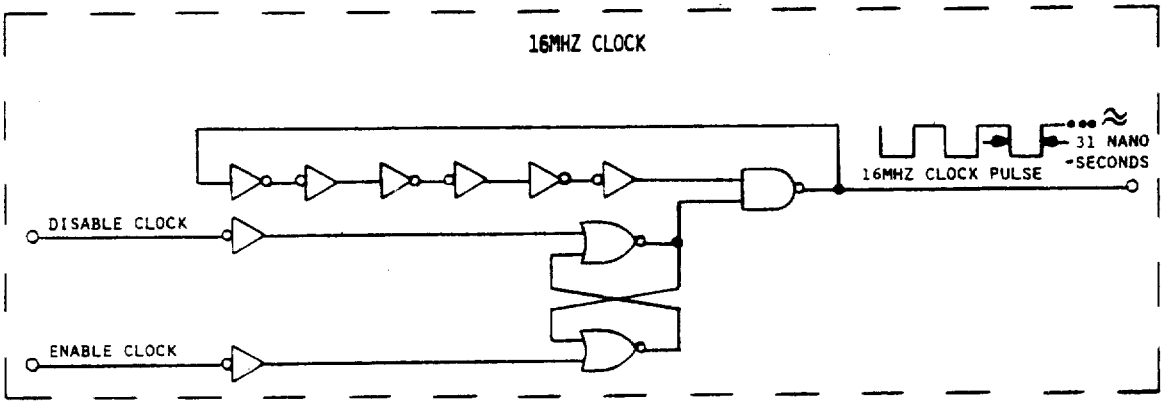
FIG. 13.5

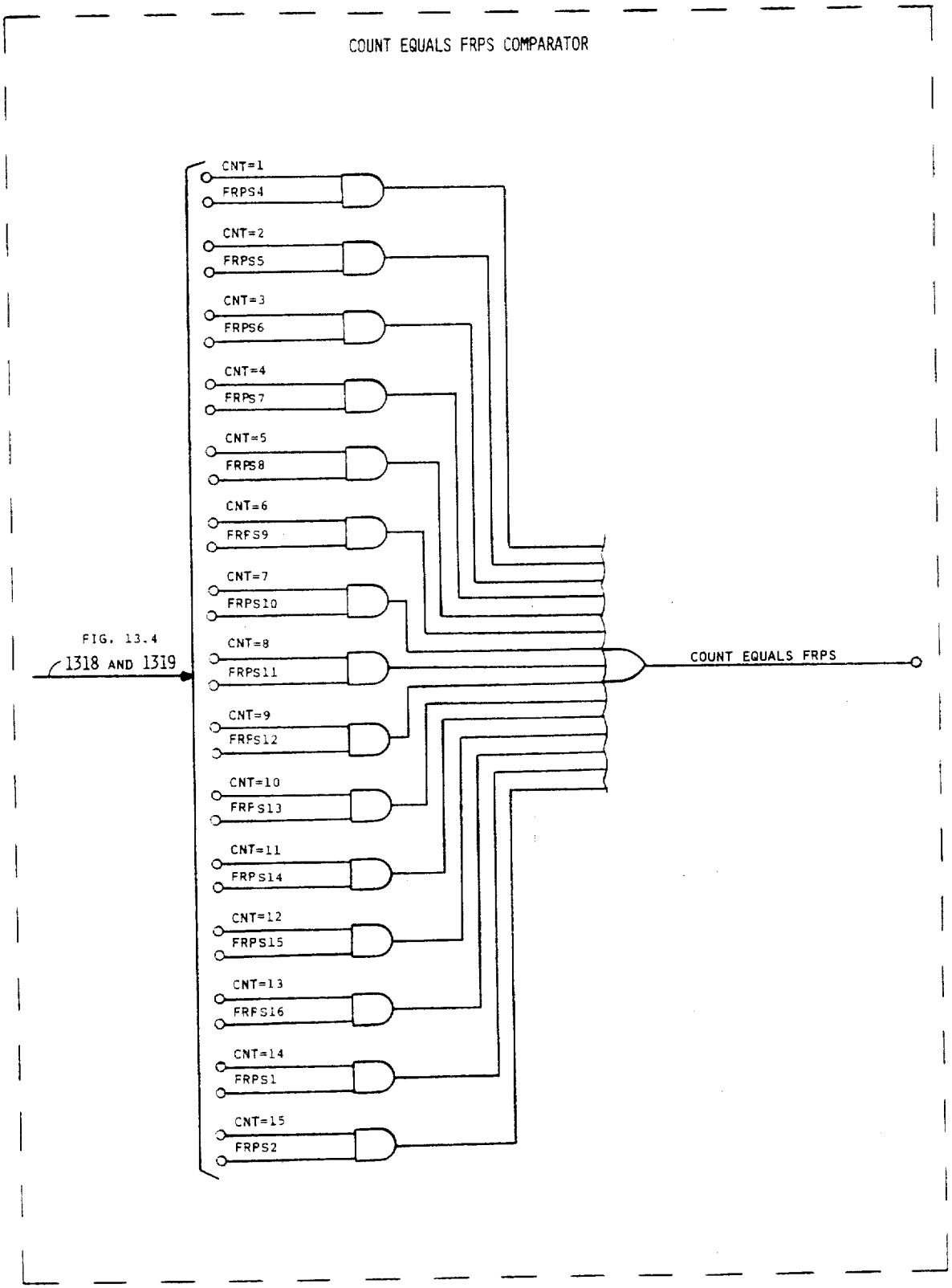
FIG. 13.6

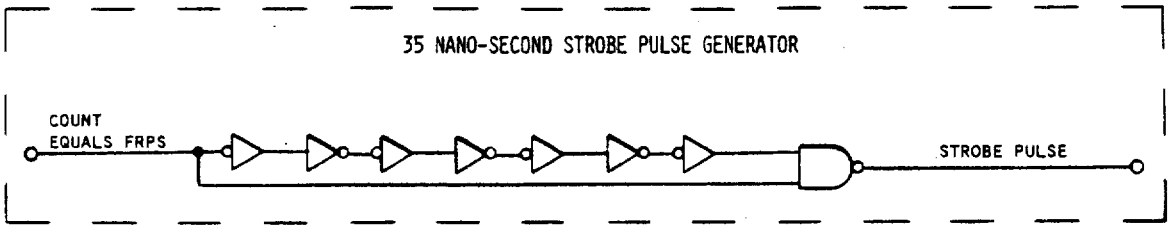
FIG.13.7
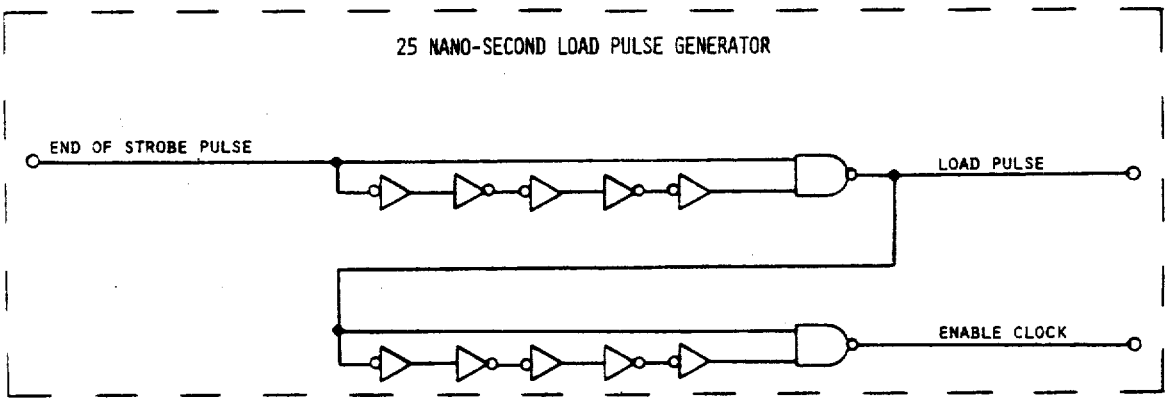
FIG.13.8
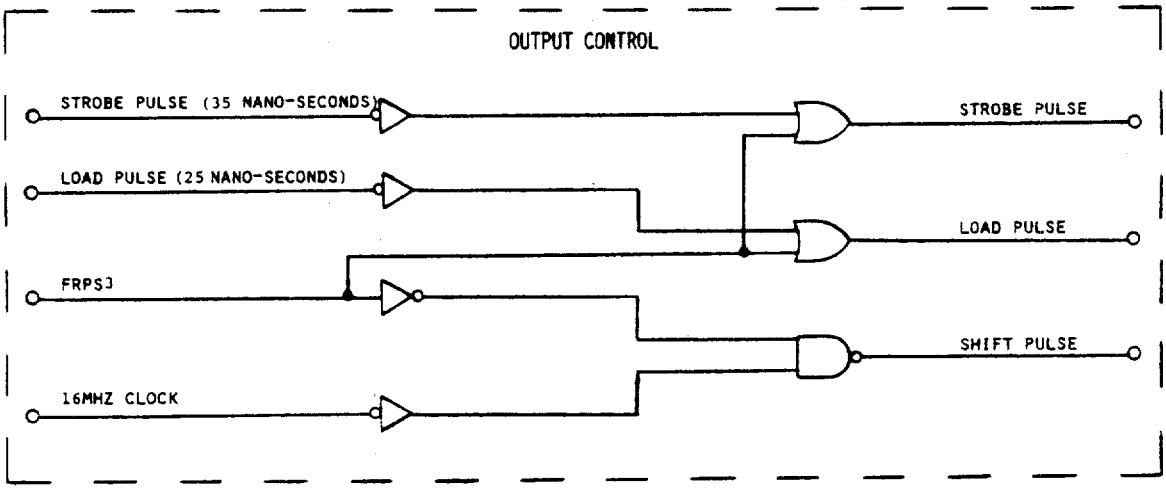
FIG.13.9

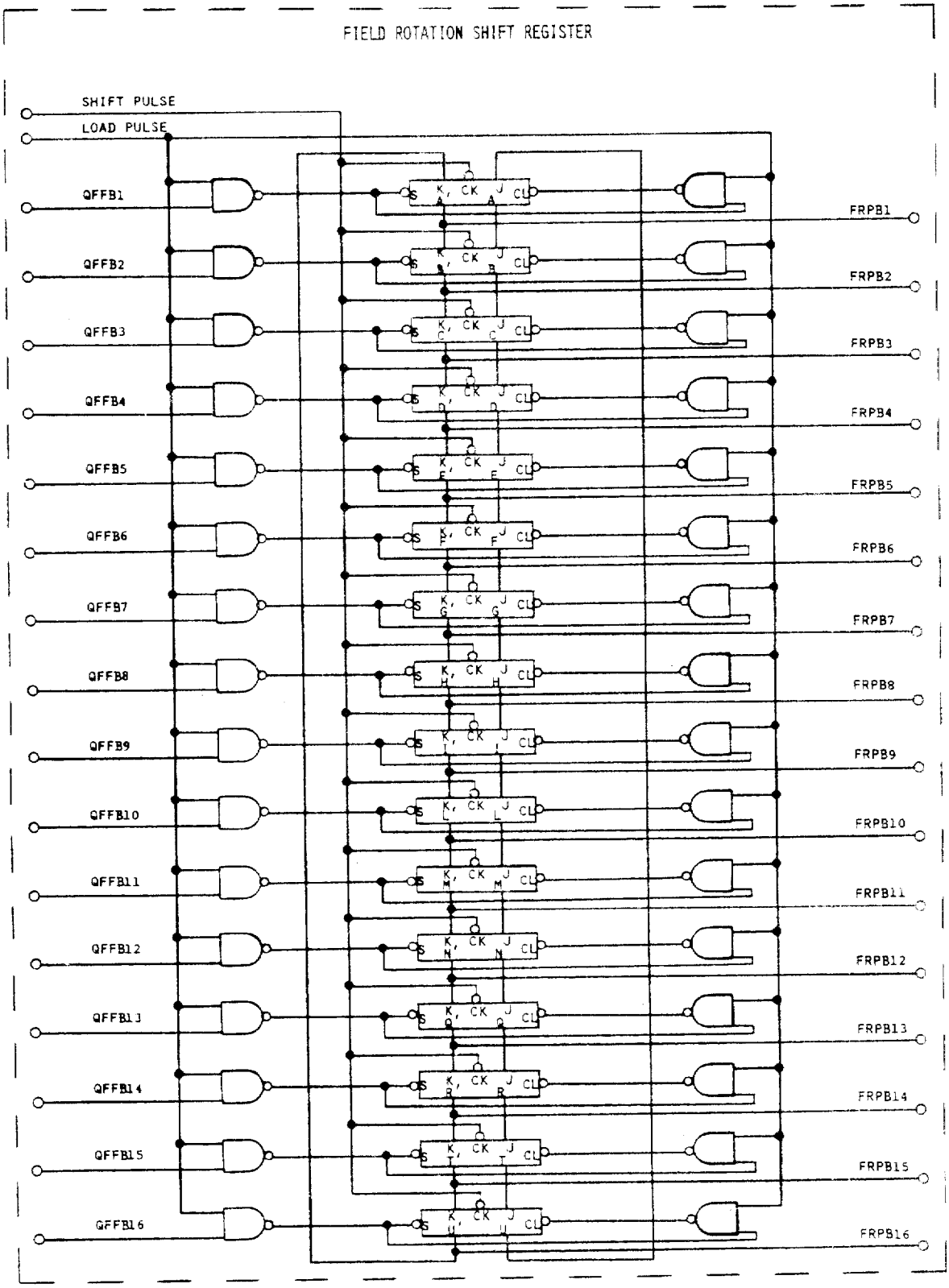
FIG.13.10

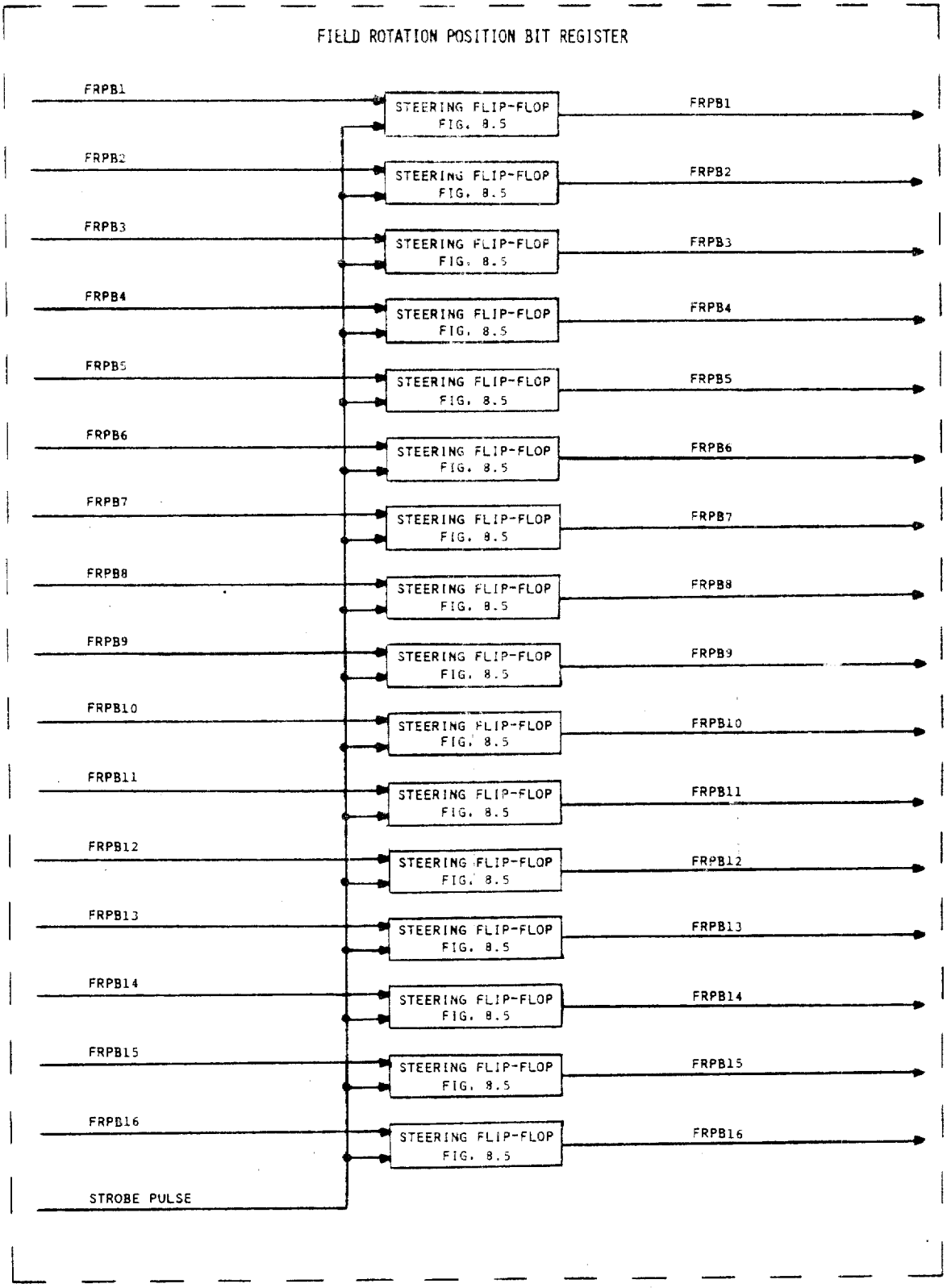
FIG. 13.11

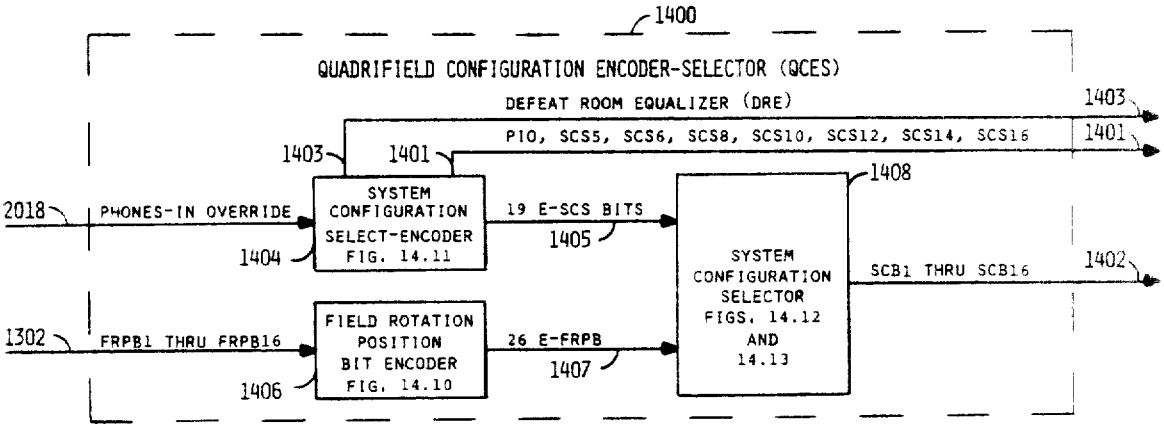

FIG.14.0

| TRANSDUCER LOCATION VERSUS SYSTEM CONFIG. BIT | SYSTEM CONFIGURATION SELECT | | | | | | | |
|---|---|---|---|---|---|---|---|---|
| | 4-CH | 5-CH | 6-CH | 8-CH | 10-CH | 12-CH | 14-CH | 16-CH |
| TL1:SCB1 | FRPB14+FRPB15+ FRPB16+FRPB1+ FRPB2+FRPB3+ FRPB4 | FRPB14+FRPB15+ FRPB16+FRPB1+ FRPB2 | FRPB14+FRPB15+ FRPB16+FRPB1+ FRPB2 | FRPB16+ FRPB1+ FRPB2 | FRPB1 + FRPB2 | FRPB1 + FRPB2 | FRPB1 | FRPB1 |
| TL2:SCB2 | NA | NA | NA | NA | NA | NA | FRPB2 | FRPB2 |
| TL3:SCB3 | NA | FRPB2+FRPB3 + FRPB4 | FRPB2+FRPB3 + FRPB4 | FRPB2+ FRPB3+ FRPB4 | FRPB2+ FRPB3+ FRPB4 | FRPB2+ FRPB3+ FRPB4 | FRPB3 | FRPB3 |
| TL4:SCB4 | NA | NA | NA | NA | NA | NA | FRPB4 | FRPB4 |
| TL5:SCB5 | FRPB2+FRPB3+ FRPB4+FRPB5+ FRPB6+FRPB7+ FRPB8 | FRPB4+FRPB5+ FRPB6+ FRPB7+FRPB8 | FRPB4 + FRPB5+ FRPB6+ FRPB7+FRPB8 | FRPB4+ FRPB5+ FRPB6 | FRPB4 + FRPB5 | FRPB4 + FRPB5 | FRPB5 | FRPB5 |
| TL6:SCB6 | NA | NA | NA | NA | FRPB6 | FRPB6 | FRPB6 | FRPB6 |
| TL7:SCB7 | NA | NA | NA | FRPB6+ FRPB7+ FRPB8 | FRPB7 + FRPB8 | FRPB7 | FRPB7 | FRPB7 |
| TL8:SCB8 | NA | NA | NA | NA | NA | FRPB8 | FRPB8 | FRPB8 |
| TL9:SCB9 | FRPB6+FRPB7+ FRPB8+FRPB9+ FRPB10+FRPB11+ FRPB12 | FRPB6+FRPB7+ FRPB8+FRPB9+ FRPB10+FRPB11+ FRPB12 | FRPB6+FRPB7+ FRPB8+FRPB9+ FRPB10 | FRPB8+ FRPB9+ FRPB10 | FRPB8+ FRPB9+ FRPB10 | FRPB9 + FRPB10 | FRPB9 + FRPB10 | FRPB9 |
| TL10:SCB10 | NA | NA | NA | NA | NA | NA | NA | FRPB10 |
| TL11:SCB11 | NA | NA | FRPB10+FRPB11 + FRPB12 | FRPB10+ FRPB11+ FRPB12 | FRPB10+ FRPB11+ FRPB12 | FRPB10+ FRPB11+ FRPB12 | FRPB10+ FRPB11+ FRPB12 | FRPB11 |
| TL12:SCB12 | NA | NA | NA | NA | NA | NA | NA | FRPB12 |
| TL13:SCB13 | FRPB10+FRPB11+ FRPB12+FRPB13+ FRPB14+FRPB15+ FRPB16 | FRPB10+FRPB11+ FRPB12+FRPB13+ FRPB14+FRPB15+ FRPB16 | FRPB11+FRPB12+ FRPB13+FRPB14+ FRPB15+FRPB16 | FRPB12+ FRPB13+ FRPB14 | FRPB12+ FRPB13+ FRPB14 | FRPB12 + FRPB13 | FRPB12 + FRPB13 | FRPB13 |
| TL14:SCB14 | NA | NA | NA | NA | NA | FRPB14 | FRPB14 | FRPB14 |
| TL15:SCB15 | NA | NA | NA | FRPB14+ FRPB15+ FRPB16 | FRPB14 + FRPB15 | FRPB15 | FRPB15 | FRPB15 |
| TL16:SCB16 | NA | NA | NA | NA | FRPB16 | FRPB16 | FRPB16 | FRPB16 |

FIG.14.1

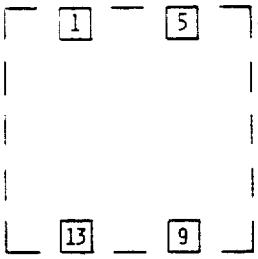
FIG.14.2
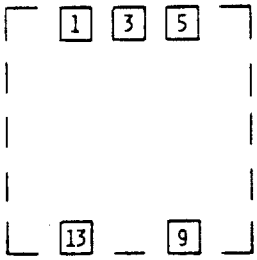
FIG.14.3
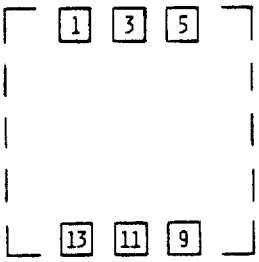
FIG.14.4
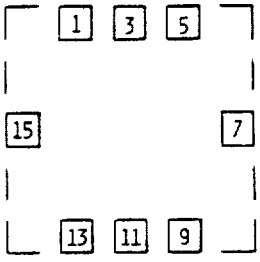
FIG.14.5
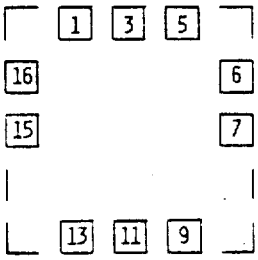
FIG.14.6
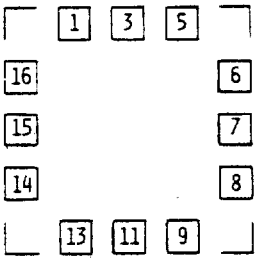
FIG.14.7
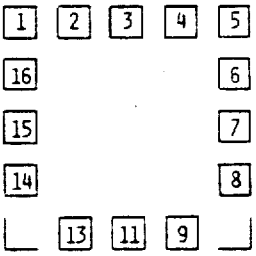
FIG.14.8
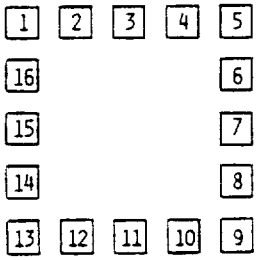
FIG.14.9
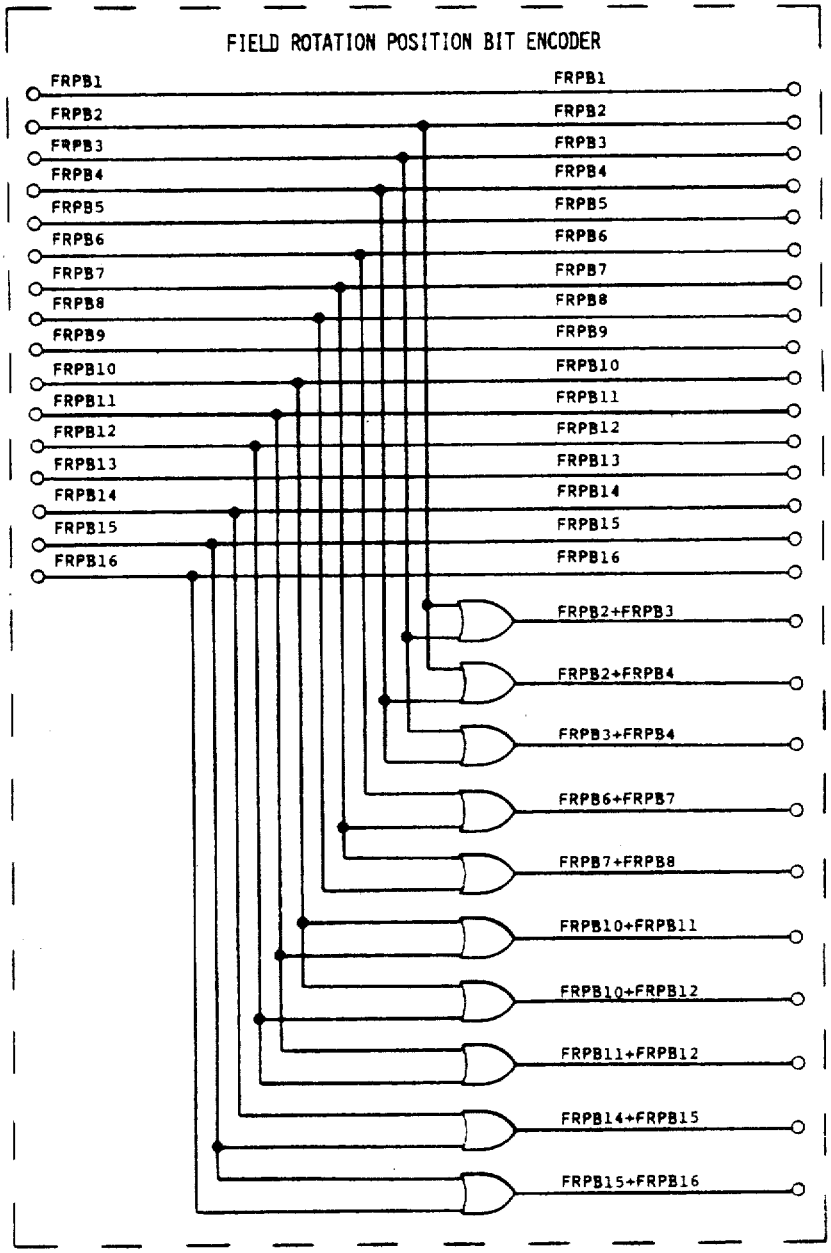
FIG.14.10

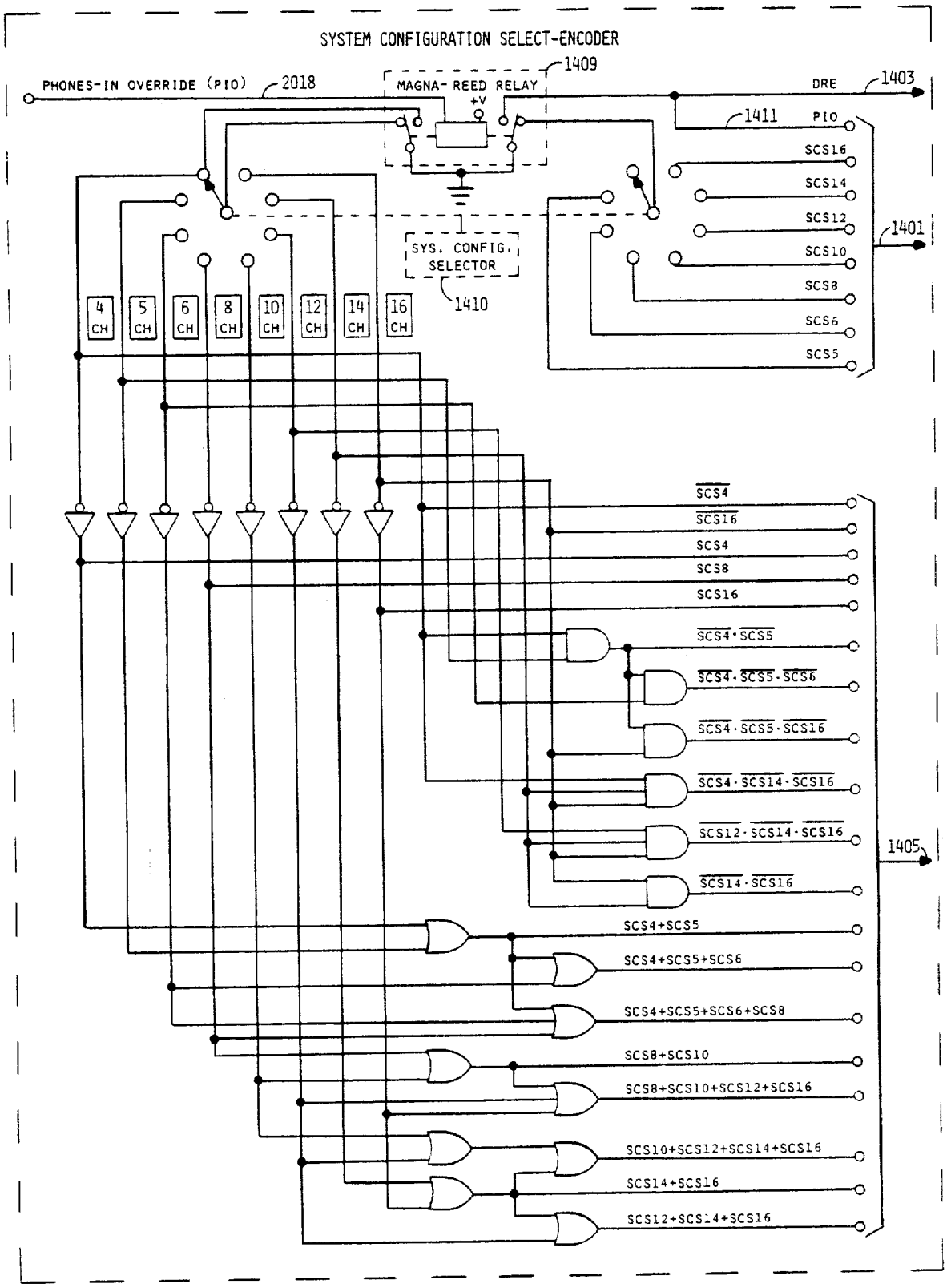
FIG. 14.11

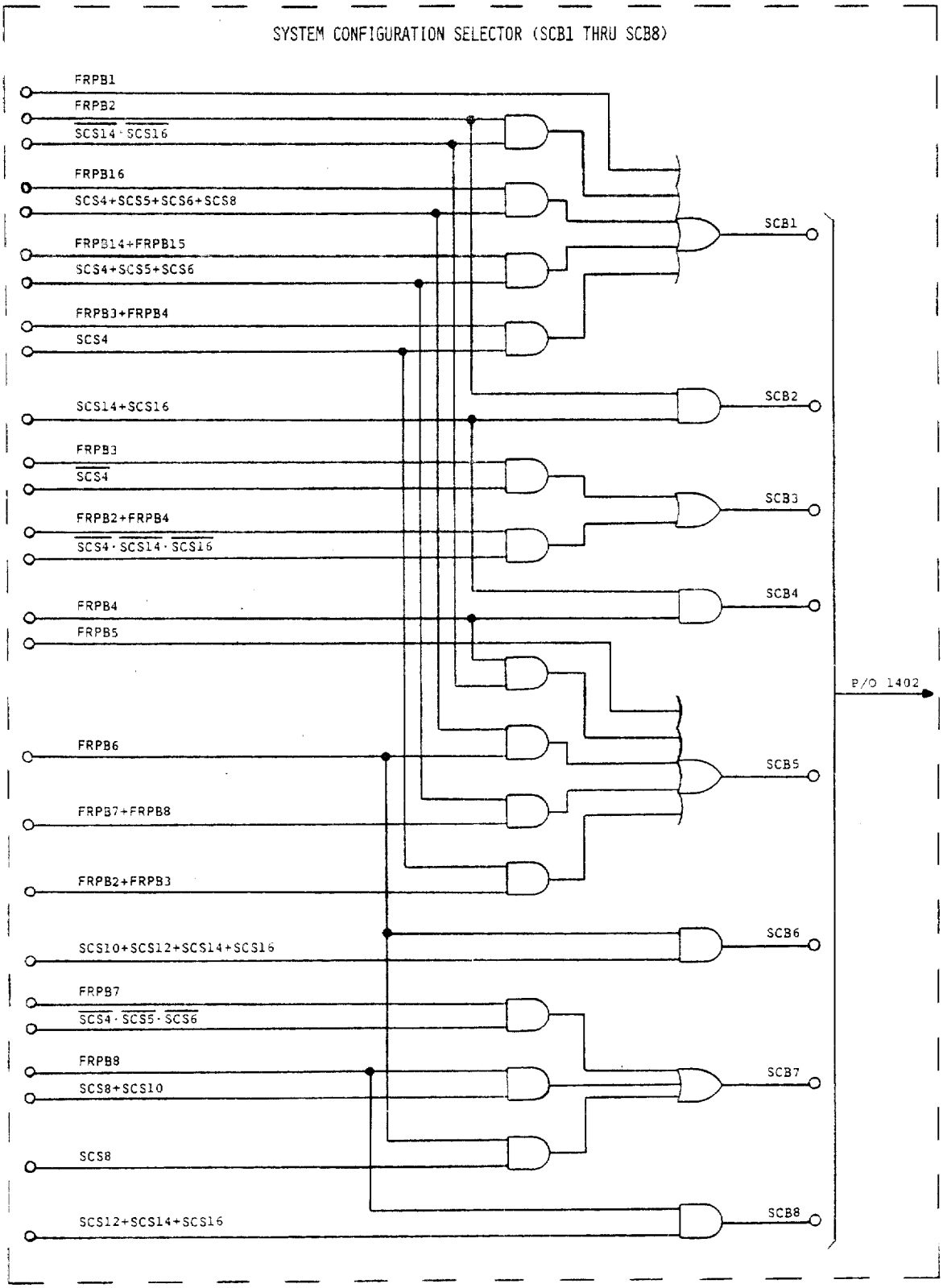
FIG. 14.12

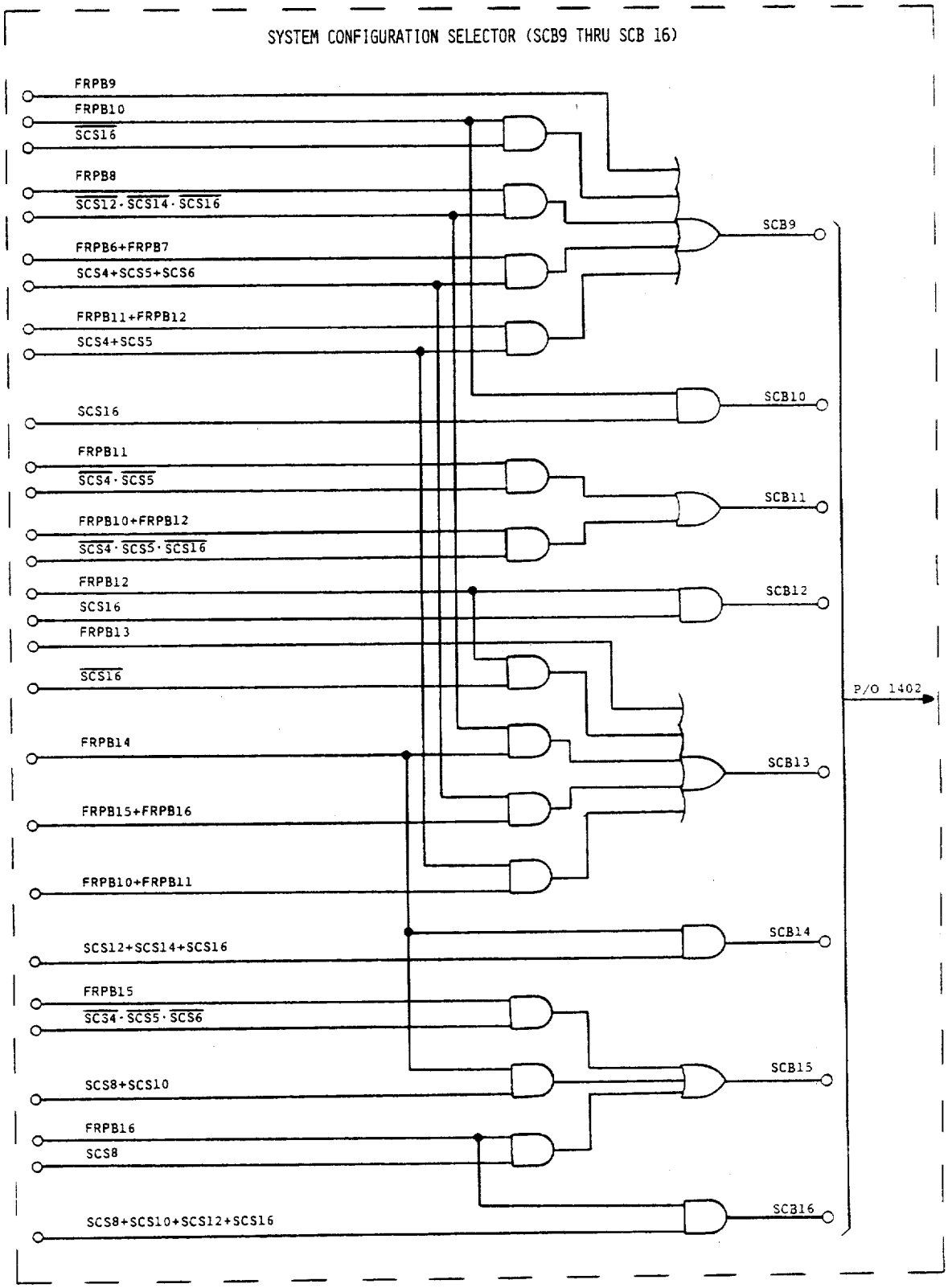
FIG. 14.13

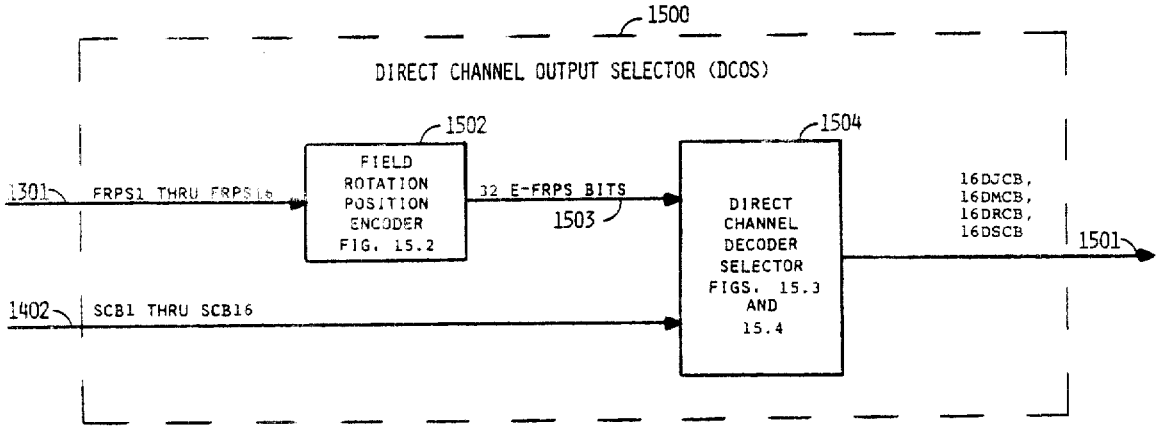

FIG. 15.0

| FIELD ROTATION POSITION SELECTS (FRPS) | DIRECT AUDIO OUTPUT CHANNELS | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| 1 | J | M | M | M | M | R | R | R | S | S | S | S | J | J | J | J |
| 2 | J | J | M | M | M | M | R | R | R | S | S | S | S | J | J | J |
| 3 | J | J | J | M | M | M | M | R | R | R | S | S | S | S | J | J |
| 4 | J | J | J | J | M | M | M | M | R | R | R | S | S | S | S | J |
| 5 | J | J | J | J | J | M | M | M | M | R | R | R | S | S | S | S |
| 6 | S | J | J | J | J | J | M | M | M | M | R | R | R | S | S | S |
| 7 | S | S | J | J | J | J | J | M | M | M | M | R | R | R | S | S |
| 8 | S | S | S | J | J | J | J | J | M | M | M | M | R | R | R | S |
| 9 | S | S | S | S | J | J | J | J | J | M | M | M | M | R | R | R |
| 10 | R | S | S | S | S | J | J | J | J | J | M | M | M | M | R | R |
| 11 | R | R | S | S | S | S | J | J | J | J | J | M | M | M | M | R |
| 12 | R | R | R | S | S | S | S | J | J | J | J | J | M | M | M | M |
| 13 | M | R | R | R | S | S | S | S | J | J | J | J | J | M | M | M |
| 14 | M | M | R | R | R | S | S | S | S | J | J | J | J | J | M | M |
| 15 | M | M | M | R | R | R | S | S | S | S | J | J | J | J | J | M |
| 16 | M | M | M | M | R | R | R | S | S | S | S | J | J | J | J | J |

FIG. 15.1

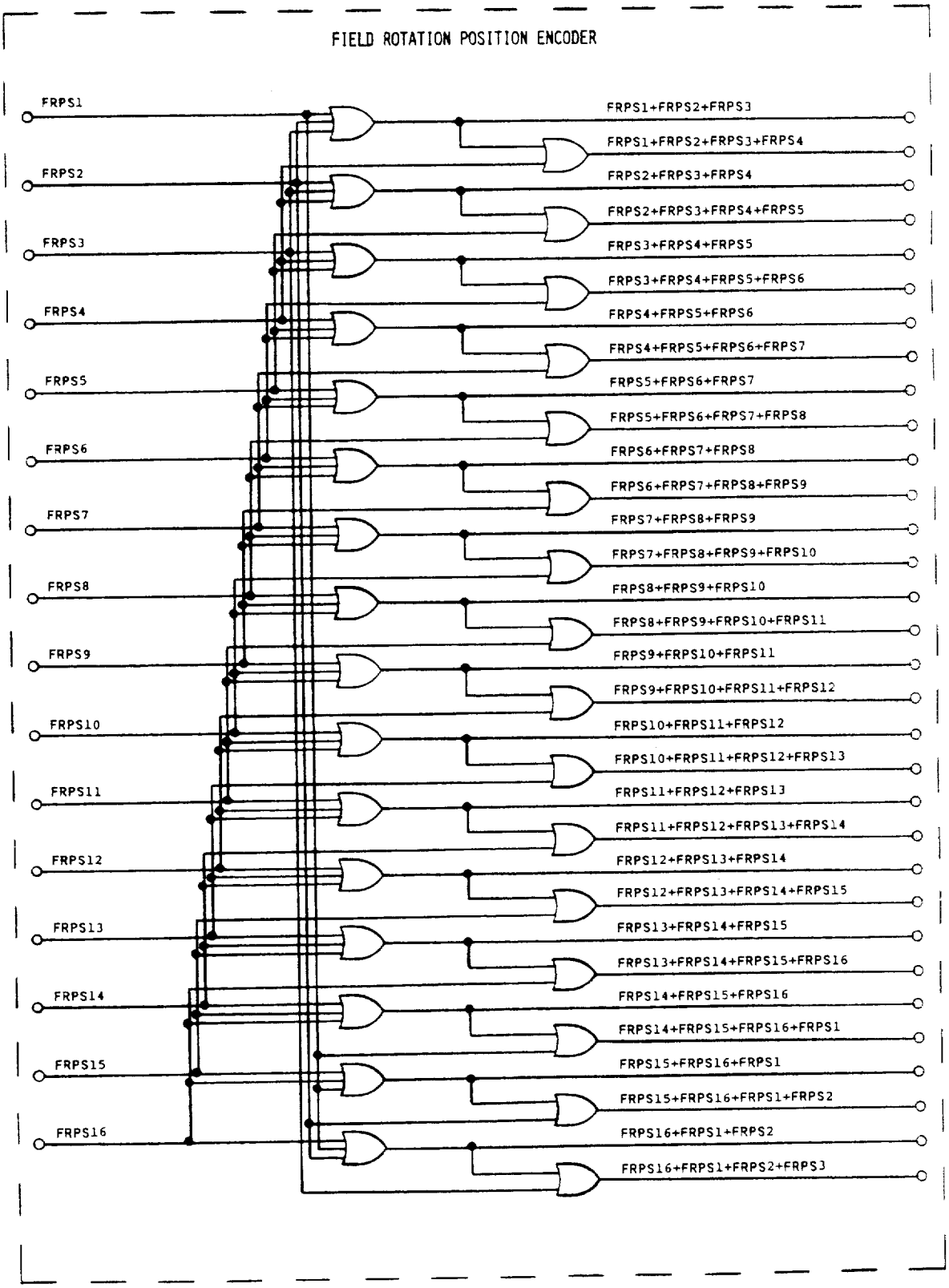
FIG. 15.2

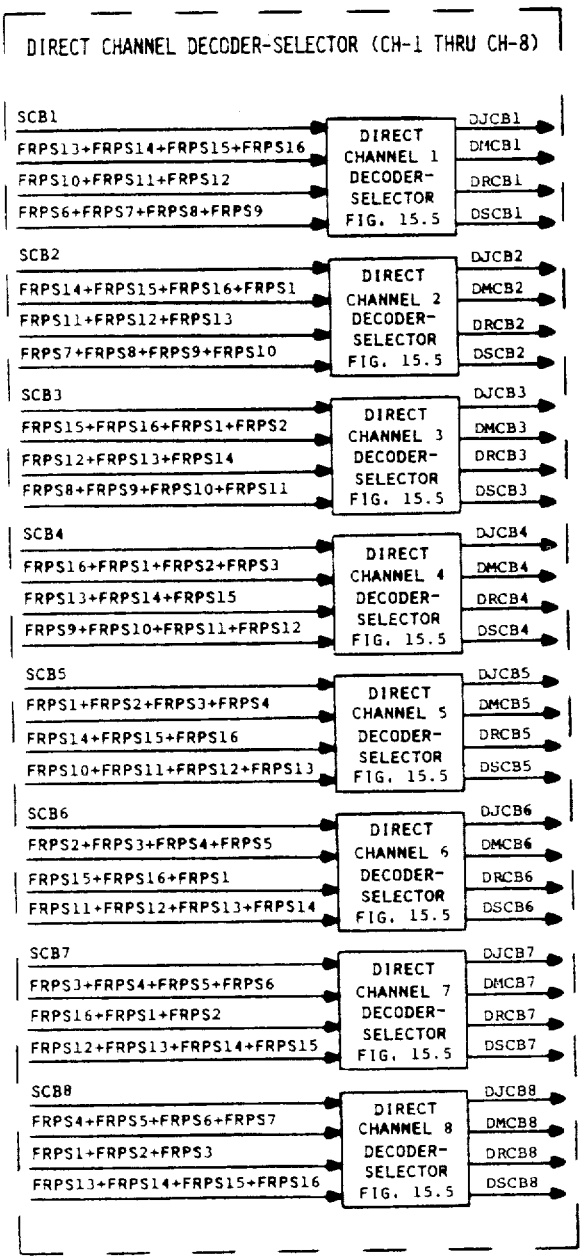
FIG. 15.3
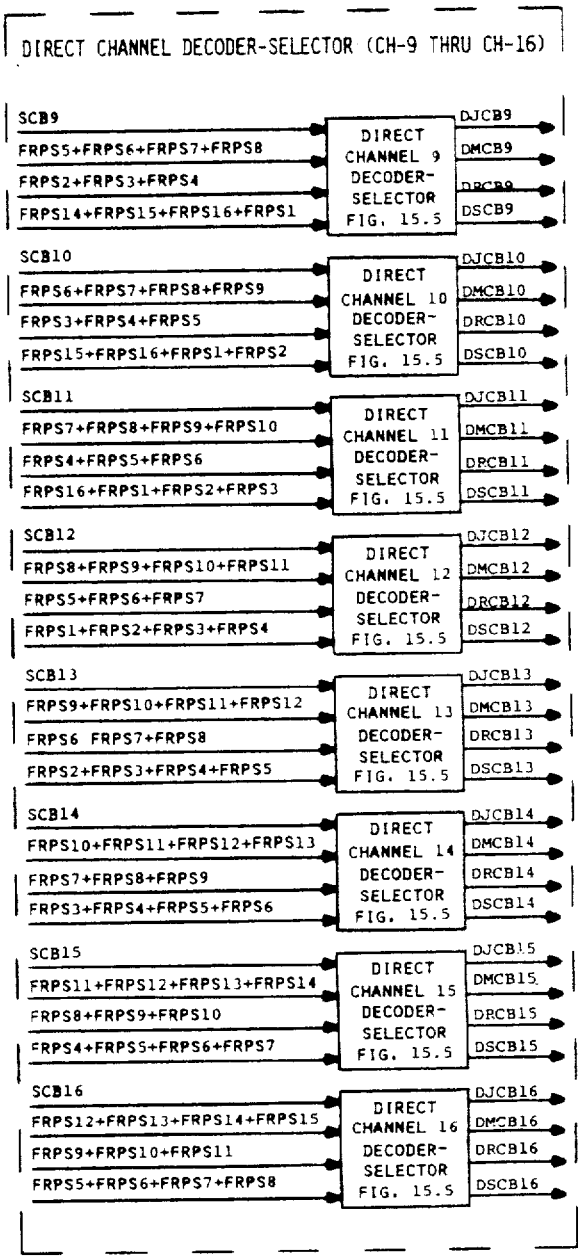
FIG. 15.4
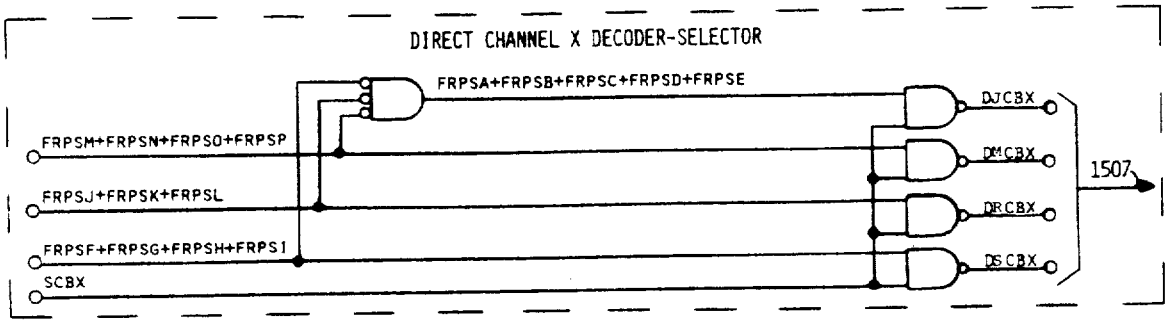
FIG. 15.5

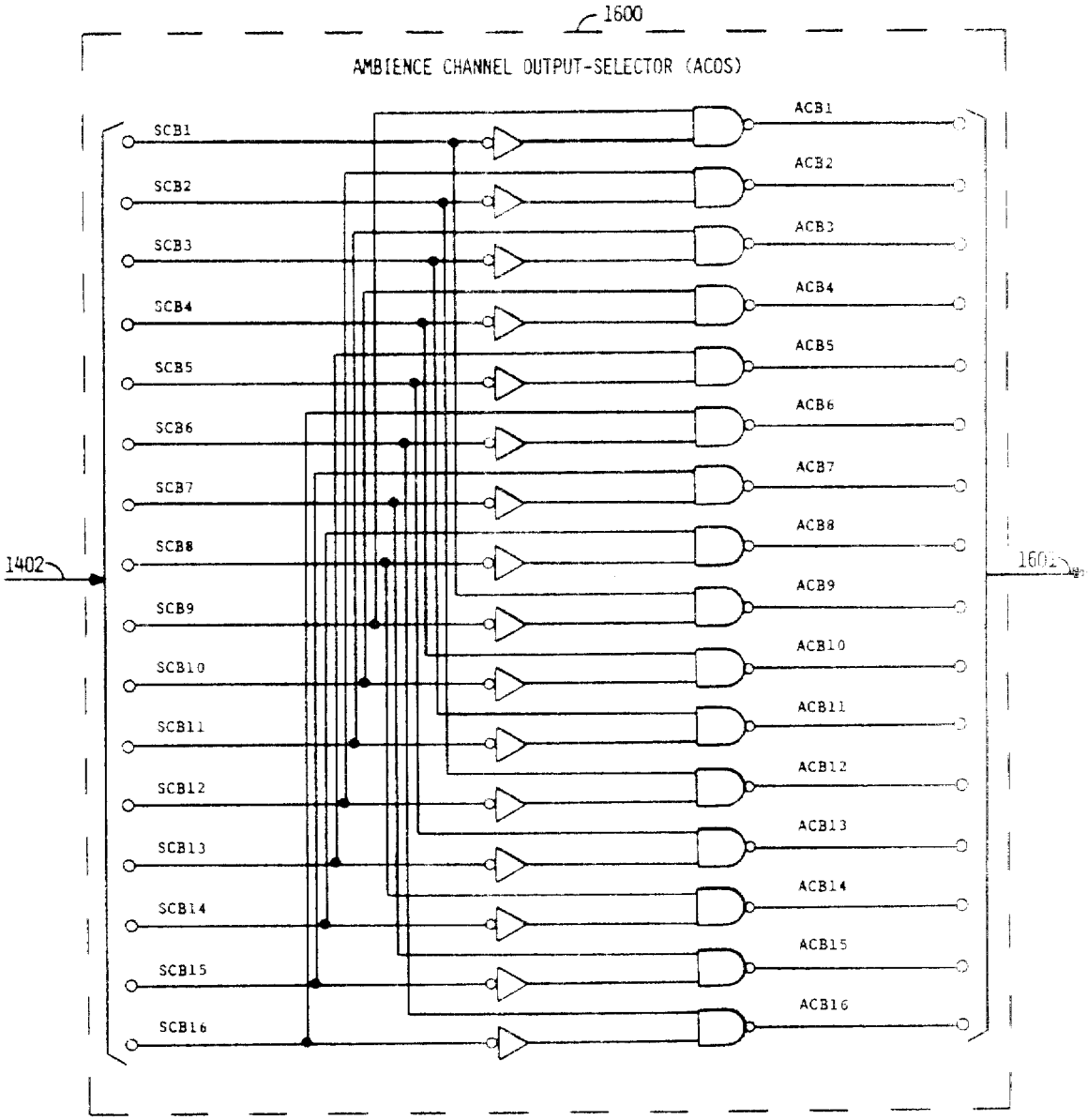

FIG. 16.0

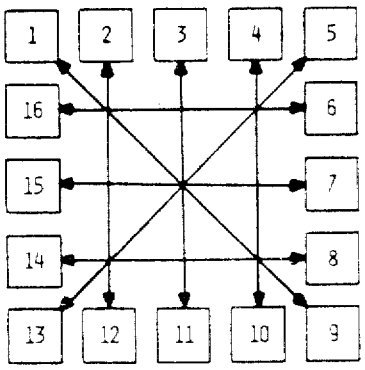

FIG. 16.1

TL01: ACB1 = $\overline{SCB1}\cdot SCB9$ ; $\overline{ACB1}$ = (SCB1·SCB9) +(SCB1·$\overline{SCB9}$) +($\overline{SCB1}$·SCB9)
TL02: ACB2 = $\overline{SCB2}\cdot SCB12$; $\overline{ACB2}$ = (SCB2·SCB12)+(SCB2·$\overline{SCB12}$)+($\overline{SCB2}$·SCB12)
TL03: ACB3 = $\overline{SCB3}\cdot SCB11$; $\overline{ACB3}$ = (SCB3·SCB11)+(SCB3·$\overline{SCB11}$)+($\overline{SCB3}$·SCB11)
TL04: ACB4 = $\overline{SCB4}\cdot SCB10$; $\overline{ACB4}$ = (SCB4·SCB10)+(SCB4·$\overline{SCB10}$)+($\overline{SCB4}$·SCB10)
TL05: ACB5 = $\overline{SCB5}\cdot SCB13$; $\overline{ACB5}$ = (SCB5·SCB13)+(SCB5·$\overline{SCB13}$)+($\overline{SCB5}$·SCB13)
TL06: ACB6 = $\overline{SCB6}\cdot SCB16$; $\overline{ACB6}$ = (SCB6·SCB16)+(SCB6·$\overline{SCB16}$)+($\overline{SCB6}$·SCB16)
TL07: ACB7 = $\overline{SCB7}\cdot SCB15$; $\overline{ACB7}$ = (SCB7·SCB15)+(SCB7·$\overline{SCB15}$)+($\overline{SCB7}$·SCB15)
TL08: ACB8 = $\overline{SCB8}\cdot SCB14$; $\overline{ACB8}$ = (SCB8·SCB14)+(SCB8·$\overline{SCB14}$)+($\overline{SCB8}$·SCB14)
TL09: ACB9 = $\overline{SCB9}\cdot SCB1$ ; $\overline{ACB9}$ = (SCB9·SCB1) +(SCB9·$\overline{SCB1}$) +($\overline{SCB9}$·SCB1)
TL10: ACB10= $\overline{SCB10}\cdot SCB4$; $\overline{ACB10}$= (SCB10·SCB4)+(SCB10·$\overline{SCB4}$)+($\overline{SCB10}$·SCB4)
TL11: ACB11= $\overline{SCB11}\cdot SCB3$; $\overline{ACB11}$= (SCB11·SCB3)+(SCB11·$\overline{SCB3}$)+($\overline{SCB11}$·SCB3)
TL12: ACB12= $\overline{SCB12}\cdot SCB2$; $\overline{ACB12}$= (SCB12·SCB2)+(SCB12·$\overline{SCB2}$)+($\overline{SCB12}$·SCB2)
TL13: ACB13= $\overline{SCB13}\cdot SCB5$; $\overline{ACB13}$= (SCB13·SCB5)+(SCB13·$\overline{SCB5}$)+($\overline{SCB13}$·SCB5)
TL14: ACB14= $\overline{SCB14}\cdot SCB8$; $\overline{ACB14}$= (SCB14·SCB8)+(SCB14·$\overline{SCB8}$)+($\overline{SCB14}$·SCB8)
TL15: ACB15= $\overline{SCB15}\cdot SCB7$; $\overline{ACB15}$= (SCB15·SCB7)+(SCB15·$\overline{SCB7}$)+($\overline{SCB15}$·SCB7)
TL16: ACB16= $\overline{SCB16}\cdot SCB6$; $\overline{ACB16}$= (SCB16·SCB6)+(SCB16·$\overline{SCB6}$)+($\overline{SCB16}$·SCB6)

FIG. 16.2

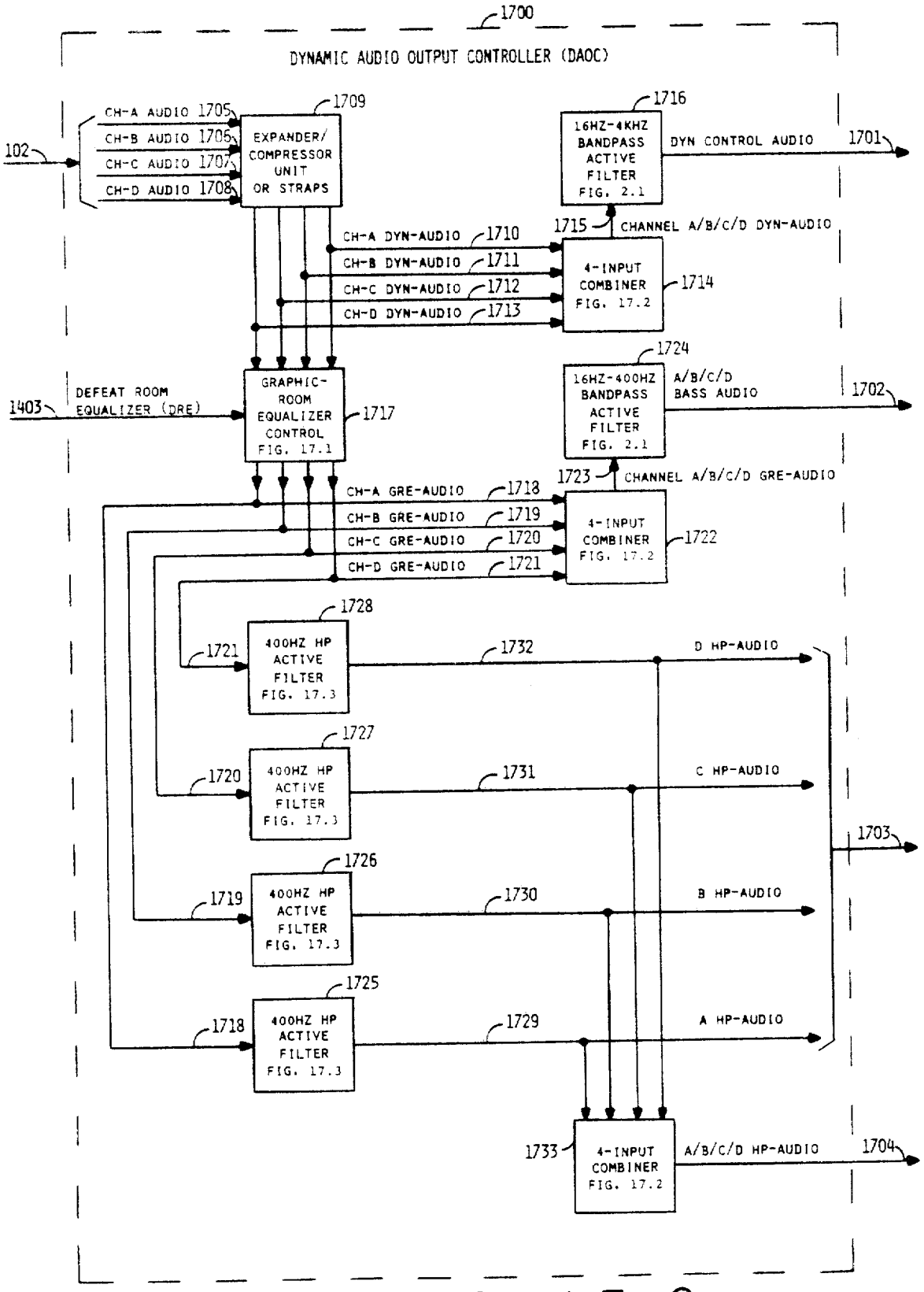
FIG. 17.0

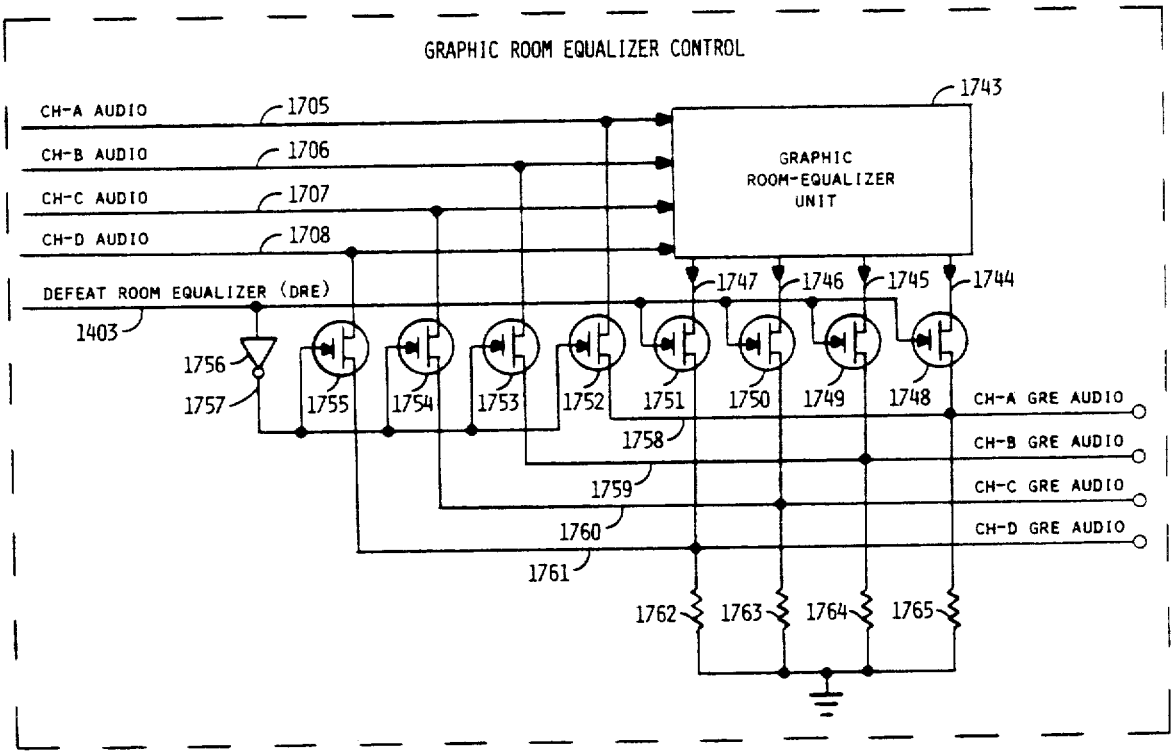
FIG. 17.1
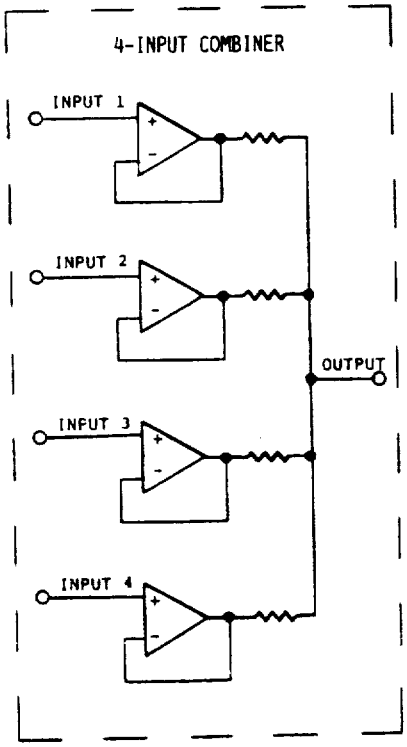
FIG. 17.2
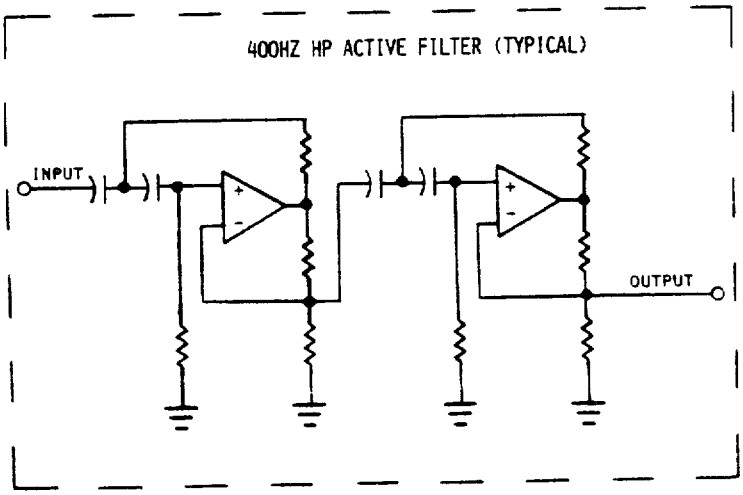
FIG. 17.3

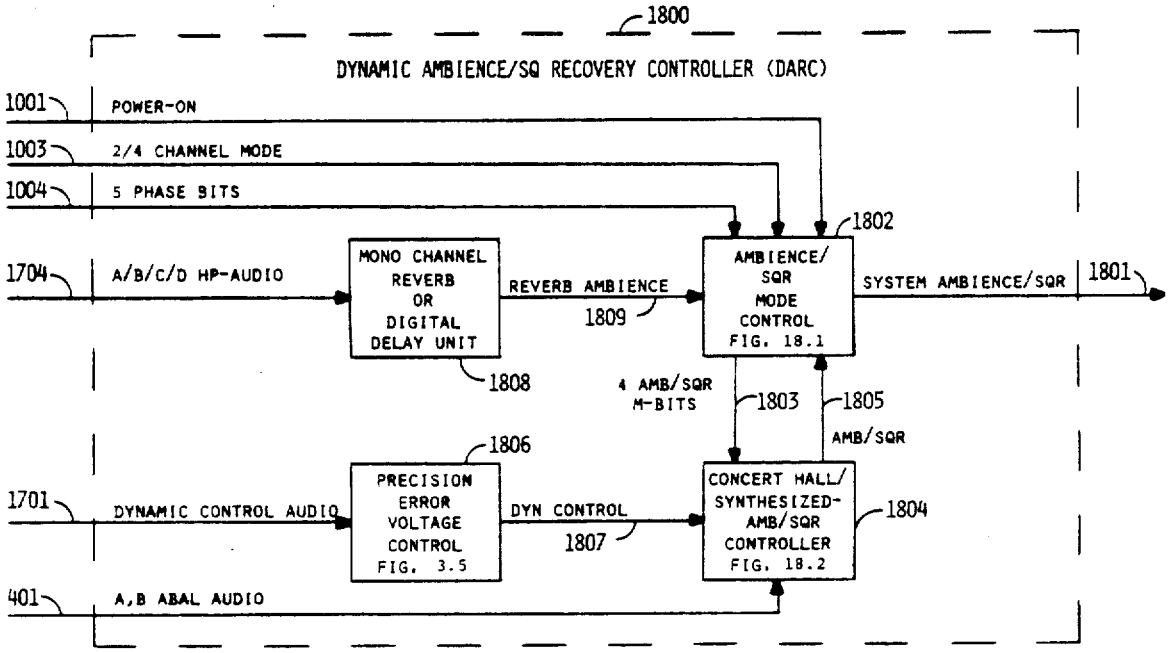
FIG. 18.0
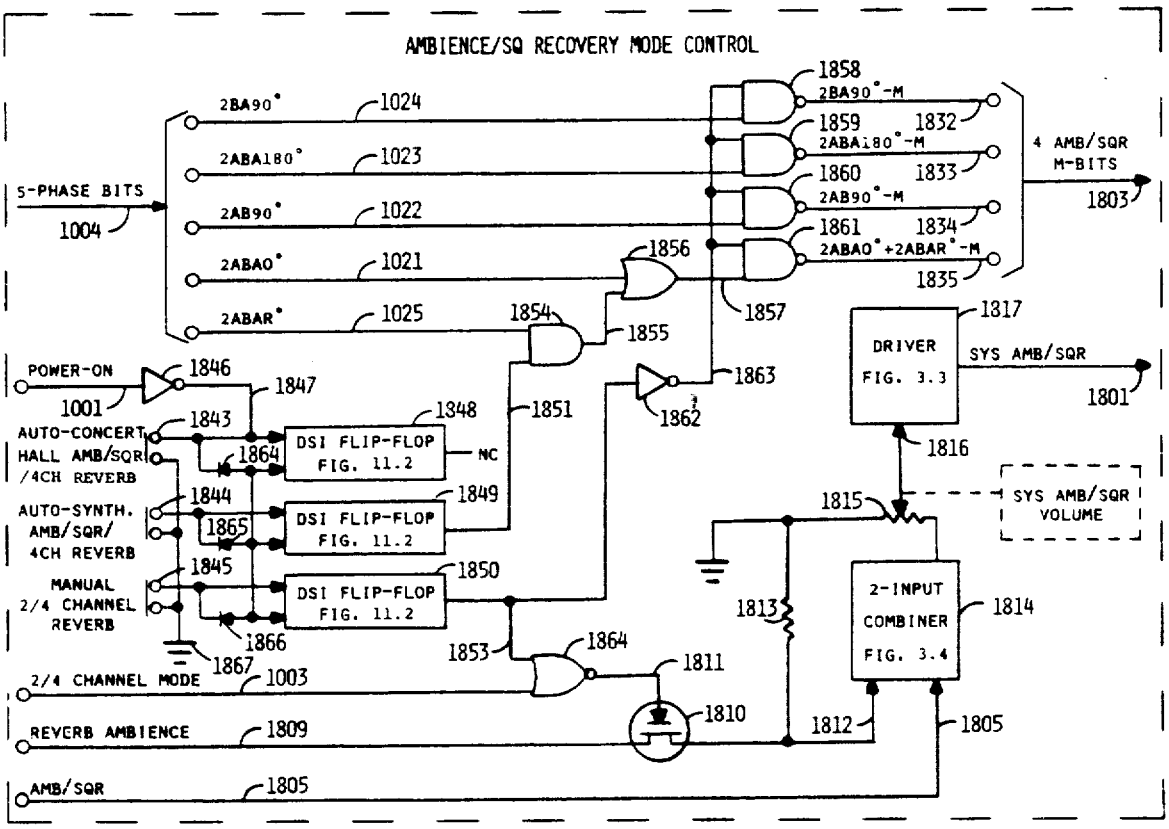
FIG. 18.1

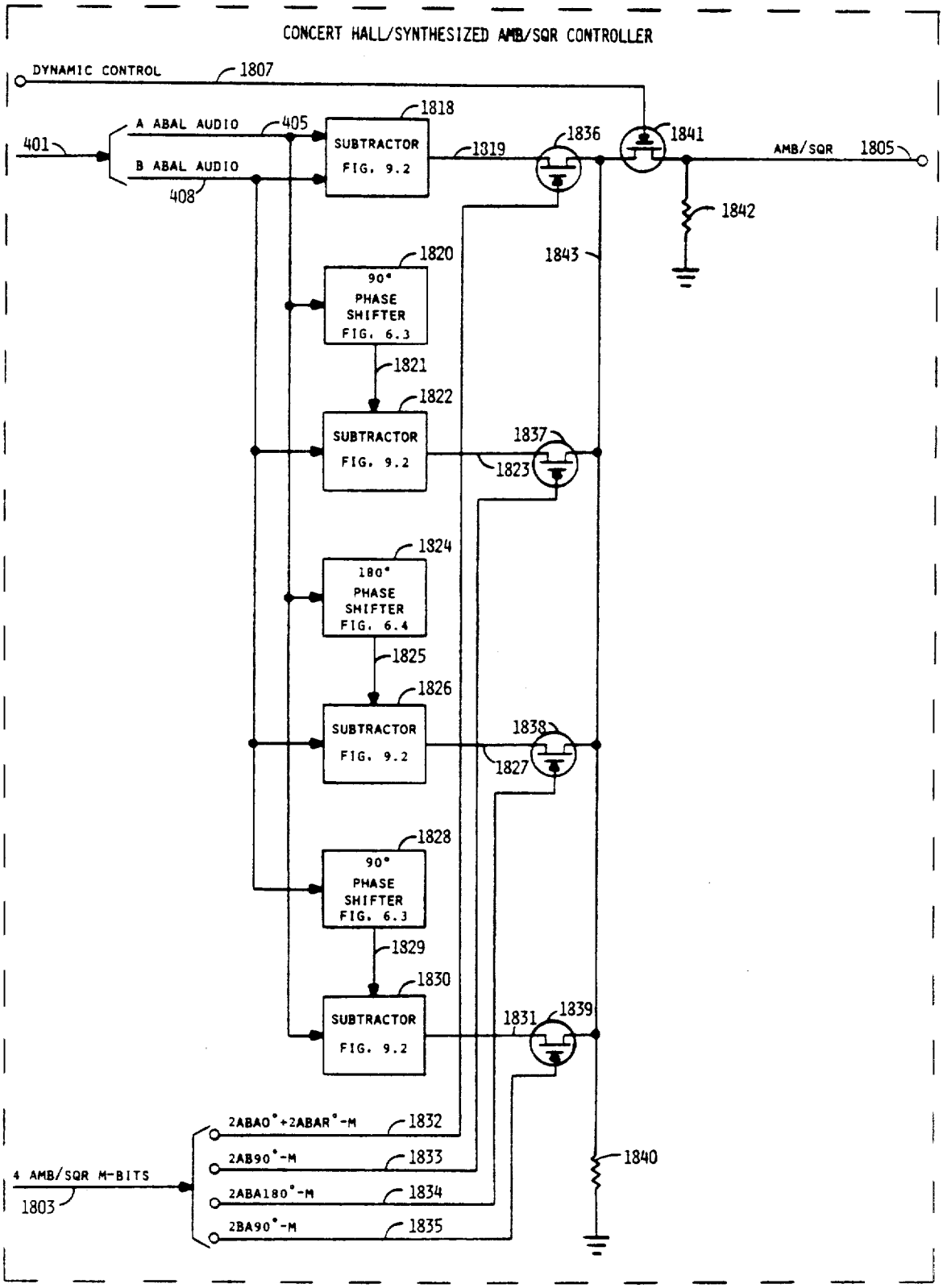
FIG. 18.2

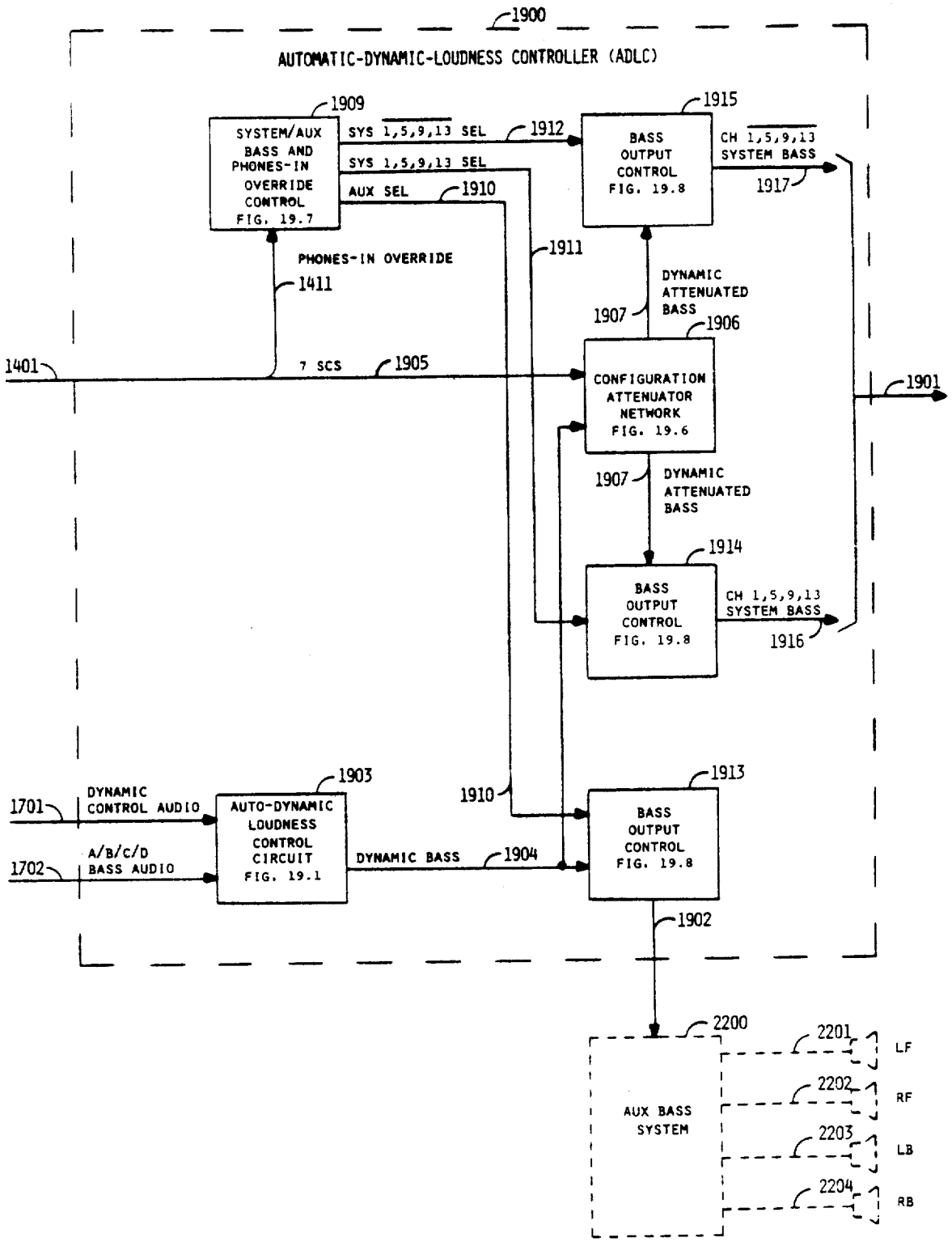
FIG. 19.0

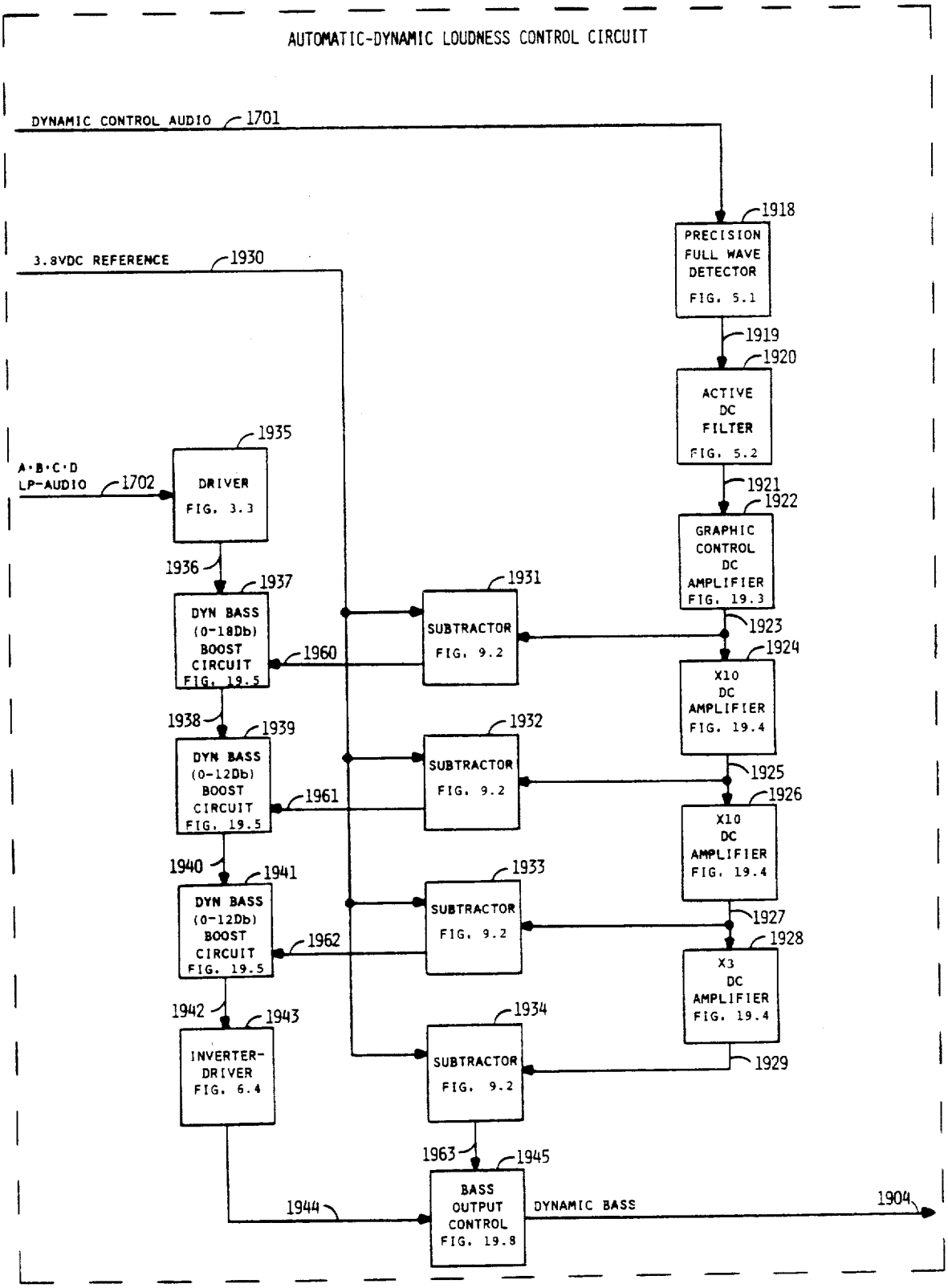
FIG. 19.1

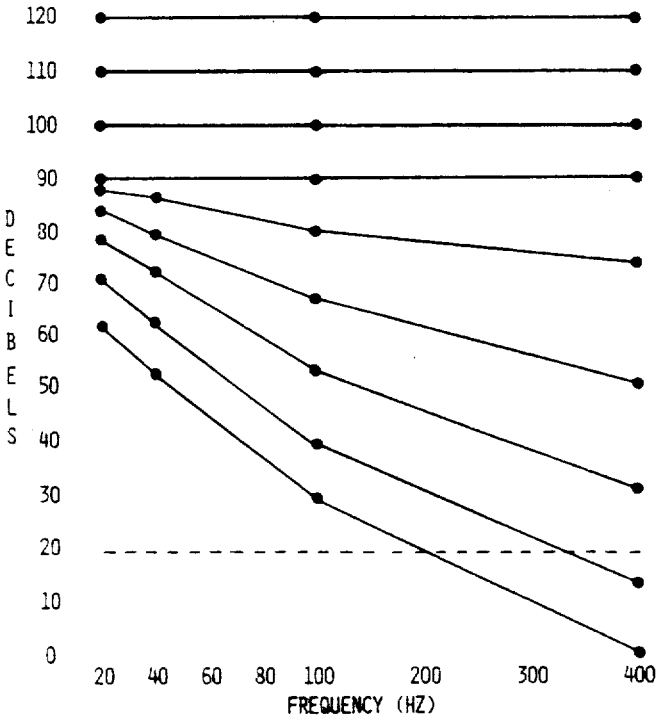
FIG. 19.2
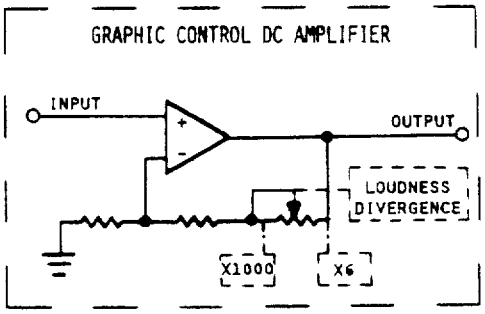
FIG. 19.3
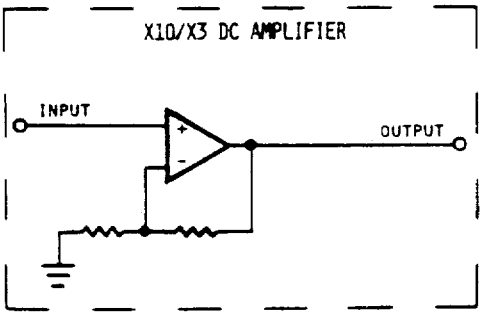
FIG. 19.4
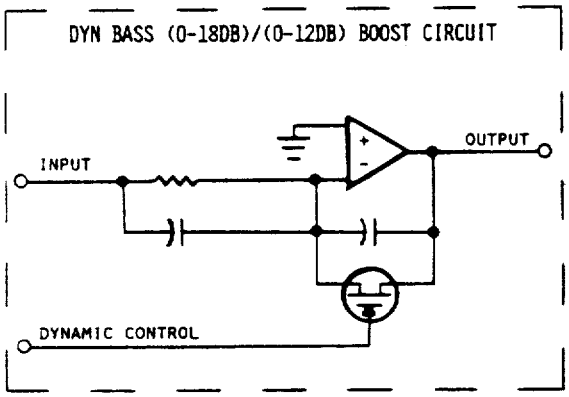
FIG. 19.5
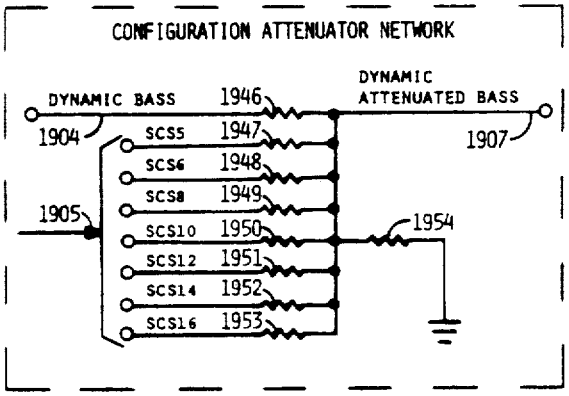
FIG. 19.6
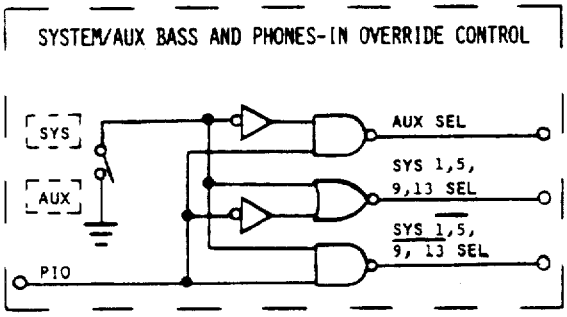
FIG. 19.7
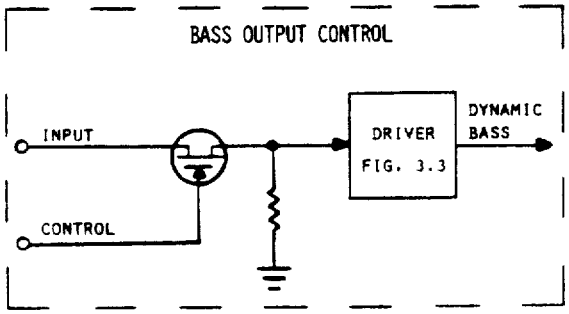
FIG. 19.8

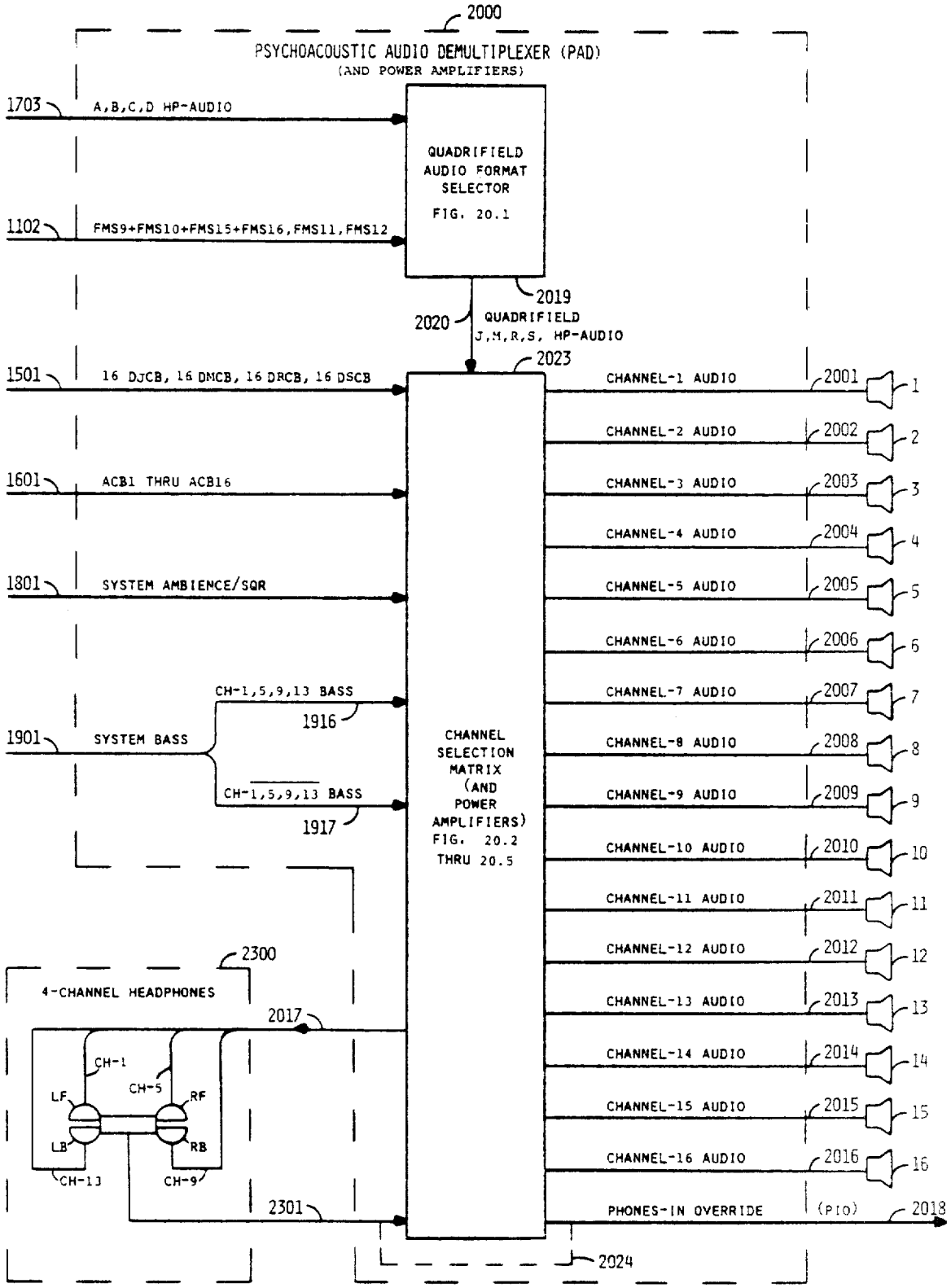
FIG. 20.0

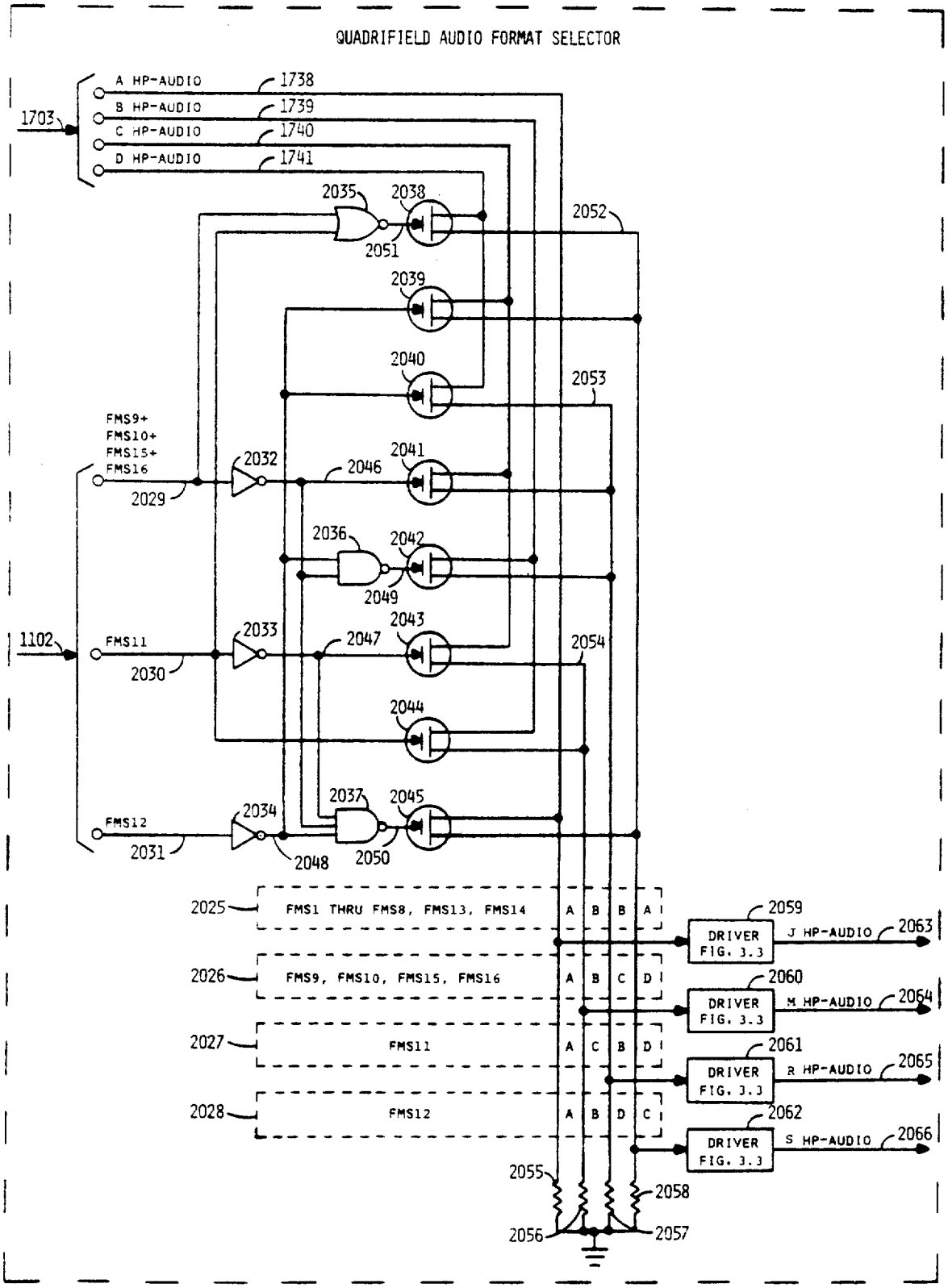
FIG. 20.1

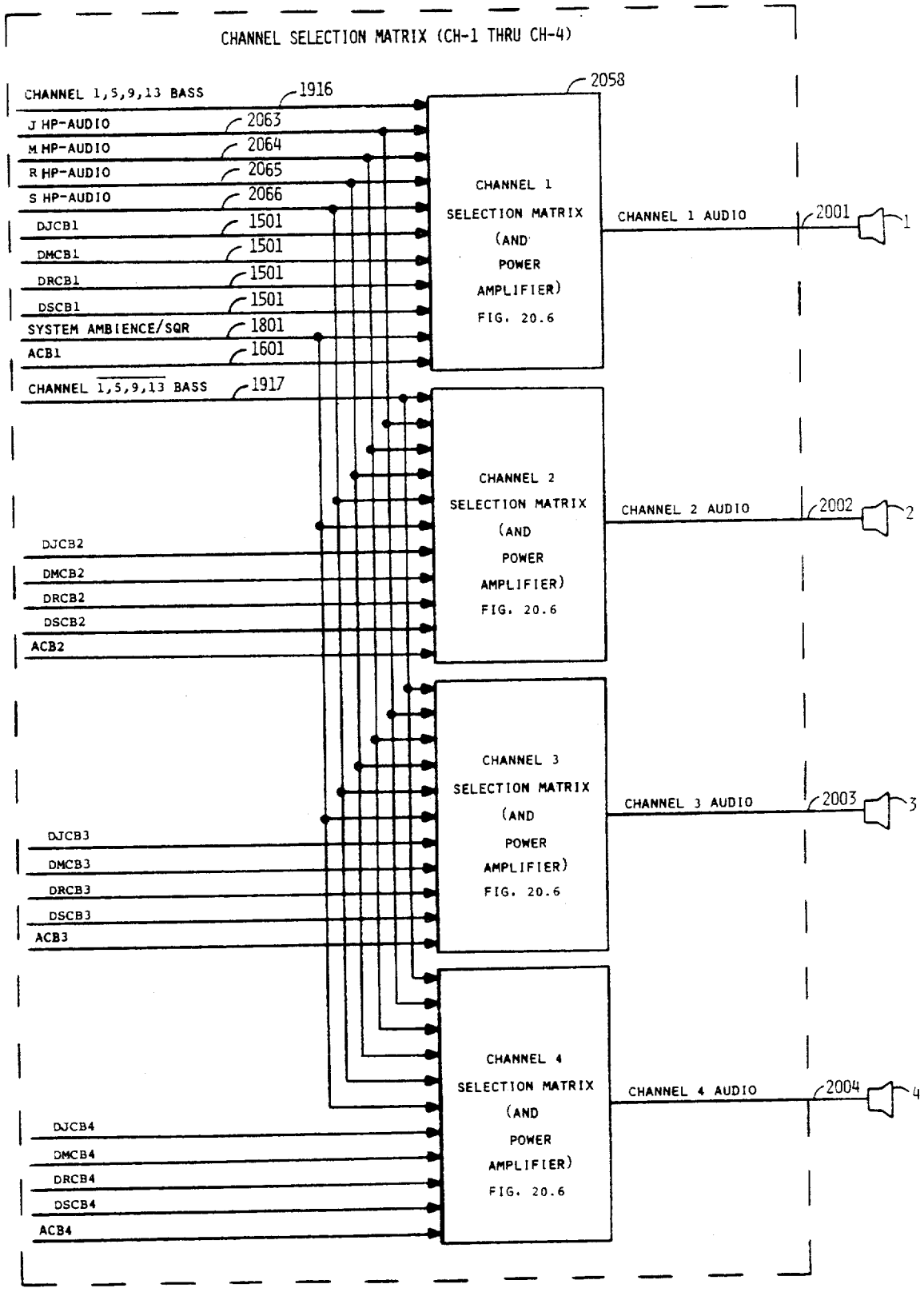
FIG. 20.2

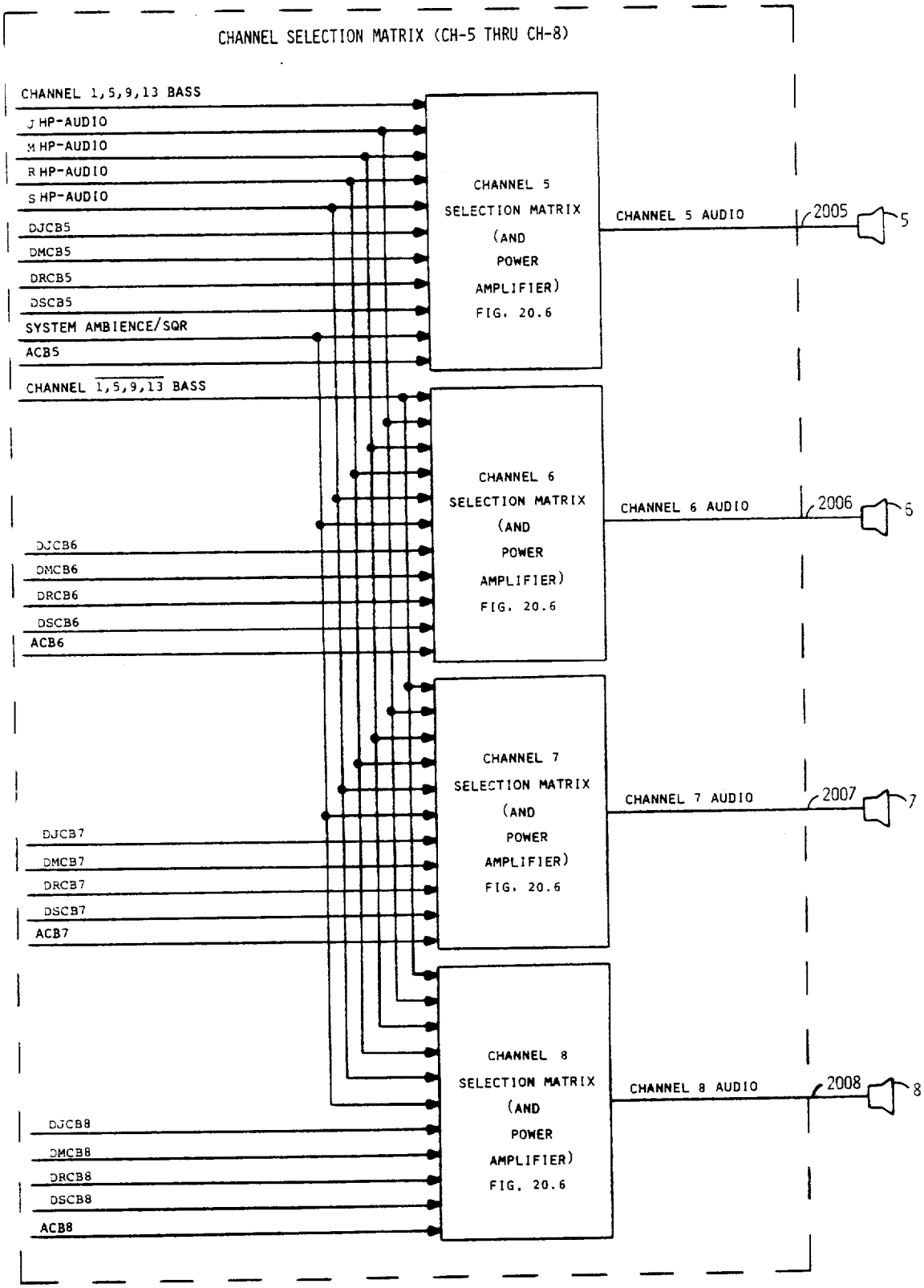
FIG. 20.3

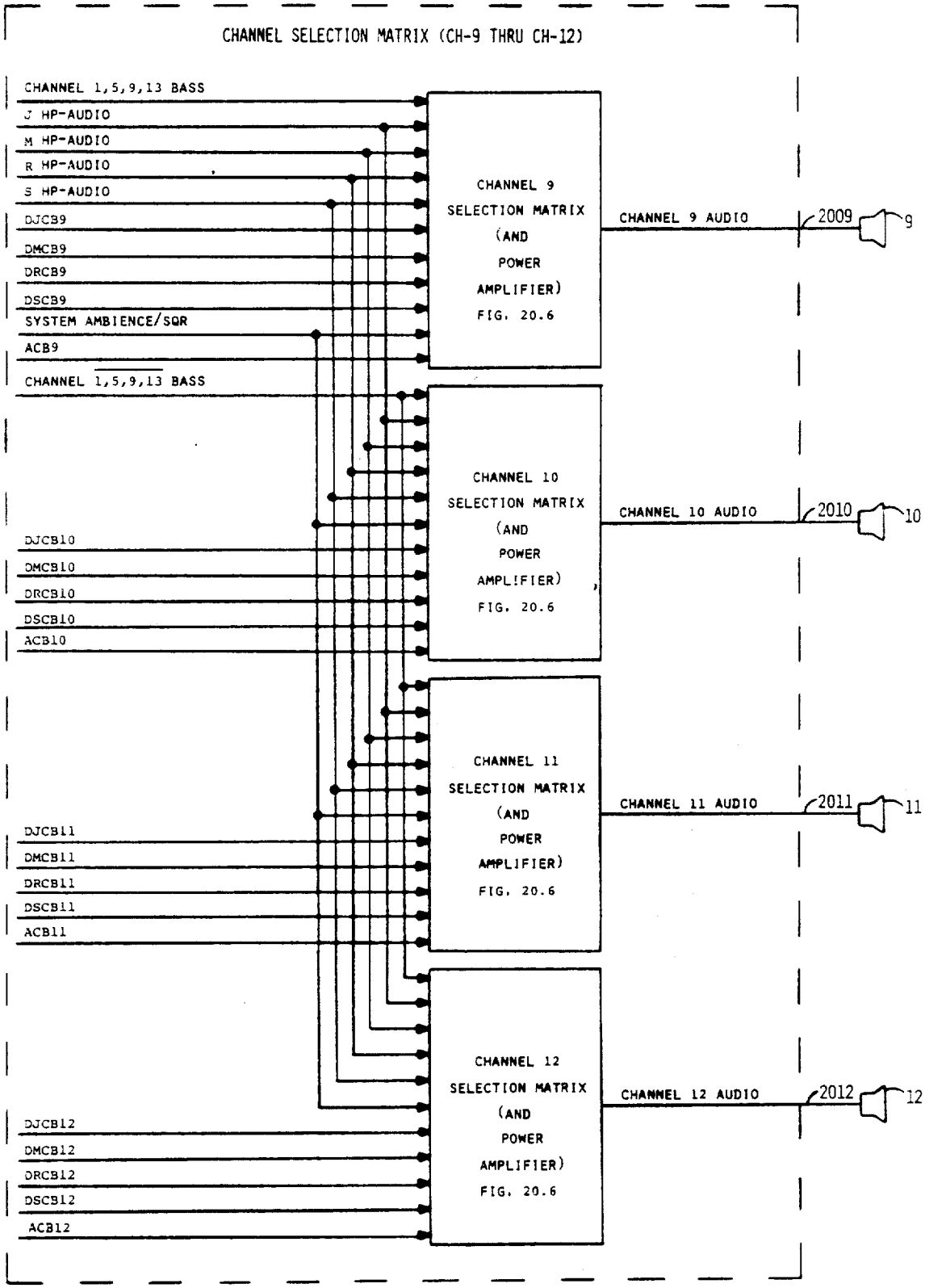
FIG. 20.4

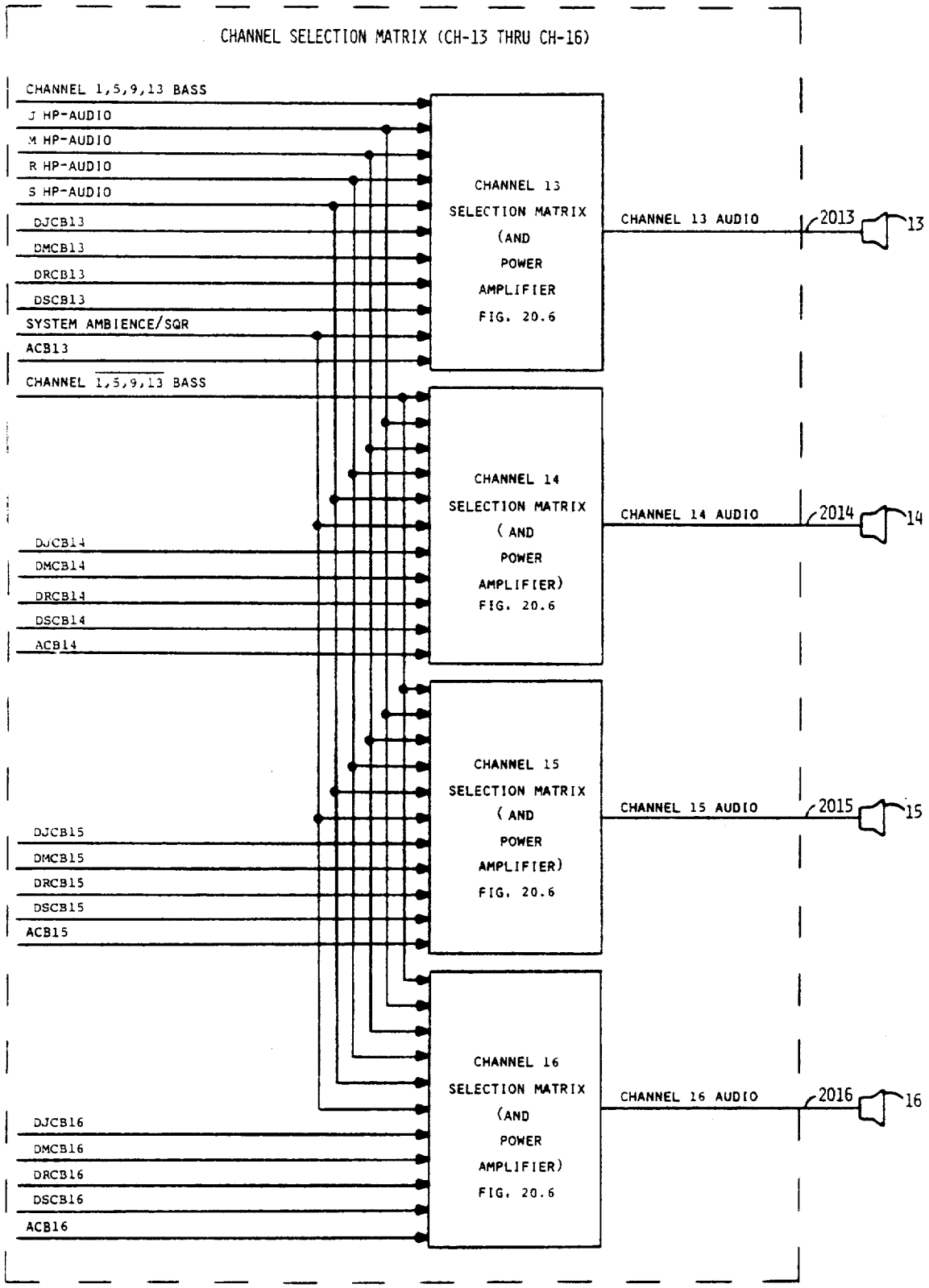
FIG. 20.5

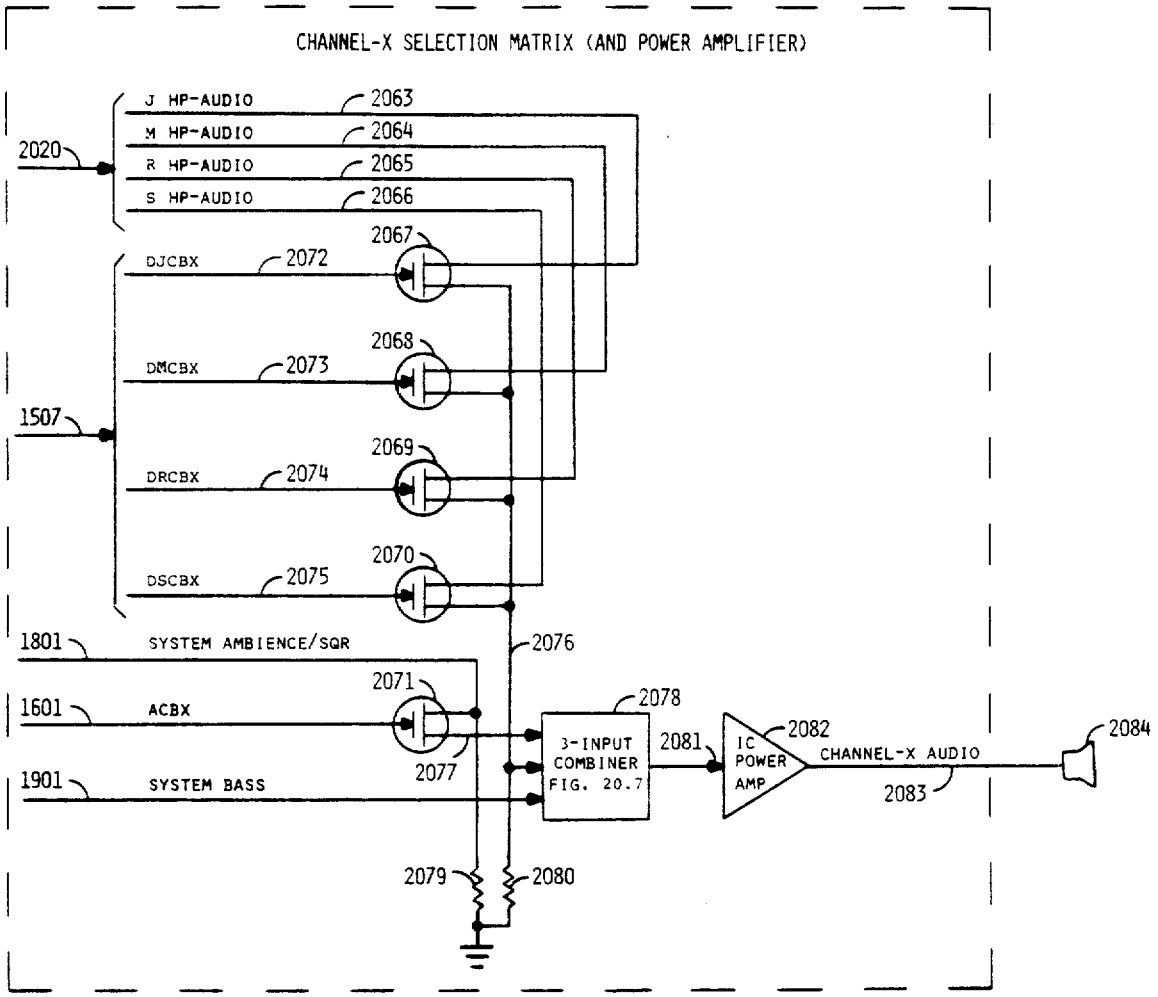
FIG. 20.6
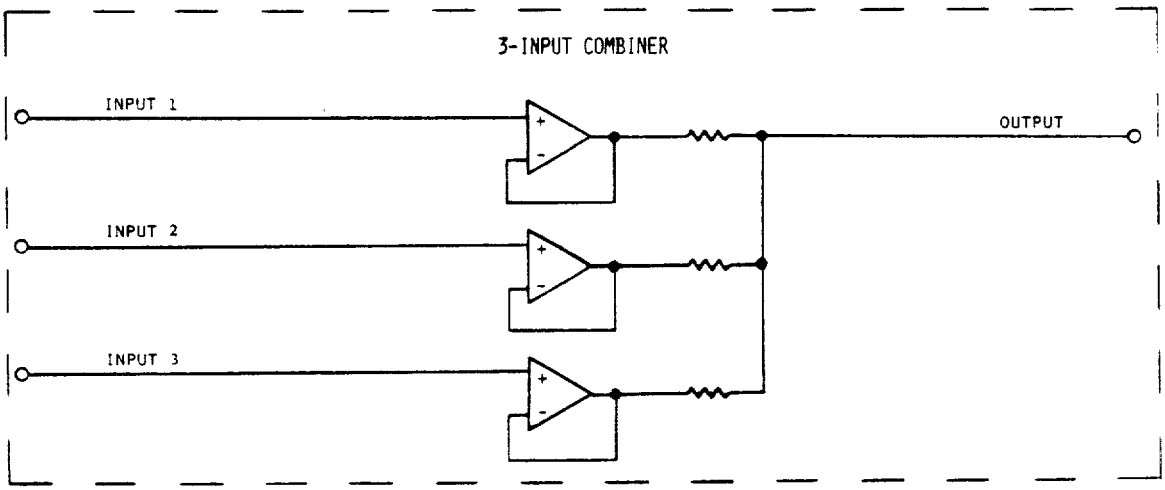
FIG. 20.7

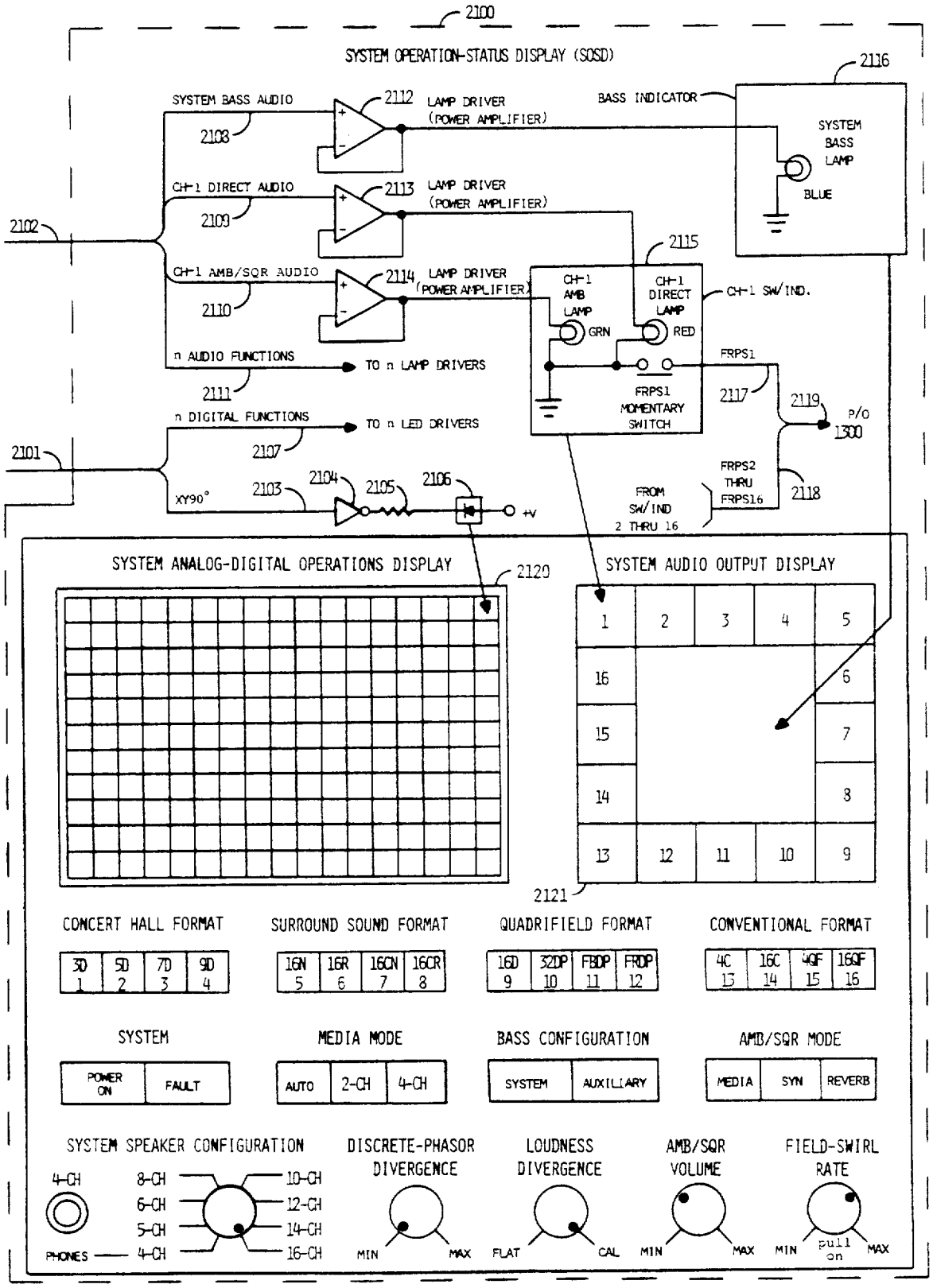
FIG. 21.0

AUDIO-DIGITAL PROCESSING SYSTEM FOR DEMULTIPLEXING STEREOPHONIC/QUADRIPHONIC INPUT AUDIO SIGNALS INTO 4-TO-72 OUTPUT AUDIO SIGNALS

BACKGROUND OF THE INVENTION

A plurality of transducer-channels has been the goal of audio engineers since the invention of the stereophonic art (a radiotelephony patent issued in 1924 to F. M. Doolittle) and its implementation in 1954 by the sound and motion picture industries. Since the first commercial recording of the stereophonic disc in 1958, the primary goal has been to resolve the Haas Effect by channelizing the phantom images residing between two transducers of a stereophonic sound field into point-source audio images. This phantom phenomenon has been referred to as the "stereophonic seat", and more recently as the "quadriphonic seat."

Numerous analog processing methods have failed in their attempts to channelize or enhance the directionality of phantom images. These methods, to mention a few, include: the algebraic sum derivation of a center channel (a method that failed to consider algebraic differences); a key signal detection method for emphasizing directionality (an impractical electromechanical method similar to SQ); an artificial high-passing and low-passing scheme (produced double sound images and listener confusion); an artificial time delay technique of delaying one channel for Haas effect derivation (several recording companies produced a limited quantity of recordings using this method); and a cosine derivation of multiple emphasized directions via a network of output power transformer taps (a 5-channel phase shifting method described in the March 1969 issue of "Audio").

In early 1970 algebraic matrix techniques made significant progress in multi-channel stereo reproduction. The first algebraic matrix system by Schieber was a "straight algebraic" method that provided a relatively poor separation of only 3 dB. Other algebraic matrix inventions, claiming to be improvements, did little or nothing more than change matrix factors to achieve slightly different directionality characteristics.

The "matrix wars" subsided as SQ (Columbia) and QS (Sansui) systems emerged as the dominant contenders. Both of these algebraic matrix systems, utilizing either "j" factors (90-degree phase shifts) or other matrix phase angle relationships (the Sansui "Variomatrix"), made substantial performance improvements over all previous algebraic matrix systems. In the SQ system, the 90-degree phase relationship is panpot-derived from a single-source audio signal and recorded on disc/tape as two identical "j" factor encoded (shifted) audio signals. These signals are then reproduced as a discrete audio image after "mirrored" 90-degree phase shift decoding. Both SQ and QS systems provide 4-channel phase shift decoding performance but neither solve the Haas effect for phantom images residing between any two transducers of a stereo field. In some respects the Sansui QS system is superior since its discriminator circuitry provides directional control for audio reproduction in a 360-degree field.

A new quadriphonic contender rekindled the "matrix wars" by employing a frequency multiplexing method (JVC Quadradisc). Since SQ or QS systems produced four transducer channels having limited channel separation, the JVC system was to provide superior separation or directionality. While this method proved to be feasible, it still exhibited erractic f.m. demodulation, limited phono-cartridge separation, and stylus tracking and record wear problems.

An improved SQ matrix system then evolved which utilized gain-riding logic that employed both side-to-side and front-to-back wave-matching logic. With this method, channel separation is equal to or better than the JVC multiplex system, but the SQ system inherently confuses directionality when all four channels require simultaneous reproduction. The JVC multiplex system maintains directionality for four channels of simultaneous reproduction.

Attempts have been made at affecting compatibility of the existing SQ system by utilizing amplitude modulated (a.m.) sideband multiplexing techniques; a method of compatibility for Columbia but a fifth system for the consumer. This method is significantly more susceptable to noise than the f.m. (JVC) multiplexing method.

Another approach to the systems previously described is a relative amplitude detection gate circuit that incorporates both an algebraic matrix and a logic circuit gate. This circuit attempts to recognize an amplitude ratio. From a signal processing standpoint, it fails to meet logic and analog circuit design guidelines or to provide processing functions such as: dynamic range compression, phase-angle decoding, peak-amplitude strobe synchronization, and flip-flop storage of the decoded amplitude ratio result during zero-crossover. This patented approach has yet to be put into practice.

In addition to previously mentioned quadriphonic methods, a discrete 4-track/Q8 tape system is available. The discrete 4-track tape system has been available since 1961 and is far superior to all previous methods for all aspects of functional performance; separation, signal-to-noise, and the like. However, this method is limited to the tape media while the bulk of the consumer market comprises the disc media.

To date; SQ, QS, JVC Quadradisc (having sufficiently resolved its previously stated problems), and discrete 4-channel/Q8 tape hardware systems and media attempt to coexist in the stereophonic-quadriphonic marketplace. This marketplace has a much curtailed consumer interest in both quadriphonic equipment and media since these four systems are not compatible, offer only 4-channel performance, and do nothing for the bulk of the recorded media . . . the 25-year consumer collection of stereophonic discs and tapes. And to compound this compatibility problem, the FCC is faced with deciding upon one of at least nine quadriphonic transmission methods before it sanctions 4-channel f.m.

The current state-of-the-art has been undergoing further improvement, such as: a shadow vector analysis unit for SQ; a paramatrix decoder by CBS; a Tate directional enhancement system alternative by CBS; a new system for cutting CD-4 masters (JVC Quadradisc); a CD-4 demodulator by Quadracast Systems, Inc.; and a JVC professional CD-4 demodulator. From the media standpoint, these improvements are resulting in a fragmentation of the 4-channel market by a number of companies attempting to promote their own matrix decoding/demultiplexing systems. None of the aforementioned systems or improvements can rival the performance made possible by this invention in terms of its flexibility, versatility, and performance/cost ratio.

SUMMARY OF THE INVENTION

The present invention is compatible with all prior art systems. It point-source recovers all phantom images present in any 2 or 4-channel media, including: monophonic (normally phantom in stereophonic/quadriphonic systems), stereophonic, matrix encoded (SQ or QS), JVC Quadradisc, discrete 4-channel/Q8 tape, and future 4-channel f.m. It processes 1 to 12 point-source channels from stereophonic and SQ/QS disc/tape media; including the heretofore neglected 25-year consumer collection of stereophonic discs and tapes. Although it is compatible with matrix encoded media, this invention tends to make both SQ and QS systems obsolete. This invention upgrades the importance of JVC Quadradisc and discrete 4-channel/Q8 systems since the media of any one of these systems provides processible information to recover more than 12 and up to 72 point-source audio images; with discrete 4-channel/Q8 tape providing the best performance, and JVC Quadradisc providing the only acceptable disc media.

This invention reconciles the difference of opinions as to the "real" purpose of recorded sound. It brings the concert hall to the listener, takes the listener to the concert hall, puts the listener at the conductor's podium, places the listener at the center of an orchestra or at the center of a hard-rock group. It places the listener anywhere he chooses since the recorded sound is whatever the producer, recording engineer, recording group/person, and conductor want to create. These production efforts must satisfy the musical tastes of a diversified listening audience. This invention optimizes the aesthetic results of any production effort by precisely processing the psychoacoustic information created within each unique recording; thereby achieving system and media versatility and listener satisfaction unmatched by any prior art.

The present invention recognizes fundamental signal relationships present in all recorded media and inherent in pan-potted recordings (panpotting was implemented in early 1960). Panpot recording is a method using audio differential multiplexing. It's results were heretofore referred to as an algebraic sum and difference process—a simplified technical description of a method that is the foundation of the recording industry's flexibility in accurately producing recorded media having multiple phantom images.

Multiplexing is generally thought of as either time division of frequency division. Panpotting is an audio differential multiplexing method that derives two signals from the same source signal where both signals establish an image positional relationship in a given stereophonic field, dependent upon their psychoacoustic data relationship. These relationships remain valid even when two more images (two signals per image) are mixed down and panpotted from the master tape. The 2-channel mixed-down result is merely a more complex psychoacoustic data relationship requiring further processing considerations as to common mode/phasor and frequency differences. These psychoacoustic data relationships or audio localization data are the panpotted amplitude, phase-angle, common mode/phasor, and frequency differentials that when real-time "computed", provide the "digital data instructions" to demultiplex the panpotted phantom images into point-source transducer locations.

This invention processes panpotted audio localization data into digital localization data which is used to channelize phantom audio images (that created the "digital data instructions") into point-source transducer outputs. It recovers and reproduces the original number of recording channels present on the master tape before the recording engineer panpotted and mixed then down for 2 or 4-channel disc or tape media production.

The primary difference between this invention and the systems of all prior art is in its method of processing. Prior art systems use algebraic and phase matrix encoding and decoding (with or without gain-riding logic) or frequency/amplitude multiplexing methods. The present invention automatically converts the 2 or 4-channel input media's audio localization data into digital localization data which is then passively processed by sophisticated digital circuits. These digital circuits psychoacoustically process and demultiplex (by commutating analog switches) output audio signals that are point-source reproduced by corresponding transducers. For example, a front center singer, normally phantomed midpoint between two separated speakers (transducers) in a conventional stereo system, is reproduced in accordance with this invention by a front center (midpoint) transducer. Thus, phantom images present in 2 or 4-channel tapes or discs (manufactured since 1954 or 1958) are accurately processed into discrete point-source images.

The present invention has a preselectable 4 to 72 channel capability, while prior art systems have a 4-channel maximum capability. Moreover, certain prior art systems suffer from limited channel separation, image shifting, gain-riding logic confusion (causing improper directional enhancement and/or loss of audio), and unwanted crosstalk. Near infinite channel separation is achieved by this invention for all past, present and future disc and tape media.

In preparation of analog-to-digital data conversion, the present invention provides special analog processes for the 2 or 4-channels of input audio signals to satisfy electrical characteristics for interfacing analog and digital circuits. Only the bandpassed fundamental and harmonic audio frequencies in a restricted audio frequency range are utilized. This band-passing function applies only to the digitally-processed frequencies and not to the audio reproduced by the system's transducers. Frequencies below, for example, 400 Hz are handled separately and upper harmonic frequencies above, for example, 4 kHz are not required for processing by the digital circuits. The invention, since it digitizes only the 400 Hz to 4 kHz range of music fundamentals, is thus immune to both high and low frequency separation, channel balance, and noise problems, and particularly to floating surface disc noise which causes image shifting. Prior art systems continue to encounter these problems.

The present system performs proportional amplitude leveling functions to compress and expand or otherwise level the dynamic range of the bandpassed audio signals to a near steady-state 0 dB level. It maintains a 0 dB level for one channel output signal and preserves the second channel output signal at the same original amplitude differential/panpot ratio as the lower input signal for each input channel-pair signal combination. This is an essential amplitude differential processing function required for phantom image channelization for which prior systems have no requirement.

The present system also performs a biased-amplitude leveling function on each of the bandpassed 2 or 4-channel signals and is yet another key function required for phase-angle differential, phasor differential, peak amplitude strobe generation and special ambience and SQ recovery processing. The biased-amplitude function also establishes audio threshold and dropout parameters which stabilize noisy audio images and silence the system transducers during no audio input. There are no known stereophonic/quadriphonic systems that incorporate this feature.

This invention instantaneously and synchronously converts audio localization data prepared by the previous analog processes into digital localization data. This digital localization data corresponds to: the amplitude differential of a unique audio panpotted image; the phase-angle differential of unique or multiple panpotted images; the phasor differential of multiple panpotted images, the peak amplitude strobe conditions for synchronously updating and loading output registers associated with amplitude/phasor differential processes at optimum audio amplitude points; and the audio amplitude-to-noise amplitude ratio of tape or disc media (otherwise known as signal-to-noise data comprising audio threshold and dropout data). The updated digital localization data, by operating simultaneously on such converted digital parameters as threshold, dropout, field activity, amplitude differential, phasor differential, and phase-angle differential data, is then psychoacoustically processed and translated by a unique psychoacoustic data translator into digital translated data for any one of 64 major processing cases. These 64 major processing cases function to resolve all possible permutations of panpotted combinations created by the recording engineer and the musical score into multiple simultaneous channelizations for point-source recovery. These 64 major processing cases resolve all prior art's separation and directionality problems. This invention is immune to phase shift decoding errors caused by poor stylus tracking, the phono cartridge, tape heads, tape skew, and playback equipment. Matrix encoded prior art is susceptable to these phase shift errors which produce crosstalk and directional ambiguities. Also, the digital phase-angle processing method for rear and front channel recovery of matrix encoded audio by the present invention is a performance improvement over the prior art's slow and inaccurate gain-ridding method.

In addition to the data translation functions, the invention also provides automatic data processing functions, that: preset special control functions at system power-on; initialize the system; determine whether 2 or 4-channel media inputs are active (thus setting corresponding mode control functions); and controls special ambience and SQ recovery functions.

This invention further provides preselectable quadrifield operations that perform data management processing functions which process the translated digital data into encoded data for format selection. The system at power-on or the user selects a 2-channel mode format and a 4-channel mode format and the system automatically allows either of these selections to be processed by the automatic mode control function. Each of 16 possible formats permits the user to create certain spatial effects, wherein the recording engineer's placement of channelized images in the sound field can be re-distributed to obtain different spatial listening experiences from the same recording. Even a 16-track master tape played back in the listener's environment does not have this automatic feature. Also, certain format selections will create 32-channel performance from 16 transducers; 16 transducers will be point-source and any two adjacent and simultaneously active transducers will effectively create 16 additional pseudo-point-sources, wherein each pseudo-point-source resides between said two adjacent and simultaneously active transducers.

This invention further processes each user selected format of 16 quadrifield format data bits into any one of 16 user selected quadrifield rotation control functions. These functions provide the user with a 360-degree clockwise field rotation capability to rotate and reposition the point-source sound images in one to 16 transducer repositional increments. This feature provides the user with the unique means to change the physical-geometric shape of the instruments/voices reproduced in the audio reproduction environment comprising his four sound fields (walls). Also, this feature allows the user to change his room-seat location and still maintain his listening perspective by rotating the channelized instruments/voices to accommodate his positional change. The user may also change his room furniture-seating locations and using this feature, eliminate the need to move speakers/connections, etc..

The invention further processes the translated, formatted and field rotated channelization distributions for each configuration of 4, 5, 6, 8, 10, 12, 14, or 16 transducer-channels. It provides the user with the means to build a point-source system from a 4-channel configuration to a 16-channel configuration (and even a 72-channel configuration) commensurate with his financial/spatial resources and specific audiophile interests. This configuration function also automatically provides optimum channelization when 4-channel headphones are connected to the system.

Ambience/SQ recovery and automatic dynamic bass recovery functions are utilized to affect compatibility with all system audio and digital functions and with all user configured special dynamic control devices such as volume compressors/expanders, graphic room equalizers, and the like. The system produces high-passed 2 or 4-channel audio for ambience and matrix encoded recovery functions. It produces low-passed 2 or 4-channel audio for automatic dynamic loudness (system bass) recovery. And it produces bandpassed audio for the dynamic restoration control functions required for control of ambience, matrix encoded, and automatic dynamic loudness recovery functions. In addition, this system interfaces with functions performed by volume compressors/expanders and graphic room equalizers to prevent unwanted coloration of the system's audio output performance. This system defeats graphic room equalization when 4-channel headphones are utilized and permits the volume compressor/expander to logically influence the invention's dynamic control functions for ambience and bass recovery. The system's unique interface with a 4-channel preamplifier, a 4-channel graphic room equalizer, a single channel reverberation or digital delayed ambience unit, and a 4-channel volume compressor/expander allows these units to provide audio for up to 72 transducer channels.

The present invention processes the high-passed and dynamically controlled audio for dynamic ambience and for special matrix encoded recovery. In response to digital encoded data, this invention recovers phase dependent concert hall ambience or synthesizes concert hall ambience, recovers SQ rear audio when the front direct audio predominates and recovers front direct audio when rear SQ audio predominates. The "gain-riding" logic method of prior art confuses directionality and fails to accomplish this function. In addition, this invention permits the user to utilize a single channel reverberation unit to generate 16 transducer channels of time-sharing reverberation/ambience for either 2 or 4-channel media inputs. All prior art require 2 or 4-channel reverberation units. All aforementioned processes are digitally synchronized to produce a contiguous and geometric mirror-image ambient sound field correspondence with the direct audio sound fields.

The unique loudness control or bass recovery performance by this invention accomplishes complete compatibility with all system digital and audio functions and with any user bass hardware configuration requirements. It causes bass output below approximately 500 Hz, for example, to automatically track the Fletcher-Munson equal loudness contours. This tracking is immune to overload and is proportional to the volume setting of the 4-channel preamplifier, the dynamic fluctuations of the musical instruments/voices, and the dynamic action of the volume compressor/expander. The invention automatically selects the correct base volume equalization for any configuration of transducers implemented by the user. It allows the user to configure a high-powered, high efficiency, low distortion auxiliary bi-amplification bass system that uses large baffle speakers. If the user decides to use the system transducers configured for channelization, then the omni-directional bass is distributed to all 16 transducers for a pseudo-biamplification power gain of 12 dB. It also performs a unique override function which causes 4 channels of bass, direct audio, matrix encoded, and ambient/SQR audio to be routed to only the 4-channel headphones when connected by the user.

This invention thus performs logic-matrix selection (demultiplexing) of the high-level bass, direct audio, matrix encoded audio, and ambient/SQR audio while being synchronously controlled by psychoacoustic data processes and by digital format, digital rotation, digital configuration, digital direct, and digital ambient data. The resultant formatted, field rotated, and configured transducer channelizations correspondingly cause the panpotted phantom images to be reproduced as discrete point-sources; thereby providing a "walk-through" quadrifield whose point-sources remain fixed in space and time regardless of the listener's physical movement in his sound reproducing environment. Prior art systems do not channelize these phantom images. Since the inception of stereo in 1924 and the first commercial stereophonic tape recording in 1954, the greatest problem plaguing the audio industry and the listener was the stereophonic or quadriphonic seat. After all, phantom images do not really exist between two stereo speakers, but are a psychoacoustic phenomenon of the listener's brain. The listener is deceived, through binaural fusion, into believing that a center singer and/or other displaced phantaom images are spatially located around him. The deception continues until the listener moves his head a few inches, and the phantom images collapse (Haas effect) into the nearer transducer. This present invention ultimately solves the stereophonic/quadriphonic seat dilemma of the past two decades, and now enables the listener to retire to his sofa, to recline, or to walk around and experience a natural dimension of precise point-source images.

OBJECTIVES OF THE INVENTION

From the foregoing, it is obvious that a basic objective of this invention is to provide a novel system for demultiplexing 2 or 4 input audio signals into 4 to 72 output audio signals.

A further objective of the invention is to provide a modular system having a growth capability of 2 transducer channel increments up to the maximum 72-channel configuration.

Another objective of the present invention is to utilize component functional designs that are applicable to a wide range of circuit package integration techniques.

Yet another objective of the present invention is to produce modular functional designs which permit manufacturers to market a complete line of equipment options ranging from basic portables to a 72-channel theater system.

Yet a further objective of this invention is to automatically process any 2 or 4-channel media including, but not limited to, monophonic media, 2-miked stereo media, panpotted media, multiplex/encoded media, or discrete 4-channel media that has been panpotted from master tape to 2 or 4-track disc/tape; thereby point-source reproducing each discretely panpotted instrument or voice from a corresponding transducer.

Another objective of the invention is to provide a system that is compatible with all media hardware; including monophonic, stereophonic, CD-4 (JVC), SQ, QS, discrete 4-track/Q8 tape, f.m.-mux, a.m., auxiliary equipment, future 4-channel f.m.-mux, and future 2-channel a.m.-mux.

Another objective of the invention is to provide a system requiring only a 4-channel preamplifier for user and hardware control of from 4 to 72-channels, and to be functionally compatible with a 2/4 channel power amplifier, a volume expander/compressor, a graphic room equalizer, and other devices.

Another objective of the present invention is to provide a system and method for performing audio band-passing, proportional amplitude leveling, and biased amplitude leveling on 2 or 4-channel input signals to meet all electrical prerequisites for analog-to-digital conversion and processing.

Yet a further objective of the present invention is to process signal-to-noise relationships from the input audio signals to ensure reliable digital processing and to provide special system silencing functions when noise (or no audio) is present.

Another objective of the invention is to convert audio localization data, comprising: amplitude peaks, amplitude differential, phasor differential, phase-angle differential, and signal-to-noise data into corresponding digital localization data and to process the corresponding digital localization data, representative of numerous permutations of possible panpotted combinations, into digital translated data.

Another objective of the invention is to provide system immunity from phase shift errors produced by stylus/cartridges, tapeheads, preamplifiers, and the like.

A further objective of this invention is to digitally recognize media separation deficiencies and directionality ambiguities, to perform special processing functions, to restore near infinite channel separation, and to resolve all directional ambiguities for one to four simultaneously active audio fields having one to eight simultaneously active transducers.

Another objective of the invention is to digitally manage one to four simultaneous fields of audio in a manner which logically assigns processing priorities to all of the possible panpot combinations for four sound fields of corresponding channelization functions.

A further objective of the invention is to perform all tasks automatically, require minimum manual intervention on the part of the user during operation, require no internal adjustments, and require maintenance effort only by a relatively unskilled user.

Another objective of this invention is to determine if 2 or 4-channel media signals are active and to automatically produce digital mode control functions that select user-system presets.

Yet another objective of this invention is to provide the user with the means to automatically or manually select any one of sixteen formats, wherein each format creates positional modifications of the recording engineer's placement of the originally panpotted instruments and/or voices in the 360-degree quadrified.

Yet another objective of this invention is to provide a means to selectively rotate or continuously swirl the four sound fields in one to 16-channel increments capable of transversing the 360-degree quadrifield, to provide the listener with the means to change the geometric shape of the 360-degree quadrifield and permit the user to change his seat position or room decor associated with the four sound fields and thereby restore the listener's front-center perspective.

Another objective of the invention is to allow the user to gradually build a system configuration to any number of transducers (4, 5, 6, 8, 10, 12, 14, 16 . . . 72) commensurate with his environmental space and financial resources and audiophile interests without any loss of channel information and with each configuration reproducing an optimum distribution of demultiplexed point-source audio images.

Yet another objective of this invention is to provide a system: for performing special dynamic control functions on the channelized audio; to extract concert hall ambience; to synthesize concert hall ambience; to permit a single channel reverberation unit or digital time delay unit to be used for 16 channels of system synchronous and time-shared ambience for either 2 or 4-channel input audio signals; and to control bass recovery in a manner that automatically tracks the Fletcher-Munson equal loudness contours.

Another objective of this invention is to produce a time-shared, contiguous, and geometrically-mirror-image ambient sound field correspondence with each direct sound field.

A further objective of this invention is to process panpot information into channelized transducer channels by logic-matrix selection circuits which employ transient and distortion free digital-controlled MOSFET analog switches.

Another objective of the invention is, by means of 16 point-source transducer channels, to create a "walk-through" quadrifield in which the listener's location and movement remains independent of channelization.

A further objective of this invention is to provide a means for the user to utilize either all 16 transducers for pseudo bi-amplification of bass reproduction or a high performance, large baffle, auxiliary bi-amplification system for bass reproduction.

A further objective of this invention is to provide automatic control functions to enable complete compatibility with 4-channel headphones.

Another objective of this invention is to eliminate the need for closely matched and critically placed speakers, since channelization eliminates phantom images which require same for stable localization; hence the system design enables the use of any good quality transducer having a smaller and less expensive enclosure of any shape to meet the decor requirements of the user. For example; a picture frame speaker enclosure.

Yet another objective of this invention is to reduce the need for high-power amplifiers to drive the transducers through the bass frequencies (required in current audio systems) because the system provides the means for all 16 transducers to reproduce the omnidirectional bass at a power gain of 12 dB.

Another objective of the invention is to provide a means to display all pertinent analog (audio) and digital signals for visual entertainment and for the isolation of faults to the integrated circuit package replacement level by the user.

Other objectives and novel and unique features of this invention, as well as the invention itself, both as to its organization and method of operation, will best be understood from the following figure descriptions and detailed description taken in conjunction with the accompanying drawings.

FIGURE DESCRIPTIONS

The following is a brief description of the accompanying drawings, wherein like reference characters designate like parts throughout the numerous views. Within each view, a series of numbers (e.g. 201 through 299, etc.) refer to parts within and comprising a major part (e.g. 200). Also, each series of parts is uniquely associated with a series of figure numbers (e.g. parts 200 through 299 with FIGS. 2.0, 2.1, etc.; parts 300 through 399 with FIGS. 3.0, 3.1, . . . and so forth). For example, FIG. 1.1 is an overall system block diagram that references all major parts (200, 300, 400, etc.), as well as like reference characters between said major parts. Reference characters that are less than 300 or more than 2000 on FIG. 1.1 indicate off-the-shelf items or conventionally designed circuits utilized by this invention.

FIG. 1.0 is a simplified block diagram showing a simplified block version of FIG. 1.1. Each block on FIG. 1.0 references one or more blocks on FIG. 1.1.

FIG. 1.1 is an overall system block diagram of the present invention.

FIG. 1.2 is a monophonic/single-microphone recording and production method block diagram.

FIG. 1.3 is a monophonic-stereophonic/2-microphone recording and production method block diagram.

FIG. 1.4 is a monophonic-stereophonic/binaural recording and production method block diagram.

FIG. 1.5 is a monophonic-stereophonic-quadriphonic panpot recording and production method block diagram.

FIG. 1.6 is a table of transpositions of related panpot steps versus panpot angular displacement parameters correlated to system angular displacement parameters which are converted to dB ratios and corresponding voltage ratios.

FIG. 1.7 is a diagram of system angular displacement parameters of a common stereophonic/quadriphonic field and associated field-channel allocations.

FIG. 1.8 is a diagram illustrating the data processing conventions of a common field.

FIG. 1.9 is a diagram of audio input channels related to system data field conventions.

FIG. 1.10 is a diagram of the system output audio buses related to the system transducer channels.

FIG. 1.11 is a table relating the common field to system fields and their corresponding data processing parameters.

FIG. 1.12 is a block diagram example illustrating an opera concert-hall format 4; automatically processed from two input audio signals and related to system data processing parameters, output audio to transducer buses, and to point-source results of musical instruments or voices within the associated quadrifield environment.

FIG. 1.13 is a block diagram example illustrating an alternative hard-rock surround-sound format 8; automatically processed from two audio input signals and related to system data processing parameters, output audio to transducer buses, and to point-source results of musical instruments or voices within the associated quadrifield environment.

FIG. 1.14 is a block diagram example illustrating an alternative opera surround-sound format 9; automatically processed from four input audio signals and related to system data processing parameters, output audio to transducer buses, and to point-source results of musical instruments or voices within the associated quadrifield environment.

FIG. 1.15 is a block diagram example illustrating an alternative opera surround-sound format 10; automatically processed from four input audio signals and related to system data processing parameters, output audio to transducer buses, and to point-source results of musical instruments or voices within the associated quadrifield.

FIG. 2.0 is an overall block diagram of the four audio-bandpass active-filters.

FIG. 2.1 is a schematic diagram of a typical audio-bandpass active-filter of FIG. 2.0.

FIG. 3.0 is an overall block diagram of the four automatic-proportional-amplitude levelers.

FIG. 3.1 is a common detailed-block diagram of an automatic-proportional-amplitude leveler of FIG. 3.0.

FIG. 3.2 is a schematic diagram of a typical MOSFET attenuator-x1000 amplifier useable with automatic-proportional-amplitude leveler of FIG. 3.1.

FIG. 3.3 is a schematic diagram of a typical driver useable with automatic-proportional-amplitude leveler of FIG. 3.1.

FIG. 3.4 is a schematic diagram of a typical 2-input combiner useable with said automatic-proportional-amplitude leveler of FIG. 3.1.

FIG. 3.5 is a schematic diagram of a typical precision error voltage control useable with automatic-proportional-amplitude leveler of FIG. 3.1.

FIG. 4.0 is an overall block diagram of the four automatic-biased-amplitude levelers.

FIG. 4.1 is a common detailed block diagram of an automatic-biased-amplitude leveler of FIG. 4.0.

FIG. 4.2 is a schematic diagram of a typical automatic-amplitude leveler useable with said automatic-biased-amplitude leveler of FIG. 4.1.

FIG. 4.3 is a schematic diagram of a typical 60 Hz notch filter useable with automatic-biased-amplitude leveler of FIG. 4.1.

FIG. 5.0 is a detailed block diagram of the audio threshold-dropout decoders.

FIG. 5.1 is a schematic diagram of a typical precision full-wave detector useable with audio threshold-dropout decoders of FIG. 5.0.

FIG. 5.2 is a schematic diagram of a typical active dc filter useable with audio threshold-dropout decoders of FIG. 5.0.

FIG. 5.3 is a schematic diagram of a typical a/d voltage comparator useable with audio threshold-dropout decoders of FIG. 5.0.

FIG. 5.4 is a logic diagram of a threshold decoder useable with audio threshold-dropout decoders of FIG. 5.0.

FIG. 5.5 is a logic diagram of a dropout decoder useable with audio threshold-dropout decoders of FIG. 5.0.

FIG. 6.0 is an overall block diagram of the four phase-angle processor-memories.

FIG. 6.1 is a common detailed-block diagram of a phase-angle processor-memory of FIG. 6.0.

FIG. 6.2 is a graphic plot of phase-angle versus frequency and timing window parameters.

FIG. 6.3 is a schematic diagram of a typical 90° phase shifter useable with phase-angle processor-memory of FIG. 6.1.

FIG. 6.4 is a schematic diagram of a typical 180° phase shifter useable with phase-angle processor-memory of FIG. 6.1.

FIG. 6.5 is a schematic diagram of a typical pulse shaper useable with phase-angle processor-memory of FIG. 6.1.

FIG. 6.6 is a schematic diagram of a typical single shot useable with phase-angle processor-memory of FIG. 6.1.

FIG. 6.7 is a logic diagram of a coincidence-comparator memory useable with phase-angle processor-memory of FIG. 6.1.

FIG. 6.8 is an illustration of a coincidence-comparator memory timing diagram showing signal timing relationships per FIG. 6.7.

FIG. 6.9 is a logic diagram of a random phase and field decoder useable with phase-angle processor-memory of FIG. 6.1.

FIG. 7.0 is an overall block diagram of the four peak-amplitude strobe generators.

FIG. 7.1 is a common detailed-block diagram of a peak-amplitude strobe generator useable with peak-amplitude strobe generators of FIG. 7.0.

FIG. 7.2 is a logic diagram of the strobe output control useable with peak-amplitude strobe generators of FIG. 7.0.

FIG. 8.0 is an overall block diagram of the four amplitude-differential processor-memories.

FIG. 8.1 is a detailed block diagram of a common amplitude-differential processor-memory of FIG. 8.0.

FIG. 8.2 is a detailed block-logic diagram of an amplitude differential converter useable with amplitude-differential processor-memory of FIG. 8.1.

FIG. 8.3 is a logic diagram of an amplitude differential decoder useable with amplitude-differential processor-memory of FIG. 8.1.

FIG. 8.4 is a detailed block-diagram of an amplitude differential memory useable with amplitude-differential processor-memory of FIG. 8.1.

FIG. 8.5 is a logic diagram of a steering flip-flop common to FIG. 8.4.

FIG. 9.0 is an overall block diagram of four phasor-differential processor-memories.

FIG. 9.1 is a detailed block-logic-diagram of a common phasor-differential processor memory of FIG. 9.0.

FIG. 9.2 is a schematic diagram of a typical differential amplifier useable with phasor-differential processor-memory of FIG. 9.1.

FIG. 9.3 is a detailed block-logic-diagram of a phasor-differential converter useable with phasor-differential processor-memory of FIG. 9.1.

FIG. 9.4 is a detailed block diagram of a phasor-differential memory useable with phasor-differential processor-memory of FIG. 9.1.

FIG. 10.0 is an overall block diagram of a psychoacoustic data translator.

FIG. 10.1 is a block diagram of a 4-line to 16-line decoder useable with psychoacoustic data translator of FIG. 10.0.

FIG. 10.2 is a truth table depicting quadrifield operations decoded from field activity data as related to FIG. 10.1.

FIG. 10.3 is a logic diagram of a special operation decoder useable with psychoacoustic data translator of FIG. 10.0.

FIG. 10.4 is a schematic-logic diagram of an automatic/manual mode control useable with psychoacoustic data translator of FIG. 10.0.

FIG. 10.5 is a logic diagram of a quadrifield suboperation encoder useable with psychoacoustic data translator of FIG. 10.0.

FIGS. 10.6 through 10.19 are logic diagrams of the 14 quadrifield operation decoders useable with psychoacoustic data translator of FIG. 10.0.

FIG. 10.20 is a logic diagram of the quadrifield discrete-phasor convergers useable with psychoacoustic data translator of FIG. 10.0.

FIGS. 10.21 through 10.24 are logic diagrams of the four quadrifield translators useable with psychoacoustic data translator of FIG. 10.0.

FIG. 10.25 is a table defining the sixty-four major case operations of the psychoacoustic data translator, resultant quadrifield translator outputs, and adjacent field corner inhibits.

FIG. 11.0 is a detailed block-schematic-logic diagram of the automatic/manual format selector.

FIG. 11.1 is a table depicting the overall format operation characteristics for each of the 16 formats.

FIG. 11.2 is a logic diagram of a common digital station interlock flip-flop useable with the automatic/-manual format selector of FIG. 11.0.

FIG. 12.0 is a detailed block diagram of the quadrifield format encoder-selector.

FIGS. 12.1 through 12.4 illustrate tables defining the encoding functions for each quadrifield format bit for 16 possible formats.

FIGS. 12.5 through 12.8 are logic diagrams of the four field format encoders useable with quadrifield format encoder-selector of FIG. 12.0.

FIG. 12.9 is a logic diagram of a quadrifield corner format encoder useable with quadrifield format encoder-selector of FIG. 12.0.

FIG. 12.10 is a logic diagram of a format mode encoder useable with quadrifield format encoder-selector of FIG. 12.0.

FIG. 12.11 through 12.26 are logic diagrams of 16 quadrifield-format selector-convergers useable with quadrifield format encoder-selector of FIG. 12.0.

FIG. 13.0 is an overall block diagram of the quadrifield rotation position selector.

FIGS. 13.1 and 13.2 illustrate tables defining the resultant positions of quadrifield format bits per field rotation position bits and corresponding field rotation position selects.

FIG. 13.3 is a detailed block-schematic-logic diagram of a field rotation position selector useable with quadrifield rotation position selector of FIG. 13.0.

FIG. 13.4 is a detailed block-logic diagram of a load-shift-strobe control useable with quadrifield rotation position selector of FIG. 13.0.

FIG. 13.5 is a logic diagram of a 16 MHz clock useable with load-shift-strobe control of FIG. 13.4.

FIG. 13.6 is a logic diagram of count-equals-FRPS comparator useable with load-shift-strobe control of FIG. 13.4.

FIG. 13.7 is a logic diagram of a 35 nano-second pulse generator useable with load-shift-strobe control of FIG. 13.4.

FIG. 13.8 is a logic diagram of a 25 nano-second load pulse generator useable with load-shift-strobe control of FIG. 13.4.

FIG. 13.9 is a logic diagram of an output control useable with load-shift-strobe control of FIG. 13.4.

FIG. 13.10 is a logic diagram of a field rotation shift register useable with quadrifield rotation position selector of FIG. 13.0.

FIG. 13.11 is a logic diagram of a field rotation position bit register useable with quadrifield rotation position selector of FIG. 13.0.

FIG. 14.0 is an overall block diagram of a quadrifield configuration encoder-selector.

FIG. 14.1 is a table defining the encoded field rotation position bits with respect to the system configuration selects and corresponding system configuration control bits.

FIGS. 14.2 through 14.9 illustrate location diagrams showing typical room placement of system transducers for each of the eight typical user configurations.

FIG. 14.10 is a logic diagram of a field rotation position bit encoder useable with quadrifield configuration encoder-selector of FIG. 14.0.

FIG. 14.11 is a schematic-logic diagram of a system configuration select-encoder useable with quadrifield configuration encoder-selector of FIG. 14.0.

FIGS. 14.12 and 14.13 are logic diagrams of two system configuration selectors useable with quadrifield configuration encoder-selector of FIG. 14.0.

FIG. 15.0 is an overall block diagram of a direct channel output selector.

FIG. 15.1 is a table defining the field rotation position selects for each direct audio output channel and corresponding J-M-R-S-audio rotated positions.

FIG. 15.2 is a logic diagram of a field rotation position encoder useable with direct channel output selector of FIG. 15.0.

FIGS. 15.3 and 15.4 are detailed block diagrams of two direct channel decoder-selectors useable with direct channel output selector of FIG. 15.0.

FIG. 15.5 is a common logic diagram of a direct channel X decoder-selector useable with the direct channel decoder-selectors of FIGS. 15.3 and 15.4.

FIG. 16.0 is a logic diagram of an ambience channel output-selector.

FIG. 16.1 is a channel location diagram illustrating the direct to ambience mirror-image field position relationships.

FIG. 16.2 is a table defining ambient channel bit Boolean operations decoded from direct system configuration bits (direct channel commutation bits) as related to transducer locations TL01 through TL16.

FIG. 17.0 is a detailed block-diagram of a dyamic audio output controller.

FIG. 17.1 is a block-schematic-logic diagram of a graphic room equalizer control useable with dynamic audio output controller of FIG. 17.0.

FIG. 17.2 is a schematic diagram of a 4-input combiner useable with dynamic audio output controller of FIG. 17.0.

FIG. 17.3 is a schematic diagram of a typical 400 Hz high-pass active-filter useable with dynamic audio output controller of FIG. 17.0.

FIG. 18.0 is an overall block diagram of a dynamic ambience/SQ recovery (SQR) controller.

FIG. 18.1 is a detailed block-schematic-logic diagram of an ambience/SQ recovery mode control useable with dynamic ambience/SQ recovery controller of FIG. 18.0.

FIG. 18.2 is a detailed block-schematic diagram of a concert hall/synthesized amb/sqr controller useable with dynamic ambience/SQ recovery controller of FIG. 18.0.

FIG. 19.0 is an overall block diagram of an automatic-dynamic-loudness controller.

FIG. 19.1 is a detailed block diagram of an automatic-dynamic loudness control circuit useable with automatic-dynamic-loudness controller of FIG. 19.0.

FIG. 19.2 is a graphic plot illustrating the dynamic equal loudness tracking characteristics of FIG. 19.1.

FIG. 19.3 is a schematic diagram of the graphic control dc amplifier useable with automatic-dynamic loudness control circuit of FIG. 19.1.

FIG. 19.4 is a X10/X3 dc amplifier useable with automatic-dynamic loudness control circuit of FIG. 19.1.

FIG. 19.5 is a schematic diagram of a dyn bass (0–18 dB)/(0–12 dB) boost circuit useable with automatic-dynamic loudness control circuit of FIG. 19.1.

FIG. 19.6 is a schematic diagram of a configuration attenuator network useable with automatic-dynamic-loudness controller of FIG. 19.0.

FIG. 19.7 is a schematic-logic diagram of a system-/aux bass and phones-in override control useable with automatic-dynamic-loudness controller of FIG. 19.0.

FIG. 19.8 is a schematic-block diagram of a bass output control useable with automatic-dynamic-loudness controller of FIG. 19.0 and with automatic-dynamic loudness control circuit of FIG. 19.1.

FIG. 20.0 is an overall block diagram of a psychoacoustic audio demultiplexer.

FIG. 20.1 is a block-schematic-logic diagram of the quadrifield audio format selector useable with psychoacoustic audio demultiplexer of FIG. 20.0.

FIGS. 20.2 through 20.5 are block diagrams illustrating the distribution of 16 channel selection matrixes useable with psychoacoustic audio demultiplexer of FIG. 20.0.

FIG. 20.6 is a block-schematic diagram of a common channel-X selection matrix useable with channel selection matrixes of FIGS. 20.2 through 20.5.

FIG. 20.7 is a schematic diagram of a 3-input combiner useable with channel-x selection matrix of FIG. 20.6.

FIG. 21.0 is a special purpose diagram showing the typical circuits and front panel controls and indicators of equipment embodying the present inventive concepts.

DETAILED DESCRIPTION OF THE DISCLOSURE

The following list of definitions is included to aid in the interpretation of the description of the preferred embodiment of the present invention and of the appended claims. While the definitions, for the most part, are consistent with terms presently used by those skilled in the art, some of the definitions (as underlined) are developed as a part of the present invention to characterize or define devices and/or functions not heretofore precisely classified.

ACOUSTIC—Used as a qualifying term "Acoustic" means containing, producing, arising from, actuated by, or carrying sound and capable of doing so.

ACOUSTIC CENTER, EFFECTIVE—An acoustic generator, the point from which the spherically divergent sound waves, observable at remote points, appear to diverge. See point source.

ACOUSTICAL—Used as a qualifying term "Acoustical" denotes related to, pertaining to, or associated with sound, but not having its properties or characteristics.

ACOUSTICS—The Science of sound or the application thereof.

AGC—Automatic Gain Control (refer to Automatic Gain Control for definition).

AMBIENCE—In Quadriphonics, a reference to reverberant sound as opposed to sound coming directly from musical instruments. In the audio sense, refers to the acoustic properties of any environment in which sound is produced or reproduced. Ambience has been used to describe the type of 4-channel recording in which the rear channels are devoted exclusively to reproducing the sound reflections (reverberation) from the interior surfaces of the concert hall or recording studio with the aim of communicating to the listener their acoustical contribution to the sound and spatial sensation of the actual performance.

AMPLITUDE—(1) If a complex number is represented in polar coordinates it becomes $r(\cos\theta + i\sin\theta)$ and the angle $\theta$ is the amplitude, argument, or phase of the number. The term also designates a parameter occurring in elliptic functions and integrals. (2) The crest or maximum value of a periodic (or specifically a simple harmonic function of space or time) or, more generally, any parameter that when changes, merely represents a change in scale factor. In amplitude-modulation systems, this quantity becomes a function of time, and its instantaneous value is of importance; however it is still referred to as the amplitude.

AMPLITUDE (SINE WAVE)—"A" in a sin $(wt+\theta)$ where "A", w, $\theta$ are not necessarily constants, but are specified functions of t. In amplitude modulation, for example, the amplitude "A" is a function of time. In electrical engineering, the term "Amplitude" is often used for the modulus of a complex quantity. Amplitude with a modifier, such as peak or maximum, minimum, root-mean-square, average, etcetera, denotes values of the quantity under discussion that are either specified by the meanings of the modifiers or otherwise understood.

AMPLITUDE (SIMPLE SINE WAVE)—The positive real "A" in a sin $(wt+\theta)$, where "A", w, $\theta$ are constants. In this case, amplitude is synonymous with maximum or peak value.

AMPLITUDE DIFFERENTIAL—Difference in amplitude between two waveforms or the ratio of amplitude A to amplitude B and vica versa.

AMPLITUDE GATE—See Slicer.

AMPLITUDE VERSUS FREQUENCY RESPONSE CHARACTERISTIC—The variation with frequency of the "gain" or "loss" of a device or system.

ANALOG—(1) Pertaining to data in the form of continuous variable physical quantities. (2) (Adjective). Used to describe a physical quantity, such as voltage or shaft position, that normally varies in a continuous manner, or devices such as potentiometers and synchros that operate with such quantities. (3) (Industrial Control). Pertains to information content that is expressed by signals dependent upon magnitude. (4) (Electronic Computers). A physical system on which the performance of measurements yields information concerning a class of mathematical problems. (5) Pertains to audio signals.

ANALOG AND DIGITAL DATA—Analog data implies continuity as contrasted to digital data that is concerned with discrete states. NOTE: many signals can be used in either the analog or digital sense, the means of carrying the information being the distinguishing feature. The information content of an analog signal is conveyed by the value of magnitude of some characteristics of the signal such as the amplitude, phase, or frequency of a voltage, the amplitude or duration of a pulse, the angular position of a shaft, or the pressure of a fluid. To extract the information, it is necessary to compare the value or magnitude of the signal to a standard. The information content of the digital signal is concerned with discrete states of the signal, such as the presence or absence of a voltage, a contact in the open or closed position, or a hole or no hole in certain locations on a card. The signal is given meaning by assigning numerical values or other information to the various possible combinations of the discrete states of the signal.

ANALOG COMPUTER—(1) (General). A computer than operates on analog data by performing physical processes on these data. (2) (Direct-Current). An analog computer in which computer variables are represented by the instantaneous values of voltages. (3) (Alternating-Current). An analog computer in which signals are of the form of amplitude-modulated suppressed-carrier signals where the absolute value of a computer variable is represented by the amplitude of the carrier and the sign of a computer variable is represented by the phase (0 or 180 degrees) of the carrier relative to the reference alternating-current signal.

ANALOG OUTPUT—One type of continuously variable quantity used to represent another; for example, in temperature measurement, an electric voltage or current output represents temperature input.

ANALOG SIGNAL—A signal that is solely dependent upon magnitude to express information content.

ANALOG-TO-DIGITAL CONVERTER—(1) (Data Processing). A device that converts a signal that is a function of a continuous variable into a representative number sequence. (2) (A-D). A circuit whose input is information in analog form and whose output is the same information in digital form. (3) (Digitizer). A device or a group of devices that converts an analog quantity or analog position input signal into some type of numerical output signal or code. NOTE: The input signal is either the measurand or a signal derived from it.

ANGLE OR PHASE (SINE WAVE)—The measure of the progression of the wave in time or space from a chosen instant or position or both. NOTES: (1) In the expression for a sine wave, the angle or phase is the value of the entire argument of the sine function. (2) In the representation of a sine wave by a phasor or rotating vector, the angle or phase is the angle through which the vector has progressed.

AUDIO—Pertaining to sound or hearing. Audio may be used as a modifier to indicate a device or system intended to operate at "audio frequencies."

AUDIO-DIGITAL PROCESSING SYSTEM—See computer.

AUDIO FREQUENCY—Any frequency corresponding to a normally audible sound wave. Audio frequencies range roughly from 15 to 20,000 cycles (Hz) per second.

AUDIO PHASOR FUNCTION—An audio wavefront produced by two transducers which correspond to two points having a given wavefront length as a function of phasor differential, whereby the audio reproduced is perceived by an auditor as any one of the following psychoacoustic effects: (1) Two simultaneous point-source sound images relative to the two points established by the phasor differential, (2) Two simultaneous point-source sound images and one or more distinguishable phantom sound images relative to the two points established by the phasor differential, (3) An overall phantom sound image perceived by an auditor as only having a general direction and which is a phasor vector function of the audio wavefront's SPL-distribution relative to the two points established by the phasor differential.

AUTOMATIC GAIN CONTROL (AGC)—(1) A process or means by which gain is automatically adjusted in a specified manner as a function of input or other parameters. (2) A method of automatically obtaining a substantially constant output of some amplitude characteristic of the signal over a range of variation of that characteristic at the input. The term is also applied to a device for accomplishing this result.

BASS—(1) Audio frequencies below 750 Hz. See omnidirectional. (2) Audio frequencies below 400 Hz which are utilized for system bass processing by this invention since the 400 Hz cutoff point is optimum in terms of the Fletcher-Munson Equal Loudness Contours and disc channel balance.

BINARY DIGIT (BIT)—A character used to represent one of the two digits in the numeration system with a radix of two.

BIT—A binary digit.

BUS—(1) Analog devices. A conductor, or group of conductors, that serve as a common connection for two or more circuits. (2) (Electronic computers). One or more conductors used for transmitting signals or power to one or more destinations.

CD-4—A phonograph record that can store four channels of discrete sound using FM-multiplexing techniques. Also known as JVC-Quadradisc.

COMMON MODE—Signals identical with respect to both amplitude and time. Also identifies the respective parts of two signals identical with respect to amplitude and time. See phasor differential.

COMMON-MODE SIGNAL—Instantaneous algebraic average of two signals applied to a balanced circuit, both signals referred to a common reference.

COMMUTATE—To turn on an analog switch (e.g. minimum resistance of a FET type device) as gated by an active digital signal. Conversely, an inactive digital signal gates an analog switch to off (e.g. maximum resistance of a FET type device).

COMMUTATION DATA, DIGITAL—Digital signals which commutate audio signals applied to analog switches into corresponding output audio signals.

COMMUTATION ELEMENTS—Circuit elements used to provide circuit-commutated turnoff time.

COMPUTER—(1) A device for carrying out calculations. (2) By extension, a device for carrying out specified transformations on information ("audio-digital processing system"). See data processor. (3) A stored-program data-processing system.

CROSSTALK—Portion of one channel signal heard in another channel, and vice versa. Expressed as level of unwanted signal in relation to wanted signal, measured in dB.

DATA—Representations such as characters or analog quantities to which meaning is assigned. A general term used to denote any or all facts, numbers, letters, and symbols, or facts that refer to or describe an object, idea, condition, or situation. Data connotes basic elements of information which can be processed or produced by a computer. Sometimes data are considered to be expressible only in numerical form, but information is not so limited.

DATA CONVERSION—The changing of data from one form of representation to another.

DATA PROCESSING—Any operation or combination of operations on data. Handling of information in a sequence of reasonable operations.

DATA PROCESSOR—Any device capable of performing operations on data, e.g. desk calculator, analog or digital computer or a psychoacoustic data processor. See computer. An electronic or mechanical device for handling information in a sequence of reasonable operations.

DECODER—(1) A device that extracts 4-channel sound from 2-channel encoded sound. (2) A device for translating a combination of signals into a single signal that represents the combination. A decoder is often used to extract information from a complex signal. (3) (Also referred to as a matrix). In an electronic computer, a logic network, or system in which a combination of digital inputs is gated at one time to produce a single digital output. (4) A device that converts coded information into a more useable form, for example, a binary-to-decimal decoder.

DEMULTIPLEXER—(1) A device used to separate two or more signals combined by a compatible multiplexer and transmitted over a single channel. (2) A circuit that directs information from a single input to one of several outputs at a time in a sequence dependent upon the information applied to the control inputs. (3) Two or more logic matrix selection circuits that switch audio signals from one or more inputs to two or more outputs in a sequence that depends on digital commutation data which is psychoacoustically processed from audio localization data and applied to the control inputs of analog switches. See MATRIX.

DIFFERENTIAL SIGNAL—The instantaneous, algebraic difference between two signals.

DIGITAL—(1) Pertaining to data in the form of digits. (2) Information in the form of one of a discrete number of codes.

DIGITAL DATA—Data in the form of digits, or integral quantities.

DIGITAL-TO-ANALOG CONVERTER—(1) (Power-System Communication). A circuit or device whose input is information in digital form and whose output is the same information in an analog form. (2) (Data Processing). A device that converts an input number sequence into a function of a continuous variable.

DIRECT AUDIO SIGNALS—A reference to audio signals representative of sound coming directly from musical instruments or sources as opposed to reverberant (ambience) sound reflections from physical objects.

DISCRETE—(1) Four-channel sound. (2) Quadriphonic sound handled as such without conversion to 2-channel. (3) Four discrete audio signals on tape or disc played back via four amplifiers and reproduced by four speakers. See point source.

ENCODER—(1) A matrix circuit for combining four sound channels into two. (2) A device that produces coded combinations of digital outputs from discrete digital inputs.

FIELD—(1) "Sound field"—One wall of a sound reproducing room having one or more suitably placed transducers. (2) A set of audio localization data processed from an audio signal pair into digital localization data, comprising digital phase-angle differential data, digital amplitude differential data, digital phasor differential data, digital peak-amplitude strobes, and digital signal-to-noise data. (3) Digital data representative of digital commutation data used to demultiplex audio signals to one or more transducers of one corresponding sound field. (4) Digital localization data translated by field-discrete and field-phasor functions.

HAAS EFFECT—See precedence effect.

INFORMATION—The meaning assigned to data by known conventions.

INFORMATION PROCESSING—(1) The processing of data that represents information. (2) Loosely, automatic data processing.

LOCALIZATION—Complete localization involves the specification of horizontal angle, vertical angle, and distance.

LOCALIZATION DATA, AUDIO—Consists of any one or more of the following audio signal parameters and/or interrelationships thereof: Phase-angle differentials, amplitude differentials, phasor differentials, amplitude peaks, and signal-to-noise. Psychoacoustic audio data having the following interrelationships: (1) A symmetrical audio waveform signal pair whose individual modulus frequency components have an in-phase value and whose amplitude differential has a discrete value, whereby their interrelationship represents a given point on a locus of points for a given segment of space. (2) A non-symmetrical audio waveform signal pair whose modulus frequency components have no phase relationship (random or different frequencies) and whose phasor differential is inversely proportional to the common mode frequency, phase, and amplitude components thereof and thereby function to represent two points, having an audio phasor function, equidistant from a center point on a locus of points for a given segment of space. (3) A symmetrical audio waveform signal pair whose modulus frequency components are phase shifted by a predetermined number of degrees and whereby functions to represent a given point on a locus of points for a given segment of space. NOTE: The psychoacoustic effect of (3) above requires special processing functions to produce point-source definition which otherwise is perceived by an auditor as a broad phantom image.

MASKING EFFECT—Psychoacoustic phenomenon in which low level sounds are obsecured or "Masked" by the presence of loud sounds. This principle is used in a variety of audio applications. The inability of an auditor to hear certain sounds because of the presence of other sounds. Masking is most noticeable at the higher frequencies. Also, an unwanted effect illogically caused by gain-riding logic (SQ).

MATRIX—(1) A circuit used for the addition and subtraction of signals. (2) The circuit used for encoding 4 related sound sources into 2 channels on tape or disc, requiring a matrix decoder to retrieve the original 4 channels. (3) A logic "matrix" selection circuit that switches one of two or more audio signals to one output channel in response to one of two or more digital commutation data bits. See demultiplexer.

MODULUS (PHASOR)—Its absolute value. The modulus of a phasor is sometimes called its amplitude.

OMNI-DIRECTIONAL—Being in or involving all directions or not discernable as having a specific direction; frequencies where the interaural time differences exceed one half the signal repetition period. Localization is ambmiguous at frequencies below 750 Hz, at which frequency the acoustic wavelength of the sound corresponds roughly to the path between the ears. This helps explain why above 750 Hz, interaural amplitude differences play a major role in localization. This is not to say that, for high-frequency localization, time differences are never significant; on the contrary, they remain very important at high frequencies for localizing signals that are not repetitive. See bass.

PANPOT—Panoramic controls, or panpots are used by stereophonic or quadriphonic tape mastering techniques for rerecording the apparent position of the sound source from one section of a sound field to another.

PHASE ANGLE—The measure of the progression of a periodic wave in time or space from a chosen instant, point or position.

PHASE-ANGLE DIFFERENTIAL—Difference in zero crossover point in degrees or in coincidence between two waveforms.

PHASE-ANGLE DIFFERENTIAL DATA, DIGITAL—Phase-angle differential in digital form.

PHASE CHARACTERISTIC—(1) The variation with frequency of the phase angle of a phasor quantity. (2) (Linear passive networks). The angle of a response function evaluated on the imaginary axis of the complex-frequency plane.

PHASE DIFFERENCE—The difference in phase between two sinusoidal functions having the same periods.

PHASE SHIFT—(1) The absolute magnitude of the difference between two phase angles. (2) (Electrical conversion). The displacement between corresponding points in similar wave shapes expressed in degrees lead or lag. (3) (Transfer function). A change of phase angle with frequency as between points on a loop phase characteristic. (4) (Signal). A change of phase angle with transmission.

PHASE VECTOR (OF A WAVE)—The vector in the direction of the wave normal, whose magnitude is the phase constant.

PHASOR—An entity which includes the concept of magnitude and direction in a reference plane.

PHASE (VECTOR)—A phasor is a complex number. Unless otherwise specified, phasor is assumed to be used only in connection with quantities related to the steady alternating state in a linear network or system. NOTES: (1) Phasor is used instead of vector to avoid confusion with space vectors. (2) In polar form any phasor can be written $Ae^{j\theta a}$ or $a\angle\theta_a$, in which A, real, is the modulus, absolute value, or amplitude of the phasor and $\theta_a$ its phase angle.

PHASOR DIFFERENTIAL—Difference between two leveled waveforms having equal amplitudes. This difference is inversely proportional to the common mode frequency and/or phase content thereof. See common mode.

PHASOR DIFFERENTIAL DATA, DIGITAL—Phasor differential in digital form.

PHASOR DIFFERENCE—See phasor sum (Difference).

PHASOR FUNCTION—A functional relationship that results in a phasor.

PHASOR PRODUCT (QUOTIENT)—A phasor whose amplitude is the product (quotient) of the amplitudes of the two phasors and whose phase angle is the sum (difference) of the phase angles of the two phasors.

PHASOR QUANTITY—(1) A complex equivalent of a simple sinewave quantity such that the modulus of the former is the amplitude A of the latter, and the phase angle (in polar form) of the former is the phase angle of the latter. (2) Any quantity (such as impedance) that is expressed in complex form. NOTE: In case (1), sinusoidal variation with t enters; in case (2), no time variation (in constant-parameter circuit) enters. The term phasor quantity covers both cases.

PHASOR SUM (DIFFERENCE)—A phasor of which the real component is the sum (difference) of the real components of two phasors and the imaginary component is the sum (difference) of the imaginary components of the two phasors.

POINT SOURCE—Any source viewed from a distance sufficiently great compared to the linear size of the source is considered as a point source. In the distance range in which measurements of the radiation from a source show that it obeys the inverse square law (no absorption), the source is considered as a point source. A transducer (loudspeaker) point-source origin of sound.

PRECEDENCE EFFECT—When a single sound is reproduced from two loudspeakers and the sound from one speaker is delayed by several milliseconds, the listener will hear the sound as if it came from the loudspeaker where he first heard it. The listener also will judge the second speaker to be silent. The phenomenon has been given various names, among them the "Law of first wavefront" and the "Haas Effect." NOTE: This effect was discovered in 1933 by P. K. Baker of the Bell Telephone Laboratories and applies to the reproduction of stereophonic sound.

PROCESSOR—Electronic equipment which is used to reformat, convert, translate, edit, or pulse-shape signals or data to satisfy the requirements of other equipment such as a computer.

PSYCHOACOUSTIC—Of or relating to psychoacoustics.

PSYCHOACOUSTICS—A branch of science dealing with hearing, the sensations produced by sounds, and the problems of hearing.

PSYCHOACOUSTIC DATA PROCESSOR—A device that psychoacoustically processes digital localization data into digital commutation data. It comprises one or more means to correlate, translate, reformat, encode, decode, shift, and so forth one or more of each of one or more of the following into digital commutation data: digital phase-angle differential data, digital phasor differential data, digital amplitude differential data, and digital signal-to-noise data.

PSYCHOACOUSTIC INFORMATION—Information comprising audio localization data contained in any two audio signals of stereophonic or quadriphonic media which is normally perceived by an auditor through the process of binaural fusion.

Q-8—RCA's name for 4-channel, 8-track tape cartridges.

QS—A matrixing technique for encoding 4-channel sound into two channels; developed by Sansui Company.

QUADRADISC—RCA's name for CD-4 discrete records.

QUADRAPHONIC—Illiterate form of quadriphonic.

QUADRI—Four.

QUADRIFIED—(1) A 4-sided sound field comprising four walls of a sound reproducing room or environment wherein each wall (real or imaginary) contains transducers which reproduce point source sounds. (2) Four fields of digital data representative of digital commutation data used to demultiplex audio signals into the transducers of 4 corresponding sound fields. (3) A quadrilateral.

QUADRIPHONIC—An audio media such as JVC quadra-disc, 4-track tape, Q8, SQ or QS which provides either four discrete or two audio signals matrix-encoded/multiplexed from four audio signals. (2) An audio system for decoding or demultiplexing four audio signals from two encoded or multiplexed audio signals and for reproducing four audio signals by suitable transducers, (3) An audio system for recording/reproducing four discrete audio signals.

RADIATION—The emission and propagation of energy through space or through a material medium in the form of waves: for instance, the emission and propagation of electromagnetic waves, or of sound and elastic waves.

REGULAR MATRIX (RM)—A 4-channel disc recording and playback system developed in Japan in which four channels are encoded down to two for recording or broadcast purposes and decoded back to four when played through a suitable decoder. Symmetrical in its separation capability from any one channel to the others. QS matrix system, developed by Sansui company, is a variation of regular matrix.

REVERBERATION—Reflection of sound from physical objects, having a time delay.

SIGNAL—(1) A visual, audible, or other indication used to convey information. (2) The intelligence, message, or effect to be conveyed over a communication system. (3) A signal wave; the physical embodiment of a message. (4) (Computing systems). The event or phenomenon that conveys data from one point to another. (5) (Control) (Industrial Control). Information about a variable that can be transmitted in a system.

SLICER (AMPLITUDE GATE)—A transducer that transmits only portions of an input wave lying between two amplitude boundaries. NOTE: The term is used especially when the two amplitude boundaries are close to each other as compared with the amplitude range of the input.

SOUND—A wave motion propagated in an elastic medium, traveling in both transverse and logitudinal directions, producing an auditory sensation in the ear by change of pressure at the ear.

SOUND FIELD—A region containing sound waves.

SQ—A 4-channel matrixing technique for "J"-factor encoding into or decoding from two channels. Developed by CBS.

TRANSDUCER (COMMUNICATION AND POWER TRANSMISSION)—A device by means of which energy can flow from one or more transmission or media to one or more other transmission systems or media. NOTE: The energy transmitted by these systems or media may be for any form (for example, it may be electric, mechanical, or acoustical), and it may be of the same form or different forms in the various input and output systems or media. A speaker.

WAVEFORM—(1) The shape of an electromagnetic wave. (2) The graphic representation of the wave in (1), showing the variations in amplitude with time.

WAVEFORM DIFFERENTIAL DATA, DIGITAL—Waveform differentials in digital form including one or more of each of one or more of the following: Phase-angle differential data, peak amplitude strobes, phasor differential data, amplitude differential data, and signal-to-noise data.

WAVEFORM DIFFERENTIAL INFORMATION—Data comprising waveform differentials and/or interrelationships between waveform differentials.

WAVEFORM DIFFERENTIALS—Differentials of two signals of one or more signal-pairs which include one or more of each of one or more of the following waveform differences and quantities: phase-angle differential, amplitude peak, phasor differential, amplitude differential, and signal-to-noise.

Referring now to FIG. 1.0 which is a simplified block diagram of FIG. 1.1. This figure, in conjunction with the following description, is provided herein as an overall introduction to the group of functional blocks that comprise FIG. 1.1. Thus, each functional block on FIG. 1.0 therein references one or more blocks on FIG. 1.1 (excluding blocks 2100 through 2300). In addition, FIG. 1.0 is included as an aid in relating the functional means of the broader claims to the functional means of the narrower claims and as a supportive illustration for the abstract of this application.

This invention incorporates an off-the-shelf Four-Channel Preamplifier that functions to selectively control stereophonic or quadriphonic input audio signals. It correspondingly produces 2 or 4 low-level audio signals and 2 or 4 high-level audio signals. The 2 or 4 low-level audio signals, equalized to flat response and typically taken from the tape monitor jacks, are applied to the Input Audio Processor. The 2 or 4 high-level audio signals, affected by all Four-Channel Preamplifier manual controls and taken from the main output jacks, are applied to the Output Audio Processor.

The Input Audio Processor functions to bias-amplitude level each low-level audio signal and to proportional-amplitude level each pair of low-level audio signals. The resultant bias-amplitude leveled audio signals and proportional-amplitude leveled audio signals are applied to the Psychoacoustic Data Converter. In addition, certain predetermined amplitude leveled audio signals are routed to the Output Audio Processor.

The Psychoacoustic Data Converter processes the bias-amplitude leveled audio signals and proportional-amplitude leveled audio signals into audio localization data. The audio localization data is converted into digital localization data and synchronously loaded with each instantaneous change in the audio localization data into output registers (memories). The updated digital localization data is routed from the output registers of the Psychoacoustic Data Converter to the Psychoacoustic Data Processor. At this point in the processing chain, the updated digital localization data is representative of 1 to 4 digital fields (up to 6 digital fields in an expanded system) of simultaneously active voices/musical instruments. Wherein, each independent digital field contains digital data that represents: a single image whose two audio signals are phase-angle coincident and of a given amplitude ratio; or a matrix encoded image whose 2 audio signals either lead or lag 90° in phase-angle coincidence; or multi-images whose two audio signals are phase-angle anti-coincident and less than phasor maximum and dual positional from field center to field corners; or 2 discrete images whose two audio signals are anti phase-angle coincident, phasor maximum and field corner positional.

The Psychoacoustic Data Processor performs encoding, decoding, correlation, translation, reformatting, shifting, and reconfiguring functions on the updated digital localization data to:

1. automatically establish 2/4 channel input mode of operation for the stereophonic or quadriphonic input audio signals applied to the Four-Channel Preamplifier.

2. decode, correlate, and translate the 1 to 4 digital fields of digital localization data into prioritized digital translated data that resolves all monophonic, stereophonic, SQ, QS, JVC Quadradisc, 4-channel tape/Q8 tape directional ambiguities and separation problems.

3. reformat, shift, and reconfigure said digital translated data as automatically controlled by the system and manually selected by the listener to obtain 1 of 16 possible listening formats from the same recording, reposition or swirl the discrete sound images in the 360-degree quadrifield, match the number of output audio channels to the number of configured power amplifiers and associated transducers, encode time-sharing ambience and numerous other functions.

The resultant digital commutation data and digital output audio control data are routed from the Psychoacoustic Data Processor and applied to the Psychoacoustic Audio Demultiplexer and to the Output Audio Processor, respectively.

The Output Audio Processor, in response to the digital output-audio-control data, functions to process the 2 or 4 high-level audio signals and the predetermined amplitude leveled audio signals into output audio signals which are sent to the Psychoacoustic Audio Demultiplexer.

The Psychoacoustic Audio Demultiplexer, under logic control by the digital commutation data, functions to demultiplex the output audio signals into 4 to 72 preselectable output audio signals whose audio channels are configured with a corresponding number of power amplifiers and transducers.

The audio reproduced by the transducers consists of up to 72 point-sources of direct audio, recovered direct audio when matrix-encoded audio predominates, omnidirectional system bass reproduced by all system transducers and which automatically tracks the Fletcher-Munson equal loudness contours at a power gain of up to 18 dB, ambient audio that is time-shared with direct audio, recovered matrix-encoded audio signals when direct audio predominates, and matrix-encoded audio.

Referring to FIG. 1.1, which is the overall system block diagram. This figure illustrates the major circuit blocks comprising this invention.

The four-channel preamplifier (FCP) 100 is used to select the desired stereophonic or quadriphonic audio input from 2-Channel Phono 17, 2-Channel Tape/Aux 18, 2-Channel FM-MUX 19, 4-Channel CD-4 Phono 20, 4-Channel Tape/Aux 21, or 4-Channel FM-Mux 22. The respectively selected 23, 24, 25, 26, 27, or 28 input of 2 or 4-channel input audio signals are processed by FCP 100 and then routed as outputs 101 and 102 to the system. The 101 output consists of 2 or 4 audio signals wherein each audio signal is a low-level, low-noise, low-distortion, essentially flat response audio signal typically taken from the tape monitor output jacks. The 101 output is not affected by the bass, treble, balance, volume, or other manual controls of FCP 100. The 101 output is utilized by this invention to perform numerous audio and digital data processing functions, and is not the audio reproduced by the system transducers. The 101 output is applied to the Audio-Bandpass Active-Filters (ABAF) 200.

The 102 output consists of 2 or 4 audio signals, wherein each audio signal is a high-level audio signal that is affected by the bass, treble, balance, volume and all other manual controls of FCP 100. The 102 output is applied to the Dynamic Audio Output Controller (DAOC) 1700, and is the subsequent audio demultiplexed by the system and reproduced by transducers 1 through 16.

The ABAF 200 is comprised of 4 identical audio-bandpass active-filters that filter the low-level audio input 101 and provide approximately a 400 Hz to 4 kHz bandpassed output 201 for each of the 2 or 4 input audio signals. Thus each 201 audio signal is restricted to a processing bandwidth that is required for optimum digital data processing by this invention. The ABAF 200 applies the bandpassed audio 201 to Automatic-Proportional-Amplitude Levelers (APAL) 300 and to Automatic-Bias-Amplitude Levelers (ABAL) 400.

The APAL 300 dynamically operates upon input 201 and processes either 1 or 4 audio fields wherein each audio field is comprised of 2 audio signals or a field channel pair.

The 301 output for each field channel pair is maintained at the same proportional dB ratio as its respective 201 field channel pair inputs while maintaining the higher of the two audio output signals at zero dB. The APAL 300 functions to quantify each field channel pair of proportional-amplitude-leveled audio signals as a prerequisite for analog-to-digital processing of output 301 by Amplitude-Differential Processor-Memories (ADPM) 800.

The ABAL 400 consists of 4 identical Automatic-Biased-Amplitude Levelers; each dynamically operates to process one of the bandpassed audio signals 201 and a bias reference signal 501 into a bias-free constant amplitude output 401 and 402 and into a dynamic bias control signal 403. The bias reference signal 501 establishes an audio signal-to-noise threshold or dropout reference amplitude that is further processed by the system to meet psychoacoustic data processing requirements. Each band-passed audio signal of input 201 having a dynamic variation up to 60 dB and which exceeds the critical audio-to-noise threshold and dropout reference amplitudes is automatically leveled by ABAL 400 into a constant amplitude (approximately 0 dB) output 402. Output 402 (representing 1 to 4 constant amplitude signals) is routed to the Phase-Angle Processor-Memories (PAPM) 600, to the Peak-Amplitude Strobe Generators (PASG) 700, and to the Phasor-Differential Processor-Memories (PDPM) 900. Output 401 (representing constant amplitude signals comprising the A and B audio signals) is applied to the Dynamic AMB-SQ Recovery Controller (DARC) 1800 to be processed into recovered concert hall ambience or recovered matrix-encoded audio signals.

The ATDD 500 functions to produce a bias reference signal 501 and to decode critical audio-to-noise threshold and dropout reference amplitudes represented by each dynamic bias control signal contained in input 403. Bias reference signal 501 (adjustable by the system user) is applied to ABAL 400. The ATDD 500 detects and decodes each dynamic bias control signal, whose amplitude varies inversely proportional to its respective audio signal, from input 403 into digital decisions representing audio above threshold, audio at threshold, or audio at dropout. The phrase "audio above threshold" means that the audio is relatively noise-free. The phrase "audio at threshold" means that the audio is at a signal level where the accompanying noise will cause erroneous pyschoacoustic data processing in the system. The phrase "audio at dropout" means that the audio signal level is equal to or less than media/equipment noise levels or that the audio is not present. Output 502, representing up to 4 fields of encoded digital threshold data, inhibits PAPM 600 and PASG 700. Output 503, representing up to 4 fields of encoded digital dropout, functions to clear the internal memories of PAPM 600. Output 504, representing up to four digital dropout data bits, is applied to the Psychoacoustic Data Translator (PDT) 1000.

The PAPM 600 is composed of 4 identical Phase-Angle Processor-Memories; each processes audio phase-angle differential data from a field pair derived from any two constant amplitude signals contained in input 402. The audio phase-angle differential data is converted into digital phase-angle differential data that is stored in an internal audio-synchronous memory. Input 502 inhibits the associated internal memory when one or both of the audio signals in a given pair reaches audio threshold. Input 503 erases the associated internal memory when both audio signals in a given pair reach dropout. The 2/4 channel mode input 1003 applied from PDT 1000 is utilized to generate digital phase-angle modifications when the system is expanded to a configuration of more than 16 transducers, and to prevent the loss of system audio reproduction during rare but possible occurrences of certain phase-angle differentials that may be randomly present during 4-channel media processing by the system. The PAPM 600 decodes the digital phase-angle differential data into digital field activity data and sends a field activity data bit to PDT 1000 when any phase angle is active for each of the 4 Phase-Angle Processor-Memories. This process results in field generated operational decisions which are utilized by PDT 1000 during quadrifield processing of the 64 major cases of digital data translation. Therefore, 4 fields of updated digital phase-angle differential data and associated field activity data bits comprising output 601 are sent to PDT 1000 for further processing.

The PASG 700 utilizes the signal input 402 applied from the ABAL 400, and the digital threshold data 502 applied from the ATDD 500, to generate a digital peak-amplitude strobe for each respective audio signal. The strobe is generated at the peak amplitude point of the individual audio signals that are recognized as being above both threshold and dropout.

The digital peak-amplitude strobes 701 is applied to the ADPM 800 where they are used to control the gating of each of the peak amplitude-differentials or panpotted ratio compare decisions. Each amplitude differential decision is executed at the time when the audio signals are at peak amplitude. Each amplitude differential decision is loaded into an internal real-time synchronous memory.

The output signal 701 is also applied to the PDPM 900 where it is used to control the gating of each phasor differential at peak phasor compare conditions which are representative of multiple simultaneous panpotted images. Each phasor differential compare also takes place at the time the audio signals are at the peak amplitude, whereby the digital phasor differential decision is loaded into an internal real-time synchronous memory.

The ADPM 800 receives 1 to 4 pairs of proportional bandpassed audio signals via input 301 from the APAL 300, the system initialize signal (SI) 1002 from the PDT 1000, and the strobe input 701 from the PASG 700. Utilizing these inputs, the ADPM converts each audio signal-channel pair of amplitude differentials into a corresponding digital amplitude differential data. This data is strobe loaded into an internal memory and sent as updated digital amplitude differential data output 801 to PDT 1000. The four fields of updated digital differential data 801 is applied to PDT 1000 to be further processed into 64 major processing cases.

The PDPM 900 functions to process 4 channel-pairs of amplitude leveled audio 402 applied from the ABAL 400, the digital peak amplitude strobe 701 applied from the PASG 700, and the system initialize signal 1002 from PDT 1000. The PDPM converts audio phasor-differential data into digital phasor-differential data that is loaded into an internal memory by digital peak amplitude strobe 701. The digital phasor differential data output 901 is applied to the PDT 1000 for use in processing the 64 major processing cases of quadrified operation.

The PDT 1000 functions as the central digital data processor of the system. The PDT 1000 receives the following updated digital localization data: the digital phase-angle differential data and digital field activity data input 601 applied from the PAPM 600, the digital phasor-differential data input 901 applied from the PDPM 900, the digital amplitude-differential data input 801 applied from the ADPM 800, and the digital dropout data input 504 applied from ATDD 500. The PDT 1000 functions to process the continuously updated digital localization data into digital translated data. This processing method results in point-source demultiplexing of the audio signal information in the listening environment precisely as the recording engineer had intended. The PDT 1000, upon power being applied to the system, generates a power-on sequence pulse 1001, which is used to preset: the Automatic-Manual Format Selector (AMFS) 1100, the Dynamic Ambience-SQ Recovery Controller (DARC) 1800, and the Quadrifield Rotation-Position Selector (QRPS) 1300. The PDT 1000 responding to the ATDD 500 input 504, and the field activity data bits of input 601, generates a system initialize signal (SI) 1002, which is used by 800 and 900 to force digital data inputs 801 and 901 to all logic level zeros when all 4 audio signals are at dropout. The PDT 1000 provides the system with an automatic/-manual 2/4 channel mode control signal 1003. This signal is utilized to: initiate phase-angle modifications which prevent audio loss for certain random conditions in the PAPM 600, to establish correct ambience-SQ recovery processing conditions in the DARC 1800, and to control the user's 2 or 4-channel format selection in the AMFS 1100. The PDT 1000 decodes 5 phase bits output 1004 which is applied to the DARC 1800 and to the Quadrifield Format Encoder-Selector (QFES) 1200. The 1004 output is used by the DARC 1800 to control 2-channel media ambience and special SQ information recovery and by the QFES 1200 to encode special format terms for the user selected 2-channel formats. The major function of the PDT 1000 is to process the digital data inputs 601, 801, and 901, which are representative of 64 major processing cases, into digital translated data. Each major processing case and corresponding translation results in output 1005 which comprise 36 bits (representing up to 34,359,739,000 audio image combinations) of digital translated data that are applied to the QFES 1200.

The AMFS 1100 utilizing the automatic 2/4 channel mode control input 1003, and the power-on input 1001, generates 2 digital control outputs 1101 and 1102. Output 1101 is generated as a result of the automatic standard format command signal via the power-on sequence signal 1001 or the manual format commands, which are user selected as 1 of 16 possible formats of digital data that is formatted by the QFES 1200. Output 1102 is generated in a similar manner to control high-level audio format selection in the Psychoacoustic Audio Demultiplexer (PAD) 2000. Therefore, synchronization of digital formatting and audio formatting is executed by the system for all formats whether selected by the automatic or the manual mode.

The QFES 1200 functions to perform an encoding operation on the 36 bit input 1005, and the 5 bit input 1004 applied from the PDT 1000. The encoding, which is in response to the automatic manual format select input 1101 and the 36 bit input 1005, generates a 16 bit digital data format output 1201. This output is representative of 1 out of 16 possible formats encoded by the QFES 1200. The quadrifield format data (16-bit digital data format) output 1201 is applied to the Quadrifield Rotation-Position Selector (QRPS) 1300, which provides a field rotation control function. This function is manually initiated for any one of 16 selectable positions. The QRPS 1300 provides the user with the means to rotate the entire quadrifield of point-source audio images in a 360-degree clockwise direction, and in increments of 1 to 16 transducer positions at a time. The QRPS shifts quadrifield format data 1201 and generates two synchronized outputs 1301 and 1302. Output 1301 is applied to the Direct Channel Output Selector (DCOS) 1500 for final field rotation encoding into digital direct commutation data used for high level audio demultiplexing. Output 1302 is applied to the Quadrifield Configuration Encoder-Selector (QCES) 1400 for field configuration processing.

The QCES 1400 functions to encode the total number of QRPS 1300 input data bits 1302 into configuration data bits that equal the respective number of preselected audio channels and configured transducers. Input 2018 applied from PAD 2000 initiates a phonesin override function, which automatically generates a 4-channel configuration via outputs 1401 and 1403. Output 1401 is applied to the Automatic Dynamic-Loudness Controller (ADLC) 1900 to automatically select bass volume compensation and to automatically select bass routing and override functions when the headphones are put in use. Output 1403 controls a room equalization override function in the Dynamic Audio Output Controller 1700, which prevents coloration of the headphones' audio response. Output 1402 is applied to both the DCOS 1500 and to the Ambience Channel Output Selector (ACOS) 1600. The corresponding direct channel and ambient channel commutations are therefore synchronized with the dynamic audio processes.

The DCOS 1500 decodes input 1301 applied from the QRPS 1300 and input 1402 applied from the QCES 1400, and generates a 64 bit digital data output 1501 which is applied to the PAD 2000. The 1501 output to the PAD 2000 performs digital direct commutation and synchronous field rotation of the direct high-level audio in PAD 2000.

The ACOS 1600 performs an ambient encoding function on the 1402 input applied from the QCES 1400, which causes corresponding digital ambience commutation to be synchronized with the digital direct commutation. The encoded ambience commutation function demultiplexes ambience audio signals into transducers that are geometrically opposite the active direct transducers. The ambience encoding method provides absolute synchronization to the direct channel commutation. This synchronization of the demultiplexing process is logically executed for the ambience mode, quadrifield formatting, quadrifield rotation, or quadrifield configuration functions.

The DAOC 1700 performs a special control function on the 2 or 4-channels of high-level input audio signals 102, applied from the FCP 100. The DAOC 1700 generates a dynamic control output audio signal 1701, which is applied to the ADLC 1900 and the DARC 1800. The 1701 output is utilized to produce a control voltage for the dynamic ambience restoration process and for the Fletcher-Munson equal loudness dynamic control process. Output 1702 is a single combined channel of band-passed high-level bass audio, which is applied to the ADLC 1900. Output 1704 is a single combined channel of high-passed, high-level audio, which is applied to the DARC 1800. The 1403 input is utilized by the DAOC 1700 to inhibit a configured graphic-room equalizer when 4-channel headphones are in use. The DAOC 1700 functions to enable the user to configure a compressor/expander and continue to maintain the correct system dynamic control. It permits a single channel of digital delayed ambience to be demultiplexed into 16 time-sharing ambience channels.

Output 1703 is 2 or 4-channels of processed and controlled high-passed, high-level audio signals, which are applied to the PAD 2000 for final audio formatting and direct audio demultiplexing.

The DARC 1800 operates on input 401 applied from the ABAL 400, and on inputs 1001, 1003 and 1004 applied from the PDT 1000, and on input 1701 and 1704 applied from the DAOC 1700. The DARC automatically provides either a 2 or 4-channel ambience recovery mode. Two channel ambience recovery is automatically selected for concert hall ambience operation and 4-channel ambience recovery is automatically selected for digital delayed ambience operation. Two additional modes of manually selectable ambience/SQ recovery permits the user to select synthesized concert hall ambience or forced 2-channel or 4-channel digital delayed ambience. In the first two modes mentioned, the DARC 1800 recovers front direct audio, normally lost by the "gain-riding logic" techniques for the front transducer sound field, while the rear SQ sound field is reproduced. When the front sound field is active the DARC 1800 also recovers SQ audio signals for reproduction in the rear sound field transducers. Therefore, the DARC 1800 applies the mode-resultant ambience, front direct audio recovery, and SQ rear audio recovery output 1801 to the PAD 2000 for ambience/SQR demultiplexing.

The ADLC 1900 operates on the dynamic control input signal 1701 and the bass input signal 1702, to produce a bass output which automatically tracks the Fletcher-Munson equal loudness contours regardless of the position of manual control settings on FCP 100. This automatic function accurately tracks the program media's dynamic variations and/or the action of a compressor/expander. The tracking function is independent of any graphic-room equalization established for the demultiplexed output audio signals. The ADLC 1900, under control by the QCES 1400, sets the proper bass volume response regardless of the number of transducers configured. A manual means to apply the bass signal 1902 to an external Auxiliary Bass System 2200 is also provided. Therefore, the user is able to utilize biamplification techniques by configuring high-powered amplifiers and high efficiency, large woofer, large baffle bass transducer systems.

Whenever 4-Channel Headphones 2300 are used, the PAD 2000 output 2018 in response to phones jack ground 2301 is applied to the QCES 1400 to set ADLC 1900, via the 1401 input, to perform a phone-in override function. This function disables the bass output 1902 to 2200 and to the system transducers 1 through 16, and permits the 1901 output to be re-routed as a 2017 output containing bass/direct/ambience SQR audio to the 4-Channel Headphones 2300.

When the headphones are not used, the automatic dynamic-loudness controlled bass is applied as output 1902 to 2200 or as output 1901 through PAD 2000, to transducers 1 through 16 via the user's system/aux bass selection.

The PAD 2000 receives digital inputs 1102, 1501, and 1601 which demultiplex or analog switch the high-level direct audio signals 1703, ambience audio signal 1801 and bass audio signal 1901 into high-level audio signals 2001 through 2016 which are respectively applied to system transducers 1 through 16 or into high-level audio signal 2017 which is applied to the 4-Channel Headphones 2300. Sixteen transducer-channels are illustrated, however, the user may also configure 4, 5, 6, 8, 10, 12, 14, or 16 transducers and even 72 transducers with certain modifications of the system. The benefits of point-source channelization increase with the higher transducer configurations. If a 4 instrument group, via 4 high level input audio signals 102, were to be processed for either a 4-transducer channel configuration or a 16-transducer channel configuration, the point-source performance would be identical. However, as the input media increases in the number of instruments/voices, the 4-transducer channel configuration produces increasing numbers of phantom images which degrade the walk-through quadrifield performance. The 16-transducer channel configuration preserves the point-source performance and the walk-through sound field by processing the additional panpotted images as point-sources. The 16 transducer-channel configuration can actually function as a thirty-two channel system because it creates 16 pseudo point-sources with each pseudo point-source residing between two adjacent simultaneously active point-source transducers for certain user selected formats.

The PAD 2000 utilizes: input 1501 to demultiplex direct audio signals 1703, input 1601 to demultiplex ambience/SQR audio 1801, and bass input 1901 which is applied to all system transducers configured when 2200 and 2300 are not in use.

The System Operation-Status Display (SOSD) 2100 is utilized to visually display predetermined audio signals 2102 and predetermined digital signals and data 2101.

Prior to proceeding with subsequent descriptions of the preferred embodiments, the following descriptions are provided as an introduction for understanding said descriptions. The following brief descriptions include: recording techniques, channelization parameters of panpotted information, channel allocations, data processing concepts of a typical common sound field, channel field conventions, corresponding data to be processed by this invention, and the associated digital demultiplexing of panpotted instrument/voices into system point-source transducers.

Referring to FIG. 1.2, which represents all monophonic recording processes utilized before the advent of the first commercially available stereo tape in 1954 and disc in 1958. This type of media recorded from single MIC-M and played back on present day stereophonic/-quadriphonic equipment reproduces A-channel audio and B-channel audio as a phantom center image. This condition correlates precisely with the center channel panpot position illustrated in panpot step 10 of FIG. 1.6. The A and B audio channels of a monophonic recording will always go through zero-crossover at the same time because they are identical single source and in-phase signals having equal amplitude. Therefore, this invention processes these identical signals as a field discrete (FD) condition and places the normally phantom image in the front center channel as a point-source image.

Referring to FIG. 1.3, which is representative of the early days of stereo recording and is still one of the methods utilized for consumer home stereo recordings. The recorded media produced by this recording method relies almost entirely on the "Haas Effect." Relative to this invention, the MIC-A and MIC-B audio input channels of this media input would essentially produce field-phasor ($F\theta$) activity. For this condition the A and B audio channels will practically never go through zero-crossover at the same time, except for random occurrences. The only way that 2-mike recording techniques can achieve the center channel panpot position of step 10 in FIG. 1.6, and the zero-crossover relationship, is for the instrument/voice to be placed precisely at the midpoint between MIC-A and MIC-B. This condition would rarely occur, because this recording method must contend with the instrument/voice performer movement and environment acoustics.

Referring to FIG. 1.4, which is representative of the recording technique that was an improvement over the method of FIG. 1.3, since significant amplitude differentials are achieved by the head-shadowing principle of the dummy-head model. Furthermore, this method significantly improves discrete field functions due to the close-mike positions of MIC-A and MIC-B and relies less on the "Haas Effect," which made the previous recording method of FIG. 1.3 susceptable to image broadening or audio phase smear that varies with frequency.

Referring to FIG. 1.5, which illustrates the current panpot recording method. It appears that this method was originally created for the six-channel optical-film track movie production of "Porgy and Bess" which was released in June 1959, and said method then adopted by the stereo recording industry to meet the demand for more definitive phantom image stereo reproduction in the consumer's home and to meet the demand to optimize recording-studio control for the record producer. The panpotting and mixdown techniques using MIC-1 through MIC-12 . . . MIC-N inputs result in each individual instrument/voice being reproduced as a stable phantom image as long as the listener does not move his head. This panpot-16 track mastering method, for practical purposes, eliminates the phase-time-lag smear previously mentioned.

In the early 1970's SQ, QS, CD-4 (JVC Qudaradisc) matrix-encoding processes become available. All these systems over-looked the channelization of 9 channels of panpotted images. This situation, in part, can be attributed to technical errors in the product literature of certain panpot equipment manufacturers that made channelization seem impossible; because their literature stated that a 3 dB amplitude change will move the panpotted image across the sound field. Consequently, this error propagated itself into such audio industry reference books as "Audio Cyclopedia" by Howard M. Tremaine.

Referring to FIG. 1.6, which is a table illustration of the panpotting parameters used by the recording engineer. Steps 0 through 10 may appear to be a reenforcement of the 3 dB change statement, but the sound image position is dependent upon the dB differential or ratio between CH-X and CH-Y audio signals and not just one.

Therefore, it is the dB amplitude ratio of channel-X to channel-Y audio signals that establishes the image placement. This indicates an approximate 10.6 dB ratio change from stage center to either side or approximately a 21.2 dB differential for the total sound-field comprising the width of the stage. Furthermore, because the panpot angular displacement parameters are based on mathematical laws governing binaural fusion and geometric image displacement, all panpot equipment must function precisely the same way regardless of manufacturer. A single panpotted image, since it resides in 2 channels panpotted from a single source/tape track, contains the same audio information in both channels and therefore, both channels are always in-phase for simple sinewave tones or zero-crossover coincident for complex waveforms, and vary only in the amplitude ratio between the 2 channels.

To further illustrate the panpotting parameters, the "panpot angular displacement parameters" have been transposed to "system angular displacement parameters." Therefore, the voltage ratios described for the transposed parameters are typical peak-to-peak values utilized by this invention. Other values can also be used. The first prerequisite for the channelization process is to consider channel balance of the entire recording-to-playback chain for only that frequency bandwidth which is to be digitally processed by the system. Channel balance is consistantly towards one or the other channel over the desired bandwidth and this balance can be improved by an appropriate balance control. For this invention, an anticipated channel balance of ±1.0 dB for the total recording-playback chain is acceptable.

Referring to FIG. 1.7, which is an illustration of the channelization of the FIG. 1.6 "system angular displacement parameters" into field-channel allocations (FCA) having at least a ±1.0 dB channel balance characteristic.

This invention provides the means to channelize a ±1.0 dB channel balance or an X-channel at 0 dB and the Y-channel at −1 dB or the X-channel at −1 dB and the Y-channel at 0 dB into an XYX field channel allocation as a center transducer channel. Therefore, the normally phantomed XYX image in previous systems is resolved into a point-source XYX image that is no longer susceptible to the physical movement of the listener, and resides as a crystallized instrument/voice of precise time and space origin; a sound image reproduced from a single transducer in a multiple-transducer system exhibiting zero cross-talk or a system having infinite separation.

Referring to FIG. 1.8 which is a common field diagram for each system sound field because each sound field is derived in a manner similar to the derivation of FIG. 1.7. Therefore, the input poles are X and Y and the resultant XYX field designation is XYX-F. The nine panpotted field channel allocation (FCA) designations for the XYX field are: XY4, XY3, XY2, XY1, XYX, YX1, YX2, YX3, and YX4. The center point-source image is a result of the ratio X:Y or Y-X; hence XYX. Each position right of center is derived when the Y pole is the higher amplitude of the panpot ratio. Each position left of center is derived when the X pole is the higher amplitude of the panpot ratio. The field discrete (FD) selection for one of the 9 field channel allocations is controlled by the digital amplitude differential data, XYX strobe, and XYX 0° function, wherein both the X and Y pole inputs are in-phase and zero-crossover coincident. The field phasor ($F\theta$) selection of 2 simultaneous field channel allocations is controlled by the digital phasor differential data, XYX strobe, and XYXR° function. Wherein, both X and Y pole inputs are a random degree (R°) compare (not XYX0°, and not XY90°, and not XYX180°, and not YX90°) and is therefore a function of phasor-differential processing by the system. Thus, the XYX R° function reconstructs 2 simultaneous point sources and one or more phantom images over a distinct portion of the sound field when singular discrete point-sources do not exist. The XY90°, XYX180°, and YX90° functions are utilized for special field recovery of matrix-encoded media (excluding XYX180°) and/or future six field recovery of 72 channels.

Referring to FIG. 1.9, which illustrates the sound field placements of this invention. This invention processes either 2 or 4-channel audio signals and therefore, certain conventions have been established to correlate audio and digital localization data processing functions. There are 6 possible fields. The fields are derived in a clockwise fashion. A 2-channel media input is via field pole inputs CH-A and CH-B; therefore, denoted as the ABA field or ABA-F. A 4-channel input utilizes poles CH-A, CH-B, CH-C and CH-D; therefore, the ABA-F, BCB-F, CDC-F, and DAD-F sound fields are likewise derived. Also, the diagonal sound fields (ACA-F and BDB-F) are not processed by the preferred embodiments of this invention because certain consumer cost or environmental limitations may make it impractical to accommodate them. However, they are available for future processing for movie theater applications, and the like.

Referring to FIG. 1.10, which is an illustration of the transducer locations relative to the CH-J, CH-M, CH-R, and CH-S system audio output buses. Thus, transducer channels 15, 16, and 1 through 3, 4 through 7, 8 through 10, and 11 through 14 are driven by audio output buses CH-J, CH-M, CH-R, and CH-S, respectively; wherein transducer channels 1, 5, 9, and 13 are the system's field-corner transducers. Also, for the standardized field rotation position only, audio output buses CH-J, CH-M, CH-R, and CH-S directly correlate with input channel poles CH-A, CH-B, CH-C, and CH-D (of FIG. 1.9), respectively.

Referring to FIG. 1.11, which is a table illustration of the digital data nomenclature of the common field parameters as related to system-field digital processing parameters utilized by this invention.

Referring to FIG. 1.12, which is a special purpose diagram depicting the typical system format 4 audio and digital relationships for a hypothetical "opera" stereo recording, using CH-A and CH-B audio input channels only, and reproduced in the listener's environment where only 2 simultaneous point-sources are active via a maximum configuration of 16 transducers. This diagram correlates the concepts shown in FIGS. 1.2 through 1.11, wherein: the CH-J, CH-M, CH-R, and CH-S audio buses and respective audio input poles CH-A and CH-B are shown as a more detailed output audio-to-transducer distribution; for example, digital processing parameters are related to their associated transducers; resultant hypothetical instruments/voices are shown per their point-source activity as well as a typical field phasor wherein the associated instruments/voices appear at and/or between AB3-BA3.

Referring to FIG. 1.13, which is similar to FIG. 1.12 except the depicted format 8 for a "hard rock" recording causes the singer to be reproduced by transducers 3, 7, 11, and 15 wherein the resultant 4 phantom fields cause the singer to follow the listener within his listening environment.

Referring to FIG. 1.14 which is similar to FIG. 1.12, except format 9 for an "opera" recording is via four-pole CH-A, CH-B, CH-C and CH-D audio inputs, wherein up to any 8 out of 16 simultaneous point-sources provide the listener with spatial effects that are superior to a 2-channel recording.

Referring to FIG. 1.15, which is similar to FIG. 1.14 except format 10 effectively allows the 16 channel transducer configuration to operate as a 32 channel pseudo point-source system; thus, augmenting the listener's spatial experience. For example; a pseudo point-source snare drum is reproduced between transducers 5 and 6 when common digital decision BC3 is active.

Referring to FIG. 2.0, the ABAF 200 which is comprised of 4 identical Audio-Bandpass Active-Filters 203, 206, 209 and 212. Each ABAF filters its respective input audio signal 202, 205, 208 or 211, and respectively produces a 400 Hz to 4 kHz, unity-gain, output audio signal 204, 207, 210 or 213. The inputs designated C-audio 208 and D-audio 211 are operative only for 4-channel media. Input 101 and output 201 correspond to like reference designations shown on FIG. 1.1.

The 4 identical audio-bandpass active-filters heretofore mentioned are conventional circuits illustrated in FIG. 2.1, and therefore a discussion of operation is not required. Various other types may be employed.

The bandpass filters 203, 206, 209, and 212 must meet system analog-to-digital data (A/D data) processing requirements by providing a sharp rolloff at bass frequencies below 400 Hz and a sharp rolloff at harmonic frequencies above 4 kHz.

The frequencies below 100 Hz are removed from A/D data processing circuits because the audible frequencies from 16 Hz to 100 Hz, as well as the sub-sonic noise below 16 Hz have inherently poor channel separation and channel balance characteristics. Therefore, if these frequencies were submitted to A/D data processing, they would force illogical decisions at the system transducer outputs and would override the audio signal threshold and dropout functions utilized by PDT 1000 to resolve directional ambiguities and channel separation problems.

Also, if frequencies below 100 Hz were processed by the A/D circuits and the input audio dropped out, the noise silencing feature of the system transducer outputs would be overridden. If this were to happen the hum, wow, flutter, rumble, tape hiss f.m. hiss, or unmodulated-disc groove noise would be audible to the listener.

The frequencies from 100 Hz to 400 Hz are filtered out of the A/D data processing circuits because these frequencies may produce timing window errors in the phase-angle decoding circuits of PAPM 600; these frequencies were handled by other circuits of this invention.

The frequencies above 4 kHz are filtered out of the A/D data processing circuits because floating surface noise and stylus tracking errors, which cause image shifting, become significant as frequencies increase above 4 kHz. Also, the phase-angle decoding executed in PAPM 600, which remains logical over the desired timing window range up to 4 kHz, would produce illogical phase-angle decisions for frequencies above 4 kHz.

This invention digitally processes only the audio frequencies from approximately 400 Hz to 4 kHz, because the frequencies above 4 kHz are redundant processible harmonics of fundamental frequencies below 4 kHz. The bass frequencies below 400 Hz are omnidirectional to the listener and contain no localization data that is pertinent to the psychoacoustic processes of the human brain. However, harmonics of frequencies below 400 Hz, which fall into the 400 Hz to 4 kHz bandwidth, contain localization data that is processed by this invention. The phenomenon that localizes omnidirectional bass frequencies is the localization that the listener experiences on bass transient-generated harmonics (for example; the non-bass plucking sound of a bass viol), which falls into the system digitally processed 400 Hz to 4 kHz bandwidth. This bandwidth applies only to the system processed data and not to the bandwidth of the demultiplexed audio signals which cover the full audio bandwidth of approximately 20 Hz to 20 kHz.

Referring to FIG. 3.0, the APAL 300, which consists of 4 identical Automatic-Proportional-Amplitude Leveler circuits 302, 305, 308, and 311. Each 302, 305, 308 and 311 circuit acts independently on its associated input pair 204-207, 207-210, 210-213, and 204-213 which are paired from the 4 input audio signals 204, 207, 210, and 213. These 302, 305, 308, and 311 circuits respectively produce automatic-proportional-amplitude leveled-paired-outputs 303-304, 306-307, 309-310, and 312-313.

The APAL 300 performs an essential processing function because audio amplitude differential data can only be converted to digital amplitude differential data when the higher amplitude audio signal of an output audio pair is maintained at 0 dB, while preserving the lower amplitude output audio signal at the same dB ratio as the lower amplitude input audio signal of the associated input audio signal pair. An alternative method of using conventional A/D converters and data processing would be prohibitive due to the complexity and the inability of such circuits to process and convert two audio signals (varying over a dynamic range of 60 dB) into meaningful digital amplitude differential data.

Referring to FIG. 3.1. The X-BP audio and Y-BP audio discussion is common to the A-B, B-C, C-D, or D-A paired BP/APAL input/output combinations of the respective APAL circuits 302, 305, 308, and 311. For the purpose of a circuit functional description, assume the X-BP audio 314 and Y-BP audio 315 are at an arbitrary high input level of ΔdB with a paired-input ratio of ΔR. The two inputs are respectively attenuated uniformly by a factor ΔA by the MOS-FET Attenuators-X1000 Amplifiers 316 and 317. The resultant output signals 318 and 319 are applied to respective Drivers 320 and 321. The 2-Input Combiner 325 combines respective 2 audio signals 323 and 324 and produces a combined X and Y audio signal 326 that is applied to the Precision Error Voltage Control circuit 327. The output of 327 is a control voltage 328 applied to both 316 and 317. Because the control voltage 328 is proportional to the combined X and Y audio 326, where the signal amplitude envelope follows the highest X and/or Y signal component, the 316 and 317 circuits are both set to the same attenuation factor of ΔA+1. Therefore, either the X-APAL output audio signal 323 or the Y-APAL output audio signal 324, whichever had the higher amplitude, is set to a 0 dB output and the lower output 323 or 324 is set to a level corresponding to the original ratio ΔR of the paired-inputs 314-315.

This dual-proportional AGC process continuously and instantaneously acts upon the X-BP audio signal and Y-BP audio signal inputs 314 and 315 respectively. The X-APAL audio signal and Y-APAL audio signal outputs 323 and 324 are at all times at the same specific ratio in respect to each other, as the input X-BP audio signal 314 and Y-BP audio signal 315 are in respect to each other. Furthermore, at least one of the outputs is maintained at 0 dB, with both outputs at 0 dB if both input audio signals 314 and 315 are equal. This circuit will function and maintain the required output levels and output ratio for a dynamic input range of 60 dB.

The individual circuits that make up the APAL circuit; 316, 317, 320, 321, 325, and 327 are conventional circuits and therefore, a discussion of their operation is not required. See FIGS. 3.2, 3.3, 3.4, and 3.5.

Referring to FIG. 4.0, the ABAL 400 is comprised of 4 identical Automatic-Biased-Amplitude Levelers 404, 407, 410 and 413. Each ABAL independently performs a biased signal leveling function on its respective inputs 204, 207, 210, and 213 and produces its own bias free 0 dB±0.25 dB audio output 405, 408, 411, and 414, respectively. Contingent to the biased signal leveling function is the 60 Hz reference bias signal input 501, which is applied to each of the 4 ABAL circuits. Each ABAL, in response to the dynamic level of its respective audio input signal 204, 207, 210, or 213 and the 60 Hz reference bias signal 501, produces a dynamic bias output signal 406, 409, 412, and 415, respectively. Thus each dynamic biased output level is inversely proportional to its respective input audio level.

The system utilizes outputs 406, 409, 412, and 415 to decode threshold and audio dropout conditions relative to each of the 4 input audio signals 204, 207, 210 and 213. The dropout condition, decoded during periods of no input audio signal, is used by the system to clear phase-angle differential, phasor-differential and amplitude-differential memories. It is also used to initialize the system and to modify and generate special psychoacoustic data translator operations. The threshold condition is decoded at the instant the input audio signal drops to a known low-level where equipment noise is an undesireable factor to the A/D data processing circuits. The threshold condition is used by the system to prevent any change of state in the phase-angle differential, phasor-differential and amplitude-differential memories. Therefore, the memories of these digital localization data are protected from recoginizing noise generated data as processible information.

The output 405, 408, 411, and 414 are utilized by the system to generate precise peak-amplitude strobes, to process phasor-differentials, and to process phase-angle slopes into accurate zero-crossover decoded phase-angle differential data. Also, the 501 input is appropriately calibrated in relation to the low-level inputs 204, 207, 210, and 213, to silence the output audio channels when the lowest audio levels containing only tape hiss, or tuner hiss, or unmodulated disc-groove noise, etc., are representative of the dropout level. At the same time this establishes an optimum lower amplitude limit for the audio amplitude range to be signal processed. Output 401, comprised of outputs 405 and 408, is used by the system for ambience and SQ recovery processes.

Referring to FIG. 4.1, which is a common circuit identical to 404, 407, 410, and 413 of FIG. 4.0. The X-BP audio 416 and 60 Hz reference bias 501 are common to each of the A, B, C, and D audio BP/ABAL inputs/outputs, and the 60 Hz reference bias inputs/outputs of FIG. 4.0. Therefore, the functional description as follows will suffice for each ABAL. The 60 Hz reference bias input 501 is produced as a 0 dB output 428 when input 416 is at its worst case media noise level; assume −60 dB. Therefore, when the 426 output noise reaches −60 dB the 428 output is leveled to 0 dB. This represents an X audio dropout condition with X audio threshold concurrently active.

The X audio threshold point may be set at any point above the −60 dB level of the 60 Hz ref bias which is found to provide a useable processing level (approximately 10 dB above the noise level); assume −50 dB. When the X-BP audio input 416 is at a −50 dB level, the 2-input Combiner 417 combines signals 416 and 501 and produces output signal 418 which is routed to the MOS-FET Attenuator-X1000 Amplifier 419. Because the X-BP audio input 416 is at threshold, the X-BP audio signal predominates the peak-to-peak combined envelope of output signal 420; wherein X-BP audio equals 0 dB and 60 Hz reference bias equals −10 dB.

The 419 and 421 circuits are configured as an AGC circuit and therefore, when output 420 attempts to deviate from 0 dB, the Precision Error Voltage Control 421 applies a control voltage 422 to 419, which, in turn reestablishes the 420 output level at 0 dB.

The output 420 is then applied to an Automatic Amplitude Leveler 423 and is more precisely signal leveled to correct for any minor variations caused by the AGC circuit comprising 419 and 421. The combined audio output 424 is therefore, leveled to 0 dB±0.25 dB. The X-BP audio and 60 Hz reference bias components of output 424 are then separated by circuits 425 and 427. Circuit 425 removes the 60 Hz bias from output signal X-ABAL audio 426 which is leveled to 0 dB. Circuit 427 removes the X-ABAL audio from the −10 dB X-Dynamic bias output 428.

The decrease from the dropout 0 dB reference bias input 501 level to −10 dB therefore negates the dropout function in the system; but at this point the −10 dB X-Dynamic bias output 428 represents threshold or the −50 dB audio signal. Now, when the audio input 416 increases to any value between −49 dB and 0 dB the X-dynamic bias output 428 will respond to an inverse value between −11 dB and −60 dB, therein the threshold function is negated in the system. The circuits that typically comprise 417, 419, 421, 423, 425, and 427 are conventional circuits and require no functional description; see FIGS. 2.1, 3.2, 3.4, 3.5, 4.2 and 4.3.

Referring to FIG. 5.0, the ATDD 500 functions to detect the threshold and dropout signals that are responsive to the 4 individual audio signals leveled by ABAL 400. The 60 Hz dynamic bias input signals 406, 409, 412, and 415 are converted from analog to digital data representative of threshold and dropout conditions for the system. The 60 Hz reference bias signal 501 is produced at an output level as calibrated by circuit 548.

The 60 Hz dynamic bias inputs 406, 409, 412, and 415 are respectively applied to Precision Full-Wave Detectors 505 through 508.

The full-wave detected 60 Hz bias outputs 509 through 512 from Detectors 505 through 508 are respectively applied to Active DC Filters 513 through 516.

The active DC filters permit the use of the highly reliable 60 Hz bias source rather than an oscillator source of another frequency, because the active DC filtering method is approximately 300 times faster than a passive filter network. When any of the DC outputs 517 through 520 reaches its threshold level it causes its associated A/D Voltage Comparator 521 through 524 to produce signals $A_t$, $B_t$, $C_t$, or $D_t$, 525 through 528 respectively. These outputs are applied to the Threshold Decoder 529 which decodes an $A_t+B_t$ output 530 and/or outputs 531, 532, and 533 when the corresponding threshold levels are "OR" function active.

In like manner, when any of the DC inputs, 517 through 520, reaches the dropout level it causes its associated A/D Voltage Comparator, 534 through 537 to decode an $A_d$ output 538 and/or $B_d$, $C_d$, and $D_d$, 539 through 541 respectively. These outputs are applied to the Dropout Decoder 542 which decodes $A_d$, $B_d$ output 543 and/or outputs 544, 545, and 546, when the corresponding dropout levels are "AND" function active; outputs 530 through 533 are also concurrently active for each respective dropout output 543 through 546.

The inputs 406, 409, 412, and 415 are inversely proportional to audio levels applied to the ABAL 400 and are directly proportional to the ATDD 500 output 501.

The source utilized to obtain the 60 Hz reference bias 501 is a power transformer tap which feeds 6.3 VAC, 60 Hz signal 547 to reference bias take-off-adjust 548. Therefore, the output 501 is set by the potentionmeter in 548 to an appropriate calibrated level that causes the ABAL 400 circuitry to track a 60 dB dynamic range for each input audio signal. The circuits that comprise 505 through 508, 513 through 516, 521 through 524, and 534 through 537 are conventional circuits and therefore require no functional description; see FIGS. 5.1, 5.2 and 5.3. Also the logic circuits for 529 and 542 (see FIG. 5.4 and 5.5) are comprised of conventional logic gates and the functional description is evident by the Boolean terms.

Referring to FIG. 6.0, the PAPM 600, which consists of four identical Phase-Angle Processor-Memories 602, 609, 616, and 623. These circuits function independently on associated paired-inputs 405-408, 408-411, 411-414, and 414-405 to produce digital phase-angle differential data and digital field activity data output groups 603 through 608, 610 through 615, 617 through 622, and 624 through 629, respectively. The zero-degree digital phase-angle bit outputs 603, 610, 617, and 624 responsively share a common adjustment control consisting of a 5 micro-second to 60 micro-second Timing Window Adjustment 652. The threshold inputs 530 through 533 function to protect their respective PAPM 600 outputs by inhibiting any phase-angle bit changes, and the dropout inputs 543 through 546 function to clear or erase their respective PAPM 600 outputs comprising 601.

Input signal 1003 when in the 4-channel mode (for a 16-channel system as internally strapped within 602, 609, 616 and 623) causes outputs 604, 605, and 606 to be "ORed" with output 607, outputs 611, 612, and 613 to be "ORed" with output 614, outputs 618, 619, and 620 to be "ORed" with output 621, and outputs 625, 626, and 627 to be "ORed" with output 628. All of these outputs revert to single output functions when the input signal 1003 is in the 2-channel mode or in the 4-channel mode (for a system having more than 16 channels and wherein the internal straps are removed from 602, 609, 616, and 623).

Referring to FIG. 6.1, each PAPM functions on its respective paired audio, threshold, and dropout input signals independently and identically, therefore, the following common description explains the function of PAPM 602, 609, 616, or 623 of FIG. 6.0.

Phase-angle differential processing commences upon the application of X-ABAL audio 630° to 90° Phase Shifter 636, to 180° Phase Shifter 637, and to a Pulse Shaper 642, and upon the application of Y-ABAL audio 631° to 90° Phase Shifter 638 and to Pulse Shaper 643. Phase Shifters 636 and 637 function to phase shift the X-ABAL audio input 630 and prepare the signal for coincidence detection with the un-shifted Y-ABAL audio 631. The Y-ABAL audio 631 is phase shifted by 638 in preparation for coincidence detection with the unshifted X-ABAL audio 630. The phase shifter circuit arrangement permits SQ formatted audio signals to be shifted to zero-degree phase coincidence. The phase shifted X-ABAL audio 639 and 640, phase shifted Y-ABAL audio 641, and the unshifted audio 630 and 631 are routed to their associated Pulse Shapers 642 through 646. Each pulse shaper operates on the positive half cycle of the audio, starting at or near zero-crossover, to generate an almost ideal square wave output. Only one audio phase shift relationship between inputs 630 and 631 can exist at any given instant, therefore only 2 of the squarewave outputs 647 through 651 can be leading-edge coincident at any given instant in time.

The pulse shaper outputs 647 through 651 are applied to their associated single shots 653 through 648 and 660. The zero-cross-over timing relationship, enhanced by the non-detected negative half cycle (or dead time) of the audio signal, permits only one pair out of four possible single shot output pairs to trigger at each given instant of coincidence.

The pulse output of the single shots 653 through 658 and 660 are a result of a unique phase relationships between the X-ABAL input audio and the Y-ABAL input audio signals. These conditions are X:Y=0°, X:Y=−90°, Y:X=−90°, X:Y=−180° or Y:X=−180°. The pulse-width outputs of Single Shots 655 through 658 and 660 are fixed while the user controllable XYX0° pulse-width window adjustment of 652, permits the adjustment of the output pulse width of single shots 653 and 654 from 5 micro-seconds to 60 micro-seconds.

The time period of XYX0°, XY90°, XYX180°, and YX90° phase-angle coincidence is a function of the time that respective pulse-output-pairs 664-665, 666-667, 666-668, and 662-669 are active or low.

Thus, an increase in both single shot output pulse widths from single shots 653 and 654 means that the audio inputs 630 and 631 may vary in phase-angle coincidence, depending on frequency, from 0.72° to 86.4° and still be decoded as an XYX0° output 675. This varying of the limits of an XYX0° decoding permits the PAPM to properly function regardless of the inherent phono cartridge, stylus tracking error, tape skew, amplifier phase shifts, or any other component phase shifts from the recording-through-playback processes and equipment. Also, by adjusting the pulsewidth the user can modify the field descrete, field phasor, and Psychoacoustic Data Translator 1000 operations to achieve spatial ambience and point-source distribution modifications within each transducer field.

The $X_t+Y_t$ input 661, functions to inhibit (logic 1) or enable (logic 0) the operation of the Coincidence Comparator Memories 671 through 674. The low state of $X_t+Y_t$ input 661 enables 671 through 674 and 684. The high state of $X_t+Y_t$ inhibits 671 through 674 and 684 and represents the audio threshold level. Outputs 664 through 669 and 662 are simultaneously decoded for coincidence/anti-coincidence by Coincidence Comparator Memories 671 through 674. At the instant one paired input 663-665, 666-667, 666-668, or 662-669 is coincident it is decoded and registered as digital output 675, 676, 677, or 678; the remaining three digital outputs are anti-coincident or "notfunction" outputs. The single decoded and registered output is held in its associated memory (flip-flop) until the phase relationship between the audio inputs 630 and 631 changes to one of the three other phase-angle differentials or none of the four phase-angle differentials.

The respective not-function outputs 679, 680, 681 and 682 are produced by the anti-coincidence state of all the paired inputs 664-665, 666-667, 666-668, and 662-669, which are applied to 671 through 674 respectively. The phase relationship of the audio inputs 630 and 631 is indicative of the random phase output XYXR° 685.

The Random Phase and Field Decoder 684 decodes XYXR° when coincidence comparator memory outputs 679 through 682 are all active.

Also 684 decodes output XYX-F 686, when any one of outputs 675 through 678, or 685 is active. The condition for a reset or erase state to exist for circuits 671 through 674 and 684 is controlled by the $X_d \cdot Y_d$ input 670.

Therefore, when audio inputs 630 and 631 dropout, the ATDD 500 also generates a signal $X_d \cdot Y_d$ 670 which is applied to 671 through 674 and 684. Signal 670 clears all the internal memories by setting respective outputs 675 through 678, and 685 and 686 to inactive states, and by setting the respective "not-function" outputs 679 through 682 to active states.

Furthermore, the 2/4 channel mode input 1003 applied to the Random Phase and Field Decoder 684, in conjunction with an internal system expansion strap, performs special control functions to ensure optimum processing of all media signal phase-angle differentials. This is accomplished when the 2/4 channel-mode input 1003 is a logic level "0" during mono, stereo, or SQ media processing and outputs 675 through 678, 685 and 686 are available to the system for the single ABA field; the remaining 3 fields contain no data for processing at this time. When the input signal 1003 to 684 is a logic level "1" during CD-4 or discrete 4-channel media or during the period when XYX0° and XYXR° are both inactive; to prevent loss of audio signals, an internal strap permits phase decisions XY90°, XYX180°, and YX90° to be decoded into the XYXR° function when in the 4-channel mode and if the system is limited to 16 output channels.

Thus, this strapping feature within 684 can provide an additional 18-channels of processing for the 4-channel media, if and when the 4-channel media is encoded for XY90°, XYX180° and YX90° phase relationships.

The circuits which comprise 636 and 638, 637, 642 through 646, and 653 through 658 and 660 are illustrated in FIGS. 6.3, 6.4, 6.5 and 6.6, respectively. All are conventional circuits and therefore a discussion of their operation is not required.

The logic circuits that comprise 671 through 674 are illustrated by FIG. 6.7 and functionally described by the Boolean terms and by the timing diagram of FIG. 6.8. The logic circuit of 684 is illustrated by FIG. 6.9 and is functionally described by the logic symbol relationships and by the Boolean expressions.

Referring to FIG. 6.2, plot 687 defines the minimum useable phase-angle period of phase coincidence-to-frequency relationship when the timing window is set for 5 micro-seconds. As plot 688 illustrates, 400 Hz is at 8.64°, 1 kHz is at 21.6°, 2 kHz is at 43.2°, and 4 kHz is at 86.4°. Any further increase in the timing window would result in a progressive degradation, varying with frequency, of XYX-FD and XYX-F$\theta$ into monophonic performance. An additional plot is provided to illustrate expected parameters between plots 687 and 688 and also plots exceeding the optimum 60 micro-second timing window of plot 688.

Referring to FIG. 7.0, the Peak-Amplitude Strobe-Generator (PSAG) 700 functions to convert the positive-going and negative-going portions at the peak of each half cycle (simple or complex waveform) of the respective audio inputs 405, 408, 411 and 414 into encoded logic controlled strobe outputs 711 through 714.

Audio inputs 405, 408, 411, and 414 are applied to their respective Peak Amplitude Strobe Generators 702 through 705. Since these inputs are leveled to 0 dB±0.25 dB, the strobe generators generate strobes from predetermined or quantified peak amplitudes. Thus, the strobe generators can be set to disregard any desired portion of the audio waveform below the predetermined amplitude peak. Since the deviation in the predetermined amplitude is only ±0.25 dB the strobe generators can be set to generate strobes 706 through 709 at the 96% point of the peak amplitude where optimum peak amplitude relationships exist. Also, these strobes are synchronized to their respective audio input signals in amplitude, frequency, and phase (for pure tones or complex waveforms). Furthermore, the strobes remain synchronous even to the detected and active D.C. filtered audio of the Phasor-Differential Processor-Memories 900. Inputs 530 through 533 are applied to the Strobe Output Control 710. Each input, when high, functions to inhibit its respective ABA, BCB, CDC, or DAD strobe outputs when threshold is reached for the associated input audio signals.

When a given output of 710 is active, it is an OR-gated output function; 711=706+707, 712=707+708, 713=708+709, and 714=709+706.

Peak Amplitude Strobe Generators 702 through 705 of FIG. 7.0 are identical circuits. Therefore, the following common discussion shall suffice for each.

Referring to FIG. 7.1, the Peak Amplitude Strobe Generator is comprised of a Precision Full-Wave Detector 716 and an A/D Voltage Comparator 718. The X-ABAL audio input 426 applied to 716 is full-wave detected and applied as signal 717 to 718. Both the positive-peak and negative-peak half cycles of the audio input signal 426 are converted into the positive-going pulses 717 which are applied to 718. Circuit 718 can be set for a hystersis as definitive as 25.0 millivolts. Therefore, optimum strobe generation can be set within circuit 718 to a 96% amplitude representative strobe output. Each peak of the positive going full-wave detected signal 717 is converted from its analog amplitude peak by circuit 718 into a digital X-strobe output 719.

The circuits that comprise 716 and 718 are illustrated in FIGS. 5.1 and 5.3 respectively, and are conventional circuits which require no functional description.

The logic circuits that comprise the Strobe Output Control circuit of FIG. 7.2 are functionally described by the logic symbology relationships and the Boolean output terms and requires no further description.

Referring to FIG. 8.0, the ADPM is comprised of 4 identical Amplitude-Differential Processor-Memories 802 through 805. Each ADPM processes its respective automatic proportion-amplitude-leveled audio-input-pairs 303-304, 306-307, 309-310, and 312-313. Each ADPM produces one active digital amplitude differential decision per output group 806 through 814, 815 through 823, 824 through 832, and 833 through 841; as strobed by associated strobes 711 through 714.

All ADPM outputs 806 through 841 are forced to "0" logic levels (not-function states) when signal input SI 1002 is an active logic level "1". When SI 1002 is set to a logic level "0", this enables all ADPM registers (flip-flops, memories, or storage elements) to synchronously record the processed amplitude-differential data of the APAL 300 audio signal inputs. Therefore, the following common description shall suffice for each ADPM.

Referring to FIG. 8.1, the X-APAL audio 323 and Y-APAL audio 324 inputs are respectively applied to Precision Full-Wave Detectors 849 and 850. Detectors 849 and 850 produce detected outputs 851 and 852 that are respectively applied to Amplitude Differential Converters 853 and 854.

The field-discrete condition exists when only one unique voice or musical instrument is present in an audio field at a given instant. The placement of this field-discrete audio signal in a particular transducer of a sound field depends on the audio amplitude-differential established by the recording engineer's panpotting and also to the corresponding relationship that both media input channels are carrying symmetrical audio signal waveforms having in-phase zero-degree or zero cross-over coincidence.

Signals 851 and 852, applied to Converters 853 and 854 respectively, are converted from full-wave detected audio signals to digital priority-decoded outputs 855 through 859 and 860 through 864, respectively.

Each converter 853 or 854 functionally permits the higher digital representative voltage output to inhibit the lower digital representative voltage output, where:

X4/Y4 is active when input is less than 3.0 V

X3/Y3 is active when input is equal to or greater than 3.0 V and less than 5.3 V X2/Y2 is active when input is equal to or greater than 5.3 V and less than 7.0 V X1/Y1 is active when input is equal to or greater than 7.0 V and less than 8.9 V X0/Y0 is active when input is equal to or greater than 8.9 V and equal to or less than 10.0 V The 10.0 V maximum is limited by the power supply voltage in the associated circuits.

The Amplitude Differential Decoder 865 functions to decode inputs 855 through 864 into digital channel decisions 866 through 874 as follows:

X0·Y4=XY4;
X0·Y3=XY3;
X0·Y2=XY2;
X0·Y1=XY1;
X0·Y0=XYX;
X1·Y0=YX1;
X2·Y0=YX2;
X3·Y0=YX3;
X4·Y0=YX4.

Where allocated audio signal channels are (channel balance parameters not directly shown; see FIGS. 1.6 and 1.7):

XY4: X is at 0 dB and Y is less than −10.6 dB

XY3: X is at 0 dB and Y is equal to or greater than −10.6 dB and less than −5.5 dB XY2: X is at 0 dB and Y is equal to or greater than −5.5 dB and less than −3.1 dB XY1: X is at 0 dB and Y is equal to or greater than −3.1 dB and less than −1.0 dB XYX: X is at 0 dB and Y is at 0 dB YX1: Y is at 0 dB and X is equal to or greater than −3.1 dB and less than −1.0 dB YX2: Y is at 0 dB and X is equal to or greater than −5.5 dB and less than −3.1 dB YX3: Y is at 0 dB and X is equal to or greater than −10.6 dB and less than −5.5 dB YX4: Y is at 0 dB and X is less than −10.6 dB The Amplitude-Differential Decoder 865 permits a deviation of at least ±1.0 dB for each allocated audio signal channel pair. This deviation is a significant processing consideration in producing stable channelization of the panpotted audio images. This allowable deviation considers all channel-balance gains/losses from recording and playback equipment. If any tighter channelization is attempted, any particular panpotted image processed by the system into a point-source audio image would tend to jump back and forth between point-source transducer locations with varying frequency.

With conventional audio systems this "ping-pong" effect is evident on unique voice or instrument passages when there is a mismatch in response between two stereo transducers. This invention also resolves this transducer problem by point-source processing the audio signals.

The XYX strobe 875 input is generated on the positive peak and negative peak alternations of the X and Y audio signals and is applied to the Amplitude Differential Decoder 865.

The 865 circuit functions such that, if decoder conditions are invalid at the time of the strobe, which can be caused by occasional APAL 300 gain control variations, the decoder will inhibit the XYX D-strobe output 876. Therefore, the Amplitude Differential Memory 877 is prevented from loading illogical decisions so that the last or current logical decision remains as a valid output.

When the decoder conditions are valid, where X0 or Y0 is active, the inhibit function is disabled and the XYX strobe 875 is gated through the Amplitude-Differential Decoder 865 and applied as XYX-D-strobe 876 to the Amplitude Differential Memory 877.

Therefore, the XYX-D-strobe 876 strobes 866 through 874 into 877 and sets outputs 878 through 886 to the same logic states as the inputs. This action steers the outputs 878 through 886 to the states of their respective 866 through 874 inputs; outputs 878 through 886 are held in memory at these particular states until the occurrence of the next strobe and subsequent data change in inputs 866 through 874.

Furthermore, during the field-discrete mode, outputs 866 through 874 will go through several combinations of valid and invalid conditions for each waveform cycle. However, the memory loading function is not affected because only the valid conditions can be loaded at the time of the strobe; and strobe time is representative of optimum amplitude differential or panpot ratio conditions loaded at the instant of peak amplitude.

The SI input 1002 applied to the Amplitude Differential Decoder 865, overrides the inhibit strobe function. Therefore, when SI is present, during complete audio signal dropout, the XYX-D-strobe 876 is steady-state generated and causes all memory outputs 878 through 886 to be cleared to "0" logic levels. This clearing function is accomplished because the memory will steer on the strobe signal to the same state as the decoder 865 outputs, which must be all "0" logic levels during the audio dropout condition. This feature permits the system transducer outputs to be silenced during the time SI 1002 is active, because no active digital data is available for psychoacoustic data translation and related psychoacoustic audio demultiplexing.

The circuits that comprise 849 and 850 are illustrated in FIG. 5.1 and are conventional circuits that require no functional description.

Circuits 853 and 854, as illustrated in FIG. 8.2 use conventional A/D Voltage Comparators shown in FIG. 5.3. The functional description is provided by the output Boolean expressions.

Functional block 865 is illustrated by FIG. 8.3 which utilizes conventional logic gates. The functional description is provided by the Boolean expressions. Functional block 877 is illustrated by FIG. 8.4 and is comprised of 9 conventional steering flip-flops (D-edge triggered or other types of flip-flops may be used) 887 through 895. The outputs 878 through 886 steer to the states of the inputs 866 through 874 when XYX-D-strobe is at a logic level "1", and only one out of nine is active. Typical conventional logic for the steering flip-flops is illustrated in FIG. 8.5, which requires no further description.

Referring to FIG. 9.0, the PDPM 900 consists of 4 identical Phasor-Differential Processor Memories 902 through 905. The PDPMs independently process their respective input-paired audio-leveled-signals 405-408, 408-411, 411-414, and 414-405 and convert the audio phasor differential data into digital phasor differential data output groups 906 through 909, 910 through 913, 914 through 917, and 918 through 921, respectively. The logic level outputs of these output groups remain static between strobe pulses and are steered to each new phasor differential data change during the active states of their respective strobe pulses 711, 712, 713, or 714.

When input SI 1002 is at a logic level "1" or when all audio input signal-channels are at dropout, all digital outputs are either at or are forced to logic level "0" to prevent digital phasor differential data from being generated by noise level signals.

When SI 1002 is a logic level "0", the phasor differential processor memories resume their normal phasor differential data processing functions.

Referring to FIG. 9.1. The PDPM's function identically on their respective inputs, therefore, the common description will suffice for each. The X-ABAL 922 and Y-ABAL 923 audio inputs are applied to the phasor differential subtractor 924 where they are differentially subtracted to produce up to a unit-gain output. When both signals are identical/symmetrical (XYX-FD) output 925 equals approximately $-30$ dB$\pm$0.25 dB or approximately 0.3 volts and is therefore in-phase signal data in process by the ADPM 800. When both signals are not identical/symmetrical (XYX-F$\theta$), then output 925 is proportional to the relative phasor (phase/frequency) differences or inversely proportional to the common mode content of inputs 922 and 923. The PDPM optimum phasor differential processing is achieved only by leveling both the X and Y inputs at a 10.0 volt maximum level. If 2 voices or instruments are panpotted, one at position XY1 and one at position XY1 (see FIG. 1.8), common mode components of both are shared in the inputs 922 and 923 and therefore, each will subtract from the other in accordance with their commonmode panpotted parameters.

Output 925 is therefore directly proportional to phase/frequency difference or inversely proportional to the common mode content. As the panpotted ratio approaches X equals zero dB and Y equals minus infinity for one instrument or voice, and X equals minus infinity and Y equals 0 dB for a second instrument or voice, output 925 approaches 10.0 volts. Thus, 2 musical instruments/voices having 30 dB separation causes 925 to approach 10.0 volts. The PDPM circuitry functions to process the audio signal information and utilizes this data to reconstruct audio field phasors having two discrete images and/or one or more phantom images that substantially reduce the Haas Effect. Whereas; XYX-F$\theta$ yields (XY4·YX4)+(XY3·YX3)+(XY2·YX2)+(XY1·YX1). The output 925 is applied to the Precision Full-Wave Detector 926 where signal 925 is full-wave detected and applied as signal 927 to Active D.C. Filter 928. The Active D.C. Filter 928 removes the phase/frequency decision-error-producing audio components from the signal being processed. The active D.C. filtered signal 929 is applied to the Phasor Differential Converter circuit 930. The circuitry of 930 converts the voltage level of signal 929 into priority evaluated digital outputs 931 through 934. Functionally the highest internal voltage converter has highest priority and inhibits the lower voltage converter outputs. Therefore, based on one output active at any one time, the following relationships prevail: XY1·YX1 is less than 3.0 volts; XY2·YX2 is equal to or greater than 3.0 V and less than 4.7 V; XY3–YX3 is equal to or greater than 4.7 V and less than 7.0 V; and XY4·YX4 is equal to or greater than 7.0 V and equal to or less than 10.0 V. The 10.0 volt maximum is limited by the operating power supply voltages. The outputs 931 through 934 are gated by 937 into the Phasor Differential Memory 938. When the XYX strobe input 935 is high, the XYX-D-strobe 937 is applied to circuit 938 and all inputs 931 through 934 are strobe loaded into their respective steering flip-flops of the Phasor-Differential Memory 938. The XYX-strobe 935 occurs on each peak-amplitude of the audio signal being processed and can occur more than twice for dual unsymmetrical-complex waveforms processed by the PASG 700. When XYXD-strobe 937 is active, outputs 939 through 942 are set to the same states as inputs 931 through 934, respectively. These outputs remain static between strobes and change to a new output state only when the respective inputs change and when the strobe 937 is high. For the condition when all 4 input audio processing channels dropout, the SI signal 1002 equals a logic level "1" at gate 936 and at Phasor-Differential Converter 930. This condition forces outputs 932 through 934 low. The XYX-D-strobe 937 causes circuit 938 to load the inactive phasor-differential decisions 931 through 934 and all outputs 939 through 942 are forced low. This system function causes the phasor-differential processor-memory to inhibit the processing of false noise generated phasor differential data; and to inhibit transducer activity during audio signal dropout.

For the condition when all 4 input audio signals are present to ABAL 400, SI signal 1002 equals a logic level "0" and therefore, enables phasor-differential data processing in the PDPM.

The circuits which comprise functional areas 924, 926, and 928 are conventional circuits and are illustrated in FIGS. 9.2, 5.1, and 5.2, respectively and therefore, a functional description is not required.

Referring to FIG. 9.3, this functional block utilizes conventional A/D voltage comparators that are illustrated by FIG. 5.3 and logic gates whose functional description is provided by the Boolean expressions.

Referring to FIG. 9.4, this functional area is comprised of 4 Steering Flip-Flops 939 through 942 as illustrated in FIG. 8.5 and produces outputs 943 through 946 that steer to the states of their respective inputs 931 through 934 when XYX-D-strobe 937 is high.

Referring to FIG. 10.0, the Psychoacoustic Data Translator (PDT) 1000, which functions as the central digital data processor of this invention. The PDT decodes, encodes, correlates, and translates, the input data from the ATDD 500, PAPM 600, ADPM 800, and PDPM 900, and produces digital control and digital translated data outputs. The digital translated data is used to resolve the decoding, separation and psychoacoustic problems and deficiencies associated with the existing audio reproducing systems and their recorded media. Presently, the recording engineers are limited to a 24-track master tape for the recording process. The number of recording artists can vary from a single individual to a complete 100 piece orchestra; therefore, the possible mixed-down panpotted combinations the recording engineer must contend with, including dubbing procedures can easily reach $6.3382532 \times 10^{29}$ possibilities. These combinations comprise 64 major processing cases which function to resolve all phantom images into single point-sources and/or phasor point-sources which are placed into 1 to 4 simultaneous sound fields derived from the by 2 or 4 input audio signals. Thus, the PDT 1000 translates the mixed-down, panpotted combinations into digital translated data groups in preparation for the system demultiplexing of 16 point-source output audio signals. The PDT 1000 initially processes digital data inputs 504, 601, 801 and 901 into 14 quadrifield operation bits, 11 special operation Encoded bits, a C+D bit, 17 quadrifield sub-operation bits, and 4 adjacent field corner inhibit bits. This initially processed digital data functions to initialize the system, automatically set the system in a 2 or 4-channel media mode, correlate the discrete and phasor modes, control SQ recovery and special 2-channel phase decoding. Also this data is decoded into 4 override bits, 8 field-selector-inhibit bits, 20 field-discrete-selects, and 20 field-phasor-selects that are used to translate the 16 digital phasor differential data bit inputs and 36 digital amplitude differential data bit inputs into 36 digital translated data bit outputs having up to $3.4359739 \times 10^{10}$ audio image combinations.

The Automatic/Manual Mode Control 1020 generates a power-on sequence pulse 1001 when power is applied to the system. The pulse is of sufficient duration as to allow the power supplies and system circuits to reach their operating voltage levels and stablize. The power-on sequence pulse 1001 sets the 2-channel mode of operation and presets the system's format selector and field rotation position-selector for the standard format and rotation. Inputs 504, 601, 801, 901 to the PDT 1000 are simultaneously available and synchronous with the system processing status of 2 or 4-channel audio inputs.

As illustrated, the 5 phase bits 1007, of input 601 are applied to the Automatic Mode Control 1020 for mode processing. The 4 field activity bits 1012 is applied to the 4-Line to 16-Line Decoder 1013. The 1013 circuit decodes input 1012 into 16 quadrifield operation bits by a binary decoding operation and produces output 1014 comprising 14 QFO bits. The 1014 data is applied to the quadrifield operation decoders 1019.

The 4 dropout bits input 504 is applied to the Special Operation Encoder 1016. The 1016 circuit encodes input 504 into a C+D output 1018 and the 11 SOE bits output 1017.

The 1018 output, corresponding to the 4-channel input media mode, is applied to 1020.

The 1017 output is 11 special operation encoded bits that are applied to 1019. The input bits of 504 become active when their respective input audio channels drop out or reach the noise level. When all 4 bits of 504 become active, the "AND" function of these bits in the PAPM 600 circuit causes all 4 field bits 1012 to be cleared to quadrifield operation logic level "0" states. The 1013 circuit produces quadrifield operation logic level "0"s and the 1016 circuit produces an SOE bit corresponding to the dropout states of the 504 input.

These bits are decoded by circuit 1019 and applied as a system initialize signal (SI) 1002 to 1020 and to the PDPM 900, and the ADPM 800. The SI 1002 signal forces inactive logic level "0" states at the outputs of the PDPM 900 and ADPM 800. It also presets the system to a 2-channel mode via circuit 1020, and disables the ambience-SQ recovery function of circuit 1800 (see FIG. 1). Therefore, inputs 601, 801, 901 comprised of 64 data bits are all set to logic level "0" states.

The active state of the C+D audio signal 1018 sets the 4-channel mode, therefore, the inactive state sets the 2-channel mode. A delayed response to the inactive state of signal 1018 functions to prevent the loss of the 4-channel mode during quiet passages of the 4-channel input media. The adjustable preset delayed response to the inactive state of signal 1018 permits the 1020 to revert to the 2-channel mode in anticipation of a 2-channel media input if the time limit is exceeded; otherwise the 4-channel mode awaits the return of 4-channel input media. Therefore, the SI sequence or each power-on sequence will cause the Automatic/Manual Mode Control 1020 to set the system to the 2-channel mode via output 1003.

When the C+D signal 1018 is active, corresponding to a 4-channel input media, 1020 sets the 2/4 channel mode 1003 output to a logic level "1".

The 1003 output automatically controls; special system phasor recovery functions in the PDPM 900, sets the Automatic/Manual Format Selector 1100 to the correct mode for manually selected formats, and sets the Dynamic Ambience and SQ recovery Controller 1800 for 2-channel concert hall or for 4-channel reverb-synthesized ambience.

The 5-phase bits input 1007 is applied to the Automatic/Manual Control circuit 1020. The 1020 circuit performs a unique 2-channel mode decoding function on the phase bits to generate special format terms which are used for ambience-SQ recovery processing. The 1020 circuit decodes digital output signals 1021 through 1025 which are routed, with only one active at any one instant, to the system as output 1004. Contingent to the 1004 output is the synchronous and logical changes in phase bits 1015, QFO bits 1014, SOE bits 1017, and QSE bits 1030, which are applied to the Quadrifield Operation Decoders 1019. Thus, concurrent to the above bit changes are the associated data changes of the total 52 bits of digital data contained in the 801 and 901 inputs which are applied to the Quadrifield Translator 1026 and to the Quadrifield Sub-operation Encoder 1028. The 1028 circuit, in response to the 1027 inputs, encodes 17 QSE bits output 1030, which is applied to circuit 1019. These encoded bits are used to execute field directional decisions associated with resolving the CD-4 disc and discrete 4-track tape channel separation deficiencies and are also encoded to produce four adjacent field corner inhibit bits 1029 when the interfield discrete decisions must dominate.

Digital data 1014, 1015, 1017, and 1030, applied to the Quadrifield Operation Decoders 1019, are decoded by one of the 14 internal quadrifield operation decoders into outputs 1002, 1031, 1032, 1033 and 1034.

The 1031 output is applied to the Quadrifield Translators 1026 and is unique only to quadrifield-operation decoder-zero, which functions to prevent the loss of an audio input signal that is above dropout while all 4-field bits 10112 are inactive.

The 1032 output is applied to Quadrifield Translators 1026 and is a one-active-out-of-eight field sector inhibit bits (8-FSI bits). The 8 FSI bits are decoded for all possibilities of simultaneously adjacent fields and alternately active field-discrete and field-phasor decisions. This decoding inhibits half-field-sector phasor activity while permitting activity in the remaining field phasor portion during field-discrete activity of the adjacent field. There are 40 possibilities as a result of any 1 of 13 quadrifield operation decoders (excluding zero), which catagorically correspond to the possible $6.3382532 \times 10^{29}$ panpotted and mixed-down combinations. The Quadrifield Discrete-Phasor Convergers 1035 converges or "OR" gates the 1033 and 1034 inputs into the 4 field-discrete selects (4-FD SEL) output 1036 and/or the 4-field phasor selects (4-F$\theta$ SEL) output 1037, which are applied to the Quadrifield Translators 1026.

The Quadrifield Translators 1026, utilizing the 16 phasor-differential data bits 901, the 36 amplitude differential data bits 801, the 4 override bits 1031, the 8 field-sector-inhibits 1032, the 4-field-discrete-selects 1036, and the 4-field-phasor-selects 1037, continuously translates all digital data inputs into 36 digital translator data bit output groups 1038 through 1041 which are routed to the system as output 1005. The 1005 digital data output is ultimately utilized to resolve the psychoacoustic relationships of the $6.3382532 \times 10^{29}$ panpot combinations heretofore mentioned. All PDT 1000 outputs are held at steady state logic levels between input data changes.

The processing of audio signal information as heretofore described also applies to all recording methods which do not utilize the panpotting procedures. However, the resulting sound field will not have the point-source of phasor definition that the panpotting methods achieve. Such recordings will be reproduced with a unique sound field distribution superior to the existing stereophonic/quadriphonic systems. In effect this system provides the greatest media/hardware compatibility that is possible to achieve.

Referring to FIG. 10.1, which is a conventional integrated circuit package which functions as a 4-Line to 16-Line Decoder 1013. The decoder operates on input 1012 which corresponds to system field inputs 608, 615, 622, and 629 from the PAPM 600. The decoded outputs are one-active-at-a-time, quadrifield operation outputs 1042 through 1055. These outputs are the 14 quadrifield operations previously discussed, whereby each unique QFO output term is decoded as shown in FIG. 10.2; these QFO outputs are applied to the system as output 1014.

Referring to FIG. 10.2, which is a truth table illustrating the 4 audio channels of digital field activity (ABA-F, BCB-F, CDC-F, and DAD-F) as decoded into quadrifield operation digital outputs QF00 through QF15, excluding QF05 and QF10 which are "NO OP" since adjacent field activity will exist for these two operations.

Referring to FIG. 10.3, which is the Special Operations Encoder whose functional description is illustrated by the Boolean expressions.

Referring to FIG. 10.4, which is the Automatic/-Manual Mode Control 1020. Upon application of power to the system of +5 volt DC level 1058 is applied, and its associated transient is coupled through capacitor 1059 to pulse set gate 1061 of the cross coupled flip-flops 1061-1062. Because inverter 1073 output 1074 is logic zero at gate 1062, the 1061-1062 flip-flop is set and 1001 is held high unti the delayed logic level "1" pulse input 1074 resets flip-flop 1061-1062. Resistor 1060 establishes a logic "0" input to 1061 after capacitor 1059 fully charges to +5 volts. The power-on sequence pulse 1001 is fed back to gate 1063 and regardless of the state of the SI signal 1002, causes a high output 1064 to reverse bias diode 1065. This reverse biasing allows capacitor 1068 to begin charging through the UJT gate protection resistor 1067 and variable resistor 1066. The rate at which capacitor 1068 charges toward +5 volts is established by the time constant of resistor 1067, variable resistor 1066, and capacitor 1068. The variable resistor 1066 is set to the resistance value that prevents the system from reverting to the 2-channel mode when silent passages are experienced during a 4-channel media input. Therefore, the power-on sequence pulse 1001 is the same duration as the delayed SI 1002 during the 2-channel reversion function.

For a silent passage during a 4-channel media input, the optimum delay may be approximately 5 seconds. At the end of the delay, when capacitor 1068 reaches a charge of approximately 0.6 volts, input 1069 fires UJT 1070. At this time the capacitor 1068 is dumped by the low resistance path of the UJT gatebase junction to ground. The resultant UJT current flow spike through resistor 1071 causes a 1072 negative-going transition at the input of inverter 1073. The output 1074 of inverter 1073 goes high and resets the flip-flop 1061-1062 and therefore, the power-on sequence pulse 1001 goes inactive or low. With this condition met, the gate 1063 will follow the state of the SI input 1002 and the system power-on sequence is ended.

When the SI 1002 input is logic zero and with power-on 1001 output logic zero, the output of gate 1063 is low, the diode 1065 is forward biased and the UJT 1070 input 1069 is held low. Therefore, the UJT circuit is disabled. When the SI input 1002 is logic one during no audio input to the system, the UJT fires again after the preset delay of 1066, 1067, and 1068. However, when 1074 went high at the end of the power-on sequence, flip-flop 1061-1062 was set and is not affected at this time by 1074, unless power is interrupted. Functionally 1074 and 1018 inputs to flip-flop 1075-1076 can never be simultaneously high. Therefore when the C+D input 1018 is high, indicating the presence of a 4-channel input media, the flip-flop 1075-1076 output 1078 is set to a logic zero. The 1078 output is fed through inverter 1091 and closed contacts 1080 and 1081 of the Automatic/Manual Mode Selector switch 1079 as the 2/4 channel mode output 1003. When manually operated selector switch 1079 is set to make contacts 1083 and 1081, a logic zero output 1003 is the 2-channel mode. When 1079 is set to make contacts 1082 and 1081, a logic "1" output 1003 is the 4-channel mode. Thus contact 1080 is the automatic mode control switch position while 1082 and 1083 are the manual 4 and 2-channel modes, respectively.

During the 2-channel mode, output 1085 from inverter 1084 enables gates 1086 through 1090 which produce the one-active-at-any-instant outputs 1021 through 1025 that are routed to the system. These outputs control quadrified format terms and the ambience-SQ recovery processing of the system.

Referring to FIG. 10.5 through 10.24, which are functional logic diagrams as described within FIG. 10.0; these figures are functionally described by their respective Boolean expressions.

Referring to FIG. 10.25, which is a tabular illustration of the major processing cases handled by the PDT 1000. Major case C001 is decoded when all 4 channels of input audio signals are at dropout. This case causes the system to revert to a 2-channel digital control mode, provided the preset time delay is exceeded, and forces the ADPM 800 and PDPM 900 circuits to produce all logic level zero outputs. At this time, bass audio signals may be active but the direct and ambience output audio channels are silent.

Major cases C002, C003, C004 and C006 function in a similar manner, however, these cases handle those audio input conditions where only one audio input channel has audio present while the remaining three channels are at dropout. This type of audio input causes the PDPM 900 and ADPM 800 circuits to remain in an erased and inhibit state. Therefore, to prevent loss of this single audio signal output an override decision is generated. The presence of only one audio input channel indicates to the system that the audio logically belongs in its respective sound-field corner transducer location; A=AB4, B=BA4, C=CD4, or D=DA4 (see FIGS. 1.12 through 1.15).

Major cases C005 and C007 function in a similar manner as cases C002, C003, C004, and C006 except diagonally opposite audio channel input signals are handled; A and c, B and D (see FIGS. 1.14 and 1.15).

Major cases C008, C013, C019, C027 function in a similar manner on their respective sound fields. Case C008 will occur for a 2 or 4-channel input media. Cases C013, C019, and C027 are applicable only during 4-channel input audio signals. Each of the cases are indicative of a zero-degree phase-angle compare where a unique panpotted image is active for processing into a point-source transducer location. For example; when the field discrete decision ABA-FD is active, then any one of 9 possible panpot images will be resolved as a point-source transducer location. Wherein resultant quadrified translator output ABAFD yields AB4+AB3+AB2+AB1+ABA+BA1+BA2+BA3+BA4 (see FIGS. 1.12 and 1.13).

Major cases C009, C014, C020, and C028 function in a similar manner on their respective sound fields. Each case is indicative of a random degree phase angle compare where a phasor image is active for processing into dual transducer locations. Wherein resultant quadrifield translator output ABA−F$\theta$ yields (AB4·BA4)+(AB3·BA3)+(AB2·BA2)+(AB1·BA1), (see FIGS. 1.14 and 1.15).

Major cases C010, C011 and C012 are special SQ or matrix signal processing cases involving 90-degree or 180-degree phase shifts operating independently of PDT 1000 processing. Case C011 permits the recording engineer to encode a 180-degree phase-angle relationship which cannot be utilized by current SQ or QS methods.

When either case C010 or C012 is analog processed by the current "gain-riding logic" techniques, a loss of front audio signal information is experienced. This system restores the front audio signal information that would have otherwise been lost. When front audio information predominates, any residual SQ media signal information is also restored via the ambience/SQ recovery function and placed in the rear transducer channels.

Major cases C015, C021, C029, and C035 function in a similar manner and permit the recording engineer to panpot identical audio information into 2 adjacent fields for achieving special effects. However, CD-4, because of its channel separation limitations will cause cross-talk or mirror images of a predominate sound field to appear in an adjacent sound field. For these cases the system adjacent field corner inhibits will eliminate the mirror image in adjacent sound field. This can be seen in case C015 if ABA is the predominate sound field the CD-4 channel separation relationship would cause a BC4, AD4, and CDC image placement decision but the Adjacent Field Corner Inhibit BC4-AD4 (as shown in FIG. 10.25) and decoder functions will cause all but ABA processing to be terminated. Therefore, these cases expand the approximately 20 dB of channel separation of CD-4 to a near infinite channel separation.

Major cases C016, C017, C022, C023, C030, C031, C036, and C037 function in a similar manner to their respective sound fields. Each case is representative of one sound field being discrete and the other sound field being phasor. The sound field that is carrying the discrete audio information is logically given priority for sound field operation. The field-discrete decision indicates that its 2-channel input field poles are carrying identical audio signal information and a field pole is shared with the field-phasor. Therefore, the field-discrete decision functions independently of the field-phasor and always has the highest processing priority. Furthermore, the field-phasor is prevented from duplicating the field-discrete audio information by a field sector inhibit function that disables one-half of the phasor field. The other half of the phasor field reproduces the audio of the fieldpole input not related to the two fieldpoles carrying the identical panpotted audio information. As can be seen, if a solo singer is panpotted into the A (0 dB) and B (0 dB) pole inputs for the ABA-field (see FIG. 1.15) and trombones are directly panpotted into B(−60 dB) and the C (0 dB) pole inputs; the solo singer for the ABA-FD condition will be reproduced at transducer location ABA and the trombone for the BCB-Fθ condition will be reproduced at the CB4 transducer location. The field-phasor condition BCB-Fθ alone would normally reproduce (BC4·CB4) at transducer locations but BC4 is logically inhibited by the field sector function.

Major cases C018, C024, C032 and C038 function in a similar manner. Each case is indicative of both adjacent fields carrying phasor audio information. As can be seen if case C018 had three instruments or voices being recorded; the ABA-Fθ and BCB-Fθ conditions yield (AB4·BA4) and (BC4·CB4) decisions, therefore, the audio would be reproduced as three discrete corner point-sources AB4, BA4, and CB4 (see FIG. 1.14 and 1.15).

Major cases C025, C033, C039 and C041 function in a similar fashion. Each case resolves field ambiguities for field discrete decisions for certain circumstances when two poles dropout leaving phase angle decisions in adjacent fields. Therefore, these cases function to preclude the phase angle decisions and function similarly to the major cases for single field-discrete activity.

Major cases C026, C034, C040, and C042 are similar to each other and to major cases C025, C033, C039, and C041 except the fields are phasor reproduced.

Major cases C043 through C053 are similar to each other and to major cases C015, C021, C029, and C035, except the 4 field-poles are carrying identical audio information. These cases can be utilized for special effects produced by the recording engineer and to resolve the channel separation deficiencies of the CD-4 media/system.

Major cases C054 and C057 are similar to each other and are very unique cases because two opposite fields are discrete and the other two opposite fields are phasor active. The PDT 1000 examines the corner bits and logically decides the discrete fields are valid and rejects the phasor field activity. This resolves further channel separation deficiencies of the CD-4 system.

Major cases C055, C056, C058, and C059 function in a similar manner and are alternate phasor decisions for major cases C054 and C057. The PDT examines the corner bits and determines the correct field-phasor decision for each case. These conditions resolve the CD-4 deficiencies.

Major cases C060 through C063 function in a similar manner. Each case indicates one field is discrete and the other three fields are phasor. For these conditions the field-discrete function predominates and the adjacent phasor fields are rejected because they are not common to the discrete field. However, the adjacent field-phasors are common to the field-phasor opposite the discrete field, therefore, the field-phasor opposite the discrete field is executed.

Major case C064 is indicative of any arrangement from 4 discrete instruments or voices in a 4 corner surround sound configuration to a complete 100 piece orchestra for a 4-field pole input. This case executes the ABA-Fθ, BCB-Fθ, CDC-Fθ, and DAD-Fθ decisions which, if 24 panpotted combinations are involved then up to $8.3886080 \times 10^6$ possible phasor operations are allocated four-at-a-time to 4 simultaneously active phasor fields.

Referring to FIG. 11.0, the Automatic/Manual Format Selector (AMFS) 1100, which functions to provide the user with the means to select the 16 distribution formats (32 with the operation of a normal/reverse FCP switch) that are utilized by this invention for audio signal processing. Two of the 16 formats are automatically selected by the power-on 1001 sequence control signal and also generated in response to the digital logic level of the 2/4 channel mode signal 1003. After the power-on sequence is complete, the user may select any of the other formats or retain the automatic power-on selected format. When manual format selection is made, the selection decision is held in the AMFS, and the format is determined by the state of the 2/4-channel mode 1003 control signal. The logic circuitry of the AMFS 1100 functions to control digital format-selection in the GFES 1200, and also the audio output formats in the PAD 2000. The AMFS 1100 is also, functionally, the reliable electronic equivalent of a less desireable mechanical station-interlock switch.

Formats 1 through 16 select-switches 1103 through 1118 respectively, are micro-miniture SPST memory pushbutton switches that apply (when pressed) ground 1119 to each of the digital-station-interlock (DSI) flip-flops 1142 through 1157 respectively. As each format switch is independently pressed, its associated DSI flip-flop is set and all other DSI flip-flops are reset via steering-isolation diodes 1120 through 1135, respectively. The power-on 1001 sequence signal applied to drivers 1136 and 1137, sets the DSI flip-flops 1143 and 1150 through steering-isolation diodes, 1140 and 1141 respectively, and all other DSI flip-flops are reset. The 2/4 channel mode control signal 1003, applied to driver 1138, and output signal 1139, applied to the output control logic-gates 1162 through 1169, 1174 and 1175, cause the system user's 2-channel mode format selection to be gated to the system by the associated 2/4 channel mode logic "0" signal. Signal 1139 applied to driver 1140 is routed as signal 1141 to output logic-gates 1170 through 1173, 1176, and 1177. Signal 1141 causes the system user's 4-channel mode format selection to be gated to the system when the associated 2/4 channel mode is logic "1".

Referring to FIG. 11.1, which is a table illustration of the selected format and respective mode, input media, transducer activity, and overall format operational characteristics for each of the 16 possible user selectable formats.

For example, in format 1: the 2-channel mode establishes 16 active bass transducers if a maximum transducer configuration is employed. A mono input media causes one of the direct transducers to carry point-source direct-audio and one transducer to carry reverb ambient-audio signal information; a regular stereo input media causes three transducer-channels to carry point-source direct-audio and three transducer-channels to carry ambient-audio information. The matrix-SQ, QS, etc., input media causes 2 of the 6 transducer-channels to carry SQ matrix audio signal information. The overall format operation characteristics of format 1 creates a basic concert hall configuration. The table illustrates the availability of active transducer-direct and ambient information outputs for each format selected by the mode of input media. Format 1 with a stereo input media, utilizes transducer channel positions 2, 3, and 4 for the direct-audio information and transducer-channel positions 10, 11, and 12 for the ambient-audio information (see FIG. 1.10 for relative positions).

The bass audio is applied to transducers 1 through 16. The matrix input media generates additional direct point-source information applied to transducer-channel positions 9 and 13 (see FIG. 1.10).

Format 1 can be best utilized when recovering a stereo recording of a trio group or an SQ recording of a quintet. This format, because of its corresponding transducer locations in the system transducer configuration, restores a more realistic group position to the performing artists. Whereas, in conventional stereo systems, the group may be spread out over a wide area of the listening environment, projecting an unnatural size sound field. However, the user has nine other formats to choose from to manipulate the positioning of the aforementioned trio/quintet.

For example, in format 10; a 4-channel mode produces a sound field of 16-direct point-sources, and 16-pseudo-point-sources. The overall format operation characteristics are surround sound. The table illustrates the availability of 16 transducer-channels to carry the bass audio and up to 8 transducer-channels at any one time to carry direct/ambient phasor audio information. Also any 2 opposite fields simultaneously produce precisely defined direct-audio and ambient-audio point-sources.

The table completely illustrates the availability of transducer-channels for direct and ambient audio information for other formats and the mode of operation, media input utilized, etc..

Referring to FIG. 11.2, which is comprised of conventional logic gates functioning as a Digital Station Interlock Flip-Flop as illustrated by the figure; no further discussion is necessary.

Referring to FIG. 12.0, the Quadrified Format Encoder-Selector (QFES) 1200 functions to encode the 41 bits of digital translated data applied from the Psychoacoustic Data Translator 1000 into 256 encoded format selectable bits. These 256 encoded format bits, representing the inter-relationship of the 4 audio sound fields selected by the system user, are selected in 16 bit groups for any one of the 16 possible formats.

The digital bit inputs 1004, and 1005 which is comprised of 1038, 1039, 1040, and 1041, are encoded by Field Format Encoders 1206, 1207, 1208 and 1209, respectively. The respective field format encoder outputs 1210, 1211, 1212, and 1213 are epplied to the Quadrified Format Selector Convergers 1220. Additional field format encoder outputs 1214, 1215, 1216, and 1217 are applied to the Quadrified Corner Format Encoder 1218, where the digital inputs are encoded into 8 QCF-E-bits and applied as output 1219 to circuit 1220. The 16 FMS input 1101 is applied to the Format Mode Select Encoder 1221, where they are encoded to meet fan-out requirements, and applied as output 23 E-FMS 1222 to circuit 1220. The Quadrified Format Selector Convergers 1220 utilizing inputs 1210, 1211, 1219, 1212, 1213, and 1222, generates outputs 1223 through 1238. Therefore, millions of PDT translations are reduced to 16 formats, and hundreds of millions of digital pattern possibilities are reduced to tens of thousands of possible transducer pattern selections. The Quadrified Format Selector Convergers 1220, consists of conventional logic gates that make up 16 similar logic circuits. Each circuit produces a quadrified format bit output. Each output bit and the Boolean expression for the possible formats is illustrated and described by FIGS. 12.1 through 12.4.

Referring to FIGS. 12.1 through 12.4 which illustrate in tabular form the 256 encoded bits of digital information in Boolean expressions that the QFES 1200 circuit functionally processes. Each quadrified format bit takes on the encoded Boolean expression for each associated format.

Referring to FIGS. 12.5 through 12.26, which are digital logic circuits that comprise the QFES 1200. Each circuit consists of conventional logic gates that are functionally described by the Boolean expression utilized on the respective figures and therefore, require no further discussion.

Referring to FIG. 13.0, the Quadrified Rotation Position Selector (QRPS) 1300 which functions to rotate the entire audio sound field in a 360° clockwise direction in response to the user's manually controlled selection. The front-center audio channel ABA, transducer position 3, (see FIG. 14.9), is utilized as the sound field rotation-reference position. The user can manually set the entire audio field to shift in increments of from 1 to 16 transducer locations at a time. An automatic swirling function of the sound field, with adjustable swirling rate (not shown) could be incorporated using a ring counter to provide an "OR" function control in conjunction with the pushbutton switches.

The sound field rotation function provides the user with several advantages over a fixed field distribution. It permits the user: (1) to change the geometric shape and distribution of the performance group or orchestra in the sound field; (2) to change his relative acoustical position in the sound field without changing his physical position; and (3) to change his listening area decor and seating arrangements and/or acoustical environment without the physical relocation of the transducers.

The QRPS 1300, utilizes a uniquely modified series-parallel shift register and associated control logic to perform its required functions.

The field rotation position selector 1303, provides a manual selection function. When power is applied to the system, power-on 1001 sequence input presets the FRPS 3 position as the standard reference position, front-center-channel, transducer location 3, (see FIG. 14.9). The FRPS 1303 output 1301 is applied to the Load-Shift-Strobe-Control circuit 1304 and also to the Direct Channel Output Selector 1500 which performs field rotation of the direct channel commutation data.

During the power-on sequence, when no other field rotation position is selected, the FRPS 3 input, via signal 1301, is applied to the Load-Shift-Strobe Control circuit 1304, which is forced to a steady-state condition. Wherein, load pulse 1305, and strobe pulse 1307 outputs are set to their respective active states and shift pulse output 1306 is inhibited. Therefore, the field rotation shift register 1308 and field position bit register 1310 are functionally configured to pass, unaltered, signal data bits QFFB 1 through QFFB 16 1201 through 1308 as 1309 which is applied to 1310. This data is then applied to the system as output FRPB 1 through FRPB 16 1302. The output 1302 tracks the input 1201 at a minimum through-put characteristic of approximately 20 nanoseconds. For every field rotation reference position manually selected, via circuit 1303, the corresponding output FRPS 1 through FRPS 16 1301 will produce a change of state in circuit 1304 which synchronously generates the load control pulse 1305, shift control pulse 1306 and strobe control pulse 1307. The load pulse 1305 gates QFFB 1 through QFFB 16 1201 into the field rotation shifte register 1308. In effect, this loaded data writes over the previous loaded data. When load pulse 1305 changes to the inactive state the shift pulse 1306 begins to clock circuit 1308 and the parallel-loaded data is serially shifted the required number of intervals in response to the FRPS signal 1301 as set by circuit 1303. The shift pulse 1306 requires less than one micro-second to accomplish its longest shift procedure of 16 positions. When the shift pulse (a train of clock pulses) 1306 terminates, the shifted data output 1309 is loaded by strobe pulse 1307 into the Field Rotation Position Bit Register 1310. The input data bits 1201, appropriately field shifted, are routed by circuit 1310 as outputs FRPB 1 through FRPB 16 1302. At the end of the strobe pulse 1301; the loading, shifting and strobing processes repeat continually and therefore output 1302 changes state only when the associated input data 1201 changes state.

Referring to FIGS. 13.1 and 13.2 which illustrate in tabular form the shifting or rotation operations performed on QFFB1 through QFFB16 input data in response to a user FRPS1, or FRPS3, or . . . FRPS16 preselect and the corresponding FRPB1 through FRPB16 output data. For example, if the user preselects FRPS3, then the output FRPB1 through FRBP16 are representative of input data QFFB1 through QFFB16, respectively. If the user preselects FRPS14 then the output data FRPB1 through FRPB16 are representative of input data QFFB6 through QFFB16 and QFFB1 through QFFB5, respectively. In the first example FRPS3 is a preselect that corresponds to the front and center channel transducer 3 of FIG. 14.9. The second example FRPS14 corresponds to the repositioned front and center channel appearing at transducer 14 of FIG. 14.9. Further, a direct correlation of FRPS1 through FRPS16 is shown by the typical audio output display 2121 of FIG. 21.0; wherein FRPS1 output 2117 is generated by the FRPS1 momentary switch of 2115.

Referring to FIG. 13.3, which is the Field Rotation Position Selector circuit. The circuit is comprised of 16 digital station interlock (DSI) flip-flops as used in FIG. 11.2.

Each DSI flip-flop consists of conventional digital logic gates functioning as interlock flip-flops that are controlled by their respective ground switching memory switches FRPS1 through FRPS16 (2121 on FIG. 21.0) and by the preset function of power-on sequence pulse 1001.

Referring to FIG. 13.4, the Load-Shift-Strobe control circuit. When enable clock 1311 (generated at the end of the load pulse 1325) is applied to the 16 MHz Clock Circuit 1312, it gates 16 MHz clock output 1313 to 4-Bit Binary Counter 1314. The 4-Bit Binary Counter 1314 starts to count to the binary count of 15. The counter output 1316 is decoded by the 4-Line-to-16 Line Decoder 1317 and the result is applied as a 16 bit, one-active-at-a-time, output 1318 to the Count Equals FRPS Comparator 1320. When input 1318 binary count equals input 1319, the comparator 1320 generates output count equals FRPS 1321, which is applied to the 35 nano-second Strobe Pulse Generator 1322. The Strobe Pulse Generator 1322 produces strobe pulse output 1323 which functions to inhibit clock circuit 1312, via gate 1327, and therefore, the shift process terminates. The output 1323 via gate 1327 also resets the 4-Bit Binary Counter 1314 and causes the Output Control circuit 1315 to generate strobe pulse 1307. The termination transition of the strobe pulse 1323 causes the Load Pulse Generator 1324 to generate a 25 nano-second load pulse 1325 which is applied to the Output Control Circuit 1315. This load pulse causes the Output Control circuit 1315 to gate load pulse 1305 to the output. The termination transition of the load pulse 1325 causes the Load Pulse Generator 1324 to generate a 25 nano-second enable clock 1311 which is applied to the 16 MHz clock circuit 1312. This pulse initiates a new load-shift-strobe cycle as just described. During the power-on sequence, the active high FRPS 3 input 1326 applied to 1315, forces the Load pulse 1305, shift pulse 1306, and strobe pulse 1307 to active logic highs and 1328 to logic low. Signal 1328 in the low state, holes 4-bit binary counter 1314 in the reset state and disables 16 MHz clock circuit 1312. Therefore, shift pulse 1306 output is steady state logic "1" during FRPS 3 or a pulse train, whose number of pulses are equal to 1 through 15 for CNT=1 through CNT=15, respectively and for FRPS4 through FRPS 16 and FRPS1 and FRPS2, respectively.

Referring to FIGS. 13.5 through 13.9, which are comprised of conventional logic gates. Their function is illustrated and described by the logic symbology and/or waveforms and therefore, require no further description.

Referring to FIG. 13.10, the Field Rotation Shift Register, which is a conventional cascaded 40 MHz shift register with an asynchronous, parallel load feature as loaded by the load pulse input. The circuit is arranged to provide a serial data feedback from flip-flop QFFB16 to flip-flop QFFB1 to meet system requirements for a 360° clockwise rotation of the transducer-channels in one step increments. Serial shifting is executed by the shift pulse input (the 16 MHz pulse train metered by the user's FRPS select).

Referring to FIG. 13.11, the Field Rotation Position Bit Register, which is comprised of 16 conventional steering flip-flops whose outputs, gates by the strobe pulse, follow the states of their respective inputs.

Referring to FIG. 14.0, the Quadrified Configuration Encoder-Selector (QCES) 1400, which functions to provide the user with the means to configure the system with a minimum of 4 transducers and to expand the configuration to a maximum of 16 transducers. With a maximum of 16 transducers configured, the effective result is a 32-channel point-source system. The user can expand the basic 4 channels to 5, 6, 8, 10, 12, 14, and 16 transducer-channels. Upon expansion, the QCES manages each configuration, as synchronized with the millions of PDT 1000 translations, and allocates the proper data bits in relation to the selected formats and 16 field rotation selections. The QCES 1400 automatically sets the proper attenuation for bass volume for each system transducer configuration.

The use of headphones requires four discrete audio channels, therefore, the QCES overrides the system transducer configuration feature, and attenuates bass volume when the headphones are in use. The QCES also synchronizes the simultaneous operation of the Direct Channel Output Selector (DCOS) 1500, and the Ambience Channel Output Selector (ACOS) 1600.

As illustrated, the FRPB 1 through FRPB 16 input 1302 is applied to the Field Rotation Position Bit Encoder 1406, where the bits are encoded into a 26-Encoded Field Rotation Position Bits (26-E-FRPB) output 1407 which is applied to circuit 1408.

The System Configuration Select Encoder 1404 is manually set by the user to the configuration desired. The 1404 circuit encodes the selection, and routes the 19 Encoded-System Configuration Selects (19-E-SCS) 1405 to the System Configuration Selector 1408. The 1404 circuit produces system bass attenuation control signals SCS5, SCS6, SCS8, SCS10, SCS12, SCS14, and SCS16, comprising output 1401. The 1404 circuit in response to 2018 also generates the DRE output 1403 to defeat any graphic room equalizer in use when the headphones are connected. When the headphones are put in use, the 1404 circuit produces a Phones-In override (PIO) output which sets proper bass attenuation for the 4-channel audio reproduced by the headphones.

The 1405 selection signals and 1407 encoded FRPB data are applied to the System Configuration Selector 1408 which produces SCB1 through SCB16 for each of the possible configurations. The output 1402 is routed to the system Direct and Ambient Channel Output Selectors 1500 and 1600, respectively.

Referring to FIG. 14.1, which is a table illustration of the transducer location and system configuration bits versus the 8 possible system configurations selected by the user and the field rotation position bits utilized for each. A 16-CH system configuration select results in SCB1 through SCB16 representing FRPB1 through FRPB16, respectively. Thus, SCB1 through SCB16 corresponds with TL1 through TL16 or to transducer locations 1 through 16 as shown in FIG. 14.9.

Referring to FIG. 14.2 through 14.9, which are graphic illustrations of the typical user transducer configurations; with each configuration having transducer locations that can be correlated to the system channel bits (SCB) and system configuration selects (4-CH, 5-CH . . . 16-CH) of FIG. 14.1.

Referring to FIG. 14.10, the Field Rotation Position Bit Encoder, which consists of conventional logic gates and therefore, is described by the Boolean expressions.

Referring to FIG. 14.11, which is the System Configuration Select-Encoder that encodes SCS bits in response to the 4CH, 5CH, 6CH, 8CH, 10CH, 12CH, 14CH, 16CH position of System Configuration Selector 1410 or by 2018. When the headphones are configured 2018 energizes the magnareed Relay 1409. This opens the wiper arm grounds of the dual-8-position rotary selector switch 1410, forcing a 4-channel configuration; this action disables all manually selected positions of 1410. Both outputs 1403 and 1411 are grounded to provide proper headphones dynamic tracking functions in the ADLC 1900 and DAOC 1700, respectively. Outputs 1401 control bass equalization in ADLC 1900 and outputs 1405 are applied to the System Configuration Selector 1408 (FIGS. 14.12 and 14.13). The circuit is comprised of conventional logic gates as illustrated and the functional description is presented by the Boolean expressions.

Referring to FIG. 14.12 and 14.13, the System Configuration Selectors, which are comprised of conventional logic gates. Outputs comprising 1402 of FIGS. 14.12 and 14.13 are applied to 1500 and 1600. These logic circuits are described by the Boolean expressions and logic symbology and therefore, no functional description is required.

Referring to FIG. 15.0, the Direct Channel Output Selector (DCOS) 1500, which functions to synchronously control the matrix selection or demultiplexing of direct audio signals into transducers that are not simultaneously dedicated to an ambience matrix selection. This simultaneous conditional relationship is also processed by the ACOS 1600.

The DCOS 1500 in response to FRPS1 through FRPS16 input 1301 and SCB1 through SCB16 input 1402 decodes the final rotation function and matrix-selection of the audio output signals in the PAD 2000.

The Field Rotation Position Encoder 1502 acts upon input 1301 and encodes 32-Encoded-Field Rotation Position Select bits output (32 E-FRPS) 1503 applied to the Direct Channel Decoder-Selector 1504. The 1504 logic decodes the 1503 and 1402 inputs and decodes 16 DJCB, 16 DMCB, 16 DRCB and 16 DSCB output 1501 which is applied to the PAD 2000. Therefore, all data processing in the DCOS 1500 is synchronized with all the digital field rotation select bits 1301 from QRPS 1300 and system configuration bits 1402 from QCES 1400. Thus, a maximum configuration of 16 demultiplexed channels is provided with 64 data bits 1501. In this manner, the direct commutation data and the ambience commutation data are synchronized with each other, with the millions of PDT 1000 translations, with the 16 digital controlled formats, with the 16 field rotation select functions, and with the 8 configuration control functions. These 64 data bits 1501 are applied to the PAD 2000.

Referring to FIG. 15.1, which is a table illustration of RPS1 through RPS16, selected one at a time by the user, and the 16 corresponding Direct Audio output channels that are respectively demultiplexing J, M, R, or S output audio signals.

Referring to FIG. 15.2, the Field Rotation Position Encoder utilizes the 16 field rotation position selects to encode selects for use by the Direct Channel Decoder-Selector shown in FIGS. 15.3 and 15.4. The circuit is comprised of conventional logic gates and described by the Boolean expressions.

Referring to FIG. 15.3 and 15.4, the Direct Channel Decoder-Selector which is comprised of 16 direct channel-decoder selectors that decode their respective SCB1 through SCB16 bits in response to their respective encoded FRPS selects; wherein each selector produces a one active output out of four. For example; Direct Channel 1 Decoder Selector of FIG. 15.3 decodes a DHCB1 output when input SCB1 is active and all FRPS input Boolean terms are inactive. It decodes a DFCB1 output when SCB1 is active and when any one Boolean term of FRPS13+FRPS14+FRPS15+FRPS16 is active.

Referring to FIG. 15.5, which is a common Direct Channel X Decoder-Selector comprising FIGS. 15.3 and 15.4. The circuit is comprised of 5 conventional logic gates which are functionally described by the Boolean expressions.

Referring to FIG. 16.0, the Ambience Channel Output Selector (ACOS) 1600 which functions to control the digital matrix selection or demultiplexing of the ambience audio output signals to transducers that are not simultaneously dedicated to a direct audio matrix selected output transducer. The ambience matrix selection is synchronized with the DCOS 1500 so that the digital matrix selected ambience transducer is geometrically opposite the simultaneously active direct audio output transducer.

The 16 system configuration bits 1402 are decoded by the logic circuitry as illustrated and described by the output Boolean expressions. The same 16 SCB bits 1402 as decoded by ACOS 1600 are simultaneously decoded by the DCOS 1500 thereby maintaining the synchronous output channel demultiplexing. Output 1601 is applied to the PAD 2000 for ambience matrix selection. Depending on the audio media being processed, the format, rotation, and configuration selected, and the major case operations performed by the PDT 1000, from one to 8 audio outputs are demultiplexed at any given instant in the total 360° walk-through quadrifield.

Referring to FIG. 16.1; this illustration depicts the maximum configuration of 16 transducer-channels and each opposed set of direct and ambient transducers within the typical quadrifield.

Referring to FIG. 16.2, which is a tabular description for all possible direct to ambient decoding fucntions as they relate to the transducer-channel configuration locations of FIG. 16.1. Each transducer location and its ambient matrix selection is described by the related Boolean expressions.

Referring to FIG. 17.0, the Dynamic Audio Output Controller (DAOC) 1700. The DAOC generates a dynamic control audio signal which is used to automatically control the dynamic response of the Dynamic Ambience-SQ-Recovery Controller 1800 and for similar use by the Automatic-Dynamic Loudness Recovery Controller 1900. The DAOC provides the 1800 controller with the system reverb ambience functions. The DAOC 1700 provides the PAD 2000 with 4 input channels of high-passed audio.

The DAOC 1700 is designed to be compatible with commercially available volume expanders or compressors and graphic-room equalizers, allowing their simultaneous use with the system. The DAOC 1700 is designed to permit the volume expander or compressor to establish further dynamic control over the 1800 and 1900 controllers and to expand and/or compress the actual system transducer audio.

The DAOC 1700 permits the graphic-room equalizer to influence the room acoustic response of the transducers while not affecting the dynamic control of bass loudness recovery circuits. The graphic-room equalizer is disabled when headphones are used in the system.

The DAOC 1700 requires only 4 input channels of expansion and/or compression for graphic room equalization to achieve audio output demultiplexing for a configuration of 16 transducer channels.

Input 102, comprising 1705 and 1706 for 2-channel audio inputs or 1705 through 1708 for 4-channel audio inputs, is applied to circuit 1709 to be expanded and/or compressed or unmodified and routed as outputs 1710 through 1713 to circuits 1714 and 1717.

The 4-input combiner circuit 1714 produces a combined audio signal 1715 which is routed to circuit 1716, where frequencies from approximately 20 Hz to 4 kHz are bandpass filtered and sent to the system as dyn control audio 1701 for ambience and bass dynamic control. The Graphic-Room Equalizer 1717, when 1403 is inactive, modifies the amplitude response of the 4 audio input signals 1710 through 1713 and respectively produces 1718 through 1721 which are applied to the 4-Input Combiner 1722, and to their respective 400 Hz HP Active Filters 1725, 1726, 1727, and 1728. When 1403 is active, the 4-channels of input audio 1710, 1711, 1712, and 1713 are routed as unmodified audio signals 1718 through 1721 to circuits 1722, 1725, 1726, 1727, and 1728. The 4-Input Combiner citcuit 1722 applies the combined room equalized or unmodified audio 1723 to circuit 1724 where it is low pass filtered and routed to the system as output 1702 for bass loudness recovery. Each GRE audio signal 1718 through 1721 is filtered and passed as respective outputs 1729, 1730, 1731, and 1732 which are applied to the PAD 2000 and to the 4-Input Combiner 1733.

The 4 channels of high-passed filtered audio is routed to the system as output 1703 for use in digital matrix selection or demultiplexing of the output audio signals. The high-passed filtered audio from the combiner 1733 is routed to the system as output 1704 for use in reverb ambience recovery.

Referring to FIG. 17.1; the Graphic-Room Equalizer unit 1743 is utilized as optional equipment by the user. It modifies the 4 discrete audio channel input signals, 1705 through 1708 which are controlled by 1743 to equalize room acoustics. The 4 channels of modified audio 1744 through 1747 from circuit 1743 are applied to MOS-FETs 1748 through 1751, respectively. The 4 channels of unmodified audio 1705 through 1708 are applied to the MOS-FETs 1752 through 1755, respectively. WHen headphones are not used, control input DRE 1403 is high and gate 1756 output 1757 is low. Output 1757 commutates MOS-FETs 1748 through 1751 to their low-resistance ON states and thereby passes the modified audio as respective GRE audio outputs 1758 through 1761. When headphones are used, control input DRE 1403 is low and the 1757 output from gate 1756 is high; therefore, MOS-FETs 1748 through 1751 switch to their high resistance OFF state and MOS-FETs 1752 through 1755 are switched to their low resistance ON state. The unmodified audio 1705 through 1708 are routed as GRE audio outputs 1758 through 1761 and the room-acoustics-equalized audio 1744 through 1747 is disabled.

The resistors 1762 through 1765 function as MOS-FET network attenuation resistors. Therefore, the MOSFET ON-state attenuates the audio to approximately −0.1 dB while the MOSFET OFF-state attenuates the audio to a theoretical −220 dB.

Referring to FIG. 17.2 and 17.3, which are the 4-Input Combiner and 400 Hz HP Active Filter respectively. Each is comprised of conventionally designed circuits and therefore, require no functional description.

Referring to FIG. 18.0, the Dynamic Ambience/SQ Recovery Controller (DARC) 1800, which utilizes automatic and manual features that provide the user with optional means of recovering the maximum benefits available from the signal processing of the different types of audio input media. The DARC features three manually selected modes of operation: (1) the auto-concert hall AMB/SQR/4-channel reverb mode; (2) the auto-synthesized AMB/SQR-4-channel reverb mode, and (3) the manual 2/4 channel reverb mode.

The auto-concert hall AMB/SQR 4-channel reverb mode extracts concert hall ambience or "rear SQ information" by differential audio signal processing. During this process all panpotted direct audio signal information cancels, resulting in an out-of-phase ambience differential output. This output is restored to its original dynamic characteristics and routed to the system. Also, when the SQ format is the media input, the DARC in response to inputs 2ABA180°, 2AB90°, and 2BA90° functions to extract the "front sound field" audio information lost by conventional SQ "gain riding logic" decoders. This is accomplished by "mirror-phase shifting" the SQ phase shifted information into differential amplifiers, which differentially cancels the SQ rear audio from the front audio. The differential "front sound field" audio output of the DARC is dynamically restored and demultiplexed to the "front sound field" transducer that is diagonally or directly opposite the active rear SQ transducer.

Also, when the 4-channel mode is active, all of the 2-channel ambience SQR functions are disabled. The combined 4-channels of audio are modified by a single channel digital delayed ambience unit and applied to the system.

The auto-synthesized AMB/SQR 4-channel reverb mode is active during the 2ABAR°. During this condition all functions of the previous modes are accomplished, however, out-of-phase "front sound field" phasor information as well as out-of-phase ambience audio information is extracted by the differential process. Thus, in conjunction with the system adjustable PAPM 600 FD/F$\theta$ angle divergence control 652 (FIGS. 6.0, 6.1, and 21.0), a variable level of out-of-phase "front sound field" audio information appears as synthesized ambience in the "rear sound field" as is digitally demultiplexed by the ACOS 1600.

The manual 2/4 channel reverb mode functions by forcing the 2-channel or 4-channel media input to a reverb (digital delayed ambience unit) output operation. The system ambience output is adjustable to any given level relative to the direct/bass audio levels. The system ambience is then demultiplexed to transducers opposite the respective direct audio transducers as described by the ACOS 1600 description. This constant and synchronous sound field movement of the ambience, creates the multi-reflections heretofore never experienced in the real listening environment. In addition to this unique ambience method, other methods such as feeding digital delayed ambience directly to the output transducer channels or augmenting said first method by using a random code generator OR'D with the ambient commutation data. The number of simultaneously active transducers reproducing ambience (using the first method) depends on the media being processed and the mode of the DARC 1800. One sound field synchronous transducer is active during 2-channel media for concert hall ambience and SQR. Two sound field synchronous ambient transducers are active during 2-channel media for Manual Reverb. From 1 to 8 sound field synchronous transducers are active during 4-channel media for either automatic or manually derived ambience.

As illustrated, the power-on sequence signal 1001 presets the Ambience/SQR Mode Control circuit 1802. When the 2/4-channel mode signal 1003 applied to circuit 1802 is low, the dynamic ambience/SQR input 1805 derived from the 401 input by circuit 1804 is routed to the system as system ambience/SQR input 1801.

Furthermore, when the 2/4-channel mode signal 1003 is high the reverb ambience signal 1809, derived from the 1704 input by circuit 1808 is automatically routed to the system as ambience/SQR output 1801. The 5-phase Bits input 1004 is encoded by circuit 1802 as output 1803 and is utilized by circuit 1804 to provide two operations of automatic ambience recovery, and three operations of SQ recovery for "front sound field" audio information.

The logical relationship of mode control signals 1003, and 1004, and the internally generated manual modes processed in circuit 1802 are sent to circuit 1804 via the 4 ambience/SQR M-bits signal 1803. Therefore, the 1803 input to circuit 1804 establishes the correct differential processing functional mode to be performed on the A-ABAL and B-ABAL audio input 401. The 401 input is utilized by the 1804 circuitry to recover concert hall ambience, synthesized ambience, recover "front sound field" audio information (SQR) when rear SQ predominates or recover SQ "rear sound field" audio information when front information predominates (actually, recovered SQ rear sound field audio is recovered like an ambience audio signal).

The dynamic control audio input 1701 is proportional to the system audio output volume level and dynamic variations of the recorded input audio information. Signal 1701 is applied to circuit 1806 which produces a bi-polar DC dynamic control voltage output 1807.

The 401 input comprises two constant amplitude audio signals that must have their dynamic characteristics restored after differential processing. This restoration function is accomplished by the d.c. control voltage 1807 in the 1804 circuitry. The restored dynamic audio is applied from 1804 as signal 1805 to the Ambience SQR Mode Control 1802 which routes ambience/SQR output 1801 to the system.

Referring to FIG. 18.1, the Ambience/SQ Recovery Mode Control circuit, which is comprised of ambience audio control circuits and digital control logic.

The dynamically restored ambience/SQ recovered signal 1805, and reverb signal 1809 via 1810 as 1812, are applied to circuit 1814. Depending on the mode of operation, either signal 1805 or signal 1812 is routed through ambience volume control 1815 and applied as 1816 to driver 1817, and routed to the system as system ambience/SQR output 1801. When input control signal 1003 or 1853 is applied as a logic one to OR gate 1864, output 1811 is low and MOS-FET 1810 is switched to its low resistive ON state, and signal 1809 is routed as signal 1812 and applied to circuit 1814. Resistor 1813 functions as a load attenuator resistor for MOS-FET 1810, therefore, signal 1812 is within −0.1 dB of the input 1809. When 1811 is high, the MOS-FET is switched to its high resistive OFF-state, therefore, input 1812 is approximately −220 dB down from input 1809 at the input of circuit 1814. The power-on sequence signal 1001 or the reverb selection switch 1843, sets the auto-concert hall ambience/SQR/4-channel reverb mode for the system. The logic gates 1858 through 1861 are gated by inputs 1004, 1851, and 1863 to produce outputs 1832 through 1835. The 1803 output is described by the arrangement of the logic gates and by the Boolean expressions 1832 through 1835. The circuits consisting of 1843, 1844, 1845, 1846, 1848, 1849, 1850, 1864, 1865, and 1866 function similar to the circuits of FIG. 11.1 and therefore require no description.

Referring to FIG. 18.2, the Concert Hall/Synthesized AMB/SQR Controller, wherein the A-ABAL audio 405 is applied to subtractors 1818 and 1830, and to phase shifters 1820 and 1824. The B-ABAL audio 408 is applied to subtractor 1818, 1822, and 1826 and to phase shifter 1828. The A-ABAL audio 405 is shifted 90° by 1820 and applied as signal 1821 to subtractor 1822. The A-ABAL audio 405 is also shifted 180° by 1824 and applied as signal 1825 to subtractor 1826. The B-ABAl audio 408 is shifted 90° by 1828 and applied as 1829 to subtractor 1830. The 4 subtractor outputs represent the actual active audio signal heard by the listener and contains the phase parameters used for matrixencoded audio recovery, they are: ABAO°/ABAR°, AB90°, ABA180°, and BA90°.

Subtractor 1818 functions to recover concert hall ambience or synthesized ambience. Subtractor 1822 functions to recover the "front sound field" audio information when the A-channel audio leads the B-channel audio by 90°. Subtractor 1826 functions to recover the "front sound field" audio information when the A-channel audio leads the B-channel audio by 180° or vice versa; not used by current matrix encoded systems. Subtractor 1830 functions to recover "front sound field" audio information when the B-channel audio leads the A-channel audio by 90°. Subtractors outputs 1819, 1823, 1827, and 1831 are continually active and gated one at a time by the active states of respective M-bits 1832, 1833, 1834 and 1835 which are applied to respective MOS-FETs 1836, 1837, 1838, and 1839. Recovered audio signal 1843 is applied to MOS-FET 1841 where it is dynamically restored by dynamic control signal 1807 and routed as AMB/SQR signal 1805 to PAD 2000. The resistor 1840 functions as a load attenuator resistor for MOS-FETs 1836 through 1839. Recovered rear SQ audio when the front audio signals predominate is a function of the recovered ambience.

Referring to FIG. 19.0, the Automatic-Dyanmic-Loudness Controller (ADLC) 1900 which performs 4 main functions for the operation of the system.

The ADLC 1900 performs an automatic dynamic loudness control function on the bass audio applied to the output transducers of the system. This function is independent of the FCP 100 bass boost/cut control. However, it synchronously tracks the FCP 100 volume control and is directly proportional to and synchronous with all recorded audio dynamic variations produced by the audio of any 2/4-channel disc/tape media input to the system. The ADLC 1900 functions independently of the response changes set by the graphic-room equalizer 1717 (FIG. 17.0) and is synchronous with all dynamic affects of the volume expander/compressor unit 1709 of FIG. 17.0. The ADLC enables the system to synchronously follow the Fletcher-Munson equal loudness contours up to the optimum 400 Hz (see FIG. 19.2). Thus, bass frequencies, relative to a 1000 Hz reference, are psychoacoustically perceived by the listener as having approximately equal loudness regardless of any dynamic variation. The contour tracking can be modified by the system user to make necessary bass contour divergence adjustments to achieve other headphone or system transducer bass performance. The ADLC circuits prevent bass booming and amplifier/transducer overloading, which is present in some conventional loudness control circuits when the volume is set too high. The contours at the end points of the frequency curves at 20 dB (SPL) and below are not tracked by the ADLC, because the average listening environment has an ambient or inherent noise level of approximately 40 dB and never less than 20 dB. Therefore, the bass output system attenuates rapidly when the 20 dB level is reached. For this reason, at approximately 25 dB above the threshold of hearing, relative to a 1000 Hz reference, the ADLC starts to shutdown the bass output to the system. This feature prevents the normally masked wow, rumble, flutter, hum and other low audio spectral noises from reaching the output transducers when the bass begins to drop out.

The ADLC 1900 provides a means to properly adjust the bass audio dropout to coincide with the direct/ambient audio dropout parameters established in the ATDD 500.

The ADLC 1900 functions to selectively attenuate the bass output proportionally to the increase in the number of transducers configured in the system. This feature permits the bass transducer outputs to be equalized to the 1000 Hz reference point for each point-source transducer, regardless of the number of bass-utilized-direct transducers configured by the user. Also, proper equalization of the audio is achieved when headphones are used. Furthermore, equalization can be achieved to match an auxiliary bass system.

When headphones are utilized with the system, the ADLC 1900 disables the auxiliary bass system output and the bass output to the system transducers in order to establish the proper conditions for distribution of equalized bass to the headphones.

The bass audio reproduced by the system is equalized −12 dB down for each transducer of a 16-transducer output configuration. This application of bass distribution effectively creates a pseudo-biamplification system.

This feature substantially lowers transducer generated-harmonic distortion because each transducer cone travels only a fraction of the distance of conventional systems requiring full cone travel; and substantially reduces baffle size and cost to the consumers.

The user of this system may configure an auxiliary bass system which provides biamplification features and uses high-power, low-distortion, high-efficiency, large baffle speaker systems employing high quality transducers. Furthermore, if an auxiliary bass system is not configured, then because of the efficiency of the 16-transducer system-bass technique, small transducers can be configured.

The bass system of this invention eliminates the need for low efficiency acoustic suspension speaker systems and high power amplifiers to achieve proper acoustical output for bass audio. Using for example, 4 conventional 50 watt r.m.s. output Quadpower-amplifiers and a 16-channel bass system has many advantages over the large woofer-baffle bass systems.

As illustrated in FIG. 19.0, the dynamic control audio input 1701 enables the Auto-Dynamic Loudness Control circuit 1903 to process the 4 combined channels of bass audio input 1702 and to generate dynamic bass output 1904 that is in directly proportional to the dynamic control audio level and which tracks the Fletcher-Munson equal loudness contours. This dynamic bass output 1904 is applied to the Configuration Attenuator Network 1906, and to Bass Output Control circuit 1913.

The 7 SCS inputs 1905 is the seven system configuration selects wherein, only one is active at any given time. The function of 1905 input is to set the Configuration Attenuator Network 1906 which will equalize system bass acoustic response for each transducer configuration of from 4 to 16 transducer channels. Signal 1905 sets the 1906 network to a −12 dB attenuation factor for a 16 transducer system. Signal 1907 is applied to the Bass Output Control Circuits 1914 and 1915.

The System/Auxiliary Bass and Phones-In Override Control circuit 1909 provides a manual control function that selects aux sel 1910 which is applied to circuit 1913. This switches the dynamic bass 1904 as signal 1902 to auxiliary bass system 2000. Also, control signal 1912 disables system bass to the transducers via circuit 1915 when the auxiliary bass system is selected.

When the headphones are used, the Phones-In Override signal 1411 is applied to circuit 1909. This causes outputs 1910 and 1912 to disable 1902 to the auxiliary bass system and also 1917 to the system transducers. Signal 1911 gates the 4 channels of bass 1916 to the headphones via the PAD 2000.

Because bass audio is omnidirectional below 400 Hz, 4 corner bass transducers (Klipschorns for example) would be an excellent auxiliary bass configuration for bass signals 2201, 2202, 2203, and 2204.

Referring to FIG. 19.1, the Automatic-Dynamic Loudness Control circuit, wherein the dynamic control audio input 1701 is applied to the Precision Full-Wave Detector 1918 where it is converted into a dynamic d.c. control voltage 1919. Control voltage 1919 is filtered by circuit 1920 to remove all audio signal components and is then applied as signal 1921 to the adjustable Graphic Control D.C. Amplifier 1922. Signal 1923 is applied to d.c. amplifier 1924 and subtractor 1931, and to subsequent the d.c. amplifiers 1924, 1926, 1928 which produce their respective d.c. control voltages 1925, 1927, 1929. These d.c. control voltages are applied to their respective subtractors 1932, 1933, 1934. The d.c. reference voltage 1930 is also applied to subtractors 1931 through 1934. The outputs 1960, 1961, and 1962 from subtractors 1931, 1932, and 1933 are applied to their respective Dynamic Bass Boost Circuits 1937, 1939, and 1941. The A.B.C.D LP (low passed) audio signal 1702 is applied through driver 1935 and routed as output 1936 to the chain of Bass boost circuits. The control voltage, varying according to the dynamic parameters of the Fletcher-Munson curves, boosts or passes the bass audio 1702, 1936, 1938, 1940, and 1942 through the respective stages while synchronously tracking throughout the dynamic range of bass control. Bass output 1942, which follows the Fletcher-Munson equal loudness contours, is routed through 1943 and applied as 1944 to 1945.

Bass Output Control circuit 1945 as controlled by control signal 1963 receives input 1944 and produces dynamic bass 1904; 1904 is applied to the Configuration Attenuator Network 1906 and Bass Output control 1913 as shown in FIG. 19.0. Output 1904 therefore follows the Fletcher-Munson equal loudness contours, as shaped by 1937, 1939, 1941, and 1943, in response to the dynamic level of 1701.

Referring to FIG. 19.2, which is an illustration of the dynamic bass response curves produced by 19.1 and which track the Fletcher-Munson Equal Loudness Contours.

Referring to FIGS. 19.3 and 19.4, which are typical of the d.c. amplifiers utilized by the bass system as referenced in FIG. 19.1.

Referring to FIG. 19.5 which is an active bass boost circuit and requires no functional description.

Referring to FIG. 19.6, which is a resistor attenuator network. When any one of inputs 1905 is logic low (grounded), the network resistance is selected to attenuate input 1904 via resistors 1946 through 1954 to produce attenuated output signal 1907 accordingly.

Referring to FIG. 19.7, which uses conventional logic gates and a switch that functions to generate three control signals described by the Boolean expressions.

Referring to FIG. 19.8, which is a Bass Output Control circuit that functions as a digitally controlled switch or as a variable control voltage attenuator.

Referring to FIG. 20.0, the Psychoacoustic Audio Demultiplexer (PAD) 2000, which is comprised of a Quadrifield Audio Format Selector 2019 and a Channel Selection Matrix with Power Amplifiers 2023. Circuit 2019 functions to reformat the 4-channel audio input signals 1703 received from the DAOC 1700 into 4-discrete-dedicated audio channels 2020 applied to circuit 2023. The reformatting process maintains the correct format synchronization and logic matrix selection relationships between the audio outputs, and all the direct-/ambience channel digital data bits required for each of the 16 possible formats selected by the user (see FIGS. 12.1 through 12.4).

Circuit 2023 functions to channelize all the formatted direct, ambience, and bass audio to any one or more system matrix-selected transducer channel outputs, as commutated by the associated digital commutation bit inputs. Also, 2023 performs the final audio field rotation function by formatting each direct audio channel to the respective transducer output as commutated by the associated field-rotation digital commutation bits.

Furthermore, 2023 is the controlling source of the phones-in override control signal 2018, which re-configures the system transducers as described in the ADLC 1900 FIG. 19.0 description when the headphones are used in the system.

The channel selection matrix switching method employed herein comprises 64 digital data bits representing input channels, formatted audio and transducer outputs. This channel output switching process utilizes a demultiplexing technique which switches the proper audio to the proper transducer channel; transient free and without distortion.

As illustrated, the Quadrifield Audio Format Selector 2019 formats the A, B, C, D HP-audio input 1703 as commutated by the format select input signal 1102. The J, M, R, S HP-audio output 2020, reformatted from 1703, is applied to circuit 2023. The 64 data bit input 1501 to circuit 2023 is a result of: panpot processing, analog-to-digital processing, digital translation processing, digital format processing, digital field rotation processing and digital configuration processing. Thus, demultiplexing produces the direct audio outputs 2001 through 2016, which are applied to their associated transducers 1 through 16. The systems's modular features provides the user with the option of omitting the internal power amplifiers of 2023 and routing outputs 2001 through 2016 to 4 commercially available quad-power amplifiers to obtain an audio power output limited only by the equipment chosen by the user.

The system ambience/SQR input 1801 from the DARC 1800 is applied to circuit 2023 wherein the digital commutation data, ACB1 through ACB16 inputs 1601 from the ACOS 1600 demultiplexes each actively associated ambience/SQR audio signal to the respective transducer 1 through 16.

Because the ACOS 1600 operates synchronously with the DCOS 1500, only a direct-channel-output with bass or an ambient-channel-output with bass can exist at any one instant at each of the transducer output channels 2001 through 2016. The system bass input 1901 is applied to circuit 2023 as two-bus inputs 1916 and 1917. Both of the inputs are active when the system transducers are configured for reproducing the system bass.

Furthermore, due to the system transducer configuration of 16 point-sources generated from a 4-channel input media, formats 10, 11, and 12 (FIG. 11.1) will, for certain panpotted fieldchannel allocations, cause any two adjacent transducer outputs to be simultaneously active. This situation creates a possibility of 32 channels of sound reproduction having 16 point-sources and 16 pseudo point-sources. The 16 pseudo point-sources are indentified as such and are not Haas Effect sensitive phantom images because they are each created from two point-sources located relatively close together. Each pseudo point-source exists as a very stable sound image regardless of the listener's head movement.

When the 4-channel headphones are connected a breakmake circuit 2024 in the phone-jack causes 2301 in circuit 2023 to produce the phone-in-override control signal 2018. Signal 2301 causes outputs 2001, 2005, 2009, and 2013 to be rerouted as output 2017 to the 4-channel headphones 2300 as ch-1=Lf, ch-5=Rf, ch-9=Rb, and ch-13=Lb; all other output channels are disabled. The four channel mode demultiplexes direct and ambience audio signals as output 2017, and transducer-outputs 2001 through 2016 are disabled.

In summary, with the headphones in use, the graphic-room equalizer (if configured) is disabled and an Expander (if configured) remains active. Format and field rotation functions also remain manually active. Configuration manual control is disabled. System bass input 1901 is active for input 1917 which is routed as 2017 to the headphones 2300. The System Operation Status-Display (SOSD) 2100 is operational for a 4-channel mode.

Referring to FIG. 20.1, the Quadrified Audio Format Selector, which is a digitally controlled logic matrix switching network. The network utilizes 8 N-channel depletion type MOS-FETs as commutation switching elements or analog switches.

As illustrated, when signals 2029, 2030, and 2031 are all logic zero inputs to respective inverters 2032, 2033, and 2034, outputs 2046, 2047, and 2048 are respectively logic ones and outputs 2049 and 2050 are logic zeros. Therefore, MOS-FETs 2042, 2044, and 2045 are commutated to their low resistive ON states. This resultant commutation action indicates than an AMFS 1100 format selection of 2-channel input media is eatablishing format array 2025. Format array 2025 routes A-HP-audio 1738 to driver 2059 and through MOS-FET 2045 to driver 2062. Thus, outputs 2059 and 2066 are carrying logic-matrix switched A-HP-audio signal 1738. Likewise, B-HP-audio 1739 is routed through MOS-FETs 2042 and 2044 to respective drivers 2061 and 2060. Thus, outputs 2064 and 2065 are carrying logic matrix switched B-HP-audio signal 1739. This input audio bus to output audio bus distribution corresponds with the output audio bus requirements for formats 1 through 8, 13, or 14 of FIG. 11.1. Two specific examples illustrating formats 4 and 8 are shown in FIGS. 1.12 and 1.13, respectively.

When input 2029 is logic one and inputs 2030 and 2034 are logic zeros, outputs 2046 and 2051 from gates 2032 and 2035 are logic zeros. Therefore, MOS-FETs 2038 and 2041 are commutated to their low resistive ON states. This resultant commutation action indicates that an AMFS 1100 format selection of 4-channel input media is establishing format array 2026. Format array 2026 routes A-HP-audio 1738 through driver 2059 as output 2063, B-HP-audio 1739 through MOS-FET 2044 and driver 2060 as output 2064, C-HP-audio 1740 through MOS-FET 2041 as output 2065, and D-HP audio 1741 through MOS-FET 2038 and driver 2062 as output 2066. This input audio bus to output audio bus distribution corresponds with output audio bus requirements for formats 9, 10, 15, and 16 of FIG. 11.1. Two specific examples illustrating formats 9 and 10 are shown in FIGS. 1.14 and 1.15, respectively.

When input 2030 is logic one and inputs 2029 and 2031 are logic zeros, outputs 2049, 2047 and 2051 from respective gates 2032, 2033 and 2035 are logic zeros. Therefore, MOS-FETs 2041, 2043 and 2038 are commutated to their low resistive ON states. This resultant commutation action indicates that an AMFS 1100 format selection of 4-channel media is establishing format array 2027. Format array 2027 routes A-HP-audio 1738 through driver 2059 as output 2063, B-HP-audio 1739 through MOS-FET 2042 and driver 2061 as output 2065, C-HP-audio 1740 through MOS-FET 2043 and driver 2060 as output 2064, and D-HP audio through MOS-FET 2038 and driver 2062 as output 2066. This input audio bus to output audio bus distribution corresponds with output audio bus requirements for format 11 of FIG. 11.1.

When input 2031 is logic one and inputs 2029 and 2030 are logic zeros, output 2048 is logic zero. Therefore, MOS-FETs 2039, 2040, and 2044 are commutated to their low resistive ON states. This resultant commutation action indicates that an AMFS 1100 format selection of 4-channel media is establishing format array 2028. Format array 2028 routes A-HP-audio 1738 through driver 2059 as output 2063, B-HP-audio 1739 through MOS-FET 2044 and driver 2060 as output 2066, C-HP-audio 1740 through MOS-FET 2039 and driver 2062 as output 2066, and D-HP-audio 1741 through MOS-FET 2040 and driver 2061 as output 2065. This input audio bus to output audio bus distribution corresponds with output audio bus requirements for format 12 of FIG. 11.1.

Resistors 2055, 2056, 2057, and 2058 are utilized as load resistors for the MOS-FET network.

At this point in the discussion, the output audio is properly formatted for two or four channel media and for one of 16 listening formats that is automatically or manually selected by AMFS 1100. Thus outputs 2063 through 2066 are the four audio signals which will subsequently be field rotated and demultiplexed by the PAD 2000 into 16 audio output signals. Correlation of formatting and field rotation of output audio signals 2063 through 2066, as demultiplexed into transducers 1 through 16, is derived by cross-examination of FIGS. 20.1, 20.2, 15.0, 15.1, 15.3, 15.4, and 11.1. Such a cross-examination is recommended only as an aid to reviewing information provided by discussions presented heretofore. A discussion involving all possible user sound field manipulations made practical by the use of controls on the four channel preamplifier, by formatting, by rotation, by configuration, and by the ambience circuits of this invention is beyond the scope of any written words since this invention provides over 100,000 such user manipulations. Such descriptions are best depicted by tables that are heretofore referenced.

Referring to FIGS. 20.2 through 20.5, which are the 16 channel selection matrix circuits. Each channel selection matrix functions similarly to demultiplex or logic matrix select its respective inputs.

The audio output demultiplexed by each channel selection matrix depends on its respective digital commutation data inputs. The demultiplexed possibilities for 2058 are: no audio output, bass audio only, J-HP audio only, M-HP audio only, R-HP audio only, S-HP audio only, system ambience/SQR audio only, bass and J-HP audio only, Bass and M-HP audio only, Bass and R-HP audio only, Bass and S-HP audio or Bass and system ambience/SQR audio. Since each channel selection matrix (and power amplifier) functions in a similar fashion, the following 2058 discussion of FIG. 20.2 will suffice for the 16 channel selection matrixes shown in FIGS. 20.2 through 20.5.

In respect to the previously mentioned demultiplexed possibilities, the audio signal(s) of the channel 1 audio applied to transducer 1 are demultiplexed as described in the following paragraphs.

Channel 1, 5, 9, 13, bass 1916 passes through an internal combiner in 2058 and is routed as channel 1 audio 2001 to transducer 1. Signal 1916 is disabled whenever an auxiliary bass system is configured by the user. Not shown are the conventional make-break contacts of a four channel headphones jack which would break the electrical path to transducer 1 and route output 2001 to headphones 2300 when connected by the user.

J-HP audio 2063 is commutated by DJCB1 and combined with signal 1916 in 2058 and routed as demultiplexed output 2001 to transducer 1. No other direct channel 2064, 2065, or 2066 can be demultiplexed at this time since bits DMCB1, DRCB1, and DSCB1 are logically inactive as dictated by the decoding protocol depicted in FIG. 15.5. In addition no ambience/SQR aduio 1801 can be demultiplexed at this time since bit ACB1 is logically inactive as dictated by the decoding protocol depicted in FIGS. 16.0 and 16.2.

Audio signals 2064, 2065, 2066, and 1801, under the same decoding constraints described for signal 2063, are each commutated and demultiplexed by respective 1501 bits DMCB1, DRCB1, DSCB1, and ACB1 of 1601 into output 2001 which is applied to transducer 1. Audio signals 2063, 2064, 2065, 2066 and 1801, demultiplexed one at any given instant, are also routed to the headphones in the same fashion as described for bass signal 1916. However, the user configuration of an auxiliary bass system only applies to bass signal 1916. Transducer 1 continues to reproduce demultiplexed direct and ambience/SQR audio signals while bass signal 1916 is routed as bass signal 1902 and reproduced by the transducers of auxiliary bass system 2200 shown in FIG. 19.0.

Channel 1, 5, 9, 13 bass 1917 applied to all channel selection matrixes except channel selection matrixes 1, 5, 9, and 13, and is disabled only when either the headphones 2300 or the auxiliary bass system 2200 is configured by the user.

Referring to FIG. 20.6, which is a typical channel-X selector (and power amplifier). The direct audio inputs 2063, 2064, 2065 and 2066 can be simultaneously active in any combination and are applied to their respective MOS-FET switching elements 2067, 2068, 2069 and 2070. Each switching element is commutated by its respective digital direct commutation bits 2072, 2073, 2074, or 2075; since only one bit is active-at-any instant, then 2063 or 2064 or 2065 or 2066 is demultiplexed as output 2076 to the combiner circuit 2078. When system ambience/SQR input signal 1801, applied to MOS-FET switching element 2071, is commutated by digital ambient commutation bit 1601. Bits 2072, 2073, 2074 and 2075 are inactive. Resistors 2079, and 2080 are load resistors for the respective MOS-FET switching elements. The demultiplexed ambience/SQR signal 2077 is then applied to the combiner circuit 2078. The system bass signal 1901 is applied directly to the combiner circuit without logic matrix switching. The direct audio 2076 or the ambience audio 2077 and/or the bass audio 1901 are routed through the combiner circuit 2078 and applied as output 2081 to the power amplifier 2082.

The 2083 output from power amplifier 2083 is applied to transducer 2084. If the power amplifier is omitted, at the user's option, then the output 2081 requires user-configured power-amplifiers.

Referring to FIG. 20.7, which is a typical 3-input combiner circuit used in each channel selection matrix, and therefore, requires no further description.

Referring to FIG. 21.0, the System Operation Status Display (SOSD) 2100, which functions as a sophisticated analog-to-digital "color organ" for the aesthetic enjoyment of the user. The SOSD 2100 also provides a unique "real time" audio-digital diagnostic display. The system user, by employing a special system-diagnostic 4-channel audio test-tape, may visually analyze a fault indication.

The fault indication on the displays 2120 and 2121 can be interpreted with the use of a system diagnostic fault table. This table in turn is used to determine which ICP failed. This invention, which functions in many ways like a special purpose computer, may eliminate costly repairs for the consumer.

As illustrated, two unique driver circuits are required; LED drivers and lamp drivers. The LEDs display "real-time" digital data and the lamps display the dynamic direct, ambience/SQR, and bass audio activity. Input 2101 represents "n" possible inputs from "n" possible digital functions monitored by the system.

Each monitored digital function is applied to its respective driver, as is input XY90° 2103 to driver 2104. The driver output is a digital logic zero routed through current limiting resistor 2105 to its respective LED 2106. Therefore, each digital function being monitored by the system is displayed as a "GO-NO-GO" visual indication in the system analog-digital operation display panel 2120. Input 2107 illustrates the nth digital function monitored by the LEDs. Input 2102 represents all the possible inputs from the audio functions being monitored by the system. Each transducer output is monitored for the presence of direct and ambience/SQR audio. As illustrated, transducer location one of 2121 is a typical monitoring and display arrangement shown in 2115. Direct audio 2109 or ambient/SQR audio 2110 is amplified by respective driver 2113 and 2114 and routed to the respective lamp in 2115. Each of the 16 transducer locations is represented by a dual indicator/-switch 2115 on system output display 2121. Each indicator/switch 2115 responds to direct or ambient/SQR audio at its respective transducer location. The presence of system bass is displayed by 2116. Input 2108 is applied to driver 2112, amplified, and routed to the bass indicator lamp 2116 which is located in the center of the system audio output display panel 2121. The bass indicator lamp dynamically responds to the system bass output. The SOSD 2100 also provides user operating controls that select quadrifield format and rotation functions, transducer configuration, input media mode, bass configuration, ambient/SQR mode, Discrete-Phasor Divergence, loudness divergence, ambient/SQR volume, sound field swirl rate, and headphone input.

The multi-indicator lamps of the system audio output display panel 2121 are also momentary switches. These are the Field Rotation Position Select (FRPS) switches which instruct the system as to which transducer location will be referenced to the front-center channel audio signal. Upon depressing any one of the 16 possible FRPS location momentary switches, an LED (not shown) associated with that position selected will light. The LED located next to the momentary switch will remain lit until another FRPS selection is made (see FIG. 13.3).

The manual controls and the visual displays provide the system user with the means to correlate the dynamic "walk-through quadrifield" sounds to the dynamic instantaneous point-sources as visually displayed by synchronous indicators. Therefore, the system user can visually and audibly perceive the results of his manual intervention with the automatic operation of this invention.

The previously described embodiments and arrangements are illustrative of the operation and application of the principles encompassing this invention. Other arrangements may be devised by those skilled in the art without departing from the spirit or scope of this invention. For example; the logic circuits employed may comprise any logic family or combination of logic family devices, including device technologies such as CMOS, NMOS, PMOS, SOS, DTL, TTL, IIL, ECL, CCD, and so forth. The analog circuits employed are likewise amendable to various integrated circuit technologies and other circuit designs which accomplish functions similar to the embodiments of this invention. Said analog and digital integrated circuit devices may be employed as small scale, medium scale, large scale, or very large scale integrated circuits. Said integrated circuits being off-the-shelf, uniquely designed in a microelectronics laboratory, or custom designed by custom IC house techniques. Other types of logic circuits may be employed to accomplish processing functions performed by this invention, such as: bubble memories, RAMs, PROMs, ROMs, EPROMs, ADCs, DACs, analog comparators, and microprocessor/microcomputer integrated circuit devices.

It is also feasible from the preferred embodiments that audio signals demultiplexed by phasor differential functions may further be processed into more than 2 discrete audio signals using the same methods employed by this invention to recover rear matrix encoded audio signals when the front direct audio signals predominate or to recover front direct audio signals when the rear matrix encoded audio signals predominate.

Furthermore, digital ambient data may be encoded by methods using random data generators or other encoded combinations of digital commutation data or combinations of various encoding methods. Also, discrete ambience audio signals, as applied from multichannel devices that are currently being developed to simulate the acoustics of some well known concert halls, may be combined with discrete direct audio signals in the combiner stages of the Psychoacoustic Audio Demultiplexer 2000; thereby foregoing the need for ambience audio demultiplexing.

In addition, certain embodiments of the present invention may be modified for the XYX-FD function to demultiplex combined X and Y audio signals (representative of A and B, or B and C, or C and D, or A and C, or B and D, or D and A audio signals), rather than exclusively demultiplexing only an X or only a Y audio signal.

This feature would tend to cancel out-of-phase wow, hum, and flutter and make some very marginal audio recovery improvements to the sound images reproduced by the present invention.

It should be obvious that major case operations (for a system having more than 16 output audio channels) require additional Psychoacoustic Data Converter Circuits and additional Psychoacoustic Data Translator circuits which perform processing functions similar to the associated embodiments of the present invention.

It is also obvious that one or more embodiments of the present invention may be omitted (e.g. automatic dynamic loudness, quadrified rotation, quadrifield formatting, quadrified configuration, graphic room equalizers and so forth without diverting from the spirit and scope of the present invention.

Other arrangements of the preferred embodiments (encoding waveform differential data on suitable carriers with each carrier having a predetermined frequency) may include; secure communications between computers, between voice terminals, and between telemetry equipment, and between other peripheral equipment. In addition, other arrangements of the preferred embodiments may include applications in intercom systems, telephone systems, navigational equipment, direction finding, citizen's band radio, and other communications equipment. It being understood that such applications may require that the parameters which relate to field allocations may be changed to any required voltage-amplitude ratio and/or frequency and still remain within the spirit and scope of the present invention.

Finally, the preferred embodiments of this invention will make total digital audio systems possible, whereby all audio signals are independently converted to digital data and then digital multiplexed along with a separate digital channel of digital localization data processed from said all audio signals by using the psychoacoustic processing techniques of this invention. The best approach would be to convert the compatible 2 or 4 channels recorded on stereophonic or quadriphonic master tape into 2 or 4 channels of computer mastered digital data, thereby lowering the noise floor and eliminating a digital demultiplexing control channel. The 2 or 4 channels of digital data would then be converted into 2 or 4 audio channels and re-mastered into a suitable media to be processed by this invention in the same manner as stereophonic, JVC quadradisc, or 4-channel/Q8 tape. This latter method (future digital recording method) would eliminate complex digital encoding and decoding, be fully compatible with all past and future 2 and 4 channel media, and realize the low noise and low distortion characteristics of digital computer mastering.

What I claim is:

1. An analog-digital processing system for processing and converting analog waveform differential data from two analog signals into digital waveform differential data and for processing said digital waveform differential data into digital processed data, comprising:

a. input analog signal processor means processing said two analog signals into a plurality of conditioned analog signals having predetermined amplitude and bandwidth characteristics prepared for analog-to-digital conversion of said analog waveform differential data;

b. analog-to-digital converter means processing and converting said analog waveform differential data from any two conditioned analog signals paired from said plurality of conditioned analog signals into digital waveform differential data including, in combination to predetermined analog waveform differential data, digital phase-angle differential data, digital phasor differential data, digital amplitude differential data, digital peak amplitude strobes, and digital signal-to-noise data; and c. digital data processor means processing said digital waveform differential data into digital processed data.

2. The system as claimed in claim 1 wherein said analog-to-digital converter means includes phase-angle differential converter means processing and converting predetermined analog phase-angle differential data, composed of a plurality of zero-amplitude-cross-over coincident and anti-coincident signals of two conditioned analog signals of said plurality of conditioned analog signals, into digital phase-angle differential data.

3. The system as claimed in claim 1 wherein said analog-to-digital converter means further includes peak amplitude converter means processing and converting predetermined analog amplitude peaks of each conditioned analog signal of said plurality of conditioned analog signals into digital peak amplitude strobes.

4. The system as claimed in claim 1 wherein said analog-to-digital converter means further includes phasor differential converter means processing and converting, responsive to said digital peak amplitude strobes, predetermined analog phasor differential data composed of a plurality of algebraic difference signals whose amplitudes are indirectly proportional to the common-mode of two conditioned analog signals of said plurality of conditioned analog signals, into digital phasor differential data.

5. The system as claimed in claim 1 wherein said analog-to-digital converter means further includes amplitude differential converter means processing and converting, responsive to said digital peak amplitude strobes, predetermined analog amplitude differential data composed of a plurality of amplitude ratio signals of two conditioned analog signals of said plurality of conditioned analog signals, into digital amplitude differential (amplitude ratio) data.

6. The system as claimed in claim 1 wherein said analog-to-digital converter means further includes signal-to-noise converter means processing and converting predetermined analog signal-to-noise data, composed of a plurality of predetermined reference signals whose amplitudes are indirectly proportional to the amplitudes of said plurality of conditioned analog signals, into digital signal-to-noise data.

7. An analog-digital processing system for processing and converting analog waveform differential data from two analog signals into digital waveform differential data, for processing said digital waveform differential data into digital commutation data, and for demultiplexing one or more signals (by definition, applies to analog or digital signals) into a plurality of output signals as commutated by said digital commutation data, comprising:

a. input analog signal processor means processing said two analog signals into a plurality of conditioned analog signals having predetermined amplitude and bandwidth characteristics prepared for analog-to-digital conversion of said analog waveform differential data;

b. analog-to-digital converter means processing and converting analog waveform differential data from two predetermined conditioned analog signals paired from said plurality of conditioned analog signals into digital waveform differential data including, in combination to predetermined analog waveform differential data, digital phase-angle differential data, digital peak amplitude strobes, digital phasor differential data, digital amplitude differential data, and digital signal-to-noise data;

c. digital data processor means processing said digital waveform differential data into digital commutation data; and d. output demultiplexer means demultiplexing one or more signals into a plurality of output signals as commutated by said digital commutation data.

8. The system as claimed in claim 7 further comprising a plurality of power amplifiers and associated transducers, respectively amplifying and reproducing said plurality of output signals.

9. An analog-digital processing system for processing and converting analog waveform differential data from any two analog signals paired from a plurality of analog signals into a plurality of digital waveform differential data, for processing said plurality of digital waveform differential data into a plurality of digital commutation data, and for demultiplexing one or more signals into a plurality of output signals as commutated by said plurality of digital commutation data, comprising:

a. input analog signal processor means processing said any two analog signals into a plurality of conditioned analog signal sets wherein each set is composed of a plurality of conditioned analog signals of a respective pair of two analog signals and having predetermined amplitude and bandwidth characteristics prepared for analog-to-digital conversion of said plurality of analog waveform differential data;

b. analog-to-digital converter means processing and converting analog waveform differential data from said plurality of conditioned analog signal sets into a plurality of digital waveform differential data sets including, in combination to a plurality of predetermined analog waveform differential data sets, a plurality of digital phase-angle differential data sets, a plurality of digital phasor differential data sets, a plurality of digital amplitude differential data sets, a plurality of digital peak amplitude strobe sets, and a plurality of digital signal-to-noise data sets;

c. digital data processor means processing said plurality of digital waveform differential data sets into a plurality of digital commutation data; and d. output signal demultiplexer means demultiplexing one or more signals into a plurality of output signals as commutated by said plurality of digital commutation data.

10. The system as claimed in claim 9 further comprising a plurality of power amplifiers and associated transducers, respectively amplifying and reproducing said plurality of output signals.

11. A stereophonic/quadriphonic audio-digital processing system for processing and converting analog (hereinafter referred to as audio) waveform differential data (hereinafter referred to as audio localization data) from any two low-level audio signals paired from two or four low-level audio signals applied from a four channel preamplifier into a plurality of digital waveform differential data (hereinafter referred to as digital localization data), for processing said plurality of digital localization data into a plurality of digital commutation data, for processing said two or four high-level audio signals applied from said four-channel preamplifier into a system bass audio signal, ambience signals, recovered front direct audio signals, recovered rear matrix encoded audio signals, rear matrix encoded audio signals, and direct audio signals, thereby demultiplexed into a plurality of output audio signals, comprising:

a. four-channel preamplifier means selecting two or four-channel disc, tape, a.m./f.m.-multiplex, or auxiliary input audio signals and correspondingly producing two or four low-level audio signals having flat frequency response and for correspondingly controlling frequency response and amplitude of said input audio signals and producing two to four high-level audio signals;

b. input audio processor means processing said two or four low-level audio signals into two or four bandpassed audio signals having predetermined bandwidth and amplitude characteristics, processing said two or four bandpassed audio signals into two or four bandpassed bias-amplitude leveled audio signals and into one to six pairs of bandpassed proportional-amplitude leveled audio signals;

c. analog-to-digital converter (hereinafter referred to as psychoacoustic data converter) means processing and converting said audio localization data from any two bandpassed bias-amplitude leveled audio signals of said two or four bandpassed bias-amplitude leveled audio signals and from bandpassed proportional-amplitude leveled audio signals of said one to six pairs of bandpassed proportional-amplitude leveled audio signals into a plurality of digital localization data including, in corresponding combinations to predetermined audio localization data, a plurality of digital phase-angle differential data sets, a plurality of digital phasor differential data sets, a plurality of digital amplitude differential data sets, a plurality of digital peak amplitude strobe sets, and a plurality of digital signal-to-noise data sets;

d. data processor (hereinafter referred to as psychoacoustic data processor) means psychoacoustically data processing (a digital process analogous to the brain's binaural fusion process) said plurality of digital localization data into a plurality of digital commutation data;

e. output audio processor means processing said two or four high-level audio signals and two bandpassed bias-amplitude leveled audio signals of said two or four bandpassed bias-amplitude leveled audio signals responsive to a plurality of Boolean operations performed on said digital commutation data, into a plurality of processed audio signals including, in combination to frequency, phase, and amplitude activity throughout each bandwidth of said two or four high-level audio signals, a system bass audio signal, ambience signals, recovered front direct audio signals, recovered rear matrix encoded audio signals, direct audio signals, and matrix encoded audio signals; and f. output demultiplexer (hereinafter referred to as psychoacoustic audio demultiplexer) means distributing and demultiplexing said plurality of processed audio signals are commutated by said plurality of digital commutation data into a plurality of output audio signals.

12. The system as claimed in claim 11 wherein said input audio processor means include:

a. active audio-bandpass filter means bandpass filtering said two or four low-level audio signals, thereby producing two or four bandpassed audio signals with each audio signal having a predetermined minimum to maximum amplitude range and a predetermined bandwidth of approximately 400 Hz to 4 kHz;

b. automatic proportional-amplitude leveler means pairing any two said two or four bandpassed audio signals and producing from one to six pairs of proportional-amplitude leveled audio signals with each pair having one leveled output signal maintained at a predetermined amplitude and the amplitude of the second leveled audio output signal maintained at the same instantaneous decibel ratio as the lower amplitude input bandpassed audio signal is to the higher amplitude input bandpassed audio signal; and c. automatic bias-amplitude leveler means leveling and combining each bandpassed audio signal of said two or four bandpassed audio signals with a predetermined reference frequency bias signal representative of predetermined audio signal-to-noise reference levels, producing two or four bias-free leveled audio signals having predetermined amplitudes, and recovering two or four said predetermined reference bias signals whereby the amplitude of each predetermined reference frequency bias signal is inversely proportional to the amplitude of the bandpassed audio signal and said predetermined reference bias signal amplitude having two predetermined signal-to-noise reference levels, whereby a first predetermined reference bias signal amplitude represents bandpassed audio signal threshold at or above a first predetermined noise signal amplitude and a second predetermined reference bias signal amplitude represents bandpassed audio signal dropout at or below a second predetermined noise signal amplitude.

13. The system as claimed in claim 11 wherein said psychoacoustic data converter means include:

a. automatic threshold-dropout decoder means detecting each recovered reference frequency bias signal of said two or four predetermined reference frequency bias signals and producing two or four detected reference frequency bias signals, decoding bandpassed audio signal threshold and dropout from each detected reference frequency bias signal, producing one to four digital threshold binary digits, producing one to four digital dropout binary digits, producing one to four digital OR-threshold binary digits, and producing one to four digital AND-dropout binary digits;

b. phase-angle processor-memory means pairing any two bias-free leveled audio signals of said two or four bias-free leveled audio signals, converting predetermined audio phase-angle differential data, composed of a plurality of zero-amplitude-crossover coincident and anti-coincident signal pulses, having variable pulse width means compensating for media phase shift of said any two bias-free amplitude leveled audio signals, into a plurality of digital phase-angle differential data whose plurality of digital phase-angle differential binary digits are stored in memory elements, therein inhibited from changing to opposite binary states (from a "0" to a "1" or from a "1" to a "0") by said one to four digital OR-threshold binary digits and therein cleared to inactive binary digit states (either all "0" or all "1" depending on the functional requirements of an interfacing logic means) by said one to four digital AND-dropout binary digits, said plurality of digital phase-angle differential binary digits further decoded into a random digital phase-angle differential binary digit representative of all nonpredetermined phase angle differentials responsive to all inactive binary digits stored in said memory elements, and including hardwired expansion means to add eighteen phase-angle encoded channels to the system responsive to the four-channel state of a 2/4-channel mode binary digit ( a given binary state representing four-channel and the opposite binary state representing two-channel audio signals), and decoding a plurality of digital phase-angle binary digits into a plurality of digital field activity data composed of a plurality of binary digits representing any one active digital phase-angle differential binary digit or random digital phase-angle differential binary digit being active in response to any said two of said two or four bias-free leveled audio signals);

c. peak amplitude strobe generator means detecting each bias-free leveled audio signal of said two or four bias-free leveled audio signals, converting a predetermined peak amplitude voltage of each detected said bias-free leveled audio signal into a peak amplitude strobe, encoding any two digital peak amplitude strobes into one to four digital OR-peak amplitude strobes therein correspondingly inhibited by said one to four digital OR-threshold binary digits;

d. phasor differential processor-memory means pairing any two bias-free leveled audio signals of said two or four bias-free leveled audio signals, processing predetermined audio phasor differential data composed of a plurality of algebraic difference signals into a corresponding DC voltage difference signal indirectly proportional to the common-mode of said any two bias-free leveled audio signals, converting said DC voltage difference signal into a plurality of digital phasor differential data whose plurality of digital phasor differential binary digits are stored in memory elements, therein loaded by said one to four digital OR-peak amplitude strobes, and therein cleared to inactive states by a digital system initialization binary digit produced by said psychoacoustic data processor means; and e. amplitude differential processor-memory means converting each of said one to six pairs of proportional amplitude leveled audio signals into a plurality of digital amplitude differential data composed of a plurality of digital amplitude ratio binary digits loaded into corresponding memory elements by said one to four digital OR-peak amplitude strobes and therein cleared to inactive binary states by said digital system initialization binary digit.

14. The system as claimed in claim 11 wherein said psychoacoustic data processor means include:

a. psychoacoustic data translator means translating said one to four digital dropout binary digits, said plurality of digital field activity data, said plurality of digital phase-angle differential data, said plurality of digital phasor differential data, and said plurality of digital amplitude differential data into a plurality of digital translated data, a plurality of encoded digital 2-channel phase-angle differential data, and a plurality of digital system control signals composed of a digital system power-on binary digit, a digital system initialization binary digit, and a digital 2/4 channel mode binary digit representing two active low-level input audio signals when in a given binary state and four active low-level audio signals when in the opposite binary state;

b. automatic-manual format selector means for manually entering into a register one of a plurality of digital four-channel format selects and one of a plurality of digital two-channel format selects, for automatically entering into a register one of a plurality of digital two-channel format selects and one of a plurality of digital four-channel format selects as preset by said digital power-on binary digit, for gating said one of a plurality of digital two-channel format selects when said digital 2/4 channel mode binary digit is in a predetermined two-channel binary state ("0" or "1"), for gating said one of a plurality of digital four-channel format selects when said digital 2/4 channel mode binary digit is in the opposite state ("1" or "0"), and producing a plurality of digital encoded format selects from a predetermined number of digital format selects;

c. quadrified format encoder-selector means encoding said plurality of digital translated data into a plurality of digital encoded translated data, encoding said plurality of digital encoded translated data into a plurality of digital encoded format data thereby selected by one of said plurality of digital encoded format selects;

d. quadrified rotation-position selector means parallel data loading a plurality of binary digits of said one of a plurality of digital format data into an end-around shift register (output of last shift register stage fed back to input of first shift register stage), serial shifting said plurality of binary digits of said one of a plurality of digital format data a predetermined number of shift register stages as manually entered into a field rotation position register or as preset by said digital power-on binary digit, strobing and converting the serial shifted said plurality of binary digits of said one of a plurality of digital format data into corresponding parallel binary digits thereby loaded into a field rotation position register producing a plurality of binary digits of one of a plurality of digital field rotation position data buffered from said parallel and serial conversion operations, producing one of a plurality of output digital field rotation position data and a plurality of digital field rotation position selects;

e. quadrified configuration encoder-selector encoding said output digital field rotation position data into digital encoded field rotation position data, for manually selecting a system configuration select and thereby encoding a plurality of digital encoded system configuration selects, producing digital system configuration data whose number of binary digits equal the number of output audio channels configured in the system and therein selected from said digital encoded field rotation position data by said digital encoded system configuration selects, said digital encoded configuration selects overridden by a digital headphones-in override binary digit, thereby selecting four digital encoded system configuration binary digits that equal the number of output audio channels required by 4-channel headphones and correspondingly producing a digital defeat graphic-room equalizer binary digit (a control signal used to bypass a unit used to equalize the acoustical response of a room and associated transducers but would otherwise cause coloration of said 4-channel headphones);

f. direct channel output selector means encoding said digital field rotation position selects into digital encoded field rotation position selects, selecting said system configuration data by corresponding said digital encoded field rotation position selects and producing one of a plurality of digital direct commutation data composed of a plurality of digital direct commutation binary digits; and g. ambient channel output selector means encoding said digital system configuration data into digital ambient commutation data composed of a plurality of binary digits used to time share the ambience audio signals with the direct audio signals reproduced by the system transducers, thereby producing ambience audio signals geographically opposite to the reproduced direct audio signals.

15. The system as claimed in claim 11 wherein said output audio processor means include:

a. dynamic audio output controller means for combining said two or four high-level audio signals and producing a dynamic control audio signal, for processing said two or four high-level audio signals into two or four graphic room-equalized audio signals, for selecting said two or four graphic room-equalized audio signals when said digital defeat graphic-room equalizer binary digit is inactive, for selecting said two or four high-level audio signals when said digital defeat graphic-room equalizer binary digit is active, for combining said two or four graphic room-equalized audio signals or said two or four high-level audio signals and producing a bass audio signal, for respectively highpass filtering each graphic room-equalized audio signal or each high-level audio signal of said two or four graphic room-equalized audio signals or said two or four high-level audio signals and producing two or four high-passed audio signals, and for combining said two or four high-passed audio signals and producing a combined high-passed audio signal;

b. automatic-dynamic-loudness controller means processing said bass audio signal and said dynamic control audio signal, comprising a direct current voltage which varies directly proportional to the peak amplitude of said two or four high-level audio signals, thereby producing a dynamic bass audio signal that automatically and dynamically tracks the Fletcher-Munson Equal Loudness Contours for bass audio frequencies below approximately 500 Hz, for decoding said plurality of digital encoded system configuration selects into attenuator selects that attenuate said dynamic bass audio signal and produces a system bass audio audio signal whose amplitude is equalized for the number of transducer or headphones output channels configured in the system, for selectively distributing said system bass audio signal to only the four-channel headphones when said digital headphones-in ovrride binary digit is active, or to the number of transducer output channels configured in the system or to a manually selected auxiliary bass system when said digital headphones-in override binary digit is inactive, and c. dynamic ambience/matrix encoded audio recovery controller means controlling said high-passed audio signal for producing reverb or digital delayed ambience audio signals by a suitable unit connected to the system, for producing a dynamic control signal responsive to said dynamic control audio signal and thereby processing said two bias-free leveled audio signals into recovered concert hall ambience or recovered direct audio signals when rear matrix encoded audio signals predominate or recovered rear matrix encoded audio signals when direct audio signals predominate and as dynamically restored by said dynamic control signal and conditionally decoded by said plurality of encoded digital two-channel phase-angle differential data and by said digital 2/4 channel mode binary digit when in the active two-channel state, for automatically presetting by said digital power-on binary digit and manually selecting auto-concert hall ambience audio signals, matrix recovered audio signals, four-channel reverberation/digital delayed ambience audio signals, auto-synthesized ambience audio signals, or two-channel reverberation/digital delayed ambience audio signals responsive to said digital 2/4 channel mode binary digit.

16. The system as claimed in claim 11 wherein said psychoacoustic audio demultiplexer means include:

a. quadrified audio format selector means encoding predetermined digital format selects into digital encoded format selects, for formatting said two or four high-passed audio signals responsive to said digital encoded format selects into four formatted high-passed audio signals; and b. quadrified output audio demultiplexer means demultiplexing said four formatted high-passed audio signals as commutated by said digital direct commutation data into one or more simultaneously direct audio signals or matrix encoded audio signals demultiplexed to a plurality of output audio channels, demultiplexing said system ambience audio signals, said recovered matrix recovered audio signal, said recovered direct audio signals, as commutated by said digital ambient commutation data into one or more simultaneously time-sharing output audio channels geographically opposite said direct output audio channels, for distributing said system bass audio signal and demultiplexing said direct audio signals, said ambience audio signals, said recovered matrix encoded audio signals, said recovered direct audio signals, and said matrix encoded audio signals to said four-channel headphones or to the total configuration of output audio channels as controlled by said digital headphones-in override binary digit.

17. The system as claimed in claim 11 further comprising a plurality of power amplifiers and a corresponding plurality of transducers, respectively amplifying and reproducing a plurality of system bass audio signals, said direct audio signals, said matrix encoded audio signals, said ambience audio signals, said recovered front direct audio signals, and said recovered matrix encoded audio signals.

18. The system as claimed in claim 11 further comprising system operation and status means visually displaying a plurality of predetermined audio signals, a plurality of predetermined audio control signals, and a plurality of predetermined binary digits of a plurality of predetermined digital data.

19. A method for audio-digital processing two (stereophonic) or four (quadriphonic, also incorrectly lexicographed as quadraphonic) low-level audio signals into a plurality of digital commutation data for demultiplexing corresponding two (stereophonic) or four (quadriphonic) high-level audio signals into a plurality of output audio signals, said method comprising the following steps:

a. filtering said two (stereophonic) or four (quadriphonic) low-level audio signals producing two or four bandpassed audio signals;

b. processing said two or four bandpassed audio signals and a predetermined bias reference frequency signal into two or four bias-amplitude leveled audio signals;

c. processing any two bandpassed audio signals paired from said two or four bandpassed audio signals into one to six pairs of proportional-amplitude leveled audio signals;

d. recovering and converting two or four bias reference frequency signals from said two or four bias-amplitude leveled audio signals into a plurality of digital signal-to-noise data;

e. recovering and converting any two bias-free amplitude leveled audio signals filtered and paired from said two or four bias-amplitude leveled audio signals into a plurality of digital phase-angle differential data, a plurality of random-degree digital phase-angle binary digits, and a plurality of digital field activity data;

f. processing and converting two or four bias-free amplitude leveled audio signals into a plurality of digital peak amplitude strobes;

g. processing and converting each pair of bias-free amplitude leveled audio signals into a plurality of digital phasor differential data;

h. processing and converting each pair of said one to six pairs of proportional-amplitude leveled audio signals into a plurality of digital amplitude differential data;

i. processing and translating psychoacoustic data relationships of said plurality of digital signal-to-noise data, said plurality of digital field activity data, said plurality of digital phase-angle differential data, said plurality of random-degree digital phase-angle differential binary digits, said plurality of digital peak amplitude strobes, said plurality of digital phasor differential data, and said plurality of digital amplitude differential data into a plurality of digital translated data and digital system control signals;

j. automatically and manually selecting one of a plurality of digital format selects as controlled by said digital system control signals and producing digital format selects and digital encoded format selects;

k. encoding said digital translated data into a plurality of digital quadrifield format data as selected by said digital format selects thereby selecting one predetermined digital quadrifield data format of a plurality of digital quadrifield data formats;

l. automatically and manually selecting one of a plurality of digital rotation selects to control loading and shifting operations, thereby processing said predetermined digital quadrifield data format into digital quadrifield rotation data;

m. automatically and manually selecting one of a plurality of digital configuration selects to control the encoding of said digital quadrifield rotation data into digital quadrifield configuration data;

n. encoding said digital quadrifield rotation selects and selecting said digital quadrifield configuration data producing a plurality of digital direct commutation data;

o. decoding said digital quadrifield configuration data producing a plurality of digital ambient commutation data in a time-shared correspondence with said plurality of digital direct commutation data;

p. dynamically controlling said two or four high-level audio signals producing a system bass audio signal, two or four high-passed audio signals, a dynamic control audio signal, and a combined high-passed audio signal;

q. dynamically controlling said two bias-free amplitude leveled audio signals responsive to said dynamic control audio signal, thereby producing recovered concert hall ambience audio signals, recovered front direct audio signals, or recovered matrix encoded audio signals, for controlling reverberation ambience signals or digital delayed ambience audio signals, and for selecting one of of a plurality of audio recovery modes for dynamically processing said concert hall ambience audio signals, said reverberation ambience signals or said digital delayed ambience audio signals or said recovered front direct audio signals or said recovered matrix encoded audio signals, responsive to said digital system control signals and said digital translated data;

r. dynamically controlling said system bass audio signal by said dynamic control audio signal producing automatic dynamic bass audio that tracks the Fletcher-Munson Equal Loudness Contours for bass audio frequencies below approximately 500 Hz and for attenuating the amplitude of said automatic dynamic bass audio signal in response to said digital encoded configuration control selects and to said digital system control signal, thereby producing a system bass audio signal compatible with the number of output audio channels configured in the system, with the use of four-channel headphones, and with the use of an auxiliary bass system;

s. formatting said two or four high-passed audio signals, responsive to said plurality of digital encoded format selects, said plurality of digital field rotation position selects, and said plurality of digital configuration selects into a plurality of high-passed audio signals;

t. demultiplexing said plurality of high-passed audio signals commutated by said plurality of digital direct commutation data, responsive to said plurality of digital format encoded data, to said plurality of digital rotation position data, and to said plurality of digital configuration data, into a plurality of output audio signals;

u. distributing and combining said system bass audio signal with said plurality of output audio signals; and v. demultiplexing said ambience audio signals or recovered matrix encoded audio signals or recovered front direct audio signals, commutated by said plurality of digital ambient commutation data, into a plurality of geographically time-sharing output audio signals.

20. The method as claimed in claim 19 further comprising the step of respectively amplifying and reproducing said plurality of output audio signals and and said plurality of geographically time-sharing output audio signals by a corresponding plurality of power amplifiers and associated transducers or by four-channel headphones when connected to the system, therein producing a digital headphones-in override binary digit which correspondingly reconfigures said plurality of digital direct commutation data and said plurality of digital ambient commutation data to produce four compatible channels of headphone output audio signals.

21. The method as claimed in claim 19 further comprising the step of visually displaying a plurality of predetermined audio signals, a plurality audio control signals, and a plurality of digital data.

22. A method for data processing a plurality of digital field activity binary digits, a plurality of digital dropout binary digits, a plurality of digital phase-angle differential binary digits, a plurality of digital phasor differential binary digits, and a plurality of digital amplitude differential binary digits into a plurality of digital translated binary digits, a plurality of digital two-channel encoded phase-angle differential binary digits, a digital system power-on binary digit, a digital system initialization binary digit, and a digital 2/4 channel mode binary digit, whereby said data processing produces a plurality of digital commutation data for demultiplexing two or four high-level audio signals into 1, 2, 3, 4, 5, . . . 12 . . . 16 . . . 32 . . . 72 . . . n output audio signals having near infinite channel separation and minimum directional ambiguities resolved for monophonic, stereophonic, and quadriphonic audio signals produced by, but not limited to, a.m./f.m.-multiplex equipment and monophonic, stereophonic, and quadriphonic (QS, SQ, and CD-4) discs and tapes, said method comprising the following steps:

a. decoding four inactive digital field activity binary digits and four active digital dropout binary digits into a digital system initialization binary digit, thereby decommutating all said output signals containing only noise during this decoded condition, said decommutating also responsive to a predetermined manual adjustment of audio signal threshold and dropout detection means to eliminate disc surface noise, tape and f.m. hiss, a.m. noise during silent speech/music passages and to eliminate objectionable speech/music distorted by any media noise;

b. decoding four inactive digital field activity binary digits and exclusive one inactive binary digit of four digital dropout binary digits into a predetermined digital override commutation binary digit of four possible digital override commutation binary digits, thereby precluding said data processing method from executing an illogical Boolean operation, and thus maintaining a demultiplexed output audio signal in its logical output audio channel while all but one of said two or four high-level audio signals are at audio signal dropout and said one high-level audio signal is at or above audio signal threshold;

c. decoding four inactive digital field activity binary digits and a first and a third inactive binary digit of four digital dropout binary digits, representative of a first and a third high-level audio signal of four high-level audio signals at or above audio signal threshold, into two predetermined digital overrride commutation binary digits, thereby precluding said data processing method from executing an illogical Boolean operation, and thus maintaining two demultiplexed output audio signals in their logical output audio channels while a second and a fourth high-level audio signal of said four high-level audio signals are at audio signal dropout and thereby further enhancing channel separation and directionality of 2 or 4-channel media;

d. decoding four inactive digital field activity binary digits and a second and a fourth inactive binary digit of four digital dropout binary digits, representative of a second and a fourth high-level audio signal of said four high-level audio signals at or above audio signal threshold, into two predetermined digital override commutation binary digits, thereby precluding said data processing method from executing an illogical Boolean operation, and thus maintaining two demultiplexed output audio signals in their logical output audio channels while a first and a third high-level audio signal of said four high-level audio signals are at audio signal dropout and thereby further enhancing channel separation and directionality of 2 or 4-channel media;

e. decoding an exclusively active digital field activity binary digit, when only a first and a second high-level audio signal of said two or four high-level audio signals are at or above audio signal threshold, and an active zero-degree digital phase-angle differential binary digit of said plurality of digital phase-angle differential data into a digital field discrete binary digit representative of said first and second high-level audio signals having identical complex waveforms varying only in amplitude ratio, thereby translating said digital field discrete binary digit and a corresponding plurality of digital amplitude differential data, whose plurality of digital amplitude differential binary digits correspondingly represent the amplitude ratio of said identical complex waveforms of said first and second high-level audio signals, into one active digital commutation binary digit out of a plurality of digital commutation data binary digits and thereby further enhancing channel separation and directionality of 2 or 4-channel media by providing a Boolean operation to place a normally phantom sound image into a predetermined point-source transducer location within the sound reproducing environment;

f. decoding an exclusively active digital field activity binary digit, when only a first and a second high-level audio signal of said two or four high-level audio signals are at or above audio signal threshold, and an active random-degree digital phase-angle differential binary digit of said plurality of digital phase-angle differential data into a digital field phasor binary digit representative of said first and second high-level audio signals having non-identical complex waveforms varying in phasor differential, thereby translating said digital field phasor binary digit and a corresponding plurality of digital phasor differential data, whose plurality of digital phasor differential binary digits are active two at a time and correspondingly represent two digital amplitude differential binary digit positions having equal phasor position values to either side of a one-to-one amplitude-ratio digital amplitude differential binary digit and whose equal phasor position values from said one-to-one amplitude-ratio digital amplitude differential binary digit are directly proportional to the phasor differential and indirectly proportional to the common mode of said non-identical complex waveforms of said first and second high-level audio signals, into two active digital commutation binary digits and thereby enhancing channel separation and directionality of 2 or 4-channel media by providing a Boolean operation to place two or more normally phantom sound images into two predetermined point-source transducer locations within the sound reproducing environment (e.g. two musical instruments reproduced from two point-source transducers located to either side of a phantom reproduced center singer having enhanced directionality due to a significant reduction in the Haas Effect produced by two relatively close transducers comprising a smaller segment of the sound reproducing field; conventional stereophonic/quadriphonic systems will reproduce said two musical instruments having close proximity to said center singer as three phantom images highly susceptible to the Haas Effect per two widely placed transducers comprising one total sound field; said center singer will revert to a center point-source transducer corresponding to the phantom position when said two musical instruments are counterpoint, have SPL at or just above audio threshold, and when, in the course of a musical passage, said active random-degree digital phase-angle differential binary digit reverts to said active zero-degree digital phase-angle differential binary digit of step e. above);

g. decoding the two-channel state of said digital 2/4 channel mode binary digit and a 90-degree digital phase-angle differential binary digit, responsive to said variable pulse width media phase shift correction control and representative of a first high-level audio signal leading a second high-level audio signal by 90-degrees, into a digital commutation binary digit used to demultiplex an Lb (left back or rear) matrix encoded audio signal into a left rear corner transducer and recovered direct audio signals in front transducers, thereby resolving signal loss and directional ambiguities exibited by an SQ gain riding logic system;

h. decoding the two-channel state of said digital 2/4 channel mode binary digit and a 90-degree digital phase-angle differential binary digit, responsive to said variable pulse width media phase shift correction control and representative of a second high-level audio signal leading a first high-level audio signal by 90-degrees, into a digital commutation binary digit used to demultiplex a Rb (right back or rear) matrix encoded audio signal into a right rear corner transducer and recovered direct audio signals in front transducers, thereby resolving signal loss and directional ambiguities exibited by an SQ gain riding logic system;

i. decoding the two-channel state of said digital 2/4 channel mode binary digit and a 180-degree digital phase-angle differential binary digit, responsive to said variable pulse width media phase shift correction control and representative of a first high-level audio signal leading a second high-level audio signal by 180-degrees or said second high-level audio signal leading said first high-level audio signal by 180-degrees, into a digital commutation binary digit used to demultiplex a matrix encoded audio signal into a center rear transducer and recovered direct audio signals into front transducers, thereby providing an additional 180-degree phase-angle for matrix encoding an audio signal not presently encoded by SQ or QS systems, since audio reproduction of current systems cause phase cancellation which is resolved by said demultiplexing method of this system;

j. decoding an exclusively active digital field activity binary digit, when only a second and a third high-level audio signal of said two or four high-level audio signals are at or above audio signal threshold, and an active zero-degree digital phase-angle differential binary digit of said plurality of digital phase-angle differential data into a digital field discrete binary digit representative of said second and third high-level audio signals having identical complex waveforms varying only in amplitude ratio, thereby translating said digital field discrete binary digit and a corresponding plurality of digital amplitude differential data, whose plurality of digital amplitude differential binary digits correspondingly represent the amplitude ratio of said identical complex waveforms of said second and third high-level audio signals, into one active digital commutation binary digit out of a pluarity of digital commutation data binary digits and thereby further enhancing channel separation and directionality of four-channel tape or CD-4 media by providing a Boolean operation to place a normally phantom sound image into a predetermined point-source transducer location within the sound reproducing environment;

k. decoding an exclusively active digital field activity binary digit, when only a second and a third high-level audio signal of said two or four high-level audio signals are at or above audio signal threshold, and an active random-degree digital phase-angle differential binary digit of said plurality of digital phase-angle differential data into a digital field phasor binary digit representative of said second and third high-level audio signals having non-identical complex waveforms varying in phasor differential, thereby translating said digital field phasor binary digit and a corresponding plurality of digital phasor differential data, whose plurality of digital phasor differential binary digits are active two at a time and correspondingly represent two digital amplitude differential binary digit positions having equal phasor position values to either side of a one-to-one amplitude-ratio digital amplitude differential binary digit and whose equal phasor position values from said one-to-one amplitude-ratio digital amplitude differential binary digit are directly proportional to the phasor differential and indirectly proportional to the common mode of said non-identical complex waveforms of said second and third high-level audio signals, into two active digital commutation binary digits and thereby enhancing channel separation and directionality of four-channel tape or CD-4 media by providing a Boolean operation to place two or more normally phantom sound images into two predetermined point-source transducer location within the sound reproducing environment;

l. decoding an exclusively active digital field activity binary digit, when only a third and a fourth high-level audio signal of said two or four high-level audio signals are at or above audio signal threshold, and an active zero-degree digital phase-angle differential binary digit of said plurality of digital phase-angle differential data into a digital field discrete binary digit representative of said third and fourth high-level audio signals having identical complex waveforms varying only in amplitude ratio, thereby translating said digital field discrete binary digit and a corresponding plurality of digital amplitude differential data, whose plurality of digital amplitude differential binary digits correspondingly represent the amplitude ratio of said identical complex waveforms of said third and fourth high-level signals, into one active digital commutation binary digit out of a plurality of digital commutation data binary digits and thereby further enhancing channel separation and directionality of four-channel tape or CD-4 media by providing a Boolean operation to place a normally phantom sound image into a predetermined point-source transducer location within the sound reproducing environment;

m. decoding an exclusively active digital field activity binary digit, when only a third and a fourth high-level audio signal of said two or four high-level audio signals are at or above audio signal threshold, and an active random-degree digital phase-angle differential binary digit of said plurality of digital phase-angle differential data into a digital field phasor binary digit representative of said third and fourth high-level audio signals having non-identical complex waveforms varying in phasor differential, thereby translating said digital field phasor binary digit and a corresponding plurality of digital phasor differential data, whose plurality of digital phasor differential binary digits are active two at a time and correspondingly represent two digital amplitude differential digit positions having equal phasor position values to either side of a one-to-one amplitude-ratio digital amplitude differential binary digit and whose equal phasor position values from said one-to-one amplitude-ratio digital amplitude differential binary digit are directly proportional to the phasor differential and indirectly proportional to the common mode of said non-identical complex waveforms of said third and fourth high-level audio signals, into two active digital commutation binary digits and thereby enhancing channel separation and directionality of four-channel tape or CD-4 media by providing a Boolean operation to place two or more normally phantom sound images into two point-source transducer locations within the sound reproducing environment;

n. decoding an exclusively active digital field activity binary digit, when only a fourth and a first high-level audio signal of said two or four high-level audio signals are at or above audio signal threshold, and an active zero-degree digital phase-angle differential binary digit of said plurality of digital phase-angle differential data into a digital field discrete binary digit representative of said fourth and first high-level audio signals having identical complex waveforms varying only in amplitude ratio, thereby translating said digital field discrete binary digit and a corresponding plurality of digital amplitude differential data, whose plurality of digital amplitude differential bianary digits correspondingly represent the amplitude ratio of said identical complex waveforms of said fourth and first high-level audio signals, into one active digital commutation binary digit out of a plurality of digital commutation data binary digits and thereby further enhancing channel separation and directionality of four-channel tape or CD-4 media by providing a Boolean operation to place a normally phantom sound image into a predetermined point-source transducer location within the sound reproducing environment;

o. decoding an exclusively active digital field activity binary digit, when only a fourth and a first high-level audio signal of said two or four high-level audio signals ar at or above audio signal threshold, and an active random-degree digital phase-angle differential binary digit of said plurality of digital phase-angle differential data into a digital field phasor binary digit representative of said fourth and first high-level audio signals having non-identical complex waveforms varying in phasor differential, thereby translating said digital field phasor binary digit and a corresponding plurality of digital phasor differential data, whose plurality of digital phasor differential binary digits are active two at a time and correspondingly represent two digital amplitude differential digit positions having equal phasor position values to either side of a one-to-one amplitude-ratio digital amplitude binary digit and whose equal phasor position values from said one-to-one amplitude-ratio digital amplitude differential binary digit are directly proportional to the phasor differential and indirectly proportional to the common mode of said non-identical waveforms of said fourth and first high-level audio signals, into two active digital commutation binary digits and thereby enhancing channel separation and directionality of four-channel tape or CD-4 media by providing a Boolean operation to place two or more normally phantom sound images into two point-source transducer locations within the sound reproducing environment;

p. decoding two active digital field activity binary digits, when a first, second, and third or a second, third, and a fourth or a third, fourth, and a first or a fourth, first, and a second high-level audio signal of said two or four high-level audio signals are at or above audio threshold, and two corresponding active zero-degree digital phase-angle differential binary digits into two corresponding digital field discrete binary digits and translating said two digital field discrete binary digits and a corresponding plurality of digital amplitude differential data into an active digital commutation binary digit for each of said two discrete fields, wherein the active digital commutation binary digit of the adjacent discrete field is inhibited if it corresponds to a maximum amplitude ratio whose corresponding transducer location is directly adjacent to either extreme transducer location of the predominate adjacent field, thereby eliminating a CD-4 media adjacent mirror sound image or otherwise permitting transducer activity in both adjacent fields when deliberately panpotted by the recording engineer to produce special-effects by using amplitude ratio values that are lower than ratio values producing CD-4 cross-talk;

q. decoding two active digital field activity binary digits, when a first, second, and a third or a second, third, and a fourth or a third, fourth, and a first or a fouth, first, and a second high-level audio signal of said two or four high-level audio signals are at or above audio threshold, and an active zero-degree digital phase-angle differential binary digit and an active random-degree phase-angle differential binary digit into a corresponding digital field discrete binary digit and a digital field phasor binary digit and translating said digital field discrete binary digit and a corresponding plurality of digital amplitude differential data and said digital field phasor binary digit and a corresponding plurality of digital phasor differential data into a one active digital commutation binary digit for the discrete field and two active digital commutation binary digits for the phasor field, wherein one of said two active digital commutation binary digit is inhibited if it corresponds to a maximum amplitude ratio or phasor differential whose corresponding transducer location is directly adjacent to either extreme location of the predominate adjacent field and wherein additional predetermined digital commutation binary digits of the phasor field are logically inhibited to eliminate CD-4 mirror images while permitting different sound images to be reproduced in two adjacent transducer fields (e.g. a center singer point-source in the center transducer of the discrete field and a guitar or other musical instruments point-source and/or phantom sound images in the non-adjacent extreme transducer locations of the phasor field with said phantom images reproduced from a smaller field segment and significantly less susceptible to the Haas Effect);

r. decoding two active digital field activity binary digits, when a first, second, and third or a second, third, and a fourth or a third, fourth, and a first or a fourth, first, and a second high-level audio signal of said two or four high-level audio signals are at or above audio threshold, and two correspondingly active random-degree digital phase-angle differential binary digits into two corresponding digital field phasor binary digits and translating said two corresponding digital field phasor binary digits and a corresponding plurality of digital phasor differential data of two phasor fields into two active digital commutation binary digits representative of a first phasor field and two active digital commutation binary digits representative of a second phasor field, wherein each phasor field operates independently of the adjacent phasor field (having no corresponding inhibits) by providing a Boolean operation to place two or more normally phantom sound images into two predetermined point-source transducer locations within the sound reproducing environment (e.g. from two musical instruments with each reproduced from a transducer in each field comprising a wall of a room and with a second transducer in each field reproducing said two musical instruments and thereby causing crosstalk, unwanted in any system and inherent in this system, but reproduced with a significant reduction in the Haas Effect; to three musical instruments or voices reproduced from three corresponding point-source transducers and thereby eliminating directional ambiguities experienced by SQ gain riding logic systems; and up to a full 100 piece orchestra having geometrically placed SPL images representing the brass, violins, typani, etc. faithfully placed and reproduced by two transducers in each adjacent field, thus, as the musical composition transitions from one lead violin being reproduced from its associated transducer to 25 violins, then the phasor field of corresponding transducers responds by reproducing the 25 violins from two transducers on either side of a geometric field center transducer in accordance with the SPL distribution of 25 violins as in a real-life performance and with the adjacent phasor field functioning in a similar manner for the brass);

s. decoding three active digital field activity binary digits, when all four high-level audio signals are at or above audio threshold followed by a first and a second or a second and a third or a third and a fourth or a fourth and a first high-level audio signal subsequently decaying to or below audio dropout, and one active zero-degree digital phase-angle differential binary digit into a digital field discrete binary digit, and thereby reverting to the translating sub-step of step e. above;

t. decoding three active digital field activity binary digits, when all four high-level audio signals are at or above audio threshold followed by a first and a second or a second and a third or a third and a fourth or a fourth and a first high-level audio signal subsequently decaying to or below audio dropout, and one active random-degree digital phase-angle differential binary digit into a digital field phasor binary digit, and thereby reverting to the translating sub-step of step f. above;

u. decoding four active digital field activity binary digits, when all four high-level audio signals are at or above audio threshold and containing identical audio waveforms varying only in amplitude, and four active zero-degree digital phase-angle differential binary digits into four corresponding digital field discrete binary digits, thereby translating said four corresponding digital field discrete binary digits and a plurality of corresponding digital amplitude differential data into four digital commutation binary digits, one for each transducer field, and therein inhibited by predetermined maximum amplitude differential binary digits, thereby placing one point-source sound image into only one of four transducers, with said one transducer representing the predominate sound field and thus eliminating unwanted CD-4 mirror sound images, or into four transducers, one in each field or wall of the sound reproducing environment and thereby permitting transducer activity in any two adjacent or all four fields when deliberately panpotted by the recording engineer to produce special effect amplitude ratio values that are lower than the CD-4 ratio values producing crosstalk;

v. decoding four active digital field activity binary digits, when all four high-level audio signals are at or above audio threshold and wherein two high-level audio signals contain identical audio waveforms varying in amplitude ratio and two high-level audio signals contain identical audio waveforms varying in amplitude ratio but non-identical to said identical audio waveforms of said first two high-level audio signals, and two correspondingly active zero-degree digital phase-angle differential binary digits and two correspondingly active random-degree digital phase-angle differential binary digits into two corresponding digital field discrete binary digits and two corresponding digital field phasor binary digits, thereby translating said two digital field discrete binary digits and a corresponding plurality of digital amplitude binary digits and said two digital field phasor binary digits and a corresponding plurality of digital phasor differential binary digits, responsive to a plurality of digital inhibit binary digits corresponding to maximum amplitude differential and phasor differential between any two high-level audio signals, into a plurality of digital commutation binary digits and thereby enhancing channel separation and directionality by providing a Boolean operation to determine if the two audio images belong in the predetermined front and rear transducers or in the predetermined right and left side transducers and thereby excluding said predetermined front and rear transducers or said predetermined left and right side transducers (e.g. this resolves CD-4 crosstalk when an audio image is intended to reside as a phantom image between the left side transducers and another audio image is intended to reside between the right side transducers and crosstalk images of both reside as a center image between the front transducers and said crosstalk images reside as center images between the rear transucers and further resolves CD-4 crosstalk by distinguishing whether said discrete images are crosstalk of a phasor image or if said phasor images are crosstalk of said discrete images);

w. decoding four active digital field activity binary digits, when all four high-level audio signals are at or above audio threshold and wherein two high-level audio signals contain identical audio waveforms varying in amplitude ratio and two high-level audio signals contain identical audio waveforms varying in amplitude ration but non-identical to said identical audio waveforms of said first two high-level audio signals, and one correspondingly active zero-degree digital phase-angle differential binary digit and three correspondingly active digital phasor differential binary digits into one active digital field discrete binary digit and three active digital field phasor binary digits, thereby translating said one active digital field discrete binary digit and a corresponding plurality of digital amplitude differential data and said three digital field phasor binary digits and a corrsponding plurality of digital phasor differential binary digits, representative of each digital field phasor binary digit, into a plurality of digital commutation binary digits and thereby enhancing channel separation and directionality by providing a Boolean operation to determine that a discrete audio image belongs in a predetermined front, or right, or rear, or left transducer and that a phasor audio image belongs in a predetermined phasor transducer pair directly opposite said predetermined transducer reproducing the discrete audio image, thereby further resolving CD-4 and four-channel tape deficiencies; and x. decoding four active digital field activity binary digits, when all four high-level audio signals are at or above audio threshold and wherein all said four high-level audio signals contain non-identical audio waveforms varying in phasor differential between any two audio waveforms, and four active digital random degree binary digits into four corresponding digital field phasor binary digits and a corresponding plurality of digital phasor differential data, representative of each digital field phasor binary digit, into a plurality of digital commutation binary digits, thereby placing a phasor audio image in a predetermined pair of front transducers, another audio phasor image in a predetermined pair of right side transducers, another audio phasor image in a predetermined pair of rear transducers, and another audio phasor image in a predetermined pair of left side transducers and thereby resolving CD-4 and four-channel tape separation and directionality deficiencies (e.g. significantly reducing the Hass Effect by placing a plurality of violins in a predetermined right side wall transducer pair in accordance with the phasor differential (audio phasor function), a plurality of brass and typani in a predetermined rear wall transducer pair in accordance with the phasor differential and as accented by periodic discrete point-source images created by the counter-point typani, a plurality of woodwinds in a predetermined left side wall transducer pair in accordance with the phasor differential, and a piano and a soloist in a predetermined front wall transducer pair in accordance with the phasor differential and as accented by each point-source instance of a counterpoint piano or soloist, with further translations carried out in accordance with the musical score and total musical instrument and voice permutations).

* * * * *